US006497474B2

(12) United States Patent
Irinoda et al.

(10) Patent No.: US 6,497,474 B2
(45) Date of Patent: Dec. 24, 2002

(54) ELECTROSTATIC ACTUATOR, METHOD OF PRODUCING ELECTROSTATIC ACTUATOR, MICROPUMP, RECORDING HEAD, INK JET RECORDING APPARATUS, INK CARTRIDGE, AND METHOD OF PRODUCING RECORDING HEAD

(75) Inventors: Mitsugu Irinoda, Miyagi (JP); Yukito Satoh, Miyagi (JP); Junichi Azumi, Miyagi (JP); Kaihei Isshiki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/922,010

(22) Filed: Aug. 3, 2001

(65) Prior Publication Data

US 2002/0047876 A1 Apr. 25, 2002

(30) Foreign Application Priority Data

| | | |
|---|---|---|
| Aug. 4, 2000 | (JP) | 2000-237825 |
| Mar. 19, 2001 | (JP) | 2001-078851 |
| Jun. 14, 2001 | (JP) | 2001-179412 |

(51) Int. Cl.[7] ..... B41J 2/04
(52) U.S. Cl. ..... 347/54

(58) Field of Search ..... 347/54, 68, 69, 347/70, 71, 72, 50, 40, 20, 44, 47, 27, 63; 399/261; 361/700; 310/328–330; 29/890.1

(56) References Cited

FOREIGN PATENT DOCUMENTS

| | | |
|---|---|---|
| JP | 5229118 | 9/1993 |
| JP | 671882 | 3/1994 |
| JP | 10291322 | 11/1998 |
| WO | WO9842513 | 10/1998 |

OTHER PUBLICATIONS

U.S. application Ser. No. 09/610,807, filed Jul. 6, 2000.
U.S. application Ser. No. 09/550,408, filed Apr. 14, 2000.
U.S. application Ser. No. 09/369,040, filed Aug. 4, 1999.
U.S. application Ser. No. 09/113,638, filed Jul. 10, 1998.

*Primary Examiner*—Raquel Yvette Gordon
(74) *Attorney, Agent, or Firm*—Cooper & Dunham LLP

(57) ABSTRACT

An electrostatic actuator includes a diaphragm caused to vibrate by electrostatic force, an electrode substrate opposing the diaphragm, an electrode formed on the electrode substrate so as to oppose said diaphragm with a gap being formed between the electrode and the diaphragm, an anti-corrosive thin film formed on said diaphragm, and diaphragm deflection prevention means preventing the diaphragm from deflecting.

87 Claims, 65 Drawing Sheets

| INTERNAL STRESS OF ANTI-COROSSIVE THIN FILM | STRESS | DIAPHRAGM DEFLECTION | LIQUID OR INK DROPLET EJECTION CHARACTERISTIC |
|---|---|---|---|
| +1E10 | TENSILE | ○ | ○ |
| +7E09 | TENSILE | ○ | ○ |
| +1E08 | TENSILE | ○ | ○ |
| -1E08 | COMPRESSIVE | ○ | ○ |
| -5E09 | COMPRESSIVE | ○ | ○ |
| -1E10 | COMPRESSIVE | ○ | ○ |
| -2E10 | COMPRESSIVE | × | × |

DIAPHRAGM DEFLECTION ○ : NO DEFLECTION
× : DEFLECTED

LIQUID OR INK DROPLET EJECTION CHARACTERISTIC ○ : GOOD
× : POOR

| ANTI-CORROSIVE THIN FILM RESISTIVITY (Ω・cm) | ANTI-CORROSIVENESS |
|---|---|
| 5E-4 | × |
| 9E-4 | × |
| 1E-3 | ○ |
| 5E-3 | ○ |
| 1E-2 | ○ |

ANTI-CORROSIVENESS ○ : NO CORROSION
× : CORRODED

FIG.67

| DIAPHRAGM DEFLECTION AMOUNT ($\mu$m) | LIQUID OR INK DROPLET EJECTION CHARACTERISTIC |
|---|---|
| 0 | ○ |
| 0.01 | × |
| 0.05 | × |
| 0.1 | × |

LIQUID OR INK DROPLET EJECTION CHARACTERISTIC ○ : GOOD
× : POOR

FIG.68

| OXYGEN CONCENTRATION OF TITANIUM NITRIDE THIN FILM (atom%) | ANTI-CORROSIVENESS |
|---|---|
| 0.0 | △ |
| 0.5 | ○ |
| 1.0 | ◎ |
| 5.0 | ◎ |
| 10.0 | ◎ |

ANTI-CORROSIVENESS ◎ : NO CORROSION
○ : VERY LIMITEDLY CORRODED
△ : LIMITEDLY CORRODED
× : CORRODED

ELECTROSTATIC ACTUATOR, METHOD OF PRODUCING ELECTROSTATIC ACTUATOR, MICROPUMP, RECORDING HEAD, INK JET RECORDING APPARATUS, INK CARTRIDGE, AND METHOD OF PRODUCING RECORDING HEAD

BACKGROUND OF THE INVENTION

1. Field of the Invention

The present invention relates to an electrostatic actuator vibrating by electrostatic force, a method of producing such an electrostatic actuator, an electrostatic micropump including such an electrostatic actuator, an ink jet recording head including such an electrostatic actuator and ejecting an ink droplet by a pressure wave caused by electrostatic force, an ink jet recording apparatus including such an ink jet recording head, a liquid droplet ejecting head, an ink cartridge including such a liquid droplet ejecting head, an ink jet recording apparatus including such a liquid droplet ejecting head, and a method of producing such a liquid droplet ejecting head.

2. Description of the Related Art

Products to which an electrostatic actuator is applied include an electrostatic micropump and a drop-on-demand ink jet recording head.

As methods of driving a micropump for transporting liquid, there have been disclosed a piezoelectric method using piezoelectric effect, a thermal method utilizing liquid expansion caused by heat, and an electrostatic driving method employing electrostatic attraction. Among those methods, the electrostatic driving method have the advantage of low power consumption due to its use of electrostatic force, and a micropump using this method is easy to make fine in size by means of a processing technique using a silicon device processing technique.

However, since such a micropump employs silicon as a material of its components, the silicon may be eluted from the components depending on the nature of the transported liquid of alkalinity or acidity, thus causing damage to the micropump. Therefore, it is commonly practiced to form an anti-corrosive film on a surface of the silicon which surface contacts the liquid. A description will be given below of ink jet recording heads in which this anti-corrosive film is formed.

There have been proposed a variety of methods of driving an ink jet recording head for an ink jet recording apparatus which ink jet recording head uses an electrostatic actuator which performs recording by ejecting an ink droplet through a nozzle hole directly onto a recording medium.

WO98/42513 discloses an ink jet recording head for a print head employed in a drop-on-demand ink jet recording apparatus in which ink jet recording head an anti-corrosive thin film of Ti, a Ti compound, and $Al_2O_3$ having resistance to ink is formed on the surface of a diaphragm forming an ink pressure chamber for pressurizing and ejecting ink.

Japanese Laid-Open Patent Application No. 10-291322 discloses a method of producing an ink jet head which method includes the steps of forming a silicon oxide film on the surface of a diaphragm forming an ink pressure chamber for pressurizing and ejecting ink, and thereafter forming in layers ink-resistant films of oxide, nitride, and a metal to close pinholes in the diaphragm.

Such a diaphragm of an electrostatic actuator which diaphragm is formed by a single or a plurality of layers of ink-resistant anti-corrosive thin films of Ti, a Ti compound, $Al_2O_3$, and a silicon oxide suffers a decrease in a yield due to corrosion, a malfunction caused by a deflection of the diaphragm generated by buckling, and a breakage caused by mishandling during the production thereof, thus resulting in an increase in the production costs of the electrostatic actuator.

When such an electrostatic actuator including a diaphragm formed by a single or a plurality of layers of ink-resistant anti-corrosive thin films of Ti, a Ti compound, $Al_2O_3$, and a silicon oxide is applied to an electrostatic micropump, an ink jet recording head, or an ink jet recording apparatus, the internal stress of the anti-corrosive thin films and a film thickness distribution on the diaphragm cause the diaphragm to buckle to have a deflection. The deflection of the diaphragm causes an increase in a driving voltage, which leads to an increase in the costs of a driving circuit and greater variations in the driving voltage, thus causing an increase in power consumption. Further, the deflection of the diaphragm causes differences in an ejection characteristic among bits at a time of ejecting liquid or ink, poor liquid or ink ejection, and certain corrosion depending on a type of liquid or ink.

Such a conventional method of producing, for instance, an electrostatic micropump, an ink jet recording head, or an ink jet recording apparatus separately produces a first silicon substrate of approximately 200 $\mu\mu$m in thickness having liquid or ink chambers and diaphragms of a few microns in thickness formed therein and a second silicon substrate having $n^+$ or $p^+$-type impurity diffusion driving electrodes formed therein, and bonds the first and second silicon substrates directly. In this process, the first silicon substrate may be damaged by mishandling, thus reducing a production yield.

Further, an ink jet recording apparatus employed as an image recording apparatus (an imaging apparatus) such as a printer, a facsimile machine, a copying machine, or a plotter includes an ink jet head as a liquid droplet ejecting head including nozzles for ejecting ink droplets, ink channels (also referred to as ejection chambers, pressure chambers, liquid pressure chambers, or liquid chambers) with which the nozzles communicate, and driving means for pressurizing ink in the ink channels. The liquid droplet ejecting heads include, for instance, those for ejecting liquid resist or DNA specimens as liquid droplets, but a description given below will focus mainly on an ink jet head.

As an ink jet head, known is a piezoelectric ink jet head that ejects ink droplets by changing the capacities of ink channels by deforming diaphragms forming wall faces of the ink channels by using piezoelectric elements as energy generation means for generating energy for pressurizing ink in the ink channels. Further, a so-called bubble type ink jet head that ejects ink droplets by means of pressures produced by generating air bubbles by heating ink in ink channels using calorific resistances is also known. Moreover, Japanese Laid-Open Patent Application No. 6-71882 discloses an electrostatic ink jet head that ejects ink droplets by changing the volumes of ink channels by deforming diaphragms forming wall faces of the ink channels by means of electrostatic forces generated between the diaphragms and electrodes that are arranged to oppose each other.

In order for an ink jet recording apparatus to record, particularly, a color image with high quality at a high speed, in terms of achieving high quality, high-density processing using a micromachine technique is employed to produce the ink jet recording apparatus and a material for head components has shifted from a metal or plastic to silicon, glass, or ceramics with the silicon being particularly employed as a material preferable for fine processing.

Further, in terms of colorization, efforts have been made mainly to develop ink and recording media. The development of ink ingredients and components has been promoted to optimize permeability, coloring, and a color mixture prevention characteristic of ink when the ink adheres to a recording medium and to increase long-term preservability of a printed medium and preservability of the ink itself.

In this case, the ink may dissolves the head components depending on a combination of the ink and a material for the head components. Particularly, in the case of forming a channel formation member of silicon, the silicon is dissolved in the ink to be deposited on nozzle parts so that nozzles are clogged or coloring of the ink is deteriorated to degrade quality of image. Further, in the case of a head using diaphragms, if the diaphragms are formed of silicon thin films and silicon is dissolved in the ink, the vibration characteristic of the diaphragms is altered or the diaphragms are prevented from vibrating.

In this case, it often makes it difficult to perform high-density processing or decrease processing accuracy to cope with the above-described problems by changing the material for the head components. Further, the change of the material requires a great change in processing steps or an improvement in a fabrication process, thus causing a decrease in nozzle density and further, a decrease in print quality.

On the other hand, in the case of coping with the above-described problems by adjusting the component of the ink, the image quality may be deteriorated since the component or ingredients of the ink is originally adjusted, for increasing print quality, to optimize the permeability and coloring of the ink with respect to a recording medium or to increase the preservability of the ink and a printed medium.

Therefore, in a conventional ink jet head, an ink-resistant thin film is formed on the ink-contacting surface of a channel formation member which surface contacts ink as disclosed in the above-described WO/98/42513 and Japanese Laid-Open Patent Application No. 10-291322. Further, Japanese Laid-Open Patent Application No. 5-229118 discloses an ink jet head in which an oxide film is formed on the ink-contacting surfaces of its components.

However, in the conventional ink jet head, an inorganic ink-resistant film includes an area that electrochemically easily dissolves depending on the pH of ink, therefore resulting in strict requirements for the ink. Specifically, a silicon oxide film, for instance, which easily dissolves in ink having a pH larger than nine, is required to have a considerable thickness to increase resistance to ink since ink of a good coloring characteristic is normally alkaline having a pH of approximately 10 to 11. The formation of a thick inorganic film often entails difficulties in its process and causes the problem of deformation of the channel formation member due to the generation of an internal stress.

Further, according to sputtering or evaporation employed in forming an ink-resistant film, particles for forming the thin film have their directions. Therefore, the thin film becomes partially thin or is totally prevented from being formed due to the shaded parts of channels resulting from their structures, thus making it difficult to coat the entire surface completely with the thin film.

SUMMARY OF THE INVENTION

It is a general object of the present invention to provide an electrostatic actuator vibrating by electrostatic force, a method of producing such an electrostatic actuator, an electrostatic micropump including such an electrostatic actuator, an ink jet recording head including such an electrostatic actuator and ejecting an ink droplet by a pressure wave caused by electrostatic force, an ink jet recording apparatus including such an ink jet recording head, a liquid droplet ejecting head, an ink cartridge including such a liquid droplet ejecting head, an ink jet recording apparatus including such a liquid droplet ejecting head, and a method of producing such a liquid droplet ejecting head in which the above-described disadvantages are eliminated.

A more specific object of the present invention is to provide: an electrostatic actuator that prevents a diaphragm on which an anti-corrosive thin film is formed from buckling, deflecting, and malfunctioning, has good protection against liquid or ink, has an increased yield, is producible at low costs and energy-saving with low power consumption, reduces differences in liquid or ink ejections, and records an ink image of high quality; a method of producing such an electrostatic actuator; an electrostatic micropump including such an electrostatic actuator; an ink jet recording head including such an electrostatic actuator; and an ink jet recording apparatus including such an ink jet recording head.

Yet another more specific object of the present invention is to provide a highly reliable liquid droplet ejecting head and head-integrated ink cartridge producible at low costs and free of corrosion, a highly reliable ink jet recording apparatus including such a liquid droplet ejection head or ink cartridge, and a method of producing such a liquid droplet ejecting head on which a highly reliable liquid-resistant thin film is formed at low costs.

The above objects of the present invention are achieved by an electrostatic actuator including a diaphragm caused to vibrate by electrostatic force, an electrode substrate opposing the diaphragm, an electrode formed on the electrode substrate so as to oppose the diaphragm with a gap being formed between the electrode and the diaphragm, an anti-corrosive thin film formed on the diaphragm, and diaphragm deflection prevention means preventing the diaphragm from deflecting.

The above-described electrostatic actuator prevents the diaphragm on which the anti-corrosive thin film is formed from buckling, deflecting, and malfunctioning by the deflection prevention means, has good protection or anti-corrosiveness against liquid or ink, has an increased yield, and is producible at low costs.

The above objects of the present invention are also achieved by a method of producing an electrostatic actuator including a diaphragm caused to vibrate by electrostatic force, an electrode substrate opposing the diaphragm, an electrode formed on the electrode substrate so as to oppose the diaphragm with a gap being formed between the electrode and the diaphragm, an anti-corrosive thin film formed on the diaphragm, and diaphragm deflection prevention means preventing the diaphragm from deflecting, which method includes the steps of (a) joining a first substrate in which a diaphragm is formed and a second substrate on which an electrode is formed, and (b) forming an anti-corrosive thin film on the diaphragm after the step (a).

According to the above-described method, the electrostatic actuator preventing the diaphragm on which the anti-corrosive thin film is formed from buckling, deflecting, and malfunctioning by the deflection prevention means, having good protection or anti-corrosiveness against liquid or ink, and having an increased yield is producible at low costs.

The above objects of the present invention are also achieved by an electrostatic micropump including a nozzle hole for ejecting a liquid droplet, a liquid chamber that is a liquid channel communicating with the nozzle, and an electrostatic actuator forming wall faces of the liquid chamber, the electrostatic actuator including a diaphragm caused to vibrate by electrostatic force, an electrode substrate opposing the diaphragm, an electrode formed on the electrode substrate so as to oppose the diaphragm with a gap being formed between the electrode and the diaphragm, an anti-corrosive thin film formed on the diaphragm, and diaphragm deflection prevention means preventing the diaphragm from deflecting, wherein the liquid droplet is ejected by a pressure wave generated by the electrostatic force.

The above-described electrostatic micropump includes the electrostatic actuator that prevents the diaphragm on which the anti-corrosive thin film is formed from buckling, deflecting, and malfunctioning by the deflection prevention means, has good protection or anti-corrosiveness against liquid or ink, has an increased yield, is producible at low costs and energy-saving with low power consumption, and realizes a stable liquid ejection characteristic.

The above objects of the present invention are also achieved by an ink jet recording head including a nozzle hole for ejecting an ink droplet, an ink chamber that is an ink channel communicating with the nozzle, and an electrostatic actuator forming wall faces of the ink chamber, the electrostatic actuator including a diaphragm caused to vibrate by electrostatic force, an electrode substrate opposing the diaphragm, an electrode formed on the electrode substrate so as to oppose the diaphragm with a gap being formed between the electrode and the diaphragm, an anti-corrosive thin film formed on the diaphragm, and diaphragm deflection prevention means preventing the diaphragm from deflecting, wherein the ink droplet is ejected by a pressure wave generated by the electrostatic force.

The above-described ink jet head includes the electrostatic actuator that prevents the diaphragm on which the anti-corrosive thin film is formed from buckling, deflecting, and malfunctioning by the deflection prevention means, has good protection or anti-corrosiveness against liquid or ink, has an increased yield, is producible at low costs and energy-saving with low power consumption, and realizes a stable ink ejection characteristic.

The above objects of the present invention are also achieved by an ink jet recording apparatus including a conveying part for conveying a recording medium on which an ink image is recorded, and an ink jet recording head for recording the ink image on the recording medium by ejecting ink thereon, the ink jet recording head including a nozzle hole for ejecting ink, an ink chamber that is an ink channel communicating with the nozzle, and an electrostatic actuator forming wall faces of the ink chamber, the electrostatic actuator including a diaphragm caused to vibrate by electrostatic force, an electrode substrate opposing the diaphragm, an electrode formed on the electrode substrate so as to oppose the diaphragm with a gap being formed between the electrode and the diaphragm, an anti-corrosive thin film formed on the diaphragm, and diaphragm deflection prevention means preventing the diaphragm from deflecting, wherein the ink is ejected by a pressure wave generated by the electrostatic force.

The above-described ink jet recording apparatus includes the electrostatic actuator that prevents the diaphragm on which the anti-corrosive thin film is formed from buckling, deflecting, and malfunctioning by the deflection prevention means, has good protection or anti-corrosiveness against liquid or ink, has an increased yield, is producible at low costs and energy-saving with low power consumption, and realizes a stable liquid ejection characteristic. Therefore, the ink jet recording apparatus realizes high-quality image recording.

The above objects of the present invention are also achieved by a liquid droplet ejecting head including a channel formation member including liquid channels for containing liquid and partition walls separating the liquid channels, nozzles communicating with the liquid channels, and a liquid-resistant thin film formed on liquid-contacting surfaces of the liquid channels, the surfaces contacting the liquid, the liquid-resistant thin film having resistance to the liquid and including an organic resin film, wherein the liquid in the liquid channels is pressurized to be ejected from the nozzles as liquid droplets.

According to the above-described liquid droplet ejecting head, corrosion caused by liquid can be prevented at low costs, thus increasing reliability.

The above objects of the present invention are also achieved by an ink cartridge including an ink jet head, the ink jet head including a channel formation member including ink channels for containing ink, nozzles communicating with the ink channels, and an ink-resistant thin film formed on ink-contacting surfaces of the ink channels, the surfaces contacting the ink, the ink-resistant thin film having resistance to the ink and including an organic resin film, wherein the ink in the ink channels is pressurized to be ejected from the nozzles as ink droplets, and an ink tank for supplying the ink to the ink jet head, the ink tank being formed integrally with the ink jet head.

The above-described ink cartridge, which includes the above-described ink jet head, is free of nozzle clogging, thereby increasing reliability.

The above objects of the present invention are also achieved by an ink jet recording apparatus including an ink jet head, the ink jet head including a channel formation member including ink channels for containing ink, nozzles communicating with the ink channels, and an ink-resistant thin film formed on ink-contacting surfaces of the ink channels, the surfaces contacting the ink, the ink-resistant thin film having resistance to the ink and including an organic resin film, wherein the ink in the ink channels is pressurized to be ejected from the nozzles as ink droplets.

The above objects of the present invention are also achieved by an ink jet recording apparatus including an ink cartridge, the ink cartridge including an ink jet head, the ink jet head including a channel formation member including ink channels for containing ink, nozzles communicating with the ink channels, and an ink-resistant thin film formed on ink-contacting surfaces of the ink channels, the surfaces contacting the ink, the ink-resistant thin film having resistance to the ink and including an organic resin film, wherein the ink in the ink channels is pressurized to be ejected from the nozzles as ink droplets, and an ink tank for supplying the ink to the ink jet head, the ink tank being formed integrally with the ink jet head.

The above-described ink jet recording apparatuses include the ink jet head and the ink cartridge according to the present invention, thus realizing highly reliable and stable recording with increased image quality.

The above objects of the present invention are also achieved by a method of producing a liquid droplet ejecting head including a channel formation member including liquid channels for containing liquid, nozzles communicating with the liquid channels, and a liquid-resistant thin film formed on liquid-contacting surfaces of the liquid channels, the surfaces contacting the liquid, the liquid-resistant thin film having resistance to the liquid and including an organic resin film, the liquid in the liquid channels being pressurized to be ejected from the nozzles as liquid droplets, the method including the step of applying a liquid material for forming the organic resin film on the channel formation member by a spray method.

According the above-described method, the organic resin film serving as the liquid-resistant thin film is producible at low costs by a spray method.

The above objects of the present invention are also achieved by a method of producing a liquid droplet ejecting head including a channel formation member including liquid channels for containing liquid, nozzles communicating with the liquid channels, and a liquid-resistant thin film formed on liquid-contacting surfaces of the liquid channels, the surfaces contacting the liquid, the liquid-resistant thin film having resistance to the liquid and including an organic resin film, the liquid in the liquid channels being pressurized to be ejected from the nozzles as liquid droplets, the organic resin film being a polyimide-based film, the method including the step of (a) applying a solution of a polyamide acid of a viscosity of 20 cP or less on the channel formation member, the polyamide acid being a precursor of polyimide, and (b) forming the polyamide acid into a thin film in a process of heating and dehydrating the polyamide acid into an imide.

According to the above-described method, the organic resin film is producible without pinholes.

The above objects of the present invention are also achieved by a method of producing a liquid droplet ejecting head including a channel formation member including liquid channels for containing liquid, nozzles communicating with the liquid channels, and a liquid-resistant thin film formed on liquid-contacting surfaces of the liquid channels, the surfaces contacting the liquid, the liquid-resistant thin film having resistance to the liquid and including an organic resin film, the liquid in the liquid channels being pressurized to be ejected from the nozzles as liquid droplets, the organic resin film being a polyimide-based film, the method including the step of forming the polyimide thin film by performing heating and evaporation deposition under high vacuum.

According to the above-described method, the organic resin film is producible with uniform quality.

BRIEF DESCRIPTION OF THE DRAWINGS

Other objects, features and advantages of the present invention will become more apparent from the following detailed description when read in conjunction with the accompanying drawings, in which:

FIG. 67 is a diagram for illustrating an amount of deflection of a diaphragm and a liquid or ink droplet ejection characteristic of the electrostatic actuator according to the seventh embodiment;

FIG. 68 is a diagram for illustrating a concentration of oxygen atoms contained in a titanium nitride thin film and an anti-corrosiveness characteristic thereof against liquid or ink droplets;

DETAILED DESCRIPTION OF THE PREFERRED EMBODIMENTS

A description will now be given, with reference to the accompanying drawings, of embodiments of the present invention.

Figure 1:
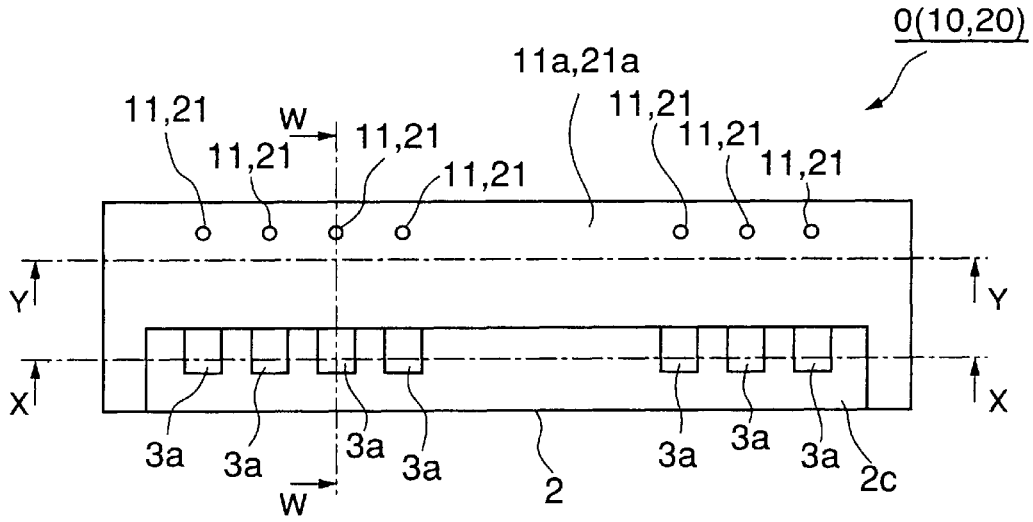
FIG. 1 is a plan view of an electrostatic actuator (an electrostatic micropump or an ink jet recording head including the electrostatic actuator) according to a first embodiment of the present invention.
Figure 2:
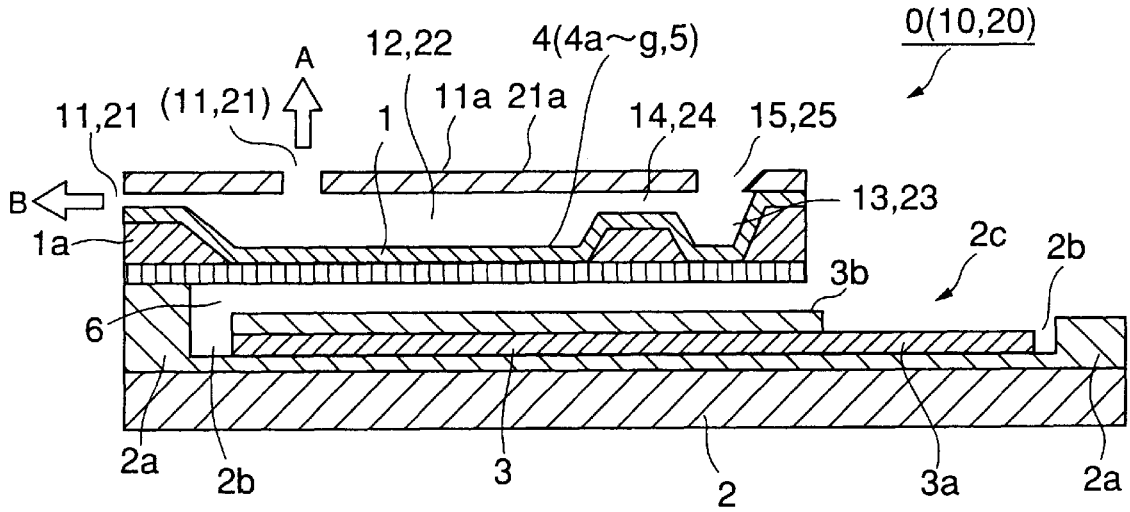
FIGS. 2 through 4 are sectional views of the electrostatic actuator (the electrostatic micropump or the ink jet recording head) of FIG. 1 taken along the lines W—W, X—X, and Y—Y, respectively.
Figure 3:
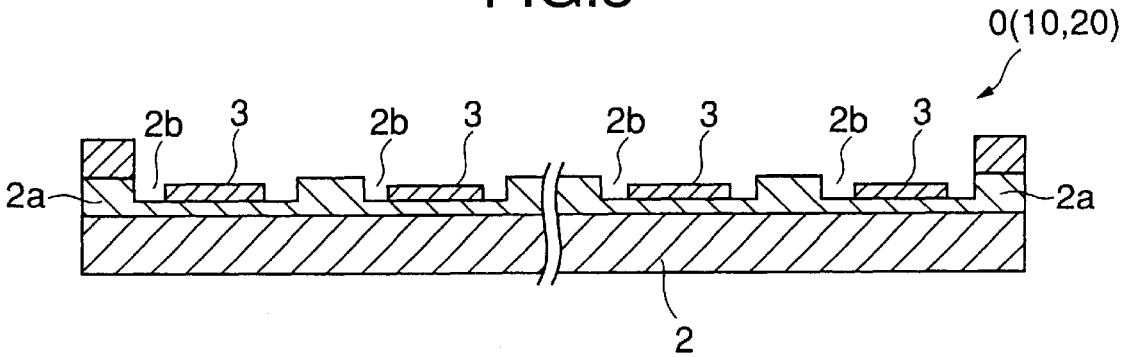
Figure 4:
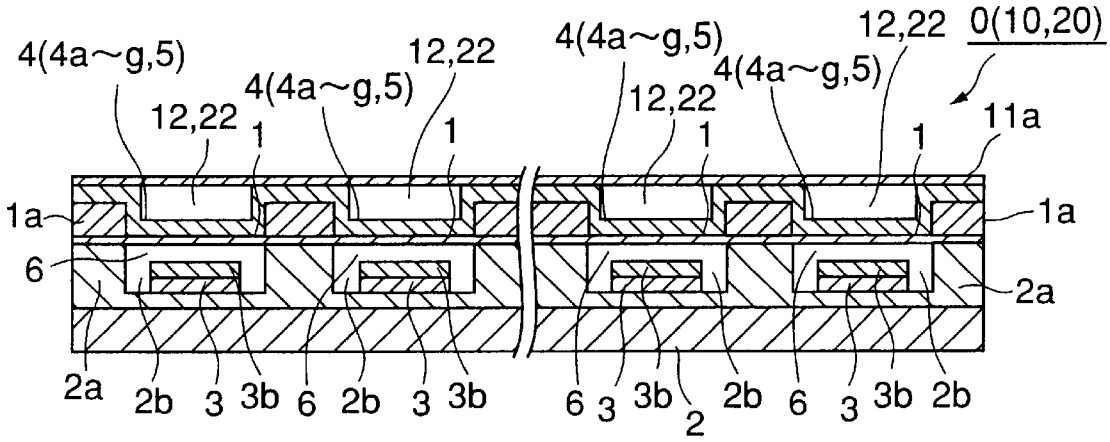

FIG. 1 is a plan view of an electrostatic actuator 0 (an electrostatic micropump 10 or an ink jet head recording head 20 including the electrostatic actuator 0) according to a first embodiment of the present invention. FIGS. 2 through 4 are sectional views of the electrostatic actuator 0 (the electrostatic micropump 10 or the ink jet head recording head 20) of FIG. 1 taken along the lines W—W, X—X, and Y—Y, respectively. The electrostatic actuator 0 vibrating and operating by electrostatic force includes diaphragms 1 vibrating to operate by electrostatic force, an electrode substrate 2 opposing the diaphragms 1, electrodes 3 formed on the electrode substrate 2 to oppose the diaphragms 1 with gaps 6 formed between the electrodes 3 and the diaphragms 1, an anti-corrosive thin film 4 formed on the diaphragms 1, and diaphragm deflection prevention means 5 for preventing deflections of the diaphragms 1. Voltage for vibrating the diaphragms 1 is applied to the electrodes 3. The diaphragm deflection prevention means 5 prevents the diaphragms 1 on which the anti-corrosive thin film 4 is formed from buckling and deflecting, and consequently from malfunctioning, thus making the electrostatic actuator 0 highly anti-corrosive, or corrosion-resistant, and increasing a yield so that the electrostatic actuator 0 is producible at low costs. The diaphragm deflection prevention means 5 vibrates to operate by electrostatic force.

The electrostatic micropump 10 and the ink jet recording head 20 that eject liquid and ink droplets by pressure waves caused by electrostatic force include nozzle holes 11 and 21 for ejecting the liquid and ink droplets in a direction indicated by arrow A or B in FIG. 2, and liquid chambers 12 and ink chambers 22 serving as liquid channels and ink channels with which the nozzles holes 11 and 21 communicate, respectively. The electrostatic micropump 10 and the ink jet recording head 20 each include the diaphragm deflection prevention means 5 that is the anti-corrosive thin film 4 formed on the diaphragms 1 of the electrostatic actuator 0 which diaphragms 1 form the wall faces of the liquid chambers 12 and ink chambers 22.

A diaphragm substrate la is a (110) single-crystal silicon substrate. In addition to the diaphragms 1, formed by anisotropic etching in the diaphragm substrate 1*a* are the liquid chambers 12 in which liquid is pressurized, a common liquid chamber 13, and liquid channels 14 in the case of the electrostatic micropump 10, and the ink chambers 22 in which ink is pressurized, a common ink chamber 23, and ink channels 24 in the case of the ink jet recording head 20. The liquid chambers 12 and the ink chambers 22 communicate with the common liquid chamber 13 and the common ink chamber 23 through the liquid channels 14 and the ink channels 24, respectively.

A nozzle plate 11*a* and a nozzle plate 21*a*, which are glass, metal, or silicon plates, have the nozzle holes 11 and the nozzle holes 21, and a liquid supply path 15 and an ink supply path 25 formed therein, respectively.

Further, the anti-corrosive thin film 4 having resistance to ink droplets is formed on the surfaces of the diaphragms 1, the diaphragm substrate 1*a*, the ink chambers 22, the common ink chamber 23, and the ink channels 24.

The diaphragm deflection prevention means 5 is a single-layer thin film or a multilayer film formed of layered films for preventing a malfunction of any of the diaphragms 1 caused by leakage of liquid or ink droplets through minute pinholes in the diaphragms 1. The diaphragm deflection prevention means 5 is formed by sputtering, CVD (chemical vapor deposition), or oxidation, by which the anti-corrosive thin film 4 is formed with good bottom coverage to contain oxygen atoms with good controllability. The diaphragm deflection prevention means 5 has at least a tensile stress or a compressive stress of 1.0E10 dyne/cm$^2$ or less as an internal stress so as to reduce the extent or prevent occurrence of a deflection of any of the diaphragms 1 by stress. The diaphragm deflection prevention means 5 preferably includes a titanium nitride thin film 4*a* of a resistivity of 1.0E–3 Ωcm or over, a silicon oxide thin film 4*b*, a zirconium thin film 4*c*, a zirconium compound thin film 4*d* formed of, for instance, zirconium nitride, a different stress multilayer thin film 4*e* of two or more layers having different stress directions of compressive stress and tensile stress, an equal stress thin film 4*f* formed under the diaphragms 1 and having an equal stress to that of the anti-corrosive thin film 4 formed on the diaphragms 1, and a uniform thickness thin film 4*g* having a uniform distribution of the film thickness of the anti-corrosive thin film 4 and including tensile stress. The titanium nitride thin film 4*a* and the silicon oxide thin film 4*b* each have good mass productivity. The zirconium thin film 4*c* and the zirconium compound thin film 4*d* each have good anti-corrosiveness, or good protection against corrosion, and an easily controllable film stress.

The electrode substrate 2 is an n- or p-type single-crystal silicon substrate. Normally, a (100) single-crystal silicon substrate is employed, but a (110) or (111) single-crystal silicon substrate may be employed depending on a process with no problem.

The electrodes 3 are formed of a refractory metal formed in concave parts 2*b* of a silicon oxide film 2*a* formed on the electrode substrate 2, and the voltage is applied to the electrodes 3 to vibrate and operate the diaphragms 1. The concave parts 2*b* are formed in the silicon oxide film 2*a* by performing thermal oxidation on the electrode substrate 2.

The electrodes 3 and the electrode substrate 2 are separated by insulation from each other. The electrodes 3 are formed of the refractory metal and its nitride or compound formed by reactive sputtering or CVD, such as titanium, tungsten, or tantalum. The electrodes 3 may have a layer structure of the refractory metal and its nitride or compound. Preferably, the electrodes 3 are formed of a titanium nitride or have a layer structure of titanium and titanium nitride formed in the order described on the silicon oxide film 2*a*.

The concave parts 2*b* serve to form the gaps 6 between the diaphragms 1 and the electrodes 3, and electrostatic attraction is generated by applying the electrodes 3 opposing the diaphragms 1 with the gaps 6 being formed therebetween.

A pad part 2*c* is formed for mounting an FPC (not shown) or performing wire bonding for applying voltage to electrode pads 3*a* of the electrodes 3 from outside.

Accordingly, by a simple stress structure, the diaphragms 1 on which the anti-corrosive thin film 4 is formed are prevented from buckling, deflecting, and malfunctioning by the diaphragm deflection prevention means 5 with a few resources of only charge and discharge currents and therefore with low power consumption while the electrostatic actuator 1 is in operation. Thus, the electrostatic actuator 0 having good anti-corrosiveness and an increased yield and producible at low costs, and the electrostatic micropump 10 and the ink jet recording head 20 including the electrostatic actuator 0 can be realized.

FIGS. 5 through 22 are diagrams for illustrating a method of producing the electrostatic actuator 0 and the electrostatic micropump 10 or the ink jet recording head 20 including the electrostatic actuator 0 according to the first embodiment of the present invention.

The method includes the following steps.

Figure 5:
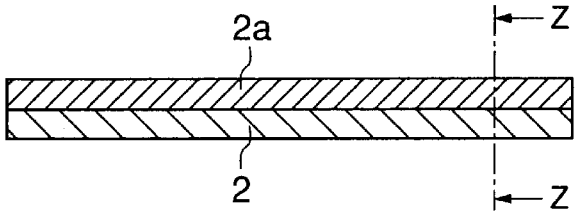
FIG. 5 is a diagram for illustrating a production process of a principal part of the electrostatic actuator (the electrostatic micropump or the ink jet recording head) of FIG. 1.
Figure 6:
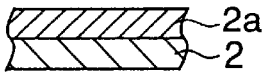
FIG. 6 is a sectional view of the principal part of FIG. 5 taken along the line Z—Z.

(a) Form the silicon oxide film 2*a* by thermal oxidation on the electrode substrate 2 that is a (100), (111), or (110) p- or n-type single-crystal silicon substrate as shown in FIGS. 5 and 6.

Figure 7:
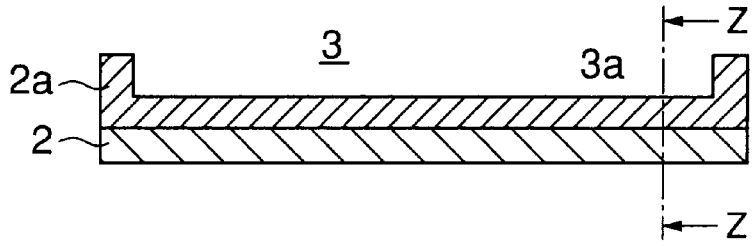
FIG. 7 is another diagram for illustrating the production process.
Figure 8:
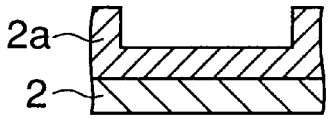
FIG. 8 is a sectional view of the principal part of FIG. 7 taken along the line Z—Z.

(b) Perform patterning on the silicon oxide film 2*a* so as to define areas for the electrodes 3 and the electrode pads 3*a* by normal photolithography and dry or wet etching as shown in FIGS. 7 and 8.

Figure 9:
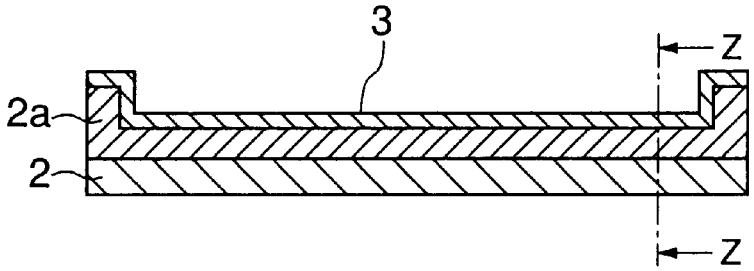
FIG. 9 is another diagram for illustrating the production process.
Figure 10:
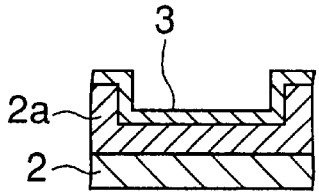
FIG. 10 is a sectional view of the principal part of FIG. 9 taken along the line Z—Z.

(c) Form the electrodes 3 by forming the refractory metal and its nitride or compound formed by reactive sputtering or CVD, such as titanium, tungsten, or tantalum, a layer structure of the refractory metal and its nitride or compound, or preferably, titanium nitride or a layer of titanium and titanium nitride on all over the patterned silicon oxide film 2*a* as shown in FIGS. 9 and 10.

Figure 11:
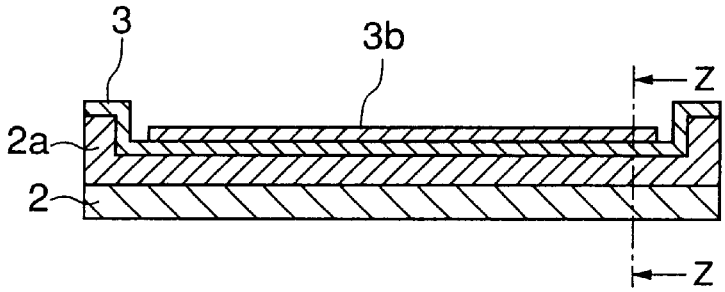
FIG. 11 is another diagram for illustrating the production process.
Figure 12:
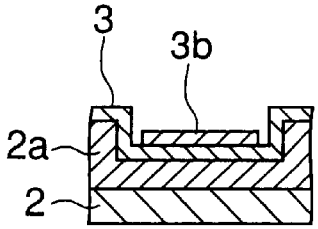
FIG. 12 is a sectional view of the principal part of FIG. 11 taken along the line Z—Z.

(d) Form insulators 3*b*, which are preferably silicon oxide, on the electrodes 3 by CVD, sputtering, or evaporation as shown in FIGS. 11 and 12.

Figure 13:
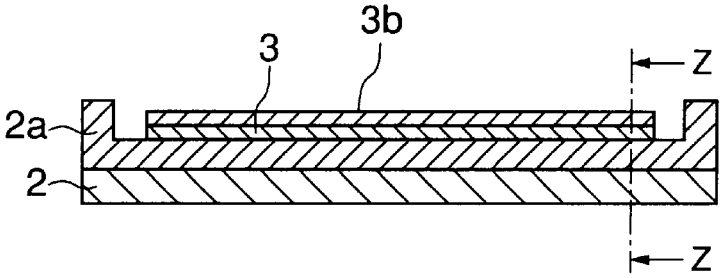
FIG. 13 is another diagram for illustrating the production process.
Figure 14:
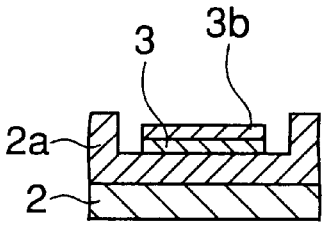
FIG. 14 is a sectional view of the principal part of FIG. 13 taken along the line Z—Z.

(e) Complete the electrode substrate 2 by etching and patterning the electrodes 3 of the refractory metal with the insulators 3 being employed as an etching mask as shown in FIGS. 13 and 14.

Figure 15:
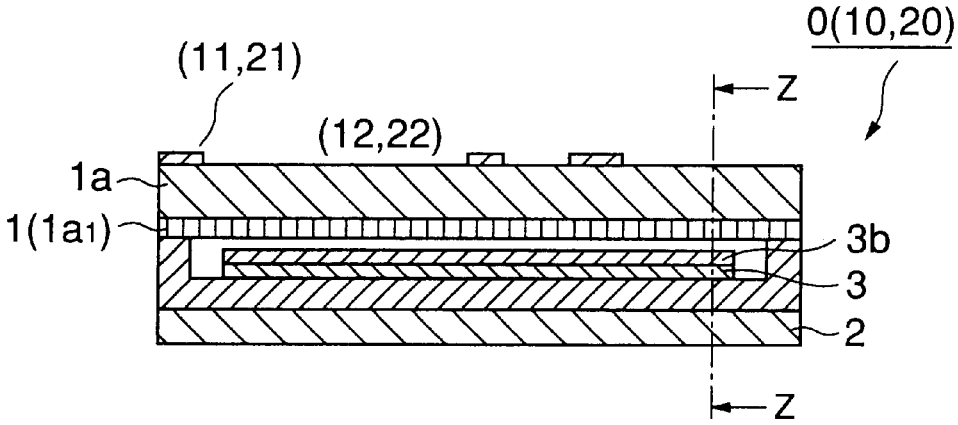
FIG. 15 is another diagram for illustrating the production process.
Figure 16:
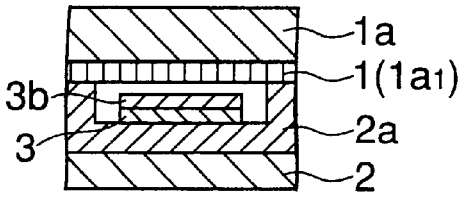
FIG. 16 is a sectional view of the principal part of FIG. 15 taken along the line Z—Z.

(f) Align and join at approximately 500° C., and thereafter perform heat treatment at 800° C. or over on the electrode substrate 2 and the diaphragm substrate 1*a* having on a first side a diffusion layer $1a_1$, in which p- or n-type impurity of 1E19/cm$^3$ or over is diffused as deep as the thickness of each diaphragm 1 and having on a second side opposite to the first side an etching mask pattern of single-crystal silicon such as silicon oxide, silicon nitride, or tantalum pentaoxide which etching mask pattern defines the nozzle holes 11 and the nozzle holes 21, and the liquid chambers 12 and the ink chambers 22 of the electrostatic micropump 10 and the ink jet recording head 20, respectively, as shown in FIGS. 15 and 16. This method, which has good joint accuracy, is called direct junction. The etching mask pattern may be formed after aligning and joining the diaphragm substrate 1*a* and the electrode substrate 2. Further, the electrode substrate 2 may be directly joined to an SOI (Silicon On Insulator) that is a (110) single-crystal silicon substrate on which single-crystal thin film silicon is formed with a silicon oxide film as thick as the film thickness of each diaphragm 1 being formed therebetween.

Also in this case, the SOI may be joined to the electrode substrate 2 after the single-crystal silicon etching mask pattern of silicon oxide, silicon nitride, or tantalum pentaoxide which etching mask pattern defines the nozzle holes 11 and the nozzle holes 21, and the liquid chambers 12 and the ink chambers 22 of the electrostatic micropump 10 and the ink jet recording head 20, respectively, is formed on a side of the SOI which side is opposite to a side on which the single-crystal thin film silicon is formed.

Figure 17:
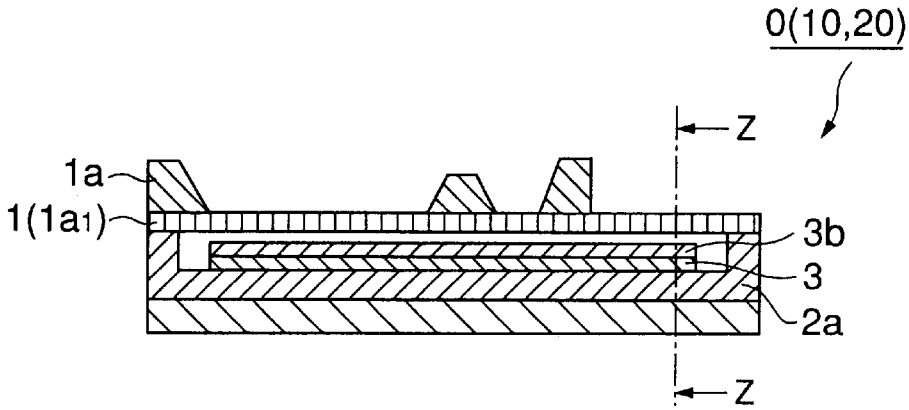
FIG. 17 is another diagram for illustrating the production process.
Figure 18:
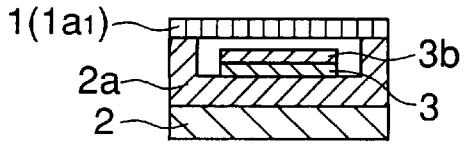
FIG. 18 is a sectional view of the principal part of FIG. 17 taken along the line Z—Z.

(g) Form the diaphragms 1 by performing anisotropic etching, using KOH or TMAH, on the directly joined diaphragm substrate 1*a* and the electrode substrate 2 from the side of the diaphragm substrate 1*a* on which side the single-crystal silicon etching mask pattern is formed. The etching process spontaneously stops when the impurity diffusion layer $1a_1$ is reached as shown in FIGS. 17 and 18.

In the case of the SOI, the anisotropic etching stops when the silicon oxide film is reached. At this point, the silicon oxide film may be removed with no problem.

Figure 19:
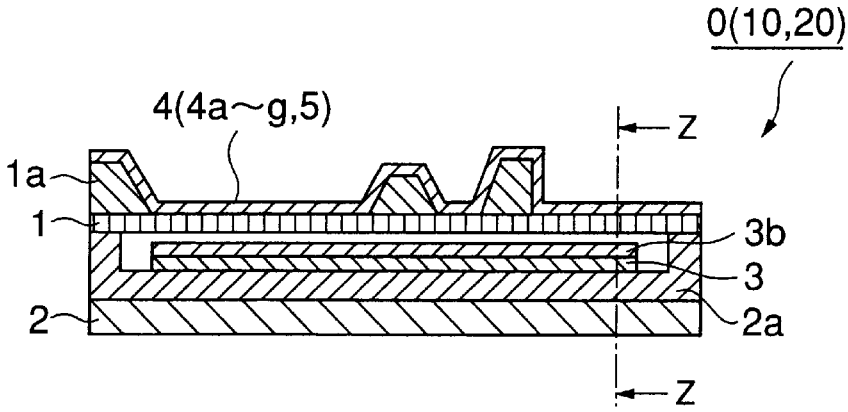
FIG. 19 is another diagram for illustrating the production process.
Figure 20:
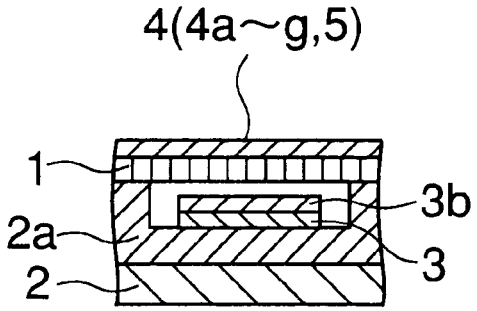
FIG. 20 is a sectional view of the principal part of FIG. 19 taken along the line Z—Z.

(h) Form the anti-corrosive thin film 4 having anti-corrosiveness against ink droplets simultaneously on the surface of the diaphragm substrate 1*a* and the entire surfaces of the diaphragms 1 as shown in FIGS. 19 and 20.

The diaphragm deflection prevention means 5 preferably includes a titanium nitride thin film 4*a* of a resistivity of 1.0E–3 Ω.cm or over, a silicon oxide thin film 4*b*, a zirconium thin film 4*c*, a zirconium compound thin film 4*d* formed of, for instance, zirconium nitride, a different stress multilayer thin film 4*e* of two or more layers having different stress directions of compressive stress and tensile stress, an equal stress thin film 4*f* formed under the diaphragms 1 and having an equal stress to that of the anti-corrosive thin film 4 formed on the diaphragms 1, and a uniform thickness thin film 4*g* having a uniform distribution of the film thickness of the anti-corrosive thin film 4 and including tensile stress.

Figure 21:
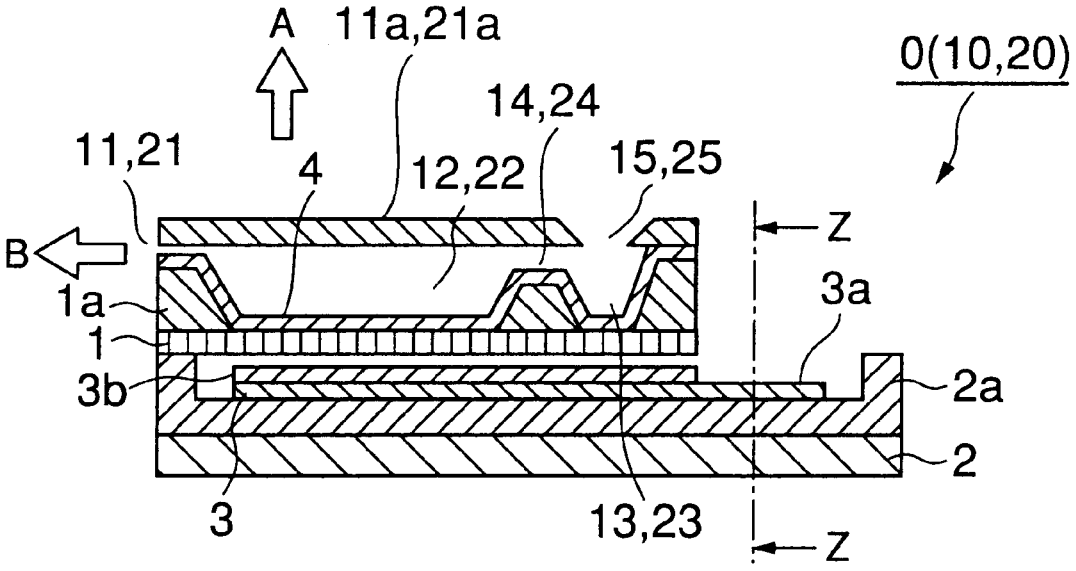
FIG. 21 is another diagram for illustrating the production process.
Figures 22, 23:
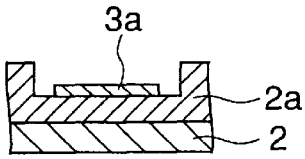
FIG. 22 is a sectional view of the principal part of FIG. 21 taken along the line Z—Z.
FIG. 23 is a diagram for illustrating an internal stress of an anti-corrosive thin film, a deflection of a diaphragm, and liquid or ink droplet ejection characteristic of the electrostatic actuator according to the first embodiment.

(i) Form the nozzle plate 11*a* or 21*a* by forming the liquid supply path 15 in the case of the nozzle plate 11*a* and the ink supply path 25 in the case of the nozzle plate 21*a* in a substrate formed of a glass or metal plate by sand blasting or laser processing and attach the nozzle plate 11*a* or 21*a* to the diaphragm substrate 1*a* as shown in FIGS. 21 and 22. Parts of the anti-corrosive thin film 4, the diaphragms 1, and the insulator 3*b* formed on the electrode pads 3*a* are removed by etching.

Thereby, realized is a method of producing the electrostatic actuator 0 having good anti-corrosiveness and a considerably increased yield, producible at low costs, and preventing the diaphragms 1 from being damaged during operation and from buckling, deflecting, and consequently, malfunctioning and the electrostatic micropump 10 or the ink jet recording head 20 including the electrostatic actuator 0.

In the diaphragm substrate 1*a*, the liquid chambers 12 or the ink chambers 22 are formed by anisotropic etching t6 correspond to the nozzle holes 11 or 21, and the common liquid chamber 13 or the common ink chamber 23 is formed to supply liquid or ink to the liquid chambers 12 or the ink chambers 22. The liquid chambers 12 and the ink chambers 22 communicate with the common liquid chamber 13 and the common ink chamber 23 with the liquid channels 14 and the ink channels 24, respectively. The anti-corrosive thin film 4 is formed on the liquid chambers 12, the ink chambers 22, the common liquid chamber 13, the common ink chamber 23, the liquid channels 14, and the ink channels 24.

When voltages are applied to the electrodes 3 via the electrode pads 3*a*, electrostatic forces are exerted between the diaphragms 1 and the electrodes 3 so that the diaphragms deflect toward the electrodes 3. As a result, the liquid chambers 12 or the ink chambers 22 are depressurized so that the liquid or ink is supplied thereto through the liquid channels 14 or the ink channels 24 from the common liquid chamber 13 or the common ink chamber 23.

When the application of the voltages to the electrodes 3 via the electrode pads 3*a* is stopped, the diaphragms 1 return to their original positions by their stiffness. At this point, the liquid chambers 12 or the ink chambers 22 are pressurized so that liquid or ink droplets are ejected through the nozzle holes 11 or 21 in the direction indicated by arrow A which is normal to the diaphragm substrate 1*a* or in the direction indicated by arrow B which is horizontal with the diaphragm substrate 1*a* by changing the orientations of the nozzles 11 or 21.

Experiments were conducted, with respect to the electrostatic actuator 0 and the electrostatic micropump 10 and the ink jet recording head 20 each including the electrostatic actuator 0, to see whether the diaphragm 1 of 2 μm in thickness including a boron impurity of 1E19/cm$^3$ or more buckles and deflects when the internal stress of the anti-corrosive thin film 4 is changed with the titanium nitride thin film 4*a* and the zirconium thin film 4*c* being employed as the diaphragm deflection prevention means 5 and to estimate liquid or ink droplet ejection characteristic. FIG. 23 shows the results of the experiments.

As a result, the diaphragm deflection prevention means 5 prevented the diaphragms 1 from buckling and deflecting and the ejection characteristic was good if the titanium nitride thin film 4*a* and the zirconium thin film 4*c* had an internal stress that was at least a tensile stress or a compressive stress of 1E10 dyne/cm$^2$ or less.

On the other hand, with a compressive stress of 2E10 dyne/cm$^2$ or more, the diaphragms 1 buckled and deflected so as to cause an ejection defect that liquid or ink droplets were prevented from being ejected.

Figures 24, 25:
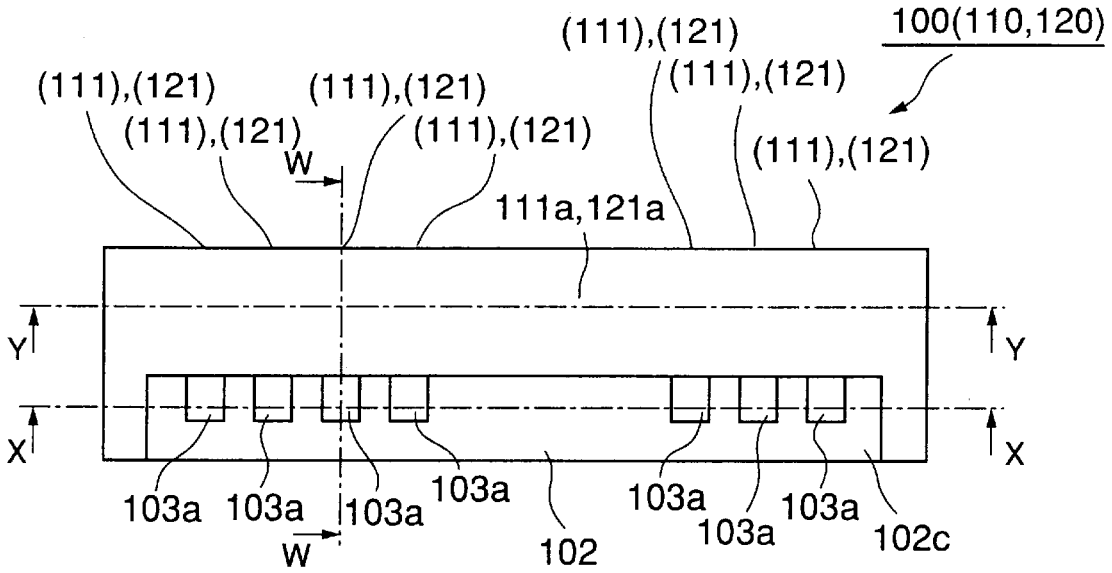
FIG. 24 is a diagram for illustrating a resistivity and an anti-corrosiveness characteristic against liquid or ink of the anti-corrosive thin film according to the first embodiment.
FIG. 25 is a plan view of an electrostatic actuator (an electrostatic micropump or an ink jet recording head including the electrostatic actuator) according to a second embodiment of the present invention.

FIG. 24 shows the results of estimation of the resistivity and the anti-corrosiveness against ink droplets of the titanium nitride thin film 4*a* in the case of employing the titanium nitride thin film 4*a* for the anti-corrosive thin film 4.

According to the results, the titanium nitride thin film 4*a* showed resistivity against ink droplets if the resistivity thereof is 1E–3 Ωcm or more, while the titanium nitride thin film 4*a* included corrosion when the resistivity thereof is less than 1E–3 Ω.cm.

A description will now be given of a second embodiment of the present invention.

Figure 26:
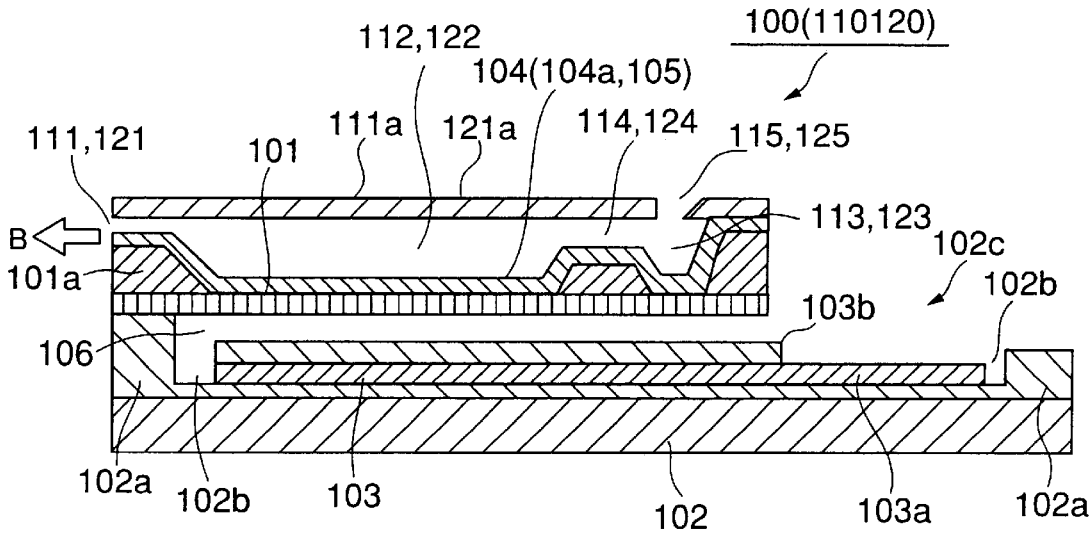
FIGS. 26 through 28 are sectional views of the electrostatic actuator (the electrostatic micropump or the ink jet recording head) of FIG. 25 taken along the lines W—W, X—X, and Y—Y, respectively.
Figure 27:
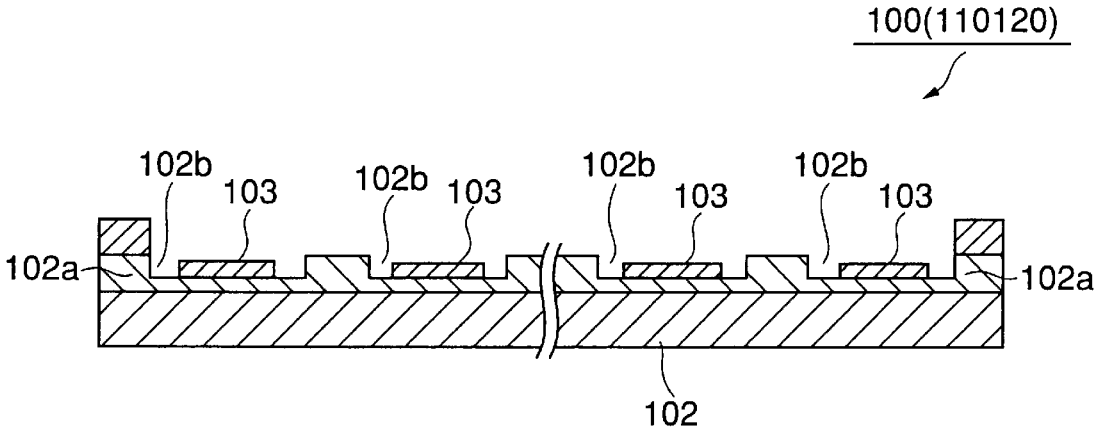
Figure 28:
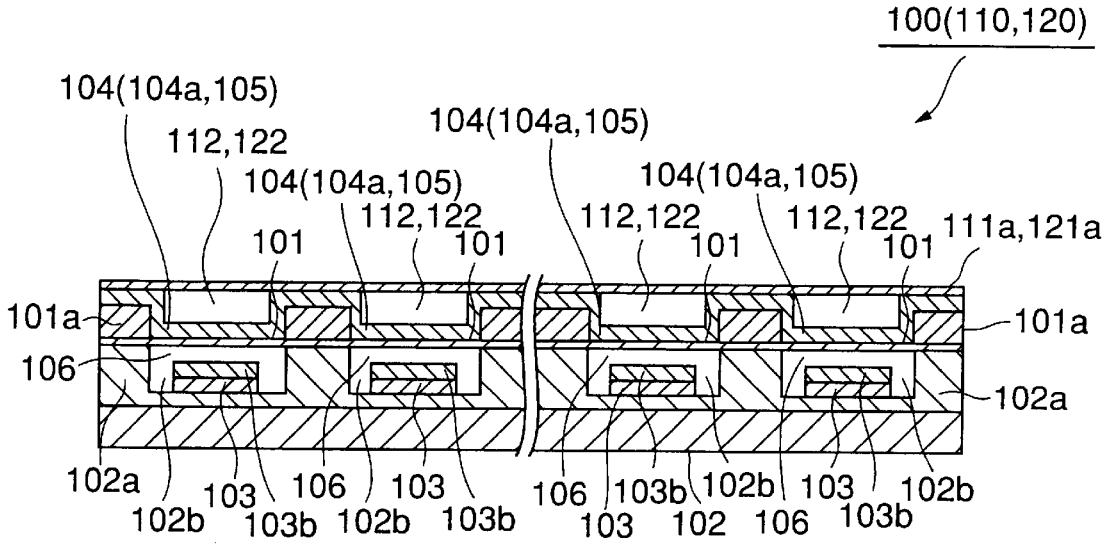

FIG. 25 is a plan view of an electrostatic actuator 100 (an electrostatic micropump 110 or an ink jet recording head. 120 including the electrostatic actuator 100) according to the second embodiment of the present invention. FIGS. 26 through 28 are sectional views of the electrostatic actuator 100 (the electrostatic micropump 110 or the ink jet recording head 120) of FIG. 25 taken along the lines W—W, X—X, and Y—Y, respectively. The electrostatic actuator 100 includes a single-layer anti-corrosive thin film 104 of a titanium nitride thin film 104*a* serving as diaphragm deflection prevention means 105. The diaphragm deflection prevention means 105 vibrates to operate by electrostatic force.

Each of the electrostatic actuator 100, the electrostatic micropump 110, and the ink jet recording head 120 is formed by the above-described steps (a) through (i).

An electrode substrate 102 is a (100) p-type single-crystal silicon substrate having a resistivity of 10 to 30 Ω.cm.

Electrodes 103 are arranged in concave parts 102*b* of 0.4 82 m in deepness formed in a silicon oxide film 102*a* of 2 μm in thickness formed on the electrode substrate 102 by thermal oxidation, and are formed of titanium nitride formed successively by reactive sputtering on the silicon oxide film 102*a*. The electrodes 103 are separated from one another by insulation.

Insulators 103*b* of a silicon oxide film of 150 nm in thickness are formed by plasma CVD on the titanium nitride of the electrodes 103 so as to secure insulation between diaphragms 101 and the electrodes 103.

A pad part 102*c* of the electrode substrate 102 is an area in which the insulators 103*b* are removed by etching and voltage is applied via electrode pads 103*a* to the electrodes 103 so as to vibrate and operate the diaphragms 101.

A diaphragm substrate 101*a* is a (110) single-crystal silicon substrate in which the diaphragms 101 of 2 $\mu$m in thickness including boron impurity atoms of 1E20/cm$^3$ or more are formed by anisotropic etching using KOH and arranged to oppose the electrodes 103 with the insulators 103*b* being interposed therebetween in gaps 106.

Further in the diaphragm substrate 101*a*, liquid chambers 112, a common liquid chamber 113 for supplying liquid to the liquid chambers 112, and liquid channels 114 connecting the liquid chambers 112 and the common liquid chamber 113 are formed by anisotropic etching in the case of the electrostatic micropump 110, and ink chambers 122, a common ink chamber 123 for supplying ink to the ink chambers 122, and ink channels 124 connecting the ink chambers 122 and the common ink chamber 123 are formed by anisotropic etching in the case of the ink jet recording head 120.

On the surfaces of the diaphragm substrate 101*a*, the diaphragms 101, the liquid chambers 112, the ink chambers 122, the common liquid chamber 113, the common ink chamber 123, the liquid channels 114, and the ink channels 124, the titanium nitride thin film 104*a*, which is the anti-corrosive thin film 104 having anti-corrosiveness against liquid or ink, is formed with a good bottom coverage to have a thickness of 1000 Å and contain oxygen atoms with good controllability by sputtering, CVD, or oxidation.

The titanium nitride thin film 104*a* of the anti-corrosive thin film 104, which serves as the diaphragm deflection prevention means 105, has an internal stress of 1E08 dyne/cm$^2$ that is a tensile stress and a resistivity of 6.0E–3 Ω.cm.

Nozzle plates 111*a* and 121*a* are formed of glass plates, in which a liquid supply path 115 for supplying the liquid and an ink supply path 125 for supplying the ink and the nozzle holes 111 and 121 are formed by sand blasting, respectively. The nozzle plates 111*a* and 121*a* are attached over the liquid chambers 112 and the ink chambers 122, respectively.

In the above-described electrostatic actuator 100, the electrostatic micropump 110, or the ink jet recording head 120, when the diaphragms 101 were electrically grounded and voltages were applied to the electrodes 103 via the electrode pads 103*a*, the diaphragms 101 vibrated and operated at a certain frequency.

When the voltages were applied to the electrodes 103 via the electrode pads 103*a*, electrostatic forces were exerted between the diaphragms 101 and the electrodes 103 so that the diaphragms 101 were attracted toward the electrodes 103.

At this point, the diaphragm deflection prevention means 105 prevented buckling of the diaphragms 101 due to the formation of the titanium nitride thin film 104*a* and consequent deflections thereof so that the diaphragms 101 were attracted sufficiently toward the electrodes 103.

As a result, the liquid chambers 112 or the ink chambers 122 were depressurized so that the liquid or ink was supplied from the common liquid chamber 113 or the common ink chamber 123 to the liquid chambers 112 or the ink chambers 122 via the liquid channels 114 or the ink channels 124.

The diaphragms 101 returned to their original positions by stiffness of silicon in accordance with the frequency of the voltages applied to the electrodes 103 via the electrode pads 103*a*. At this point, the liquid chambers 112 or the ink chambers 122 were pressurized so that liquid or ink droplets were stably ejected through the nozzle holes 111 or 121 in a direction indicated by arrow B in FIG. 26.

Further, as a result of conducting a reliability test using liquid or ink droplets in this state, it was confirmed that the titanium nitride thin film 104*a* that was the anti-corrosive thin film 104 whose resistivity was controlled had good anti-corrosiveness.

Next, a description will be given of a third embodiment of the present invention.

Figure 29:
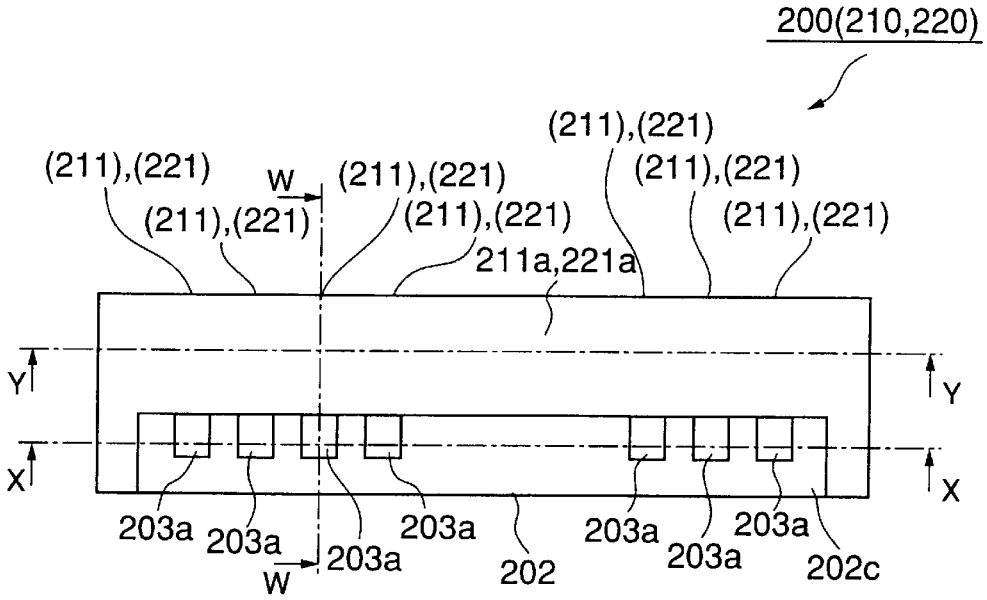
FIG. 29 is a plan view of an electrostatic actuator (an electrostatic micropump or an ink jet recording head including the electrostatic actuator) according to a third embodiment of the present invention.
Figure 30:
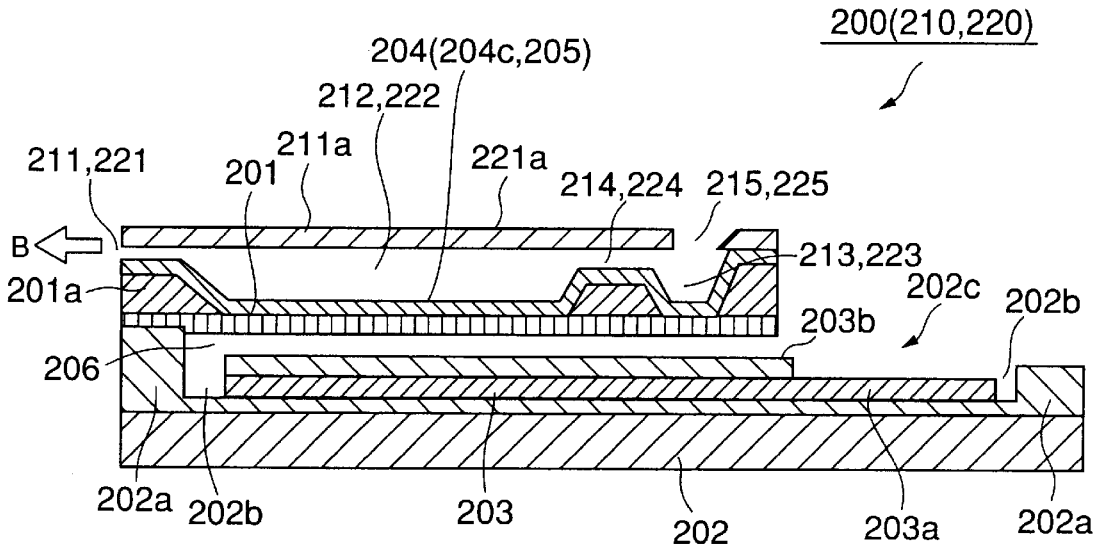
FIGS. 30 through 32 are sectional views of the electrostatic actuator (the electrostatic micropump or the ink jet recording head) of FIG. 29 taken along the lines W—W, X—X, and Y—Y, respectively.
Figure 31:
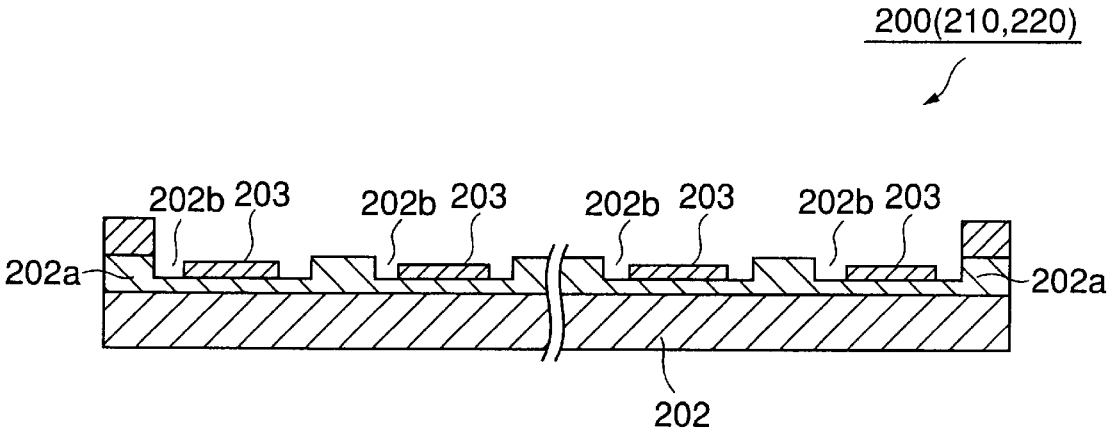
Figure 32:
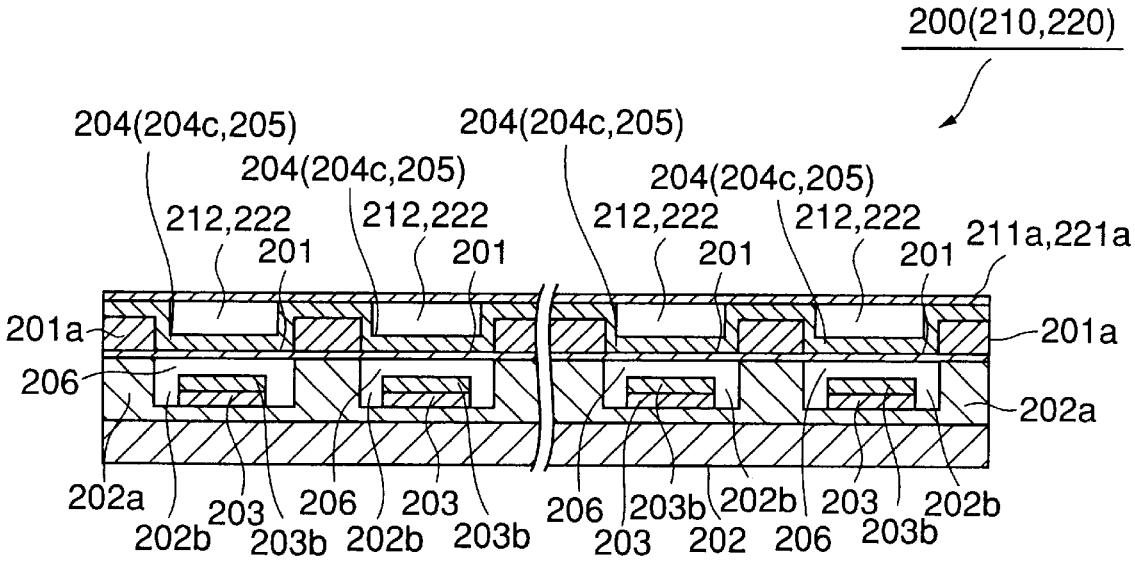

FIG. 29 is a plan view of an electrostatic actuator 200 (an electrostatic micropump 210 or an ink jet recording head 220 including the electrostatic actuator 200) according to the third embodiment of the present invention. FIGS. 30 through 32 are sectional views of the electrostatic actuator 200 (the electrostatic micropump 210 or the ink jet recording head 220) of FIG. 29 taken along the lines W—W, X—X, and Y—Y, respectively. The electrostatic actuator 200 includes a single-layer anti-corrosive thin film 204 of a zirconium thin film 204*c* serving as diaphragm deflection prevention means 205. The diaphragm deflection prevention means 205 vibrates to operate by electrostatic force.

Each of the electrostatic actuator 200, the electrostatic micropump 210, and the ink jet recording head 220 is formed by the above-described steps (a) through (i).

An electrode substrate 202 is a (100) p-type single-crystal silicon substrate having a resistivity of 10 to 30 Ω.cm.

Electrodes 203 are arranged in concave parts 202*b* of 0.4 $\mu$m in deepness formed in a silicon oxide film 202*a* of 2 $\mu$m in thickness formed on the electrode substrate 202 by thermal oxidation, and are formed of titanium nitride formed successively by reactive sputtering on the silicon oxide film 202*a*. The electrodes 203 are insulated from one another.

Insulators 203*b* of a silicon oxide film of 150 nm in thickness are formed by plasma CVD on the titanium nitride of the electrodes 203 so as to secure insulation between diaphragms 201 and the electrodes 203.

A pad part 202*c* of the electrode substrate 202 is an area in which the insulators 203*b* are removed by etching and voltage is applied via electrode pads 203*a* to the electrodes 203 so as to vibrate and operate the diaphragms 201.

A diaphragm substrate 201*a* is a (110) single-crystal silicon substrate in which the diaphragms 201 of 2 $\mu$m in thickness including boron impurity atoms of 1E20/cm$^3$ or more are formed by anisotropic etching using KOH and arranged to oppose the electrodes 203 with the insulators 203*b* being interposed therebetween in gaps 206.

Further in the diaphragm substrate 201*a*, liquid chambers 212, a common liquid chamber 213 for supplying liquid to the liquid chambers 212, and liquid channels 214 connecting the liquid chambers 212 and the common liquid chamber 213 are formed by anisotropic etching in the case of the electrostatic micropump 210, and ink chambers 222, a common ink chamber 223 for supplying ink to the ink chambers 222, and ink channels 224 connecting the ink chambers 222 and the common ink chamber 223 are formed by anisotropic etching in the case of the ink jet recording head 220.

On the surfaces of the diaphragm substrate 201*a*, the diaphragms 201, the liquid chambers 212, the ink chambers 222, the common liquid chamber 213, the common ink chamber 223, the liquid channels 214, and the ink channels 224, the zirconium thin film 204*c*, which is the anti-corrosive thin film 204 having anti-corrosiveness against liquid or ink, is formed with a good bottom coverage to have a thickness of 1000 Å and contain oxygen atoms with good controllability by sputtering, CVD, or oxidation.

The zirconium thin film 204*c* of the anti-corrosive thin film 204, which serves as the diaphragm deflection prevention means 205, has an internal stress of −0.5E09 dyne/cm$^2$ that is a compressive stress.

Nozzle plates 211*a* and 221*a* are formed of glass plates, in which a liquid supply path 215 for supplying the liquid and an ink supply path 225 for supplying the ink and the nozzle holes 211 and 221 are formed by sand blasting, respectively. The nozzle plates 211*a* and 221*a* are attached over the liquid chambers 212 and the ink chambers 222, respectively.

In the above-described electrostatic actuator 200, the electrostatic micropump 210, or the ink jet recording head 220, when the diaphragms 201 were electrically grounded and voltages were applied to the electrodes 203 via the electrode pads 203*a*, the diaphragms 201 vibrated and operated at a certain frequency.

When the voltages were applied to the electrodes 203 via the electrode pads 203*a*, electrostatic forces were exerted between the diaphragms 201 and the electrodes 203 so that the diaphragms 201 were attracted toward the electrodes 203.

At this point, the diaphragm deflection prevention means 205 prevented buckling of the diaphragms 201 due to the formation of the zirconium thin film 204*c* and consequent deflections thereof so that the diaphragms 201 were attracted sufficiently toward the electrodes 203.

As a result, the liquid chambers 212 or the ink chambers 222 were depressurized so that the liquid or ink was supplied from the common liquid chamber 213 or the common ink chamber 223 to the liquid chambers 212 or the ink chambers 222 via the liquid channels 214 or the ink channels 224.

The diaphragms 201 returned to their original positions by stiffness of silicon in accordance with the frequency of the voltages applied to the electrodes 203 via the electrode pads 203*a*. At this point, the liquid chambers 212 or the ink chambers 222 were pressurized so that liquid or ink droplets were stably ejected through the nozzle holes 211 or 221 in a direction indicated by arrow B in FIG. 30. Further, as a result of conducting a reliability test using liquid or ink droplets in this state, it was confirmed that the zirconium thin film 204*c* that was the anti-corrosive thin film 204 whose resistivity was controlled had good anti-corrosiveness.

Next, a description will be given of a fourth embodiment of the present invention.

Figure 33:
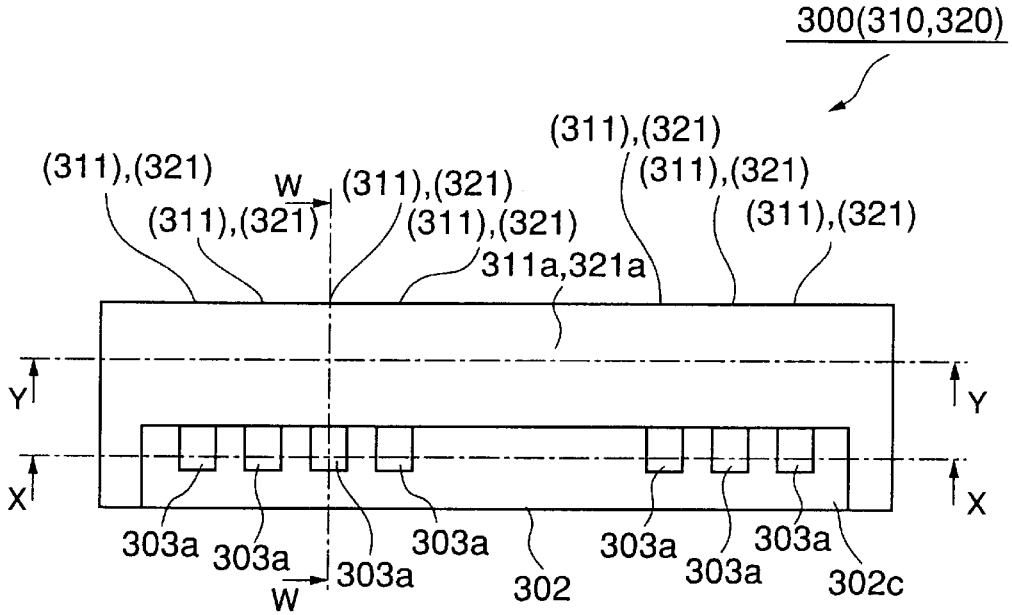
FIG. 33 is a plan view of an electrostatic actuator (an electrostatic micropump or an ink jet recording head including the electrostatic actuator) according to a fourth embodiment of the present invention.
Figure 34:
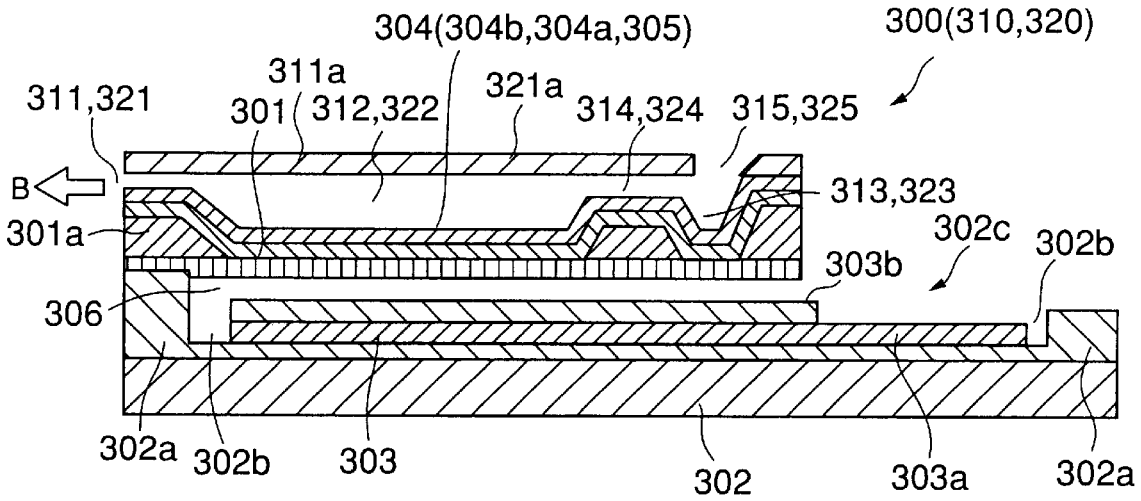
FIGS. 34 through 36 are sectional views of the electrostatic actuator (the electrostatic micropump or the ink jet recording head) of FIG. 33 taken along the lines W—W, X—X, and Y—Y, respectively.
Figure 35:
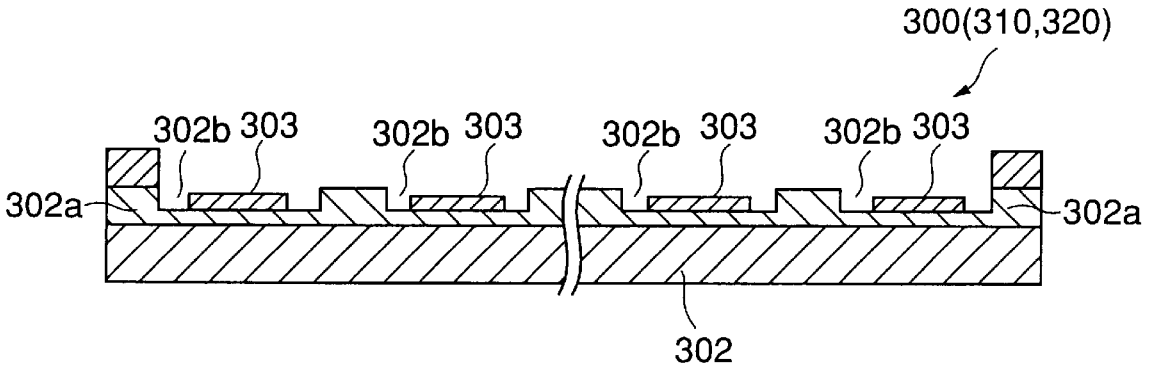
Figure 36:
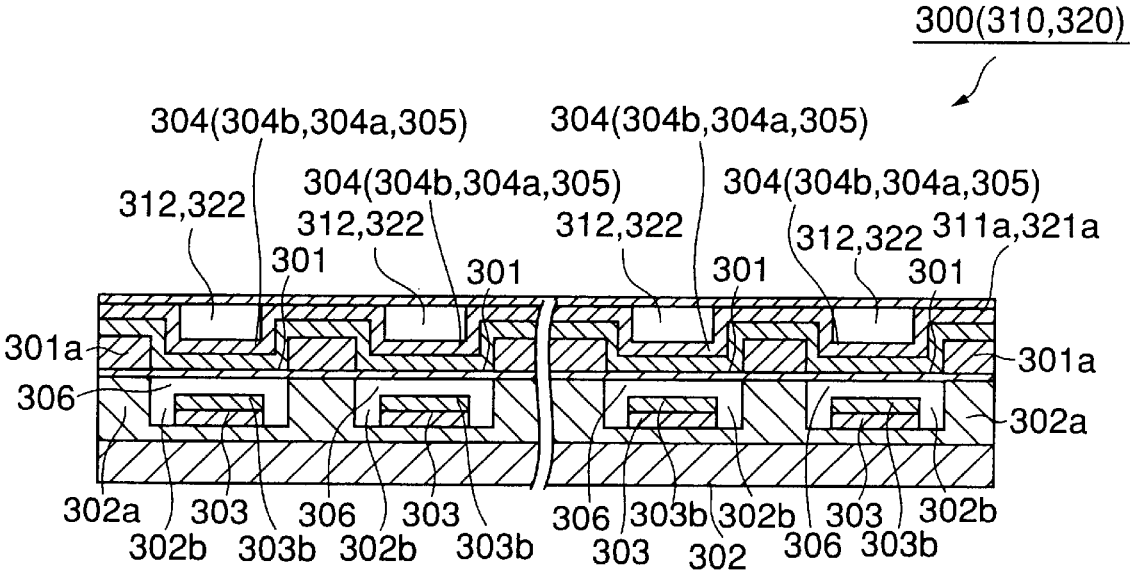

FIG. 33 is a plan view of an electrostatic actuator 300 (an electrostatic micropump 310 or an ink jet recording head 320 including the electrostatic actuator 300) according to the fourth embodiment of the present invention. FIGS. 34 through 36 are sectional views of the electrostatic actuator 300 (the electrostatic micropump 310 or the ink jet recording head 320) of FIG. 33 taken along the lines W—W, X—X, and Y—Y, respectively. The electrostatic actuator 300 includes a multilayer anti-corrosive thin film 304 of a silicon oxide thin film 304*b* and a titanium nitride thin film 304*a* serving as diaphragm deflection prevention means 305. The diaphragm deflection prevention means 305 vibrates to operate by electrostatic force.

Each of the electrostatic actuator 300, the electrostatic micropump 310, and the ink jet recording head 320 is formed by the above-described steps (a) through (i).

An electrode substrate 302 is a (100) p-type single-crystal silicon substrate having a resistivity of 10 to 30 Ω.cm.

Electrodes 303 are arranged in concave parts 302*b* of 0.4 μm in deepness formed in a silicon oxide film 302*a* of 2 μm in thickness formed on the electrode substrate 302 by thermal oxidation, and are formed of titanium nitride formed successively by reactive sputtering on the silicon oxide film 302*a*. The electrodes 303 are insulated from one another.

Insulators 303*b* of a silicon oxide film of 150 nm in thickness are formed by plasma CVD on the titanium nitride of the electrodes 303 so as to secure insulation between diaphragms 301 and the electrodes 303.

A pad part 302*c* of the electrode substrate 302 is an area in which the insulators 303*b* are removed by etching and voltage is applied via electrode pads 303*a* to the electrodes 303 so as to vibrate and operate the diaphragms 301.

A diaphragm substrate 301*a* is a (110) single-crystal silicon substrate in which the diaphragms 301 of 2 μm in thickness including boron impurity atoms of 1E20/cm$^3$ or more are formed by anisotropic etching using KOH and arranged to oppose the electrodes 303 with the insulators 303*b* being interposed therebetween in gaps 306.

Further in the diaphragm substrate 301*a*, liquid chambers 312, a common liquid chamber 313 for supplying liquid to the liquid chambers 312, and liquid channels 314 connecting the liquid chambers 312 and the common liquid chamber 313 are formed by anisotropic etching in the case of the electrostatic micropump 310, and ink chambers 322, a common ink chamber 323 for supplying ink to the ink chambers 322, and ink channels 324 connecting the ink chambers 322 and the common ink chamber 323 are formed by anisotropic etching in the case of the ink jet recording head 320.

On the surfaces of the diaphragm substrate 301*a*, the diaphragms 301, the liquid chambers 312, the ink chambers 322, the common liquid chamber 313, the common ink chamber 323, the liquid channels 314, and the ink channels 324, the silicon oxide thin film 304*b* of 500 Å in thickness and the titanium nitride thin film 304*a* of 1000 Å in thickness, which thin films form the anti-corrosive thin film 304 having anti-corrosiveness against liquid or ink, are formed successively by thermal oxidation and by sputtering, respectively.

The silicon oxide thin film 304*b* and the titanium nitride thin film 304*a* have internal stresses of 1.0E08 dyne/cm$^2$ and 1.0E09 dyne/cm$^2$, respectively. Both internal stresses are a tensile stress. The titanium nitride thin film 304*a* has a resistivity of 1.0E−2 Ω.cm.

Nozzle plates 311*a* and 321*a* are formed of glass plates, in which a liquid supply path 315 for supplying the liquid and an ink supply path 325 for supplying the ink and the nozzle holes 311 and 321 are formed by sand blasting, respectively. The nozzle plates 311*a* and 321*a* are attached over the liquid chambers 312 and the ink chambers 322, respectively.

In the above-described electrostatic actuator 300, the electrostatic micropump 310, or the ink jet recording head 320, when the diaphragms 301 were electrically grounded and voltages were applied to the electrodes 303 via the electrode pads 303*a*, the diaphragms 301 vibrated and operated at a certain frequency.

When the voltages were applied to the electrodes 303 via the electrode pads 303*a*, electrostatic forces were exerted between the diaphragms 301 and the electrodes 303 so that the diaphragms 301 were attracted toward the electrodes 303.

At this point, the diaphragm deflection prevention means 305 prevented buckling of the diaphragms 301 due to the successive formations of the silicon oxide thin film 304*b* and the titanium nitride thin film 304*a* and consequent deflections thereof so that the diaphragms 301 were attracted sufficiently toward the electrodes 303.

As a result, the liquid chambers 312 or the ink chambers 322 were depressurized so that the liquid or ink was supplied from the common liquid chamber 313 or the common ink chamber 323 to the liquid chambers 312 or the ink chambers 322 via the liquid channels 314 or the ink channels 324.

The diaphragms 301 returned to their original positions by stiffness of silicon in accordance with the frequency of the voltages applied to the electrodes 303 via the electrode pads 303*a*. At this point, the liquid chambers 312 or the ink chambers 322 were pressurized so that liquid or ink droplets were stably ejected through the nozzle holes 311 or 321 in a direction indicated by arrow. B in FIG. 34.

Further, as a result of conducting a reliability test using liquid or ink droplets in this state, it was confirmed that each of the silicon oxide thin film 304*b* and the titanium nitride thin film 304*a* that were the anti-corrosive thin film 304 whose resistivity was controlled had good anti-corrosiveness.

Next, a description will be given of a fifth embodiment of the present invention.

Figure 37:
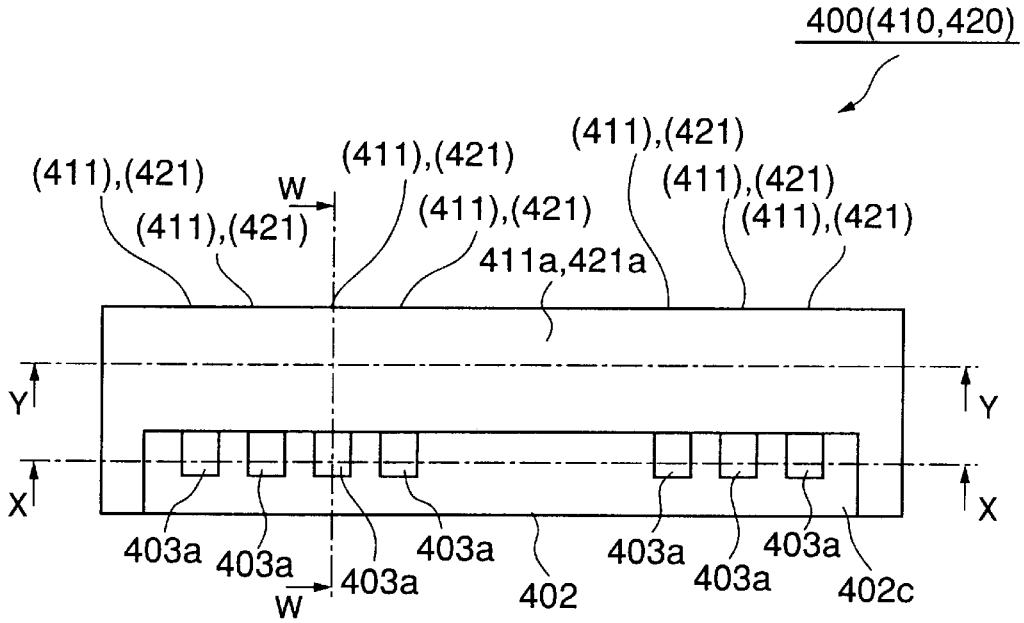
FIG. 37 is a plan view of an electrostatic actuator (an electrostatic micropump or an ink jet recording head including the electrostatic actuator) according to a fifth embodiment of the present invention.
Figure 38:
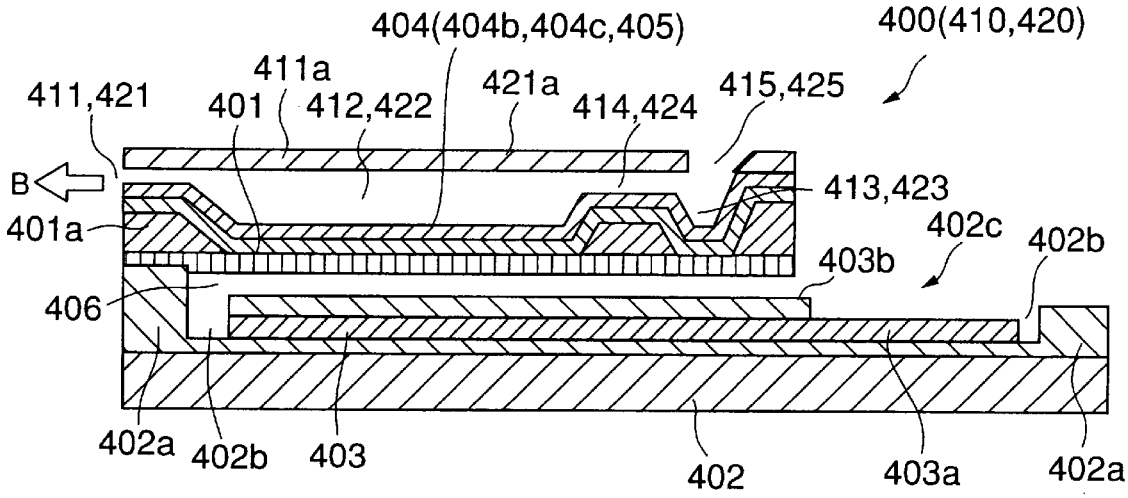
FIGS. 38 through 40 are sectional views of the electrostatic actuator (the electrostatic micropump or the ink jet recording head) of FIG. 37 taken along the lines W—W, X—X, and Y—Y, respectively.
Figure 39:
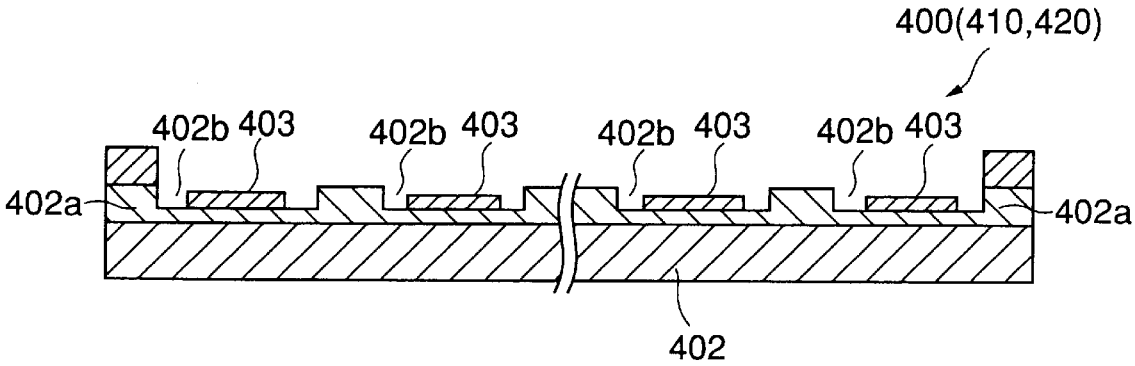
Figure 40:
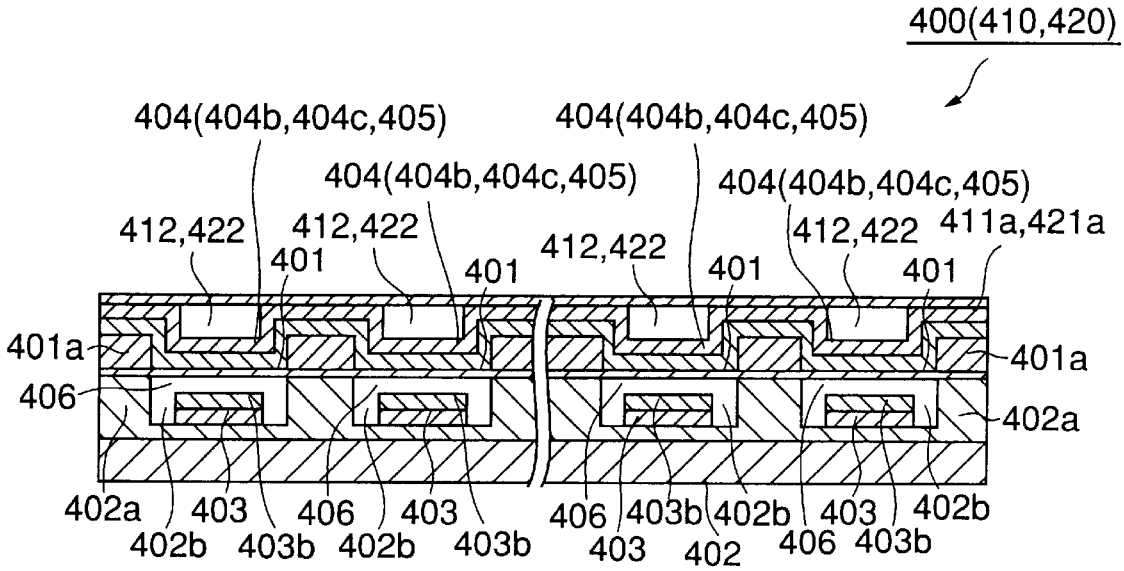

FIG. 37 is a plan view of an electrostatic actuator 400 (an electrostatic micropump 410 or an ink jet recording head 420 including the electrostatic actuator 400) according to the fifth embodiment of the present invention. FIGS. 38 through 40 are sectional views of the electrostatic actuator 400 (the electrostatic micropump 410 or the ink jet recording head 420) of FIG. 37 taken along the lines W—W, X—X, and Y—Y, respectively. The electrostatic actuator 400 includes a multilayer anti-corrosive thin film 404 of a silicon oxide thin film 404*b* and a zirconium thin film 404*c* serving as diaphragm deflection prevention means 405. The diaphragm deflection prevention means 405 vibrates to operate by electrostatic force.

Each of the electrostatic actuator 400, the electrostatic micropump 410, and the ink jet recording head 420 is formed by the above-described steps (a) through (i).

An electrode substrate 402 is a (100) p-type single-crystal silicon substrate having a resistivity of 10 to 30 Ω.cm.

Electrodes 403 are arranged in concave parts 402*b* of 0.4 μm in deepness formed in a silicon oxide film 402*a* of 2 μm in thickness formed on the electrode substrate 402 by thermal oxidation, and are formed of titanium nitride formed successively by reactive sputtering on the silicon oxide film 402*a*. The electrodes 403 are insulated from one another.

Insulators 403*b* of a silicon oxide film of 150 nm in thickness are formed by plasma CVD on the titanium nitride of the electrodes 403 so as to secure insulation between diaphragms 401 and the electrodes 403.

A pad part 402*c* of the electrode substrate 402 is an area in which the insulators 403*b* are removed by etching and voltage is applied via electrode pads 403*a* to the electrodes 403 so as to vibrate and operate the diaphragms 401.

A diaphragm substrate 401*a* is a (110) single-crystal silicon substrate in which the diaphragms 401 of 2 μm in thickness including boron impurity atoms of 1E20/cm$^3$ or more are formed by anisotropic etching using KOH and arranged to oppose the electrodes 403 with the insulators 403*b* being interposed therebetween in gaps 406.

Further in the diaphragm substrate 401*a*, liquid chambers 412, a common liquid chamber 413 for supplying liquid to the liquid chambers 412, and liquid channels 414 connecting the liquid chambers 412 and the common liquid chamber 413 are formed by anisotropic etching in the case of the electrostatic micropump 410, and ink chambers 422, a common ink chamber 423 for supplying ink to the ink chambers 422, and ink channels 424 connecting the ink chambers 422 and the common ink chamber 423 are formed by anisotropic etching in the case of the ink jet recording head 420.

On the surfaces of the diaphragm substrate 401*a*, the diaphragms 401, the liquid chambers 412, the ink chambers 422, the common liquid chamber 413, the common ink chamber 423, the liquid channels 414, and the ink channels 424, the silicon oxide thin film 404*b* of 500 Å in thickness and the zirconium thin film 404*c* of 1000 Å in thickness, which thin films form the anti-corrosive thin film 404 having anti-corrosiveness against liquid or ink, are formed successively by thermal oxidation and by sputtering, respectively.

The silicon oxide thin film 404*b* and the zirconium thin film 404*c* have internal stresses of 1.0E08 dyne/cm$^2$ and 5.0E09 dyne/cm$^2$, respectively. Both internal stresses are a tensile stress.

Nozzle plates 411*a* and 421*a* are formed of glass plates, in which a liquid supply path 415 for supplying the liquid and an ink supply path 425 for supplying the ink and the nozzle holes 411 and 421 are formed by sand blasting, respectively. The nozzle plates 411*a* and 421*a* are attached over the liquid chambers 412 and the ink chambers 422, respectively.

In the above-described electrostatic actuator 400, the electrostatic micropump 410, or the ink jet recording head 420, when the diaphragms 401 were electrically grounded and voltages were applied to the electrodes 403 via the electrode pads 403*a*, the diaphragms 401 vibrated and operated at a certain frequency.

When the voltages were applied to the electrodes 403 via the electrode pads 403*a*, electrostatic forces were exerted between the diaphragms 401 and the electrodes 403 so that the diaphragms 401 were attracted toward the electrodes 403.

At this point, the diaphragm deflection prevention means 405 prevented buckling of the diaphragms 401 due to the successive formations of the silicon oxide thin film 404*b* and the zirconium thin film 404*c* and consequent deflections thereof so that the diaphragms 401 were attracted sufficiently toward the electrodes 403.

As a result, the liquid chambers 412 or the ink chambers 422 were depressurized so that the liquid or ink was supplied from the common liquid chamber 413 or the common ink chamber 423 to the liquid chambers 412 or the ink chambers 422 via the liquid channels 414 or the ink channels 424.

The diaphragms 401 returned to their original positions by stiffness of silicon in accordance with the frequency of the voltages applied to the electrodes 403 via the electrode pads 403*a*. At this point, the liquid chambers 412 or the ink chambers 422 were pressurized so that liquid or ink droplets were stably ejected through the nozzle holes 411 or 421 in a direction indicated by arrow B in FIG. 38.

Further, as a result of conducting a reliability test using liquid or ink droplets in this state, it was confirmed that each of the silicon oxide thin film 404*b* and the zirconium thin film 404*c* that were the anti-corrosive thin film 404 whose resistivity was controlled had good anti-corrosiveness.

Next, a description will be given of a sixth embodiment of the present invention.

Figure 41:
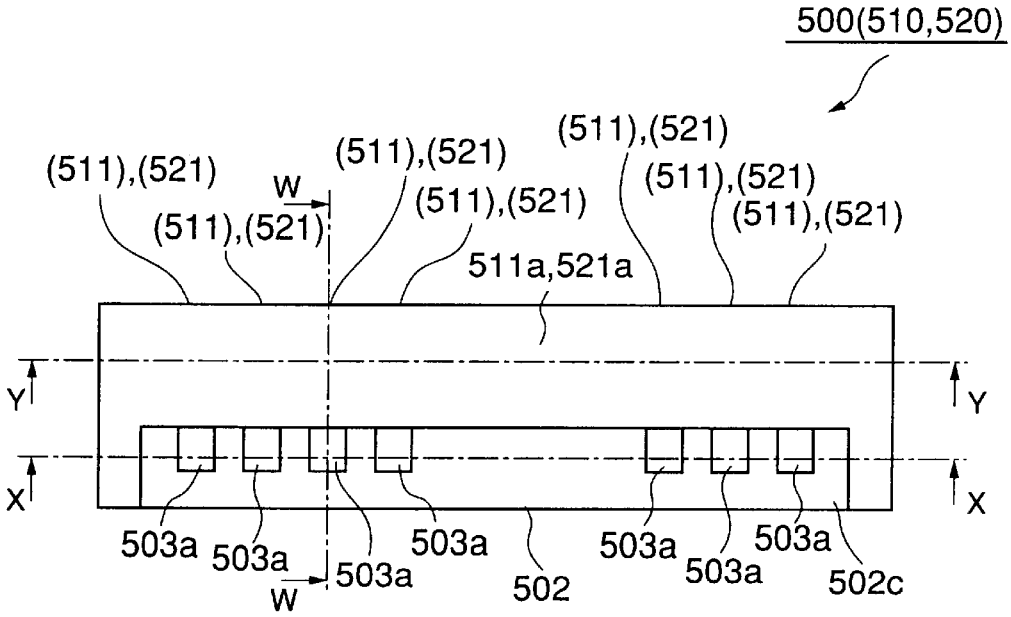
FIG. 41 is a plan view of an electrostatic actuator (an electrostatic micropump or an ink jet recording head including the electrostatic actuator) according to a sixth embodiment of the present invention.
Figure 42:
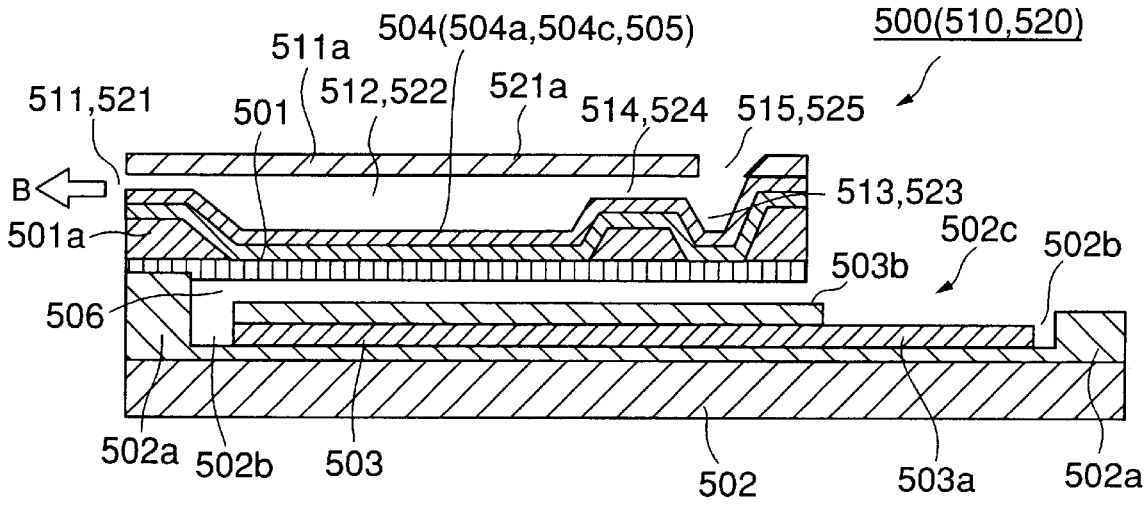
FIGS. 42 through 44 are sectional views of the electrostatic actuator (the electrostatic micropump or the ink jet recording head) of FIG. 41 taken along the lines W—W, X—X, and Y—Y, respectively.
Figure 43:
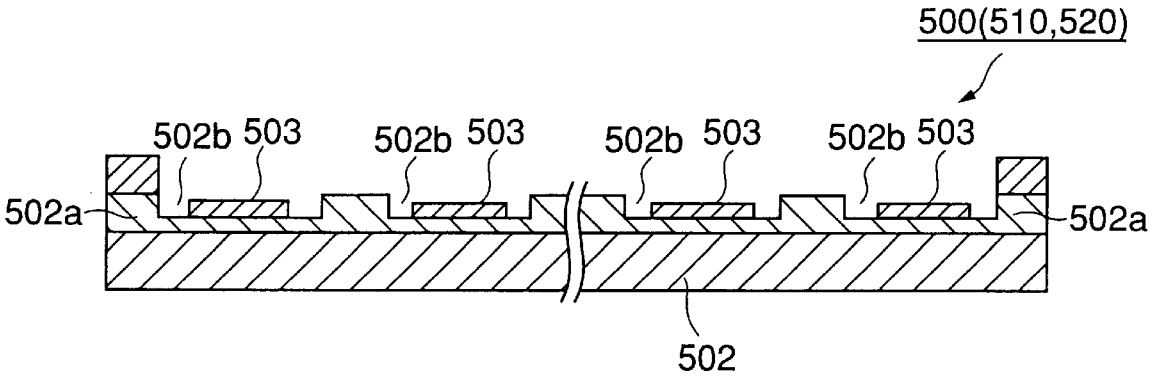
Figure 44:
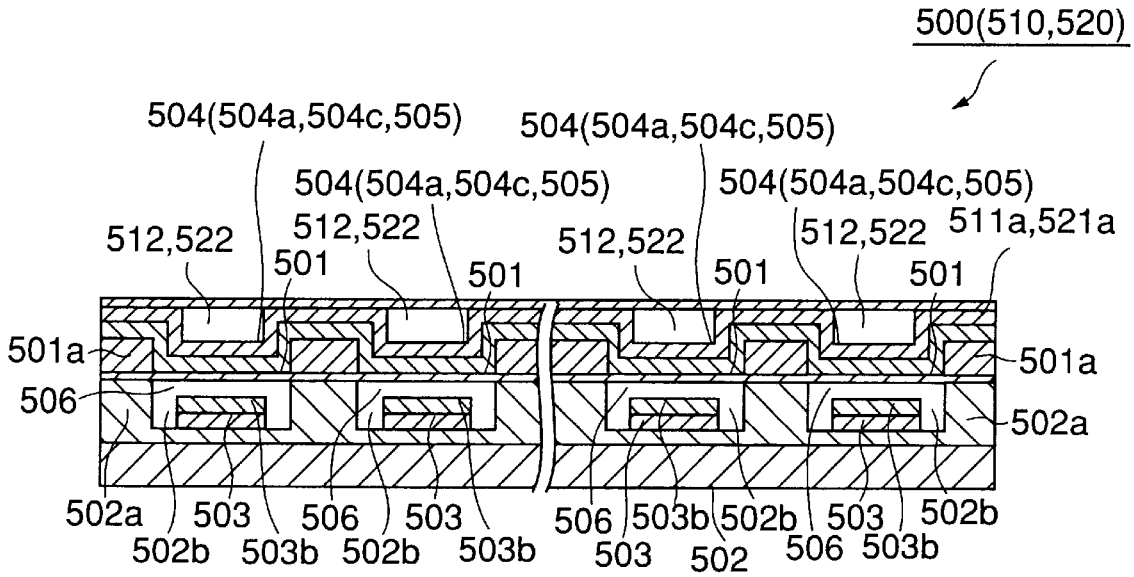

FIG. 41 is a plan view of an electrostatic actuator 500 (an electrostatic micropump 510 or an ink jet recording head 520 including the electrostatic actuator 500) according to the sixth embodiment of the present invention. FIGS. 42 through 44 are sectional views of the electrostatic actuator 500 (the electrostatic micropump 510 or the ink jet recording head 520) of FIG. 41 taken along the lines W—W, X—X, and Y—Y, respectively. The electrostatic actuator 500 includes a multilayer anti-corrosive thin film 504 of a titanium nitride thin film 504*a* and a zirconium thin film 504*c* serving as diaphragm deflection prevention means 505. The diaphragm deflection prevention means 505 vibrates to operate by electrostatic force.

Each of the electrostatic actuator 500, the electrostatic micropump 510, and the ink jet recording head 520 is formed by the above-described steps (a) through (i).

An electrode substrate 502 is a (100) p-type single-crystal silicon substrate having a resistivity of 10 to 30 Ω.cm.

Electrodes 503 are arranged in concave parts 502*b* of 0.4 μm in deepness formed in a silicon oxide film 502*a* of 2 μm in thickness formed on the electrode substrate 502 by thermal oxidation, and are formed of titanium nitride formed successively by reactive sputtering on the silicon oxide film 502*a*. The electrodes 503 are insulated from one another.

Insulators 503*b* of a silicon oxide film of 150 nm in thickness are formed by plasma CVD on the titanium nitride of the electrodes 503 so as to secure insulation between diaphragms 501 and the electrodes 503.

A pad part 502*c* of the electrode substrate 502 is an area in which the insulators 503*b* are removed by etching and voltage is applied via electrode pads 503*a* to the electrodes 503 so as to vibrate and operate the diaphragms 501.

A diaphragm substrate 501*a* is a (110) single-crystal silicon substrate in which the diaphragms 501 of 2 μm in thickness including boron impurity atoms of 1E20/cm$^3$ or more are formed by anisotropic etching using KOH and arranged to oppose the electrodes 503 with the insulators 503*b* being interposed therebetween in gaps 506.

Further in the diaphragm substrate 501*a*, liquid chambers 512, a common liquid chamber 513 for supplying liquid to the liquid chambers 512, and liquid channels 514 connecting the liquid chambers 512 and the common liquid chamber 513 are formed by anisotropic etching in the case of the electrostatic micropump 510, and ink chambers 522, a common ink chamber 523 for supplying ink to the ink chambers 522, and ink channels 524 connecting the ink chambers 522 and the common ink chamber 523 are formed by anisotropic etching in the case of the ink jet recording head 520.

On the surfaces of the diaphragm substrate 501*a*, the diaphragms 501, the liquid chambers 512, the ink chambers 522, the common liquid chamber 513, the common ink chamber 523, the liquid channels 514, and the ink channels 524, the titanium nitride thin film 504*a* of 500 Å in thickness and the zirconium thin film 504*c* of 500 Å in thickness, which thin films form the anti-corrosive thin film 504 having anti-corrosiveness against liquid or ink, are formed successively by sputtering.

The titanium nitride thin film 504*a* has an internal stress of 7.0E08 dyne/cm$^2$, which internal stress is a compressive stress, and the zirconium thin film 504*c* has an internal stress of 5.0E09 dyne/cm$^2$, which internal stress is a tensile stress. The titanium nitride thin film 504*a* has a resistivity of 1.3E–3 Ω.cm.

Nozzle plates 511*a* and 521*a* are formed of glass plates, in which a liquid supply path 515 for supplying the liquid and an ink supply path 525 for supplying the ink and the nozzle holes 511 and 521 are formed by sand blasting, respectively. The nozzle plates 511*a* and 521*a* are attached over the liquid chambers 512 and the ink chambers 522, respectively.

In the above-described electrostatic actuator 500, the electrostatic micropump 510, or the ink jet recording head 520, when the diaphragms 501 were electrically grounded and voltages were applied to the electrodes 503 via the electrode pads 503*a*, the diaphragms 501 vibrated and operated at a certain frequency.

When the voltages were applied to the electrodes 503 via the electrode pads 503*a*, electrostatic forces were exerted between the diaphragms 501 and the electrodes 503 so that the diaphragms 501 were attracted toward the electrodes 503.

At this point, the diaphragm deflection prevention means 505 prevented buckling of the diaphragms 501 due to the successive formations of the titanium nitride thin film 504*a* and the zirconium thin film 504*c* and consequent deflections thereof so that the diaphragms 501 were attracted sufficiently toward the electrodes 503.

As a result, the liquid chambers 512 or the ink chambers 522 were depressurized so that the liquid or ink was supplied from the common liquid chamber 513 or the common ink chamber 523 to the liquid chambers 512 or the ink chambers 522 via the liquid channels 514 or the ink channels 524.

The diaphragms 501 returned to their original positions by stiffness of silicon in accordance with the frequency of the voltages applied to the electrodes 503 via the electrode pads 503*a*. At this point, the liquid chambers 512 or the ink chambers 522 were pressurized so that liquid or ink droplets were stably ejected through the nozzle holes 511 or 521 in a direction indicated by arrow B in FIG. 42. Further, as a result of conducting a reliability test using liquid or ink droplets in this state, it was confirmed that each of the titanium nitride thin film 504*a* and the zirconium thin film 504*c* that were the anti-corrosive thin film 504 whose resistivity was controlled had good anti-corrosiveness.

A description will now be given of a seventh embodiment of the present invention.

Figure 45:
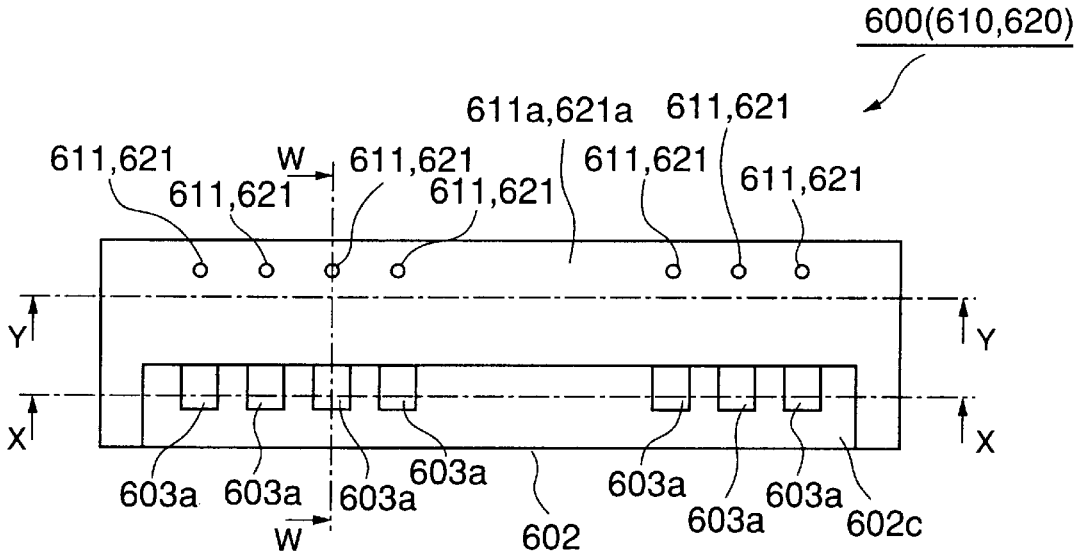
FIG. 45 is a plan view of an electrostatic actuator (an electrostatic micropump or an ink jet recording head including the electrostatic actuator) according to a seventh embodiment of the present invention.
Figure 46:
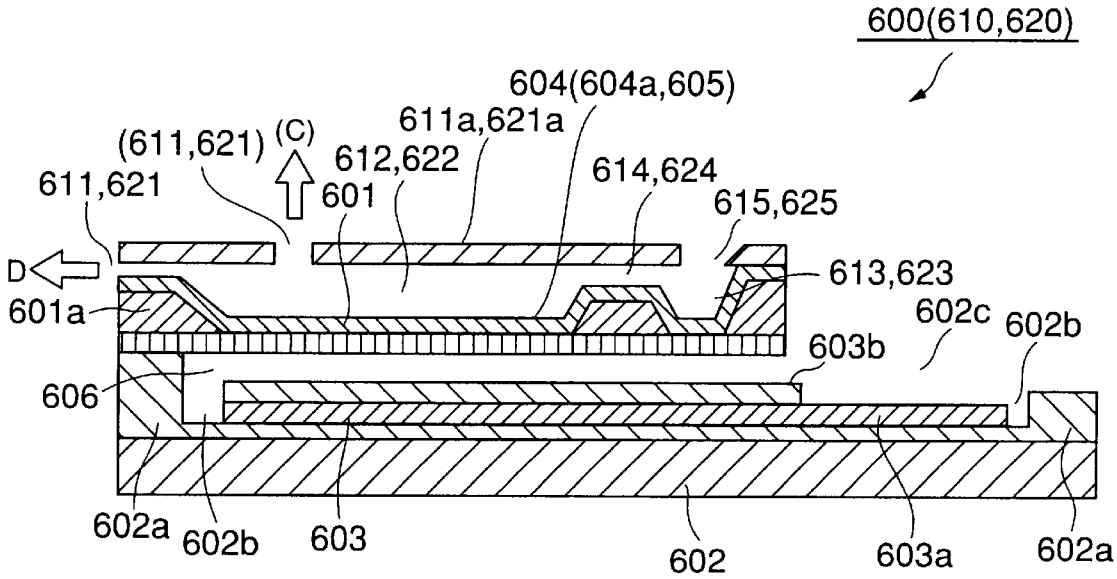
FIGS. 46 through 48 are sectional views of the electrostatic actuator (the electrostatic micropump or the ink jet recording head) of FIG. 45 taken along the lines W—W, X—X, and Y—Y, respectively.
Figure 47:
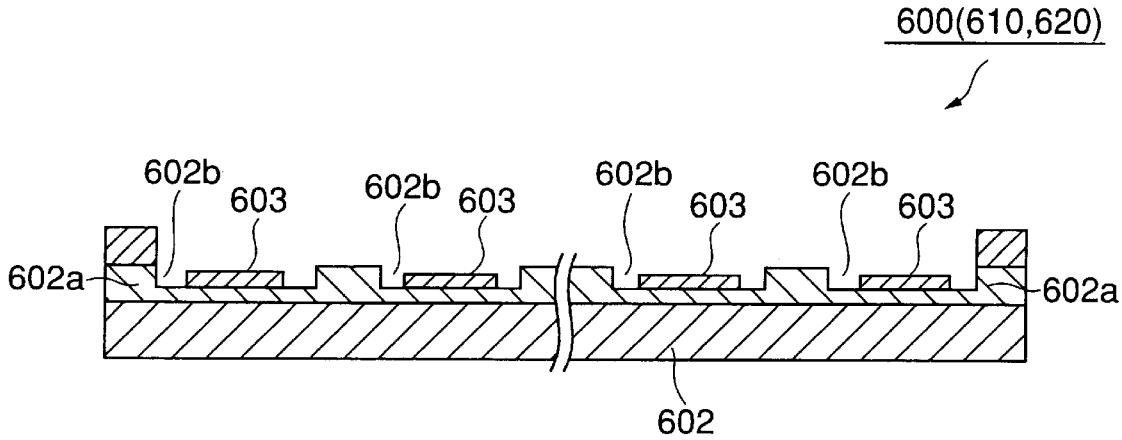
Figure 48:
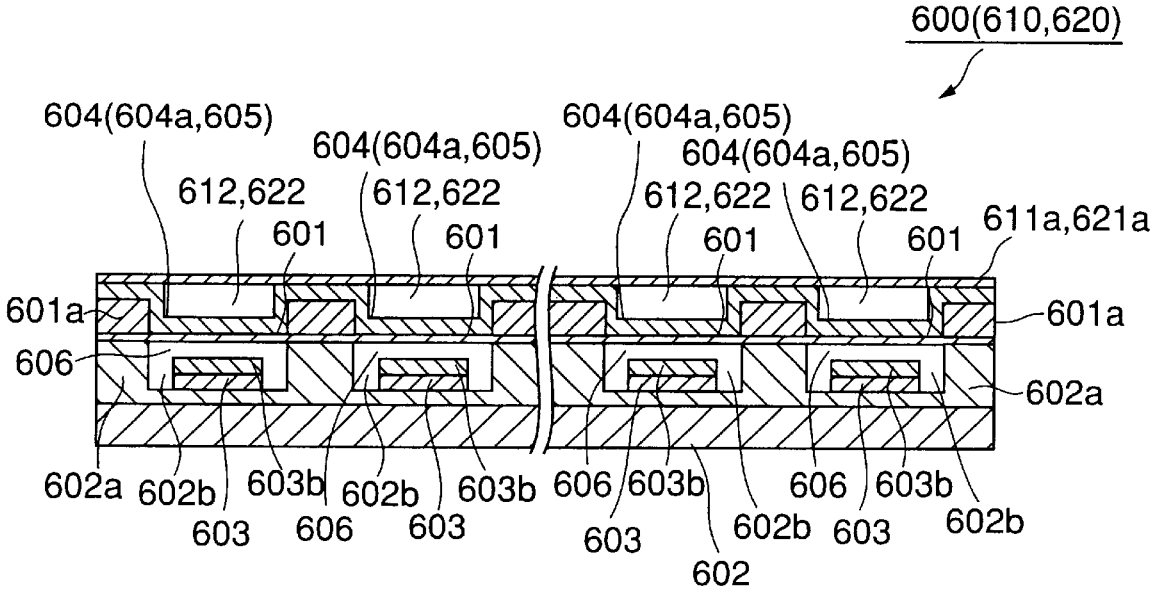

FIG. 45 is a plan view of an electrostatic actuator 600 (an electrostatic micropump 610 or an ink jet head recording head 620 including the electrostatic actuator 600) according to the seventh embodiment of the present invention. FIGS. 46 through 48 are sectional views of the electrostatic actuator 600 (the electrostatic micropump 610 or the ink jet head recording head 620) of FIG. 45 taken along the lines W—W, X—X, and Y—Y, respectively. The electrostatic actuator 600 vibrating and operating by electrostatic force includes diaphragms 601 vibrating to operate by electrostatic force, an electrode substrate 602 opposing the diaphragms 601, electrodes 603 formed on the electrode substrate 602 to oppose the diaphragms 601 with gaps 606 formed between the electrodes 603 and the diaphragms 601, an anti-corrosive thin film 604 formed on the diaphragms 601, and diaphragm deflection prevention means 605 for preventing deflections of the diaphragms 601. Voltage for vibrating the diaphragms 601 is applied to the electrodes 603. The diaphragm deflection prevention means 605 makes flat the diaphragms 601 on which the anti-corrosive thin film 604 is formed. Thereby, an operation characteristic such as an ink droplet ejection characteristic is prevented from suffering a defect or unstableness, thus preventing the diaphragms 601 from buckling and deflecting, and consequently from malfunctioning. As a result, the electrostatic actuator 600 is made highly anti-corrosive and producible at low costs with an increasing yield. The diaphragm deflection prevention means 605 vibrates to operate by electrostatic force.

The electrostatic micropump 610 and the ink jet recording head 620 that eject liquid and ink droplets by pressure waves caused by electrostatic force include nozzle holes 611 and 621 for ejecting the liquid and ink droplets in a direction indicated by arrow C or D in FIG. 46, and liquid chambers 612 and ink chambers 622 serving as liquid channels and ink channels with which the nozzles holes 611 and 621 communicate, respectively. Further, the electrostatic micropump 610 and the ink jet recording head 620 each include the anti-corrosive thin film 604 formed on formed on the diaphragms 601 of the electrostatic actuator 600 which diaphragms 601 form the wall faces of the liquid chambers 612 and ink chambers 622.

A diaphragm substrate 601*a* is a (110) single-crystal silicon substrate. In addition to the diaphragms 601, formed by anisotropic etching in the diaphragm substrate 601a are the liquid chambers 612 in which liquid is pressurized, a common liquid chamber 613, and liquid channels 614 in the case of the electrostatic micropump 610, and the ink chambers 622 in which ink is pressurized, a common ink chamber 623, and ink channels 624 in the case of the ink jet recording head 620. The liquid chambers 612 and the ink chambers 622 communicate with the common liquid chamber 613 and the common ink chamber 623 through the liquid channels 614 and the ink channels 624, respectively.

A nozzle plate 611*a* and a nozzle plate 621*a*, which are glass, metal, or silicon plates, have the nozzle holes 611 and the nozzle holes 621, and a liquid supply path 615 and an ink supply path 625 formed therein, respectively.

Further, the anti-corrosive thin film 604 having resistance to liquid or ink droplets is formed on the surfaces of the diaphragms 601, the diaphragm substrate 601*a*, the liquid chambers 612, the ink chambers 622, the common liquid chamber 613, the common ink chamber 623, the liquid channels 614, and the ink channels 624.

The diaphragm deflection prevention means 605 is formed to have a thickness of 10 to 2000 Å, preferably, 100 to 1000 Å , by sputtering, CVD, or oxidation, by which the anti-corrosive thin film 604 is formed with a good bottom coverage to contain oxygen atoms with good controllability.

The diaphragm deflection prevention means 605 is a single-layer thin film or a multilayer film formed of layered films for preventing a malfunction of any of the diaphragms 601 caused by leakage of liquid or ink droplets through minute pinholes in the diaphragms 601. The diaphragm deflection prevention means 605 is a titanium nitride thin film 604*a* containing at least oxygen atoms, preferably, at a concentration of 1% or more. The titanium nitride film 604*a* has good anti-corrosiveness against liquid or ink and good mass productivity.

The electrode substrate 602 is an n- or p-type single-crystal silicon substrate. Normally, a (100) single-crystal silicon substrate is employed, but a (110) or (111) single-crystal silicon substrate may be employed depending on a process with no problem. A glass substrate may be employed instead of the silicon substrate.

The electrodes 603 are formed of a refractory metal formed in concave parts 602*b* of a silicon oxide film 602*a* formed on the electrode substrate 602, and the voltage is applied to the electrodes 603 to vibrate and operate the diaphragms 601. The concave parts 602*b* are formed in the silicon oxide film 602*a* by performing thermal oxidation on the electrode substrate 602.

The electrodes 603 and the electrode substrate 602 are separated by insulation from each other. The electrodes 603 are formed of the refractory metal and its nitride or compound formed by reactive sputtering or CVD, such as titanium, tungsten, or tantalum. The electrodes 603 may have a layer structure of the refractory metal and its nitride or compound. Preferably, the electrodes 603 are formed of a titanium nitride or have a layer structure of titanium and titanium nitride formed in the order described on the silicon oxide film 602*a*. Insulators 603*c* are formed on the electrodes 603 by CVD, sputtering, or evaporation.

The concave parts 602*b* serve to form the gaps 606 between the diaphragms 601 and the electrodes 603, and electrostatic attraction is generated by applying the electrodes 603 opposing the diaphragms 601 with the gaps 606 being formed therebetween.

A pad part 602*c* is formed for mounting an FPC (not shown) or performing wire bonding for applying voltage to electrode pads 603*a* of the electrodes 603 from outside.

Accordingly, the diaphragms 601 on which the anti-corrosive thin film 604 is formed are prevented from buckling, deflecting, and malfunctioning by the diaphragm deflection prevention means 605. Thus, the electrostatic actuator 600 having good anti-corrosiveness and an increased yield and producible at low costs, and the electrostatic micropump 610 and the ink jet recording head 620 including the electrostatic actuator 600 can be realized.

FIGS. 49 through 66 are diagrams for illustrating a method of producing the electrostatic actuator 600 and the electrostatic micropump 610 or the ink jet recording head 620 including the electrostatic actuator 600 according to the seventh embodiment of the present invention.

The method includes the following steps.

Figure 49:
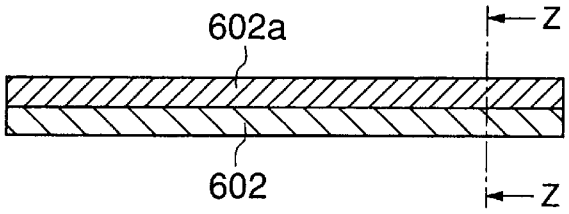
FIG. 49 is a diagram for illustrating a production process of a principal part of the electrostatic actuator (the electrostatic micropump or the ink jet recording head) of FIG. 45.
Figure 50:
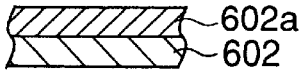
FIG. 50 is a sectional view of the principal part of FIG. 45 taken along the line Z—Z.

(k) Form the silicon oxide film 602*a* by thermal oxidation on the electrode substrate 602 that is a (100), (111), or (110) p- or n-type single-crystal silicon substrate as shown in FIGS. 49 and 50.

Figure 51:
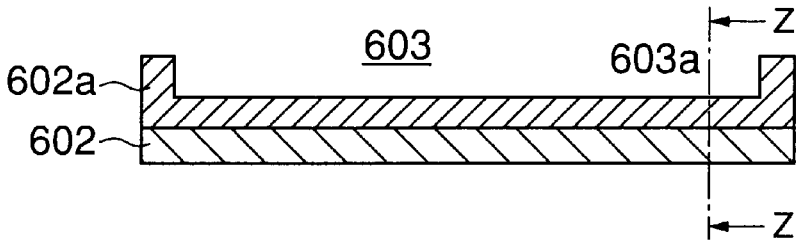
FIG. 51 is another diagram for illustrating the production process.
Figure 52:
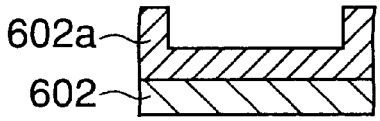
FIG. 52 is a sectional view of the principal part of FIG. 51 taken along the line Z—Z.

(l) Perform patterning on the silicon oxide film 602*a* so as to define areas for the electrodes 603 and the electrode pads 603*a* by normal photolithography and dry or wet etching as shown in FIGS. 51 and 52.

Figure 53:
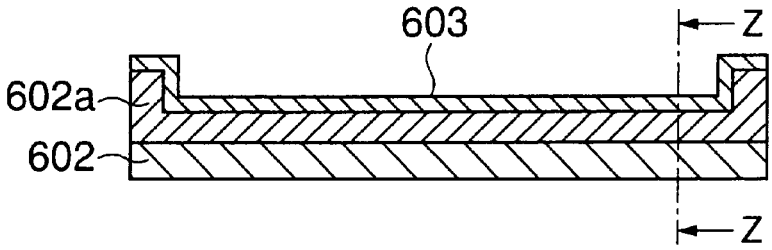
FIG. 53 is another diagram for illustrating the production process.
Figure 54:
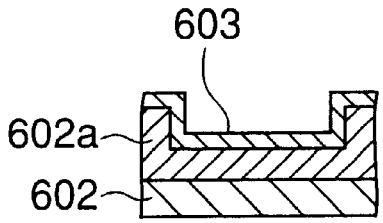
FIG. 54 is a sectional view of the principal part of FIG. 53 taken along the line Z—Z.

(m) Form the electrodes 603 by forming the refractory metal and its nitride or compound formed by reactive sputtering or CVD, such as titanium, tungsten, or tantalum, a layer structure of the refractory metal and its nitride or compound, or preferably, titanium nitride or a layer of titanium and titanium nitride on all over the patterned silicon oxide film 602*a* as shown in FIGS. 53 and 54.

Figure 55:
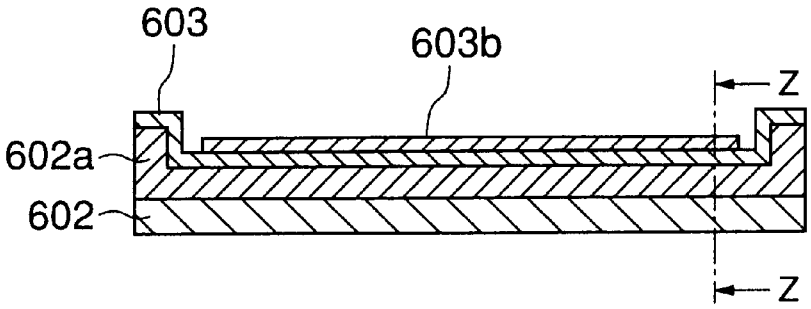
FIG. 55 is another diagram for illustrating the production process.
Figure 56:
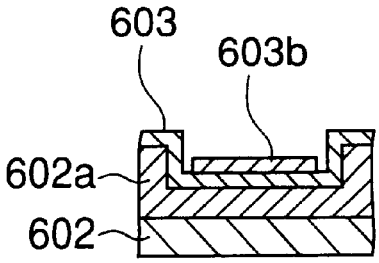
FIG. 56 is a sectional view of the principal part of FIG. 55 taken along the line Z—Z.

(n) Form the insulators 603*b*, which are preferably silicon oxide, on the electrodes 603 by CVD, sputtering, or evaporation as shown in FIGS. 55 and 56.

Figure 57:
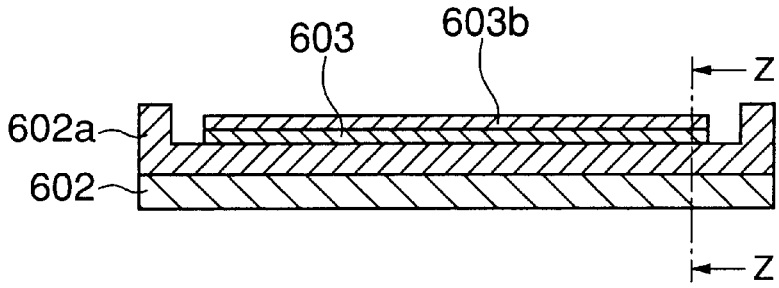
FIG. 57 is another diagram for illustrating the production process.
Figure 58:
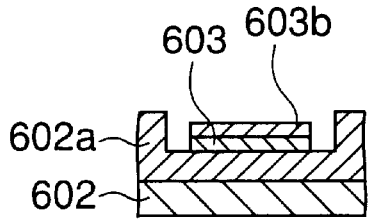
FIG. 58 is a sectional view of the principal part of FIG. 57 taken along the line Z—Z.

(o) Complete the electrode substrate 602 by etching and patterning the electrodes 603 of the refractory metal with the insulators 603 being employed as an etching mask as shown in FIGS. 57 and 58.

Figure 59:
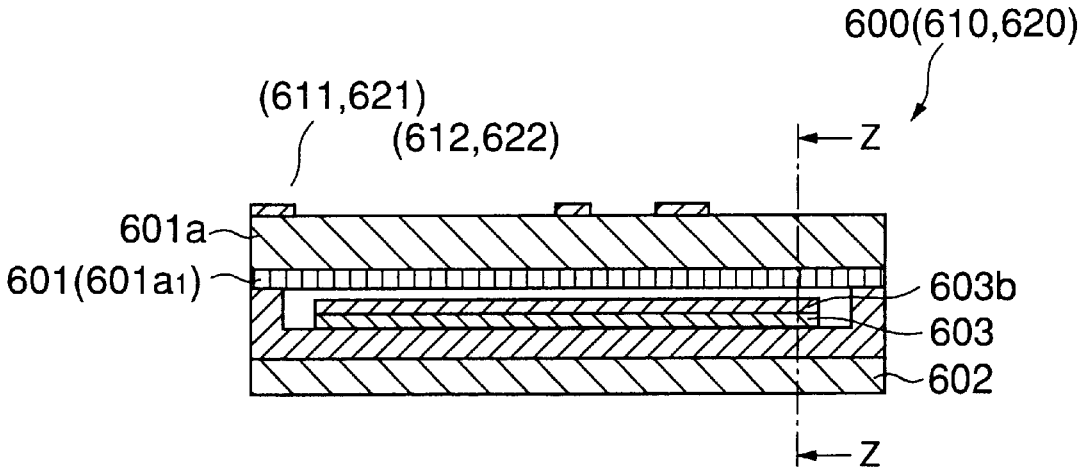
FIG. 59 is another diagram for illustrating the production process.
Figure 60:
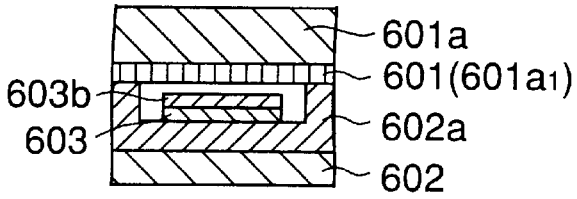
FIG. 60 is a sectional view of the principal part of FIG. 59 taken along the line Z—Z.

(p) Align and join at approximately 500° C., and thereafter perform heat treatment at 800° C. or over on the electrode substrate 602 and the diaphragm substrate 601*a* having on a first side a diffusion layer 601$a_1$ in which p- or n-type impurity of 1E19/$cm^3$ or over is diffused as deep as the thickness of each diaphragm 601 and having on a second side opposite to the first side an etching mask pattern of single-crystal silicon such as silicon oxide, silicon nitride, or tantalum pentaoxide which etching mask pattern defines the nozzle holes 611 and the nozzle holes 621, and the liquid chambers 612 and the ink chambers 622 of the electrostatic micropump 610 and the ink jet recording head 620, respectively, as shown in FIGS. 59 and 60. This method, which has good joint accuracy, is called direct junction. The etching mask pattern may be formed after aligning and joining the diaphragm substrate 601*a* and the electrode substrate 602. Further, the electrode substrate 602 may be directly joined to an SOI (Silicon On Insulator) that is a (110) single-crystal silicon substrate on which single-crystal thin film silicon is formed with a silicon oxide film as thick as the film thickness of each diaphragm 601 being formed therebetween.

Also in this case, the SOI may be joined to the electrode substrate 602 after the single-crystal silicon etching mask pattern of silicon oxide, silicon nitride, or tantalum pentaoxide which etching mask pattern defines the nozzle holes 611 and the nozzle holes 621, and the liquid chambers 612 and the ink chambers 622 of the electrostatic micropump 610 and the ink jet recording head 620, respectively, is formed on a side of the SOI which side is opposite to a side on which the single-crystal thin film silicon is formed. In the case of employing the glass substrate, anodic bonding is performed.

Figure 61:
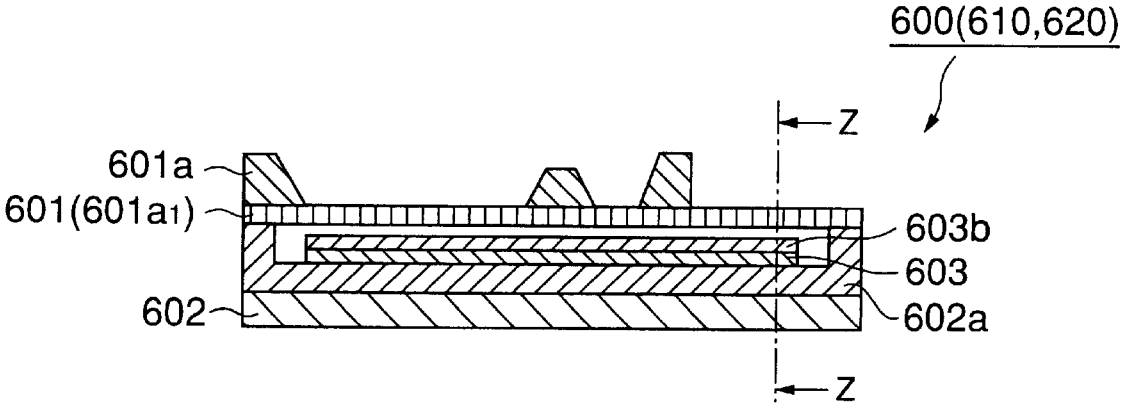
FIG. 61 is another diagram for illustrating the production process.
Figure 62:
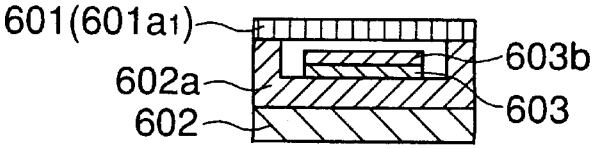
FIG. 62 is a sectional view of the principal part of FIG. 61 taken along the line Z—Z.

(q) Form the diaphragms 601 by performing anisotropic etching, using KOH or TMAH, on the directly joined diaphragm substrate 601*a* and the electrode substrate 602 from the side of the diaphragm substrate 601*a* on which side the single-crystal silicon etching mask pattern is formed. The etching process spontaneously stops when the impurity diffusion layer 601$a_1$ is reached as shown in FIGS. 61 and 62.

In the case of the SOI, the anisotropic etching stops when the silicon oxide film is reached. At this point, the silicon oxide film may be removed with no problem.

Figure 63:
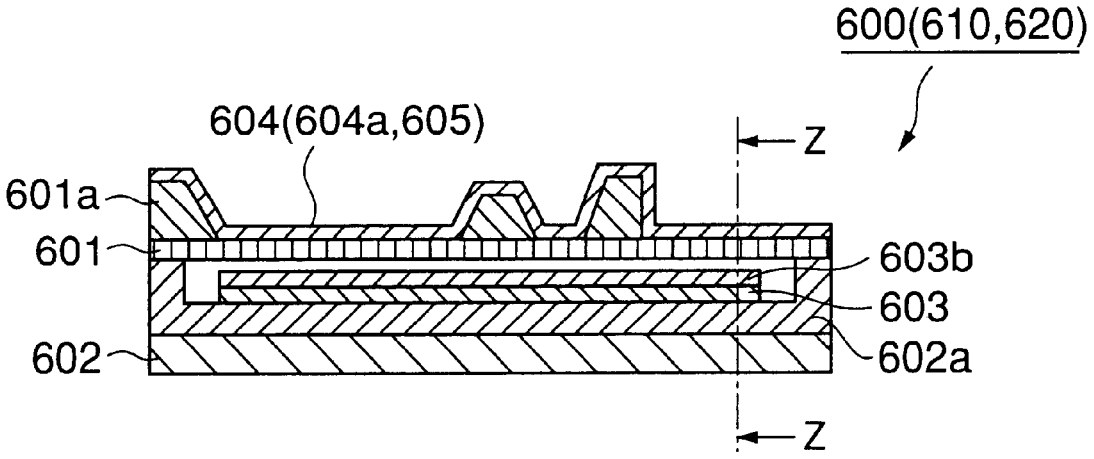
FIG. 63 is another diagram for illustrating the production process.
Figure 64:
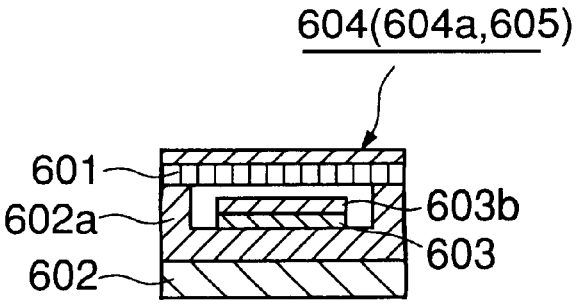
FIG. 64 is a sectional view of the principal part of FIG. 63 taken along the line Z—Z.

(r) Form the anti-corrosive thin film 604 having anti-corrosiveness against ink droplets simultaneously on the surface of the diaphragm substrate 601*a* and the entire surfaces of the diaphragms 601 as shown in FIGS. 63 and 64.

The diaphragm deflection prevention means 605 is a single layer or multilayer film formed on the diaphragms 601 by sputtering, CVD, or oxidation by which the anti-corrosive thin film 604 is formed with good bottom coverage to contain oxygen atoms with good controllability. The diaphragm deflection prevention means 605 is the titanium nitride thin film 604*a* having good mass productivity and containing at least oxygen atoms, preferably, at a concentration of 1.0% or more. The diaphragms 601 are flat. Here, the anti-corrosive thin film 604 may be any thin film having anti-corrosiveness against liquid or ink droplets.

Figure 65:
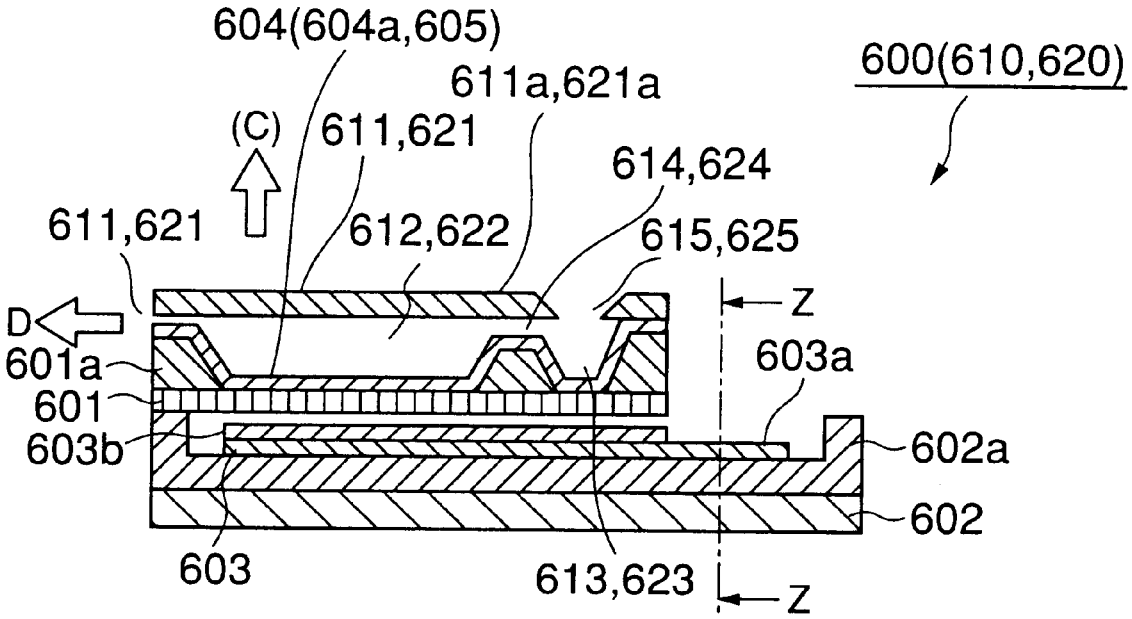
FIG. 65 is another diagram for illustrating the production process.
Figure 66:
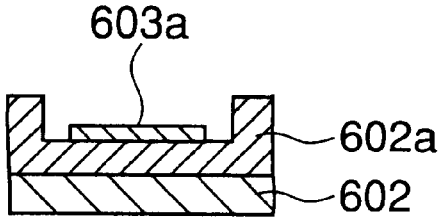
FIG. 66 is a sectional view of the principal part of FIG. 65 taken along the line Z—Z.

(s) Form the nozzle plate 611*a* or 621*a* by forming the liquid supply path 615 in the case of the nozzle plate 611*a* and the ink supply path 625 in the case of the nozzle plate 621*a* in a substrate formed of a glass or metal plate by sand blasting or laser processing and attach the nozzle plate 611*a* or 621*a* to the diaphragm substrate 601*a* as shown in FIGS. 65 and 66. Parts of the anti-corrosive thin film 604, the diaphragms 601, and the insulator 603*b* formed on the electrode pads 603*a* are removed by etching.

Thereby, realized is a method of producing the electrostatic actuator 600 having good anti-corrosiveness against liquid or ink and a considerably increased yield, producible at low costs, and preventing the diaphragms 601 from being damaged during operation and from buckling, deflecting, and consequently, malfunctioning and the electrostatic micropump 610 or the ink jet recording head 620 including the electrostatic actuator 600.

In the diaphragm substrate 601*a*, the liquid chambers 612 or the ink chambers 622 are formed by anisotropic etching to correspond to the nozzle holes 611 or 621, and the common liquid chamber 613 or the common ink chamber 623 is formed to supply liquid or ink to the liquid chambers 612 or the ink chambers 622. The liquid chambers 612 and the ink chambers 622 communicate with the common liquid chamber 613 and the common ink chamber 623 with the liquid channels 614 and the ink channels 624, respectively. The anti-corrosive thin film 604 is formed on the liquid chambers 612, the ink chambers 622, the common liquid chamber 613, the common ink chamber 623, the liquid channels 614, and the ink channels 624.

When voltages are applied to the electrodes 603 via the electrode pads 603*a*, electrostatic forces are exerted between the diaphragms 601 and the electrodes 603 so that the diaphragms deflect toward the electrodes 603. As a result, the liquid chambers 612 or the ink chambers 622 are depressurized so that the liquid or ink is supplied thereto through the liquid channels 614 or the ink channels 624 from the common liquid chamber 613 or the common ink chamber 623.

When the application of the voltages to the electrodes 603 via the electrode pads 603*a* is stopped, the diaphragms 601 return to their original positions by their stiffness. At this point, the liquid chambers 612 or the ink chambers 622 are pressurized so that liquid or ink droplets are ejected through the nozzle holes 611 or 621 in the direction indicated by arrow C which is normal to the diaphragm substrate 601*a* or in the direction indicated by arrow D which is horizontal with the diaphragm substrate 601*a* by changing the orientations of the nozzles 611 or 621.

With respect to the electrostatic actuator 600 and the electrostatic micropump 610 and the ink jet recording head 620 each including the electrostatic actuator 600, performed was the estimation of an amount of deflection of the diaphragm 601 of 2 $\mu$m in thickness containing a boron impurity of 1E19/cm$^3$ or more and differences among bits in the ejection speed of ink droplets and the ejection characteristic of an ink droplet amount in the case of employing titanium nitride as the anti-corrosive thin film 604 against liquid or ink droplets. FIG. 67 shows the results of the estimation.

As a result, it was discovered that if the diaphragms 601 were not flat and included deflections when the anti-corrosive thin film 604 was formed thereon, differences were caused among the bits in the ejection characteristic, thus causing a great practical problem. Therefore, it is not desirable for the diaphragms 601 to contain any deflections when the anti-corrosive thin film 604 is formed on the diaphragms 601. This tendency was equally found in the results of any case using a thin film having anti-corrosiveness against liquid or ink droplets.

Next, performed was the estimation of an oxygen atom concentration contained in the titanium nitride thin film 604*a* and its anti-corrosiveness against liquid or ink droplets in the case of employing the titanium nitride thin film 604 as the anti-corrosive thin film 604. FIG. 68 shows the results of the estimation.

As a result, it was discovered that the titanium nitride thin film 604 suffered corrosion to a certain extent, which caused no great practical problem, in a case where the titanium nitride thin film 604 contained no oxygen atoms, but that the titanium nitride thin film 604 had an improvement in its anti-corrosiveness when the titanium nitride thin film 604 contained at least oxygen atoms. It was also found that the titanium nitride thin film 604 had a further improvement in its anti-corrosiveness when the titanium nitride thin film 604 contained the oxygen atoms at a concentration of 1% or more. These results show that it is preferable that the titanium nitride thin film 604 contains at least the oxygen atoms when the titanium nitride thin film 604 is employed as the anti-corrosive thin film 604, and that more preferably, the titanium nitride thin film 604 contains the oxygen atoms at a concentration of 1% or more.

A description will now be given of an eighth embodiment of the present invention.

Figure 69:
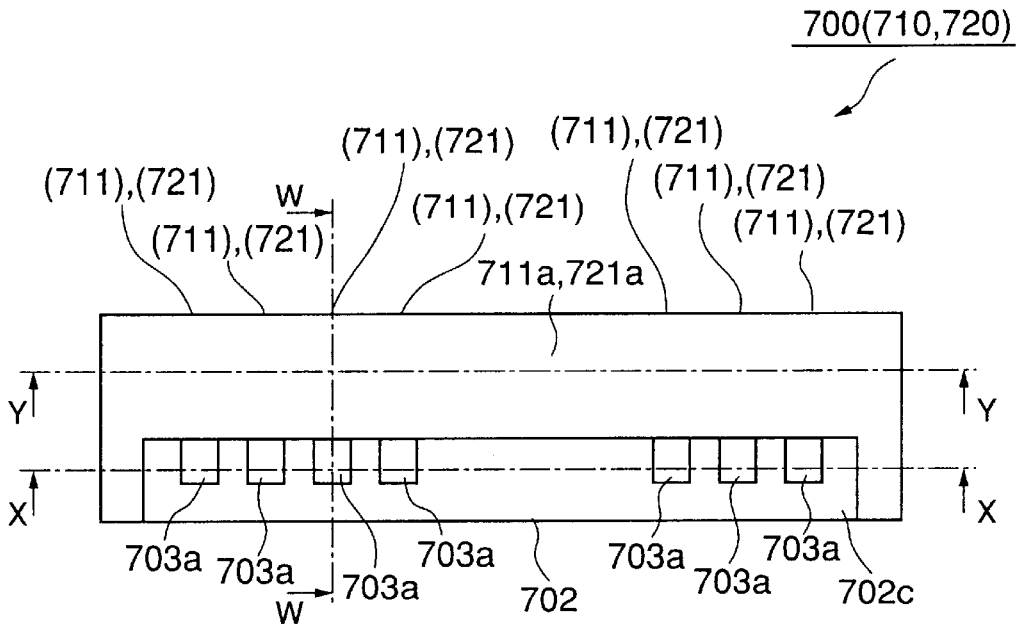
FIG. 69 is a plan view of an electrostatic actuator (an electrostatic micropump or an ink jet recording head including the electrostatic actuator) according to an eighth embodiment of the present invention.
Figure 70:
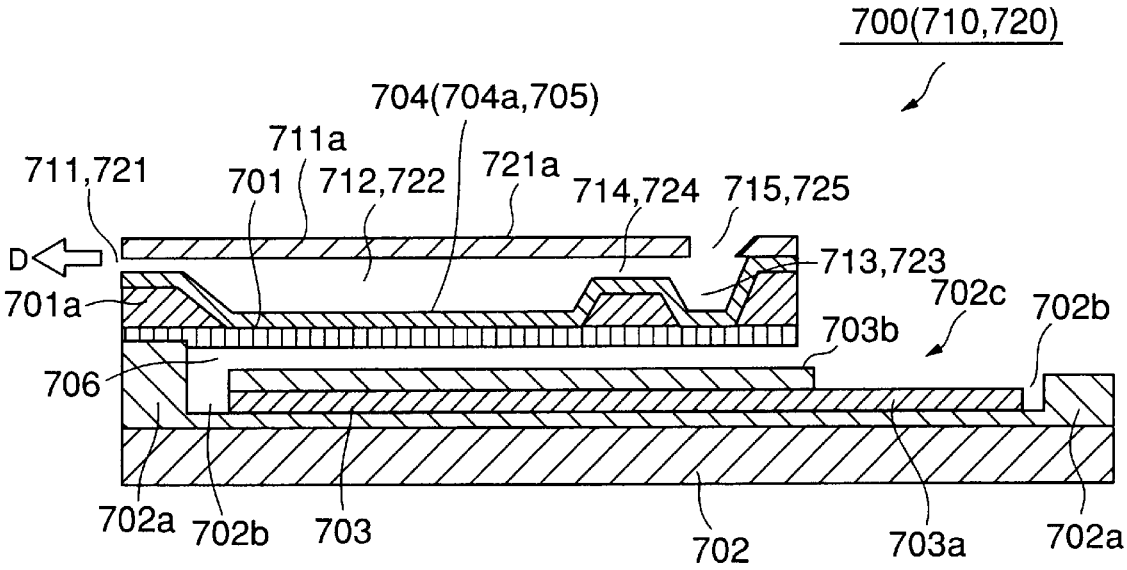
FIGS. 70 through 72 are sectional views of the electrostatic actuator (the electrostatic micropump or the ink jet recording head) of FIG. 69 taken along the lines W—W, X—X, and Y—Y, respectively.
Figure 71:
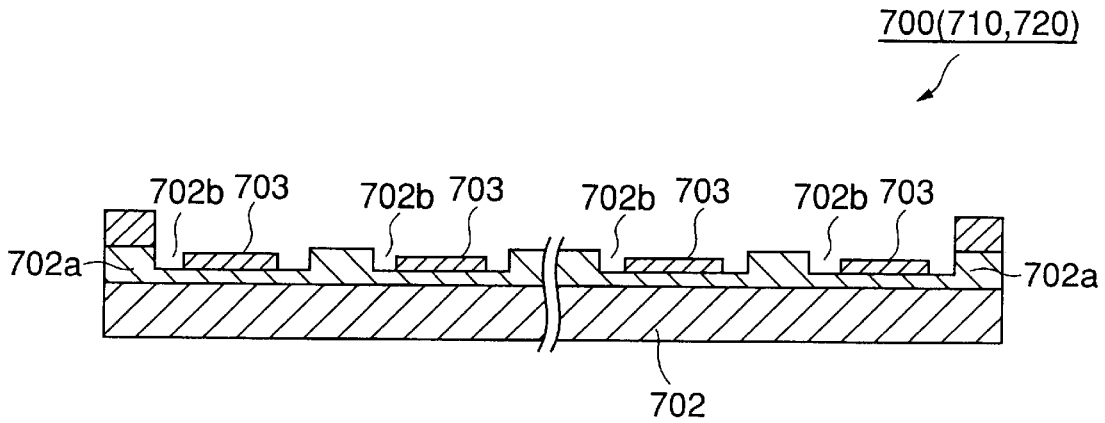
Figure 72:
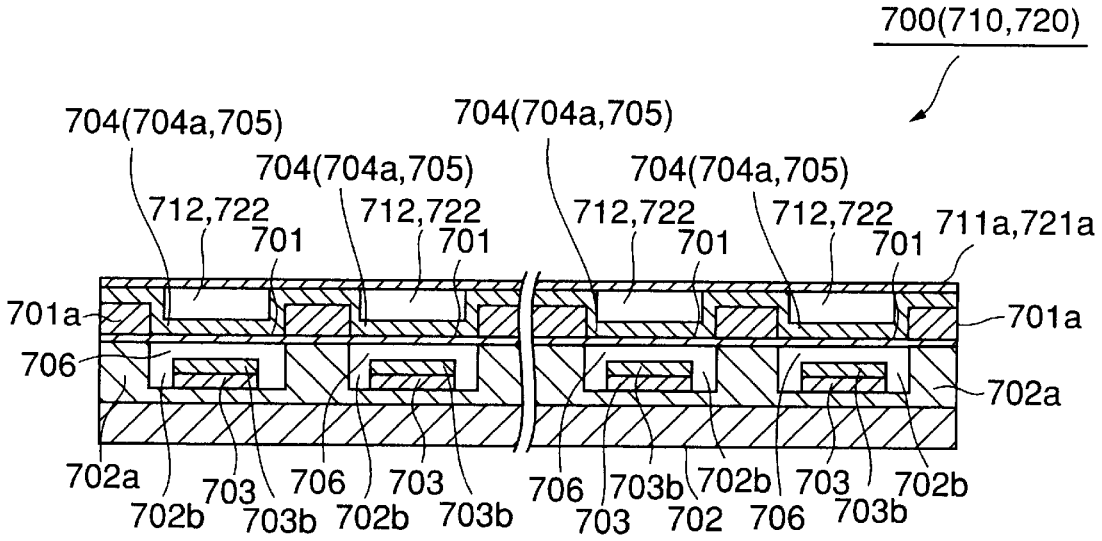

FIG. 69 is a plan view of an electrostatic actuator 700 (an electrostatic micropump 710 or an ink jet recording head 720 including the electrostatic actuator 700) according to the eighth embodiment of the present invention. FIGS. 70 through 72 are sectional views of the electrostatic actuator 700 (the electrostatic micropump 710 or the ink jet recording head 720) of FIG. 69 taken along the lines W—W, X—X, and Y—Y, respectively. The electrostatic actuator 700 includes a single-layer anti-corrosive thin film 704 of a titanium nitride thin film 704*a* serving as diaphragm deflection prevention means 705. The diaphragm deflection prevention means 705 vibrates to operate by electrostatic force.

Each of the electrostatic actuator 700, the electrostatic micropump 710, and the ink jet recording head 720 is formed by the above-described steps (k) through (s).

An electrode substrate 702 is a (100) p-type single-crystal silicon substrate having a resistivity of 10 to 30 Ω.cm.

Electrodes 703 are arranged in concave parts 702*b* of 0.4 μm in deepness formed in a silicon oxide film 702*a* of 2 μm in thickness formed on the electrode substrate 702 by thermal oxidation, and are formed of titanium nitride formed successively by reactive sputtering on the silicon oxide film 702*a*. The electrodes 703 are insulated from one another.

Insulators 703*b* of a silicon oxide film of 150 nm in thickness are formed by plasma CVD on the titanium nitride of the electrodes 703 so as to secure insulation between diaphragms 701 and the electrodes 703.

A pad part 702*c* of the electrode substrate 702 is an area in which the insulators 703*b* are removed by etching and voltage is applied via electrode pads 703*a* to the electrodes 703 so as to vibrate and operate the diaphragms 701.

A diaphragm substrate 701*a* is a (110) single-crystal silicon substrate in which the diaphragms 701 of 2 μm in thickness including boron impurity atoms of $1E20/cm^3$ or more are formed by anisotropic etching using KOH and arranged to oppose the electrodes 703 with the insulators 703*b* being interposed therebetween in gaps 706.

Further in the diaphragm substrate 701*a*, liquid chambers 712, a common liquid chamber 713 for supplying liquid to the liquid chambers 712, and liquid channels 714 connecting the liquid chambers 712 and the common liquid chamber 713 are formed by anisotropic etching in the case of the electrostatic micropump 710, and ink chambers 722, a common ink chamber 723 for supplying ink to the ink chambers 722, and ink channels 724 connecting the ink chambers 722 and the common ink chamber 723 are formed by anisotropic etching in the case of the ink jet recording head 720.

On the surfaces of the diaphragm substrate 701*a*, the diaphragms 701, the liquid chambers 712, the ink chambers 722, the common liquid chamber 713, the common ink chamber 723, the liquid channels 714, and the ink channels 724, the titanium nitride thin film 704*a*, which is the anti-corrosive thin film 704 having anti-corrosiveness against liquid or ink, is formed with a good bottom coverage to have a thickness of 1000 Å and contain oxygen atoms with good controllability by sputtering, CVD, or oxidation.

The titanium nitride thin film 704*a* of the anti-corrosive thin film 704 contains approximately 10% oxygen atoms. At this point, with the titanium nitride thin film 704*a* being formed, the diaphragms 701 included no deflections resulting from buckling.

Nozzle plates 711*a* and 721*a* are formed of glass plates, in which a liquid supply path 715 for supplying the liquid and an ink supply path 725 for supplying the ink and the nozzle holes 711 and 721 are formed by sand blasting, respectively. The nozzle plates 711*a* and 721*a* are attached over the liquid chambers 712 and the ink chambers 722, respectively.

In the above-described electrostatic actuator 700, the electrostatic micropump 710, or the ink jet recording head 720, when the diaphragms 701 were electrically grounded and voltages were applied to the electrodes 703 via the electrode pads 703*a*, the diaphragms 701 vibrated and operated at a certain frequency.

When the voltages were applied to the electrodes 703 via the electrode pads 703*a*, electrostatic forces were exerted between the diaphragms 701 and the electrodes 703. Since the diaphragms 701 were kept flat by the titanium nitride thin film 704*a* containing the approximately 10% oxygen atoms and prevented from including deflections resulting from buckling, the diaphragms 701 were attracted sufficiently toward the electrodes 703.

As a result, the liquid chambers 712 or the ink chambers 722 were depressurized so that the liquid or ink was supplied from the common liquid chamber 713 or the common ink chamber 723 to the liquid chambers 712 or the ink chambers 722 via the liquid channels 714 or the ink channels 724.

The diaphragms 701 returned to their original positions by stiffness of silicon in accordance with the frequency of the voltages applied to the electrodes 703 via the electrode pads 703*a*. At this point, the liquid chambers 712 or the ink chambers 722 were, pressurized so that liquid or ink droplets were stably ejected through the nozzle holes 711 or 721 in a direction indicated by arrow D in FIG. 70.

Further, the results of the measurement of differences in the ejection characteristic among bits in this state showed highly good uniformity in the ejection characteristic. As a result of conducting a reliability test using liquid or ink droplets in this state, it was confirmed that the titanium nitride thin film 704*a* had good anti-corrosiveness.

A description will now be given of a ninth embodiment of the present invention.

Figure 73:
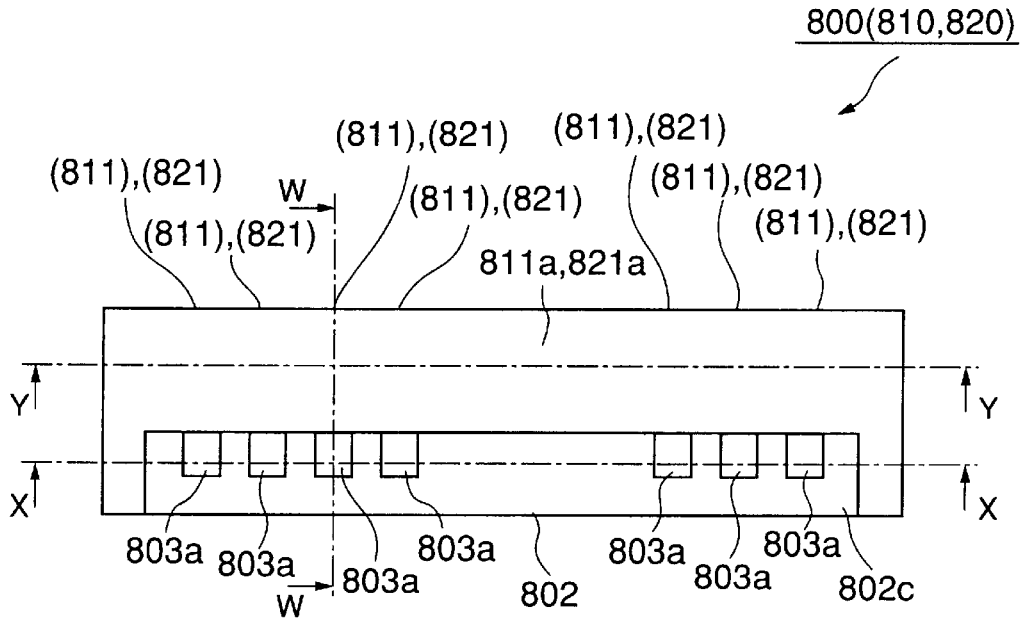
FIG. 73 is a plan view of an electrostatic actuator (an electrostatic micropump or an ink jet recording head including the electrostatic actuator) according to a ninth embodiment of the present invention.
Figure 74:
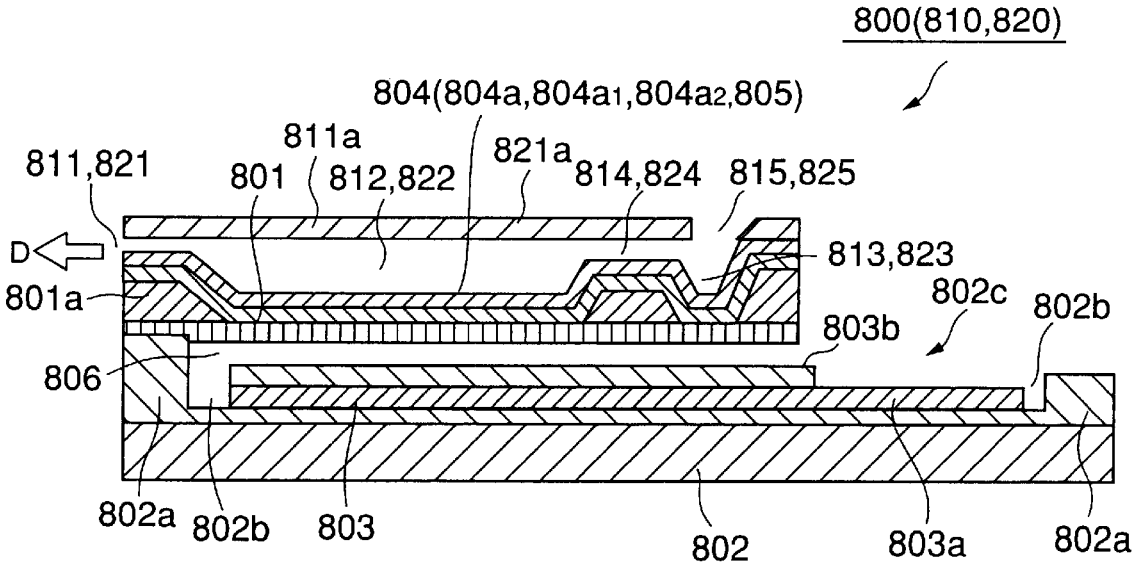
FIGS. 74 through 76 are sectional views of the electrostatic actuator (the electrostatic micropump or the ink jet recording head) of FIG. 73 taken along the lines W—W, X—X, and Y—Y, respectively.
Figure 75:
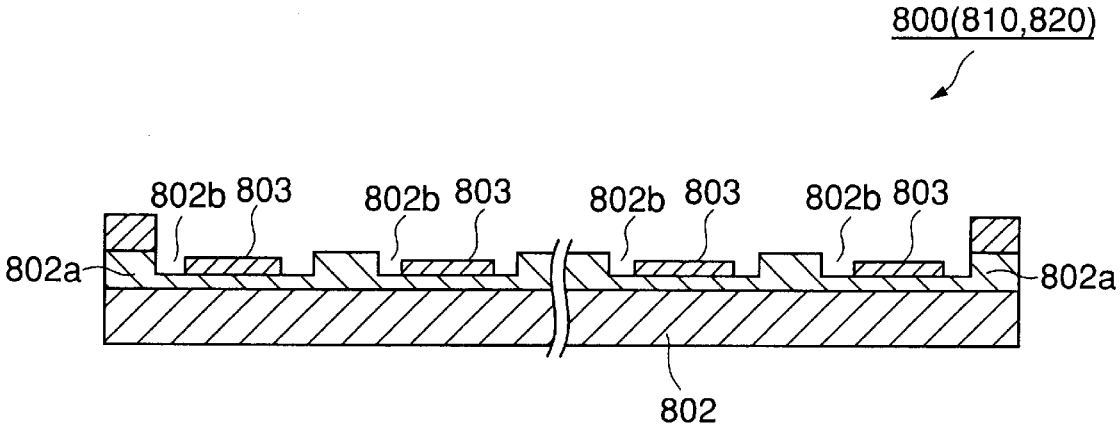
Figure 76:
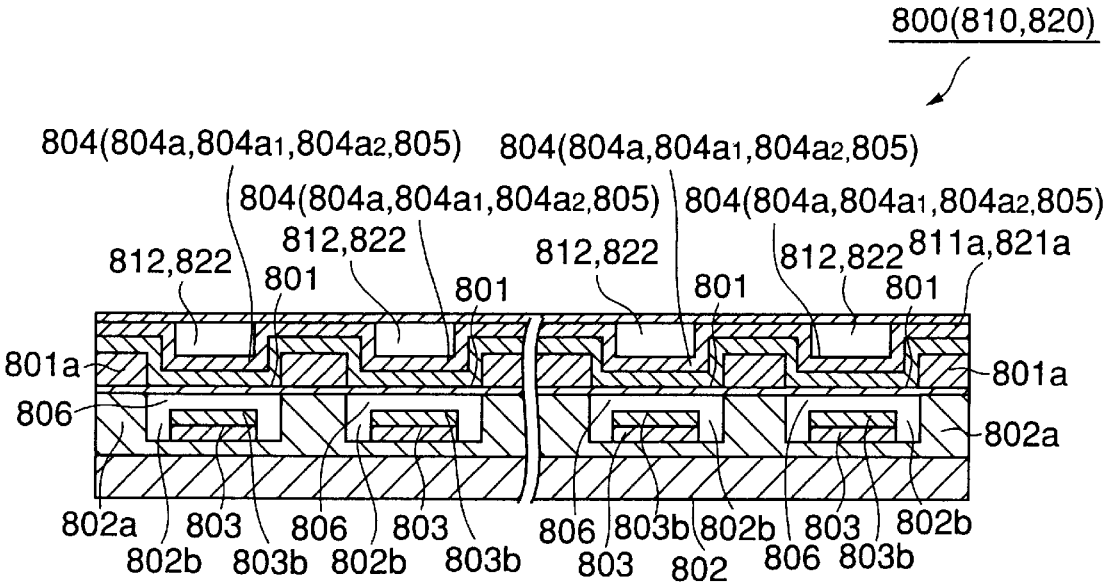

FIG. 73 is a plan view of an electrostatic actuator 800 (an electrostatic micropump 810 or an ink jet recording head 820 including the electrostatic actuator 800) according to the ninth embodiment of the present invention. FIGS. 74 through 76 are sectional views of the electrostatic actuator 800 (the electrostatic micropump 810 or the ink jet recording head 820) of FIG. 73 taken along the lines W—W, X—X, and Y—Y, respectively. The electrostatic actuator 800 includes a multilayer anti-corrosive thin film. 804 of a titanium nitride thin film 804*a* including a titanium nitride thin film $\mathbf{804}a_1$ and a titanium nitride thin film $\mathbf{804}a_2$ whose condition is different from that of the titanium nitride thin film $\mathbf{804}a_1$. The multilayer anti-corrosive thin film 804 serves as diaphragm deflection prevention means 805. The diaphragm deflection prevention means 805 vibrates to operate by electrostatic force.

Each of the electrostatic actuator 800, the electrostatic micropump 810, and the ink jet recording head 820 is formed by the above-described steps (k) through (s).

An electrode substrate 802 is a (100) p-type single-crystal silicon substrate having a resistivity of 10 to 30 Ω.cm.

Electrodes 803 are arranged in concave parts 802*b* of 0.4 μm in deepness formed in a silicon oxide film 802*a* of 2 μm in thickness formed on the electrode substrate 802 by thermal oxidation, and are formed of titanium nitride formed successively by reactive sputtering on the silicon oxide film 802*a*. The electrodes 803 are insulated from one another.

Insulators 803*b* of a silicon oxide film of 150 nm in thickness are formed by plasma CVD on the titanium nitride of the electrodes 803 so as to secure insulation between diaphragms 801 and the electrodes 803.

A pad part 802*c* of the electrode substrate 802 is an area in which the insulators 803*b* are removed by etching and voltage is applied via electrode pads 803*a* to the electrodes 803 so as to vibrate and operate the diaphragms 801.

A diaphragm substrate 801*a* is a (110) single-crystal silicon substrate in which the diaphragms 801 of 2 μm in thickness including boron impurity atoms of 1E20/cm$^3$ or more are formed by anisotropic etching using KOH and arranged to oppose the electrodes 803 with the insulators 803*b* being interposed therebetween in gaps 806.

Further in the diaphragm substrate 801*a*, liquid chambers 812, a common liquid chamber 813 for supplying liquid to the liquid chambers 812, and liquid channels 814 connecting the liquid chambers 812 and the common liquid chamber 813 are formed by anisotropic etching in the case of the electrostatic micropump 810, and ink chambers 822, a common ink chamber 823 for supplying ink to the ink chambers 822, and ink channels 824 connecting the ink chambers 822 and the common ink chamber 823 are formed by anisotropic etching in the case of the ink jet recording head 820.

On the surfaces of the diaphragm substrate 801*a*, the diaphragms 801, the liquid chambers 812, the ink chambers 822, the common liquid chamber 813, the common ink chamber 823, the liquid channels 814, and the ink channels 824, successively formed are the titanium nitride thin film 804$a_1$, and the titanium nitride thin film 804$a_2$ of the titanium nitride thin film 804*a*, which is the anti-corrosive thin film 804 having anti-corrosiveness against liquid or ink. The titanium nitride thin film 804$a_1$ is formed with a good bottom coverage to have a thickness of 500 Å and contain 5% oxygen atoms with good controllability by sputtering, CVD, or oxidation, and the titanium nitride thin film 804$a_2$ is successively formed under a different condition with a good bottom coverage to have a thickness of 500 Å and contain 15% oxygen atoms with good controllability by sputtering, CVD, or oxidation.

At this point, with the titanium nitride thin film 804$a_1$ and the titanium nitride thin film 804$a_2$ of the anti-corrosive thin film 804 being formed, the diaphragms 801 included no deflections resulting from buckling.

Nozzle plates 811*a* and 821*a* are formed of glass plates, in which a liquid supply path 815 for supplying the liquid and an ink supply path 825 for supplying the ink and the nozzle holes 811 and 821 are formed by sand blasting, respectively. The nozzle plates 811*a* and 821*a* are attached over the liquid chambers 812 and the ink chambers 822, respectively.

In the above-described electrostatic actuator 800, the electrostatic micropump 810, or the ink jet recording head 820, when the diaphragms 801 were electrically grounded and voltages were applied to the electrodes 803 via the electrode pads 803*a*, the diaphragms 801 vibrated and operated at a certain frequency.

When the voltages were applied to the electrodes 803 via the electrode pads 803*a*, electrostatic forces were exerted between the diaphragms 801 and the electrodes 803, and the diaphragms 801 were attracted toward the electrodes 803.

At this point, the diaphragm deflection prevention means 805 prevented buckling of the diaphragms 801 due to the successive formations of the titanium nitride thin film 804$a_1$ and the titanium nitride thin film 804$a_2$ of the titanium nitride thin film 804*a* and consequent deflections thereof so that the diaphragms 801 were attracted sufficiently toward the electrodes 803.

As a result, the liquid chambers 812 or the ink chambers 822 were depressurized so that the liquid or ink was supplied from the common liquid chamber 813 or the common ink chamber 823 to the liquid chambers 812 or the ink chambers 822 via the liquid channels 814 or the ink channels 824.

The diaphragms 801 returned to their original positions by stiffness of silicon in accordance with the frequency of the voltages applied to the electrodes 803 via the electrode pads 803*a*. At this point, the liquid chambers 812 or the ink chambers 822 were pressurized so that liquid or ink droplets were stably ejected through the nozzle holes 811 or 821 in a direction indicated by arrow D in FIG. 74.

Further, the results of the measurement of differences in the ejection characteristic among bits in this state showed highly good uniformity in the ejection characteristic. As a result of conducting a reliability test using liquid or ink droplets in this state, it was confirmed that the titanium nitride thin film 804$a_1$ and the titanium nitride thin film 804$a_2$ each had good anti-corrosiveness.

A description will now be given of a tenth embodiment of the present invention.

Figure 77:
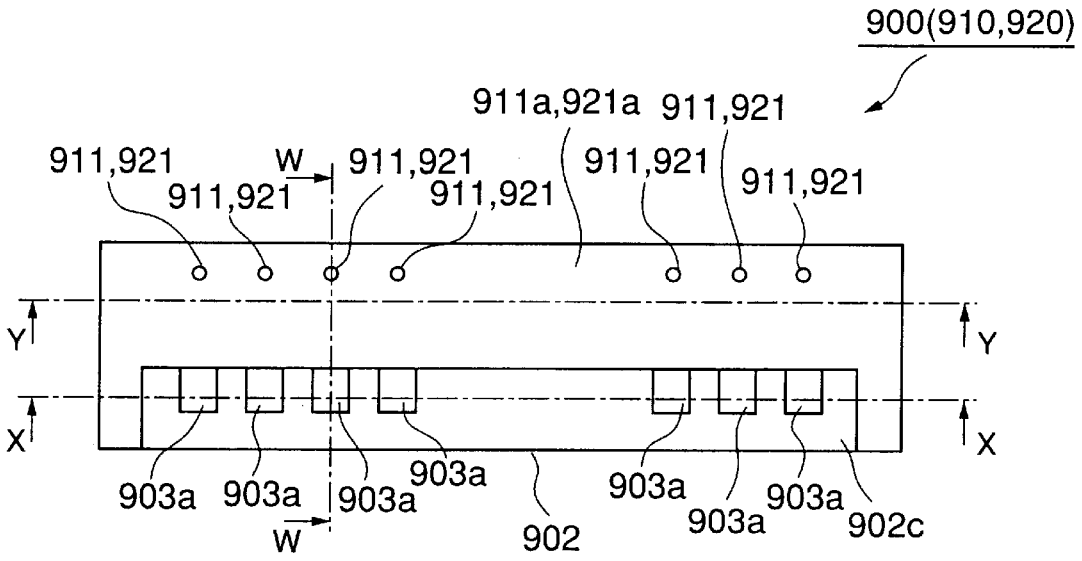
FIG. 77 is a plan view of an electrostatic actuator (an electrostatic micropump or an ink jet recording head including the electrostatic actuator) according to a tenth embodiment of the present invention.
Figure 78:
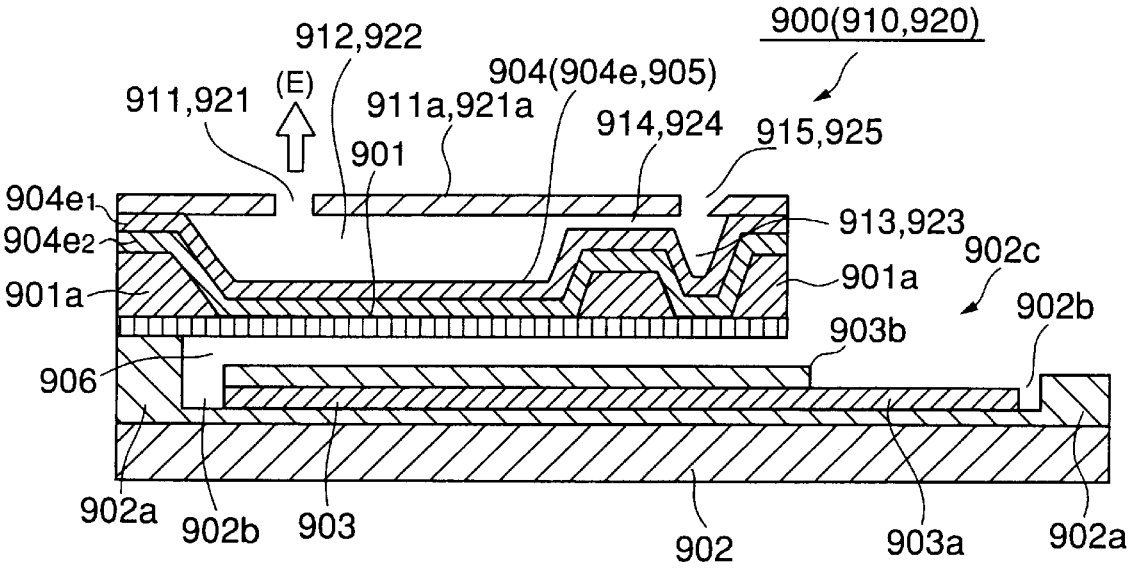
FIGS. 78 through 80 are sectional views of the electrostatic actuator (the electrostatic micropump or the ink jet recording head) of FIG. 77 taken along the lines W—W, X—X, and Y—Y, respectively.
Figure 79:
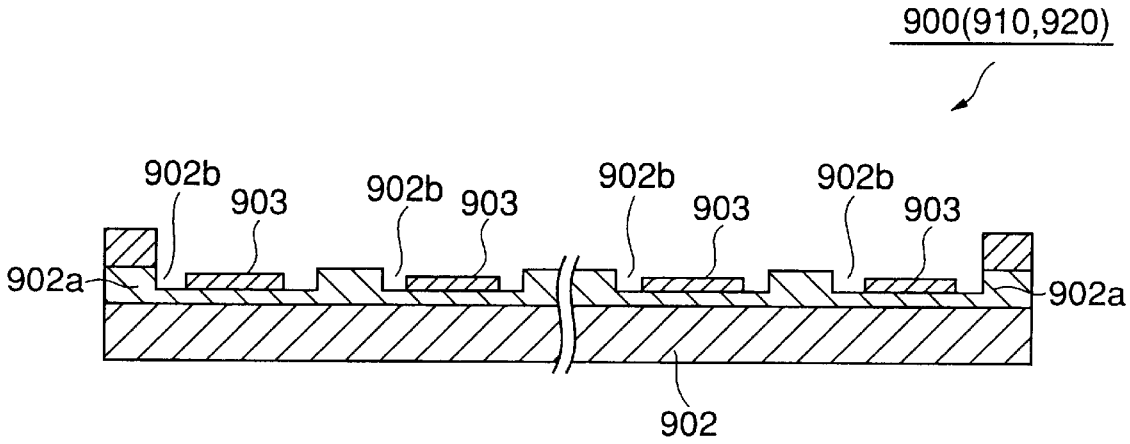
Figure 80:
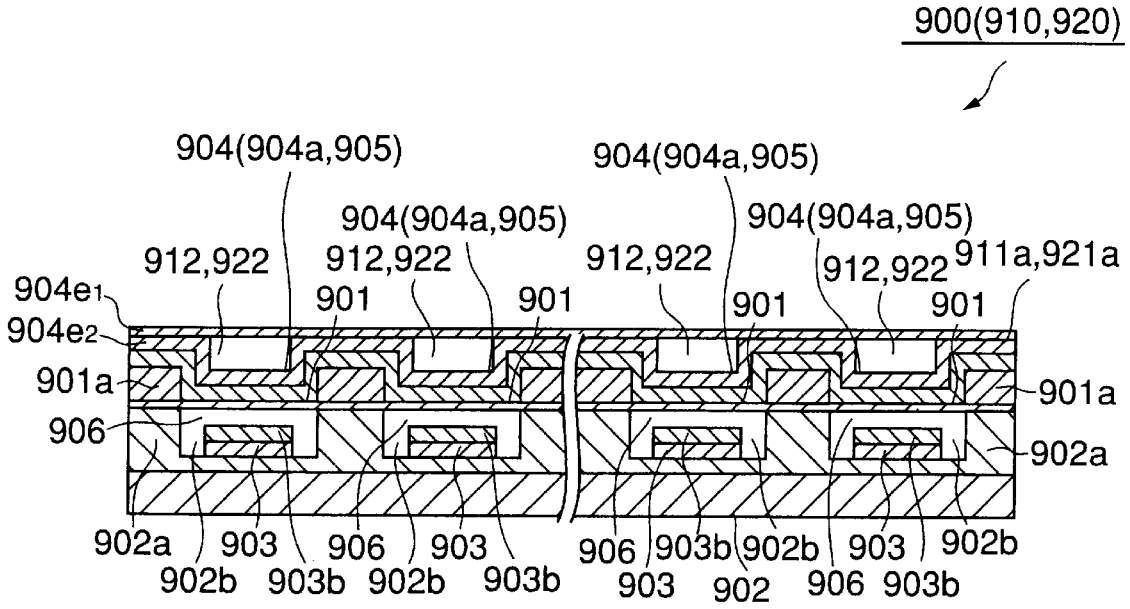

FIG. 77 is a plan view of an electrostatic actuator 900 (an electrostatic micropump 910 or an ink jet recording head 920 including the electrostatic actuator 900) according to the tenth embodiment of the present invention. FIGS. 78 through 80 are sectional views of the electrostatic actuator 900 (the electrostatic micropump 910 or the ink jet recording head 920) of FIG. 77 taken along the lines W—W, X—X, and Y—Y, respectively. The electrostatic actuator 900 includes an anti-corrosive thin film 904 of a different stress multilayer thin film 904*e* formed by sputtering of two or more layers of films having compressive and tensile stresses of different directions by another simple stress structure. The anti-corrosive thin film 904 serves as diaphragm deflection prevention means 905. The diaphragm deflection prevention means 905 vibrates to operate by electrostatic force.

Each of the electrostatic actuator 900, the electrostatic micropump 910, and the ink jet recording head 920 includes a (110) single-crystal silicon substrate 901*a* in which diaphragms 901 are formed and an electrode substrate 902. Further, the electrostatic micropump 910 and the ink jet recording head 920 respectively include liquid chambers 912 and ink chambers 922 in which liquid and ink are pressurized, respectively, a common liquid chamber 913 and a common ink chamber 923, liquid channels 914 and ink channels 924 formed by anisotropic etching in the diaphragm substrate 901*a*, and nozzle plates 911*a* and 921*a* of glass, metal, or silicon in which nozzle holes 911 and 921 and liquid supply path 915 and liquid supply path 925 are formed, respectively.

In the single-crystal silicon substrate that is the diaphragm substrate 901*a*, the diaphragms 901 driven by electrostatic force are formed so as to correspond to the liquid chambers 912 or the ink chambers 922 and the nozzle holes 911 or 921, and the common liquid chamber 913 or the common ink chamber 923 for supplying liquid or ink to the liquid chambers 912 or the ink chambers 922 are formed.

The liquid chambers 912 and the ink chambers 922 communicate with the common liquid chamber 913 and the common ink chamber 923 through the liquid channels 914 and the ink channels 924, respectively.

On the surfaces of the diaphragm substrate 901*a* and the diaphragms 901 and the liquid or ink-contacting surfaces of the liquid chambers 912, the ink chambers 922, the common liquid chamber 913, the common ink chamber 923, the liquid channels 914, and the ink channels 924, a first anti-corrosive thin film 904$e_1$ and a second anti-corrosive thin film 904$e_2$ of the different stress multilayer thin film 904*e* having anti-corrosiveness against liquid or ink are formed of a metal such as titanium nitride by sputtering, CVD, or oxidation so as to have a thickness of 10 to 5000 Å, preferably, 100 to 2000 Å.

Besides titanium nitride, any material having anti-corrosiveness may be employed. The first and second anti-corrosive thin films 904$e_1$ and 904$e_2$ have stresses reverse to each other.

That is, if the first anti-corrosive thin films 904$e_1$ has a compressive stress, the second anti-corrosive thin films 904$e_2$ has a tensile stress, and if the first anti-corrosive thin films 904$e_1$ has a tensile stress, the second anti-corrosive thin films 904$e_2$ has a compressive stress.

Thus, the first and second anti-corrosive thin films 904$e_1$ and 904$e_2$ are provided to have reverse stresses.

Further, in the case of forming two or more layers of the second anti-corrosive thin films 904$e_2$, deflections of the diaphragms 901 are relieved by controlling each of the first anti-corrosive thin films 904$e_1$ and the second anti-corrosive thin films 904$e_2$ through 904$e_n$ to ease the stress of the entire n-layered different stress multilayer thin film 904*e*.

In addition to this, the formation of pinholes resulting from minute defects is prevented.

Figure 81:
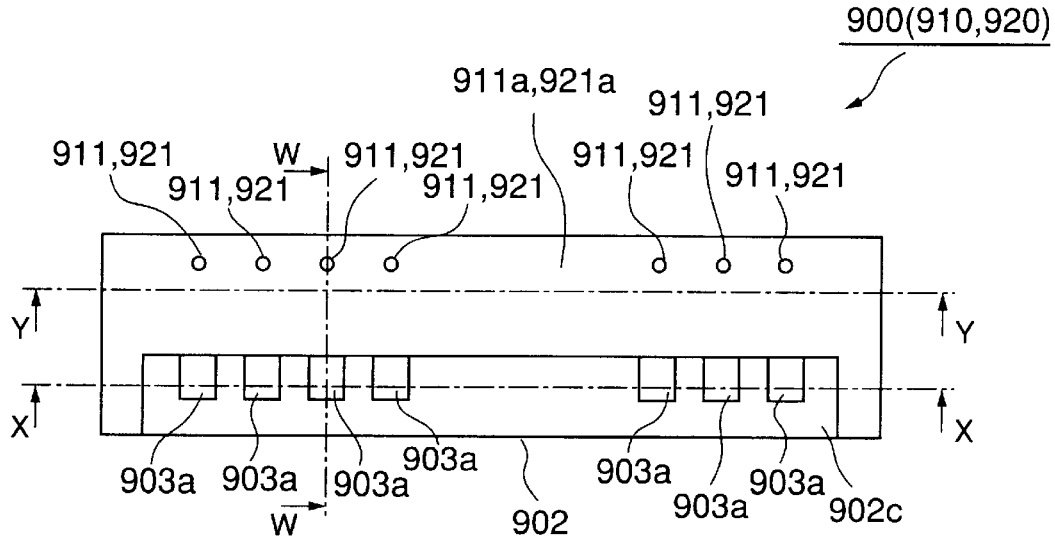
FIG. 81 is a plan view of an electrostatic actuator (an electrostatic micropump or an ink jet recording head including the electrostatic actuator) according to an 11th embodiment of the present invention.
Figure 82:
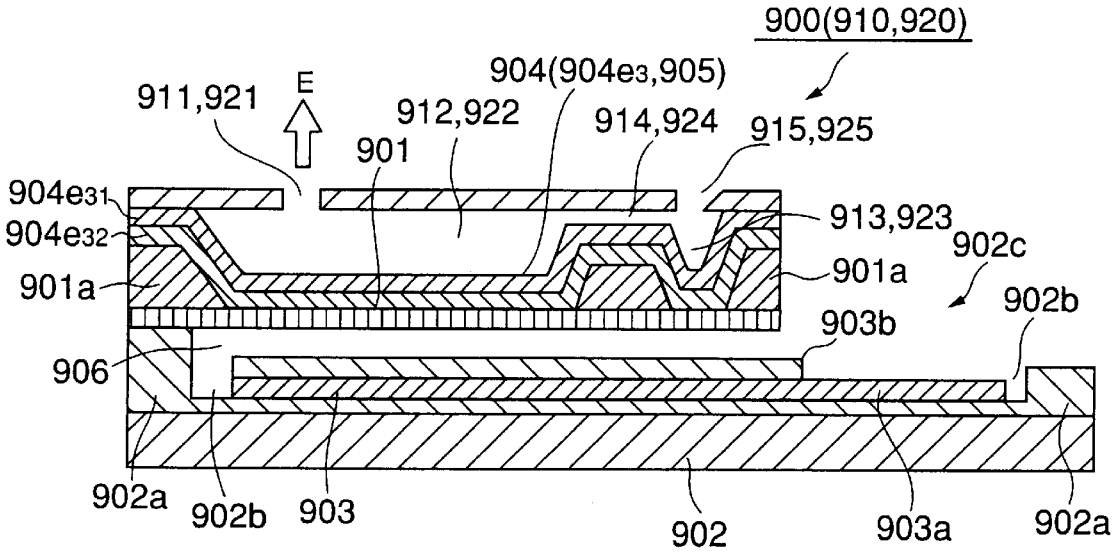
FIGS. 82 through 84 are sectional views of the electrostatic actuator (the electrostatic micropump or the ink jet recording head) of FIG. 81 taken along the lines W—W, X—X, and Y—Y, respectively.
Figure 83:
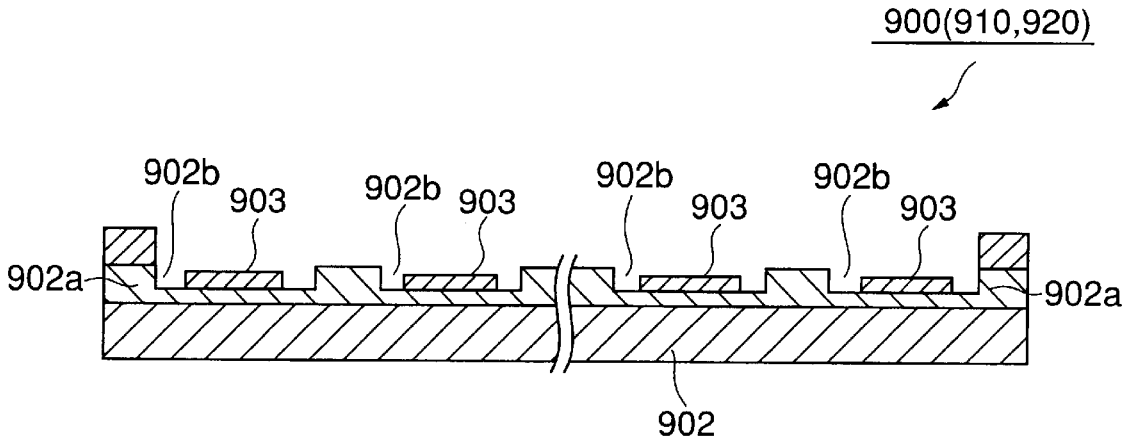
Figure 84:
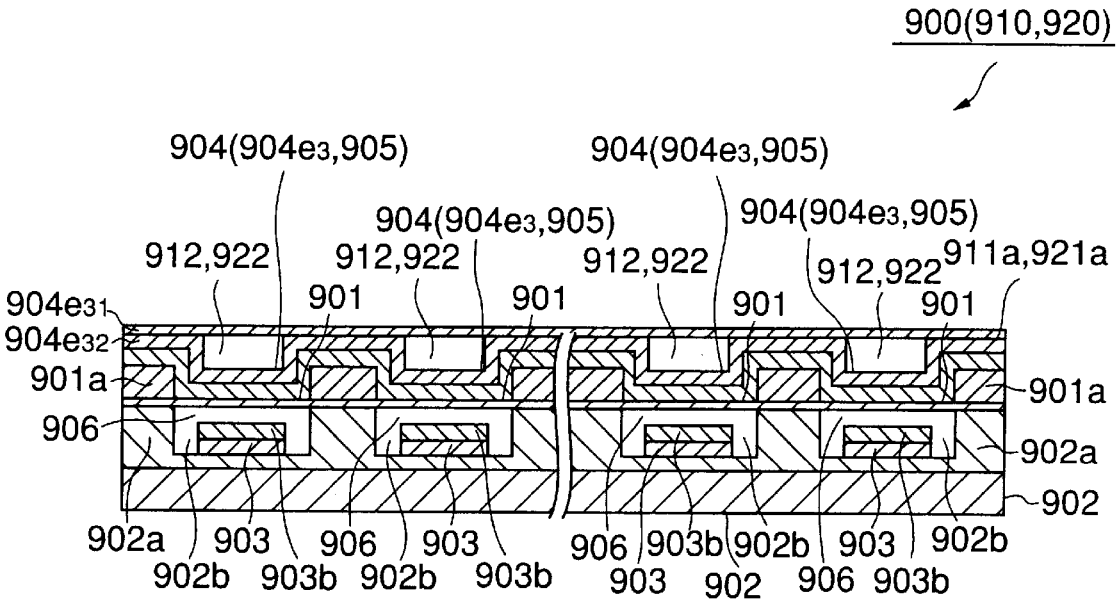
Figure 85:
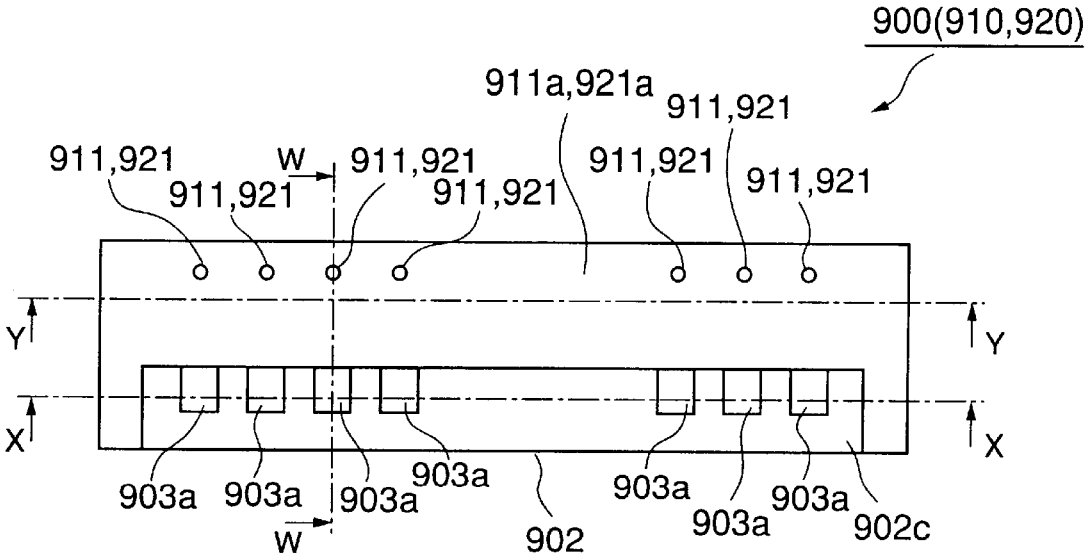
FIG. 85 is a plan view of an electrostatic actuator (an electrostatic micropump or an ink jet recording head including the electrostatic actuator) according to a 12th embodiment of the present invention.

FIG. 81 is a plan view of the electrostatic actuator 900 (the electrostatic micropump 910 or the ink jet recording head 920 including the electrostatic actuator 900) according to an 11th embodiment of the present invention. FIGS. 82 through 84 are sectional views of the electrostatic actuator 900 (the electrostatic micropump 910 or the ink jet recording head 920) of FIG. 81 taken along the lines W—W, X—X, and Y—Y, respectively. The electrostatic actuator 900 employs as the different stress multilayer thin film 904*e* of the anti-corrosive thin film 904 serving as the diaphragm deflection prevention means 905 a titanium nitride thin film 904$e_3$ including titanium nitride thin films 904$e_{31}$ and 904$e_{32}$ that are formed by sputtering which well controls an internal stress and requires low production costs.

The electrode substrate 902 is a (100) p-type single-crystal silicon substrate having a resistivity of 10 to 30 Ω.cm.

Electrodes 903 are arranged in concave parts 902*b* of 0.5 μm in deepness formed in a silicon oxide film 902*a* of 2 μm in thickness formed on the electrode substrate 902 by thermal oxidation, and are formed of titanium nitride formed successively by reactive sputtering on the silicon oxide film 902*a*. The electrodes 903 are insulated from one another.

Insulators 903*b* of a silicon oxide film of 150 nm in thickness are formed by plasma CVD on the titanium nitride of the electrodes 903 so as to secure insulation between diaphragms 901 and the electrodes 903.

A pad part 902*c* of the electrode substrate 902 is an area in which the insulators 903*b* are removed by etching and voltage is applied via electrode pads 903*a* to the electrodes 903 so as to vibrate and operate the diaphragms 901.

The diaphragm substrate 901*a* is a (110) single-crystal silicon substrate in which the diaphragms 901 of 2 μm in thickness including boron impurity atoms of 1E20/cm$^3$ or more are formed by anisotropic etching using KOH and arranged to oppose the electrodes 903, forming gaps 906 with the silicon oxide film 902*a* serving as a gap spacer.

Further in the diaphragm substrate 901*a*, the liquid chambers 912, the common liquid chamber 913 for supplying liquid to the liquid chambers 912, and the liquid channels 914 connecting the liquid chambers 912 and the common liquid chamber 913 are formed by anisotropic etching in the case of the electrostatic micropump 910, and the ink chambers 922, the common ink chamber 923 for supplying ink to the ink chambers 922, and the ink channels 924 connecting the ink chambers 922 and the common ink chamber 923 are formed by anisotropic etching in the case of the ink jet recording head 920.

On the surfaces of the diaphragm substrate 901*a*, the diaphragms 901, the liquid chambers 912, the ink chambers 922, the common liquid chamber 913, the common ink chamber 923, the liquid channels 914, and the ink channels 924, the titanium nitride thin film 904$e_{31}$ of the titanium nitride thin film 904$e_3$ corresponding to the first anti-corrosive thin film 904$e_1$ was formed by sputtering. The titanium nitride thin film 904$e_{31}$ had a thickness of 500 Å on the diaphragms 901 and a compressive stress of 5E08 dyne/cm$^2$.

Further, the titanium nitride thin film 904$e_{32}$ corresponding to the second anti-corrosive thin film 904$e_2$ was successively formed with different sputtering conditions on the diaphragms 901 so as to have a thickness of 500 Å and a tensile stress of 5E08 dyne/cm$^2$.

At this point, it was confirmed by observing an amount of deflection using optical interference that the diaphragms 901 were extremely controlled compared with a case in which the titanium nitride thin film 904$e_{31}$ was not layered.

The nozzle plates 911*a* and 921*a* are formed of glass plates, in which the liquid supply path 915 for supplying the liquid and the ink supply path 925 for supplying the ink and the nozzle holes 911 and 921 are formed by sand blasting, respectively. The nozzle plates 911*a* and 921*a* are attached over the liquid chambers 912 and the ink chambers 922, respectively.

In the above-described electrostatic actuator 900, the electrostatic micropump 910, or the ink jet recording head 920, when the diaphragms 901 were electrically grounded and voltages were applied to the electrodes 903 via the electrode pads 903*a*, the diaphragms 901 vibrated and operated at a certain frequency.

When the voltages were applied to the electrodes 903 via the electrode pads 903*a*, electrostatic forces were exerted between the diaphragms 901 and the electrodes 903. Since the diaphragms 901 were prevented from including deflections, the diaphragms 901 were attracted sufficiently toward the electrodes 903 by electrostatic attractions.

As a result, the liquid chambers 912 or the ink chambers 922 were depressurized so that the liquid or ink was supplied from the common liquid chamber 913 or the common ink chamber 923 to the liquid chambers 912 or the ink chambers 922 via the liquid channels 914 or the ink channels 924.

The diaphragms 901 returned to their original positions by stiffness of silicon in accordance with the frequency of the driving voltages. At this point, the liquid chambers 912 or the ink chambers 922 were pressurized so that liquid or ink droplets were stably ejected through the nozzle holes 911 or 921 in a direction indicated by arrow E in FIG. 82.

Further, the results of the measurement of differences in the ejection characteristic among bits in this state showed highly good uniformity in the ejection characteristic. As a result of conducting a reliability test using liquid or ink droplets in this state, it was confirmed that the titanium nitride thin film 904*a* had good anti-corrosiveness.

In FIGS. 85 through 88, according to a 12th embodiment of the present invention, the different stress multilayer thin film 904*e* having anti-corrosiveness against liquid or ink is formed on the surfaces of the diaphragm substrate 901*a* and the diaphragms 901 and the liquid or ink-contacting surfaces of the liquid chambers 912 or the ink chambers 922, the common liquid chamber 913 or the common ink chamber 923, and the liquid channels 914 or the ink channels 924. According to this embodiment, the different stress multilayer thin film 904*e* has the first anti-corrosive thin film 904$e_1$ and a stress-relieving thin film 904$e_4$ for relieving the stress of the first anti-corrosive thin film 904$e_1$ formed by another simple stress structure. The stress-easing thin film 904$e_4$ is formed preferably of a highly flexible organic resin.

In this case, the internal stress of the stress-relieving thin film 904$e_4$ may be either a compressive stress or a tensile stress. Deflections of the diaphragms 901 are relieved by relieving the stress by the stress-relieving thin film 904$e_4$.

The layered first anti-corrosive thin film 904$e_1$ and stress-relieving thin film 904$e_4$ can not only relieve the stress but also control the formation of pinholes resulting from minute defects.

Further, the silicon diaphragms 901 forming the liquid chambers 912 or the ink chambers 922 corresponding to the nozzle holes 911 or 921 form the gaps 906 with the silicon oxide film 902*a* serving as a gap spacer and are arranged to oppose the electrodes 903 to which the voltages are applied to drive the electrostatic actuator 900 and the electrostatic micropump 910 or the ink jet recording head 920 including the electrostatic actuator 900.

Figure 86:
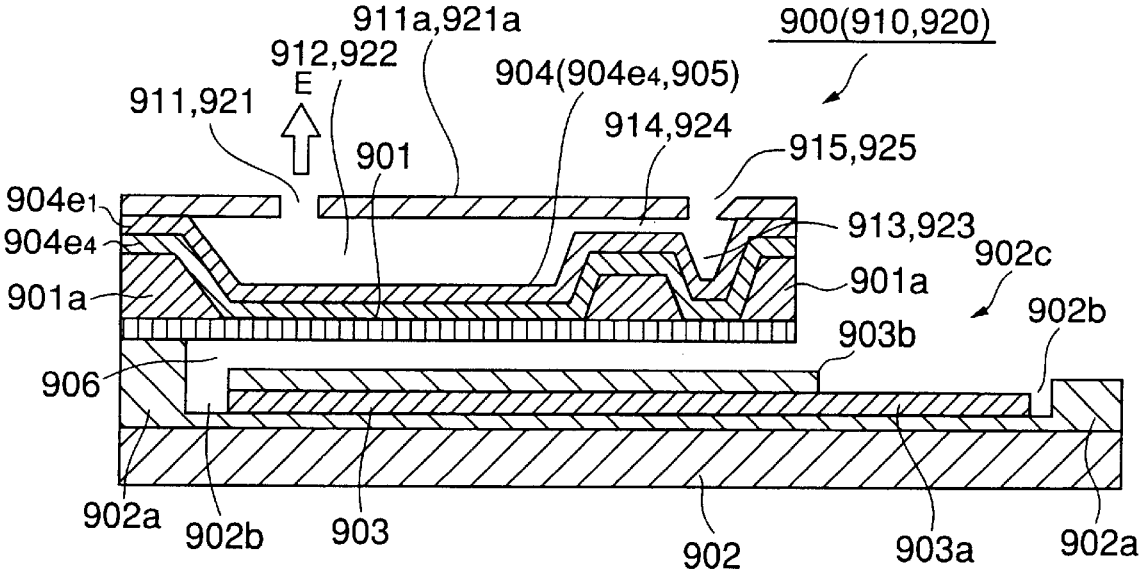
FIGS. 86 through 88 are sectional views of the electrostatic actuator (the electrostatic micropump or the ink jet recording head) of FIG. 85 taken along the lines W—W, X—X, and Y—Y, respectively.
Figure 87:
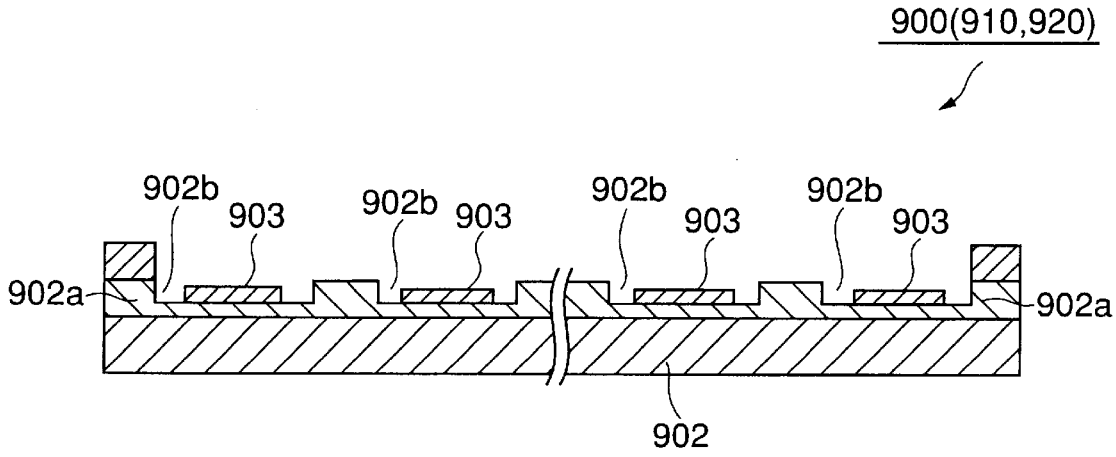
Figure 88:
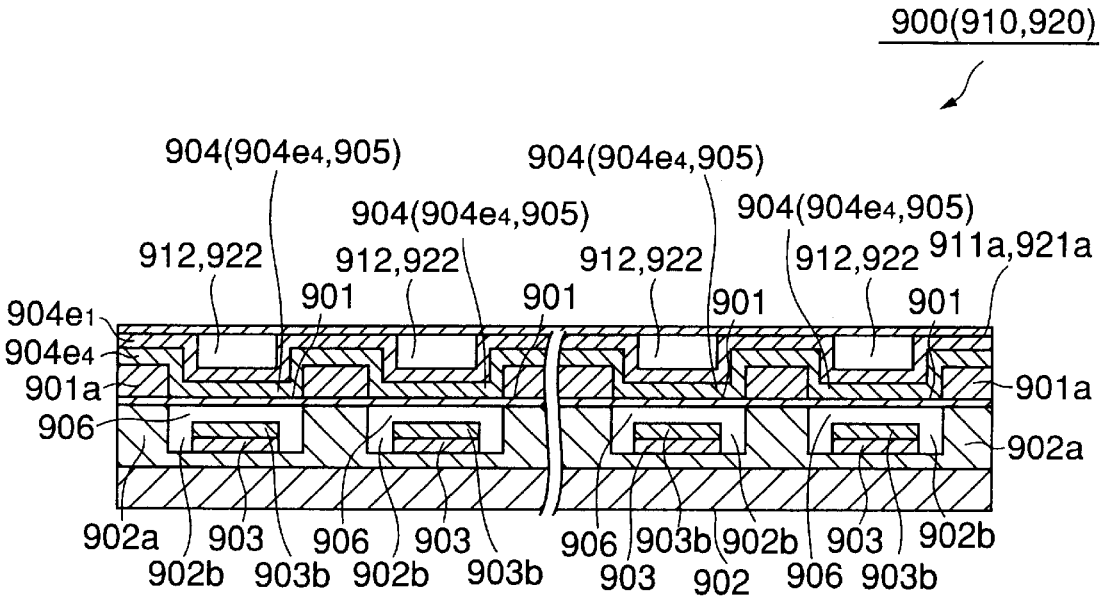

Arrow E of FIG. 86 indicates a direction in which liquid or ink is ejected, which direction is determined by an orientation with which each nozzle hole 911 or 921 is arranged.

The electrode substrate 902 is an n- or p-type single-crystal silicon substrate. Normally, a (100) single-crystal silicon substrate is employed, but a (110) or (111) single-crystal silicon substrate may be employed depending on a process. A glass substrate may be employed instead of the silicon substrate.

The electrodes 903 are arranged in the concave parts 902*b* formed in the silicon oxide film 902*a* formed on the electrode substrate 902, and may be formed of any conductive material.

The electrodes 903 are insulated from one another and formed of a refractory metal and its nitride or compound formed by reactive sputtering or CVD, such as titanium, tungsten, or tantalum. The electrodes 903 may have a layer structure of the refractory metal and its nitride or compound. Preferably, the electrodes 903 are formed of a titanium nitride or have a layer structure of titanium and titanium nitride formed in the order described on the silicon oxide film 902*a*. The electrodes 903 are formed in the gap spacer of the silicon oxide film 902*a* formed by performing thermal oxidation on the electrode substrate 902 that is a single-crystal silicon substrate.

The gap spacer of the silicon oxide film 902*a* is provided to form the gaps 906 between the diaphragms 901 and the electrodes 903. The electrostatic attractions are generated between the diaphragms 901 and the electrodes 903 by applying the voltages to the electrodes 903 with the gap spacer of the silicon oxide film 902*a* separating the electrodes 3.

The pad part 902*c* is a driving voltage application pad part that conducts electricity to the electrodes 903. The pad part 902*c* includes the electrode pads 903*a* for mounting an FPC or performing wire bonding. The driving voltages are applied from outside the electrode substrate 902 to the electrode pads 903.

In the above-described electrostatic actuator 900, the electrostatic micropump 910, and the ink jet recording head 920, the layered first anti-corrosive thin film 904$e_1$ and stress-relieving thin film 904$e_4$ of the different stress multilayer thin film 904*e* are formed by sputtering.

In this structure, titanium nitride is employed as a material for the layered first anti-corrosive thin film 904$e_1$ and polyimide, which is one of organic resins having good flexibility, is employed as a material for the stress-relieving thin film 904$e_4$ formed between the first anti-corrosive thin film 904$e_1$ and the diaphragms 901.

The electrode substrate 902 is a (100) p-type single-crystal silicon substrate having a resistivity of 10 to 30 Ω.cm.

The electrodes 903 are arranged in the concave parts 902*b* of 0.5 μm in deepness formed in the silicon oxide film 902*a* of 2 μm in thickness formed on the electrode substrate 902 by thermal oxidation, and are formed of titanium nitride formed successively by reactive sputtering on the silicon oxide film 902*a*. The electrodes 903 are insulated from one another.

The insulators 903*b* of a silicon oxide film of 150 nm in thickness are formed by plasma CVD on the titanium nitride of the electrodes 903 so as to secure insulation between diaphragms 901 and the electrodes 903.

The pad part 902*c* of the electrode substrate 902 is an area in which the insulators 903*b* are removed by etching and the electrode pads 903*a* of the electrodes 903, to which the driving voltages for driving the electrostatic actuator 900, the electrostatic micropump 910, or the ink jet recording head 920 are applied, are formed.

The diaphragm substrate 901*a* is a (110) single-crystal silicon substrate in which the diaphragms 901 of 2 μm in thickness including boron impurity atoms of 1E20/$cm^3$ or more are formed by anisotropic etching using KOH and arranged to oppose the electrodes 903, forming gaps 906 with the silicon oxide film 902*a* serving as the gap spacer.

Further in the diaphragm substrate 901*a*, the liquid chambers 912, the common liquid chamber 913 for supplying liquid to the liquid chambers 912, and the liquid channels 914 connecting the liquid chambers 912 and the common liquid chamber 913 are formed by anisotropic etching in the case of the electrostatic micropump 910, and the ink chambers 922, the common ink chamber 923 for supplying ink to the ink chambers 922, and the ink channels 924 connecting the ink chambers 922 and the common ink chamber 923 are formed by anisotropic etching in the case of the ink jet recording head 920.

On the surfaces of the diaphragm substrate 901*a*, the diaphragms 901, the liquid chambers 912, the ink chambers 922,. the common liquid chamber 913, the common ink chamber 923, the liquid channels 914, and the ink channels 924, polyimide of 5 μm in thickness was formed as the stress-relieving thin film 904$e_4$.

Further, on the polyimide formed as the stress-relieving thin film 904$e_4$, titanium nitride having 500 Å in thickness and a compressive stress of 1E09 dyne/cm$^2$ was successively formed as the first anti-corrosive thin film 904$e_1$.

At this point, it was confirmed by observing an amount of deflection using optical interference that the diaphragms 901 were extremely controlled compared with a case in which the polyimide was not formed as the stress-relieving thin film 904$e_4$.

The nozzle plates 911*a* and 921*a* are formed of glass plates, in which the liquid supply path 915 for supplying the liquid and the ink supply path 925 for supplying the ink and the nozzle holes 911 and 921 are formed by sand blasting, respectively. The nozzle plates 911*a* and 921*a* are attached over the liquid chambers 912 and the ink chambers 922, respectively.

In the above-described electrostatic actuator 900, the electrostatic micropump 910, or the ink jet recording head 920, when the diaphragms 901 were electrically grounded and voltages were applied to the electrodes 903 via the electrode pads 903*a*, the diaphragms 901 vibrated and operated at a certain frequency.

When the voltages were applied to the electrodes 903 via the electrode pads 903*a*, electrostatic forces were exerted between the diaphragms 901 and the electrodes 903. Since the diaphragms 901 were prevented from including deflections, the diaphragms 901 were attracted sufficiently toward the electrodes 903 by electrostatic attractions.

As a result, the liquid chambers 912 or the ink chambers 922 were sufficiently depressurized so that the liquid or ink was supplied from the common liquid chamber 913 or the common ink chamber 923 to the liquid chambers 912 or the ink chambers 922 via the liquid channels 914 or the ink channels 924.

The diaphragms 901 returned to their original positions by stiffness of silicon in accordance with the frequency of the driving voltages. At this point, the liquid chambers 912 or the ink chambers 922 were pressurized so that liquid or ink droplets were stably ejected through the nozzle holes 911 or 921 in a direction indicated by arrow E in FIG. 86.

Further, the results of the measurement of differences in the ejection characteristic among bits in this state showed highly good uniformity in the ejection characteristic.

As a result of conducting a reliability test using liquid or ink droplets in this state, it was confirmed that the different stress multilayer thin film 904*e* had good anti-corrosiveness.

A description will now be given of a 13th embodiment of the present invention.

Figure 89:
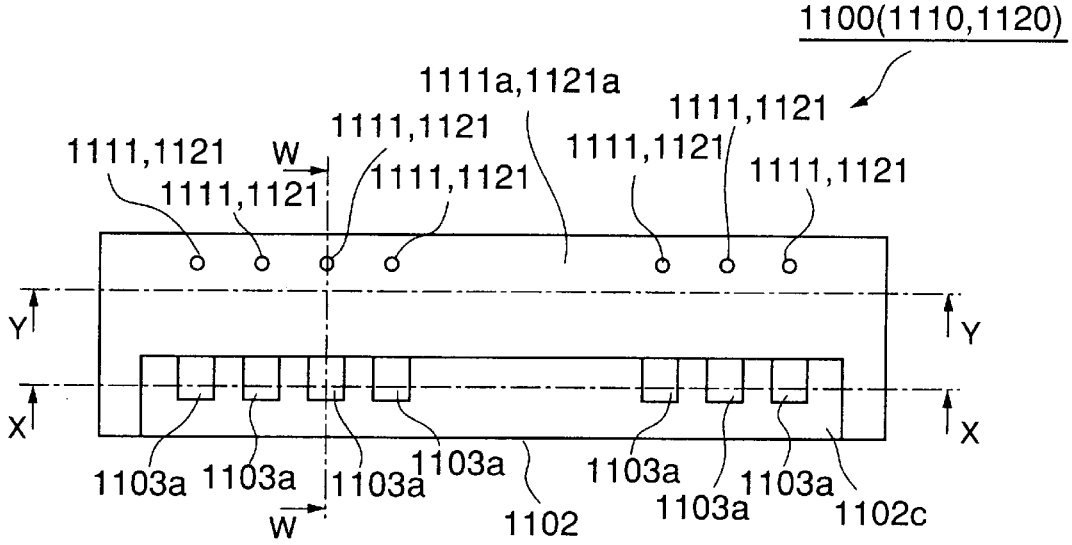
FIG. 89 is a plan view of an electrostatic actuator (an electrostatic micropump or an ink jet recording head including the electrostatic actuator) according to a 13th embodiment of the present invention.
Figure 90:
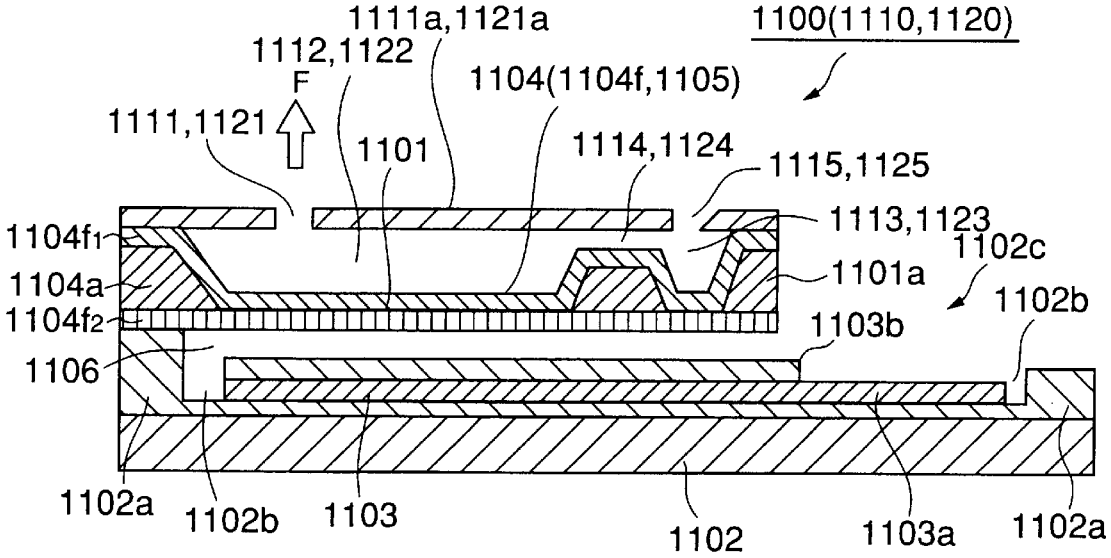
FIGS. 90 through 92 are sectional views of the electrostatic actuator (the electrostatic micropump or the ink jet recording head) of FIG. 89 taken along the lines W—W, X—X, and Y—Y, respectively.
Figure 91:
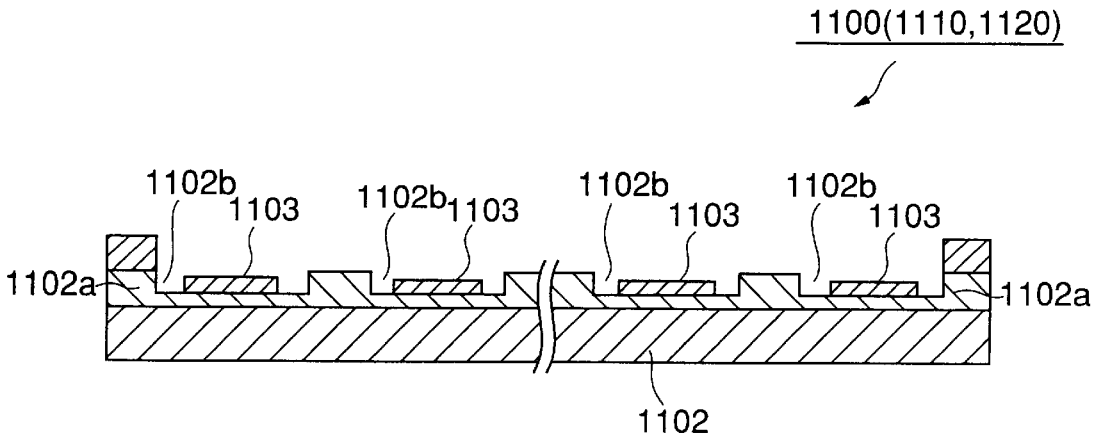
Figure 92:
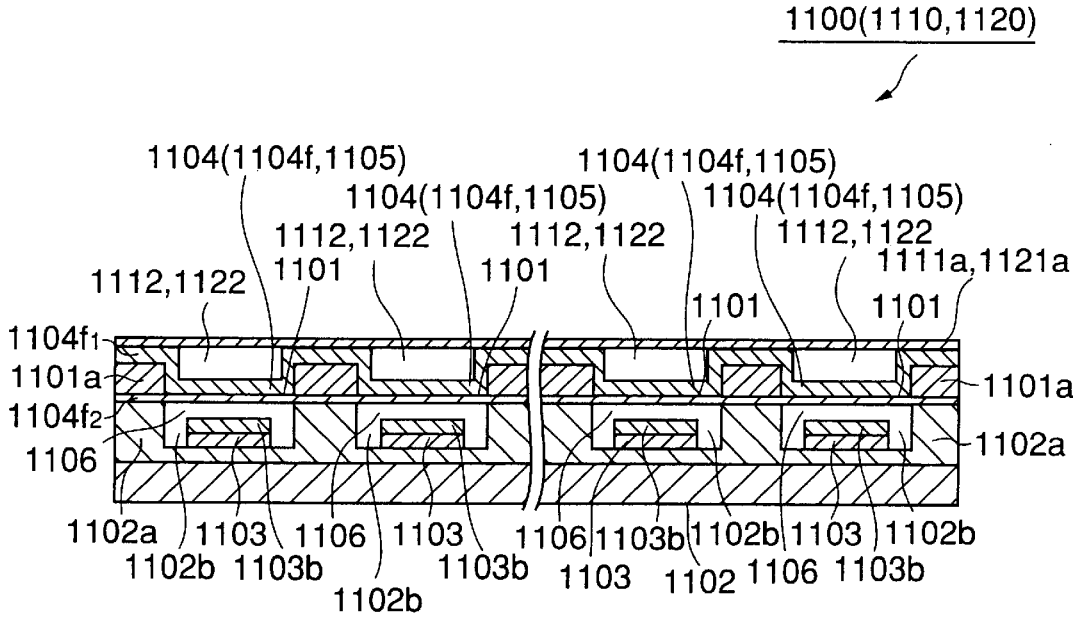

FIG. 89 is a plan view of an electrostatic actuator 1100 (an electrostatic micropump 1110 or an ink jet recording head 1120 including the electrostatic actuator 1100) according to the 13th embodiment of the present invention. FIGS. 90 through 92 are sectional views of the electrostatic actuator 1100 (the electrostatic micropump 1110 or the ink jet recording head 1120) of FIG. 89 taken along the lines W—W, X—X, and Y—Y, respectively. The electrostatic actuator 1100 includes an anti-corrosive thin film 1104 of an anti-corrosive thin film 1104$f_1$ formed on diaphragms 1101, and an equal stress thin film 1104$f_2$ formed under the diaphragms 1101 and having a stress equal to that of the anti-corrosive thin film 1104$f_1$. The anti-corrosive thin film 1104$f_1$ and the equal stress thin film 1104$f_2$ are formed in another simple stress structure by sputtering that provides good controllability in relieving an internal stress and requires low production costs. The equal stress thin film 1104$f_2$ serves as diaphragm deflection prevention means 1105. The diaphragm deflection prevention means 1105 vibrates to operate by electrostatic force.

Each of the electrostatic actuator 1100, the electrostatic micropump 1110, and the ink jet recording head 1120 includes a (110) single-crystal silicon substrate 1101*a* in which the diaphragms 1101 are formed and an electrode substrate 1102. Further, the electrostatic micropump 1110 and the ink jet recording head 1120 respectively include liquid chambers 1112 and ink chambers 1122 in which liquid and ink are pressurized, respectively, a common liquid chamber 1113 and a common ink chamber 1123, liquid channels 1114 and ink channels 1124 formed by anisotropic etching in the diaphragm substrate 1101*a*, and nozzle plates 1111*a* and 1121*a* of glass, metal, or silicon in which nozzle holes 1111 and 1121 and liquid supply path 1115 and liquid supply path 1125 are formed, respectively.

In the single-crystal silicon substrate that is the diaphragm substrate 1101*a*, the diaphragms 1101 driven by electrostatic force are formed so as to correspond to the liquid chambers 1112 or the ink chambers 1122 and the nozzle holes 1111 or 1121, and the common liquid chamber 1113 or the common ink chamber 1123 for supplying liquid or ink to the liquid chambers 1112 or the ink chambers 1122 are formed.

The liquid chambers 1112 and the ink chambers 1122 communicate with the common liquid chamber 1113 and the common ink chamber 1123 through the liquid channels 1114 and the ink channels 1124, respectively.

On the surfaces of the diaphragm substrate 1101*a* and the diaphragms 1101 and the liquid or ink-contacting surfaces of the liquid chambers 1112, the ink chambers 1122, the common liquid chamber 1113, the common ink chamber 1123, the liquid channels 1114, and the ink channels 1124, formed is the anti-corrosive thin film 1104$f_1$ of titanium nitride or the like having anti-corrosiveness against liquid or ink. Any anti-corrosive material may be used for the anti-corrosive thin film 1104$f_1$.

On a bottom surface of each diaphragm 1101, which surface is opposite to a surface on which the anti-corrosive thin film 1104$f_1$ is formed, the equal stress thin film 1104$f_2$ is formed.

That is, if the anti-corrosive thin film 1104$f_1$ has a compressive stress, the equal stress thin film 1104$f_2$ also has a compressive stress.

Contrary, if the anti-corrosive thin film 1104$f_1$ has a tensile stress, the equal stress thin film 1104$f_2$ also has a tensile stress.

According to this structure, the stress of the anti-corrosive thin film 1104$f_1$ is balanced and relieved by that of the equal stress thin film 1104$f_2$ formed on the other side of the diaphragms 1101, thereby relieving deflections of the diaphragms 1101.

Each of the anti-corrosive thin film 1104$f_1$ and the equal stress thin film 1104$f_2$ has a thickness of 10 to 5000 Å, preferably, 100 to 2000 Å, and may be any of a metal film and a film of a silicon compound such as silicon oxide or silicon nitride which films are formed by sputtering, CVD, or oxidation and has its stress controllable.

The anti-corrosive thin film 1104$f_1$ may be formed in layers to prevent the formation of pinholes resulting from minute defects. In this case, the equal stress thin film 1104$f_2$ formed under the diaphragms 1101 maintains a stress balance to relieve stress so that deflections of the diaphragms 1101 are relieved.

Further, the silicon diaphragms 1101 forming the liquid chambers 1112 or the ink chambers 1122 corresponding to the nozzle holes 1111 or 1121, with a silicon oxide film 1102*a* serving as a gap spacer, are arranged to oppose the electrodes 1103 to which the voltages are applied to drive the electrostatic actuator 1100 and the electrostatic micropump 1110 or the ink jet recording head 1120 including the electrostatic actuator 1100.

Arrow F of FIG. 90 indicates a direction in which liquid or ink is ejected, which direction is determined by an orientation with which each nozzle hole 1111 or 1121 is arranged.

The electrode substrate 1102 is an n- or p-type single-crystal silicon substrate. Normally, a (100) single-crystal silicon substrate is employed, but a (110) or (111) single-crystal silicon substrate may be employed depending on a process. A glass substrate may be employed instead of the silicon substrate.

The electrodes 1103 are arranged in concave parts 1102*b* formed in the silicon oxide film 1102*a* formed on the electrode substrate 1102 that is a single-crystal silicon substrate, and may be formed of any conductive material.

The electrodes 1103 are insulated from one another and formed of a refractory metal and its nitride or compound formed by reactive sputtering or CVD, such as titanium, tungsten, or tantalum. The electrodes 1103 may have a layer structure of the refractory metal and its nitride or compound. Preferably, the electrodes 1103 are formed of a titanium nitride or have a layer structure of titanium and titanium nitride formed in the order described on the silicon oxide film 1102*a*. The electrodes 1103 are formed in the gap spacer of the silicon oxide film 1102*a* formed by performing thermal oxidation on the electrode substrate 1102.

The gap spacer of the silicon oxide film 1102*a* is provided to form gaps 1106 between the diaphragms 1101 and the electrodes 1103. The electrostatic attractions are generated between the diaphragms 1101 and the electrodes 1103 by applying the voltages to the electrodes 1103 with the gap spacer of the silicon oxide film 1102*a* separating the electrodes 1103.

A pad part 1102*c* is a driving voltage application pad part that conducts electricity to the electrodes 1103. The pad part 1102*c* includes electrode pads 1103*a* for mounting an FPC or performing wire bonding. The driving voltages are applied from outside the electrode substrate 1102 to the electrode pads 1103.

The electrode substrate 1102 is a (100) p-type single-crystal silicon substrate having a resistivity of 10 to 30 Ω.cm.

The electrodes 1103 are arranged in the concave parts 1102*b* of 0.5 μm in deepness formed in the silicon oxide film 1102*a* of 2 μm in thickness formed on the electrode substrate 1102 by thermal oxidation, and are formed of titanium nitride of 150 nm in thickness formed successively by reactive sputtering on the silicon oxide film 1102*a*. The electrodes 1103 are insulated from one another.

Insulators 1103*b* of a silicon oxide film of 150 nm in thickness are formed by plasma CVD on the titanium nitride of the electrodes 1103 so as to secure insulation between diaphragms 1101 and the electrodes 1103.

The pad part 1102*c* of the electrode substrate 1102 is an area in which the insulators 1103*b* are removed by etching and the electrode pads 1103*a* of the electrodes 1103, to which the driving voltages for driving the electrostatic actuator 1100, the electrostatic micropump 1110, or the ink jet recording head 1120 are applied, are formed.

The diaphragm substrate 1101*a* is a (110) single-crystal silicon substrate in which the diaphragms 1101 of 2 μm in thickness including boron impurity atoms of 1E20/cm$^3$ or more are formed by anisotropic etching using KOH and arranged to oppose the electrodes 1103 with the silicon oxide film 1102*a* serving as the gap spacer.

Further in the diaphragm substrate 1101*a*, the liquid chambers 1112, the common liquid chamber 1113 for supplying liquid to the liquid chambers 1112, and the liquid channels 1114 connecting the liquid chambers 1112 and the common liquid chamber 1113 are formed by anisotropic etching in the case of the electrostatic micropump 1110, and the ink chambers 1122, the common ink chamber 1123 for supplying ink to the ink chambers 1122, and the ink channels 1124 connecting the ink chambers 1122 and the common ink chamber 1123 are formed by anisotropic etching in the case of the ink jet recording head 1120.

On the surfaces of the diaphragm substrate 1101*a*, the diaphragms 1101, the liquid chambers 1112, the ink chambers 1122, the common liquid chamber 1113, the common ink chamber 1123, the liquid channels 1114, and the ink channels 1124, the anti-corrosive thin film 1104$f_1$ of titanium nitride was formed by sputtering that provides good internal stress controllability and requires low production costs.

The anti-corrosive thin film 1104$f_1$ of titanium nitride had a film thickness of 500 Å on the diaphragms 1101 and a compressive stress of 5E08 dyne/cm$^2$.

Further, on the bottom surfaces of the diaphragms 1101, a silicon oxide film of 1000 Å in thickness and a compressive stress of 5E08 dyne/cm$^2$ was formed as the equal stress thin film 1104$f_2$.

At this point, it was confirmed by observing an amount of deflection using optical interference that the diaphragms 1101 were extremely controlled compared with a case in which the silicon oxide film was not formed as the equal stress thin film 1104$f_2$.

The nozzle plates lilla and 1121*a* are formed of glass plates, in which the liquid supply path 1115 for supplying the liquid and the ink supply path 1125 for supplying the ink and the nozzle holes 1111 and 1121 are formed by sand blasting, respectively. The nozzle plates 1111*a* and 1121*a* are attached over the liquid chambers 1112 and the ink chambers 1122, respectively.

In the above-described electrostatic actuator 1100, the electrostatic micropump 1110, or the ink jet recording head 1120, when the diaphragms 1101 were electrically grounded and voltages were applied to the electrodes 1103 via the electrode pads 1103*a*, the diaphragms 1101 vibrated and operated at a certain frequency.

When the voltages were applied to the electrodes 1103 via the electrode pads 1103*a*, electrostatic forces were exerted between the diaphragms 1101 and the electrodes 1103. Since the diaphragms 1101 were prevented from including deflections, the diaphragms 1101 were attracted sufficiently toward the electrodes 1103 by electrostatic attractions.

As a result, the liquid chambers 1112 or the ink chambers 1122 were sufficiently depressurized so that the liquid or ink was supplied from the common liquid chamber 1113 or the common ink chamber 1123 to the liquid chambers 1112 or the ink chambers 1122 via the liquid channels 1114 or the ink channels 1124.

The diaphragms 1101 returned to their original positions by stiffness of silicon in accordance with the frequency of the driving voltages. At this point, the liquid chambers 1112 or the ink chambers 1122 were pressurized so that liquid or ink droplets were stably ejected through the nozzle holes 1111 or 1121 in a direction indicated by arrow F in FIG. 90.

Further, the results of the measurement of differences in the ejection characteristic among bits in this state showed highly good uniformity in the ejection characteristic.

As a result of conducting a reliability test using liquid or ink droplets in this state, it was confirmed that the anti-corrosive thin film 1104$f_1$ had good anti-corrosiveness.

A description will now be given of a 14th embodiment of the present invention.

Figure 93:
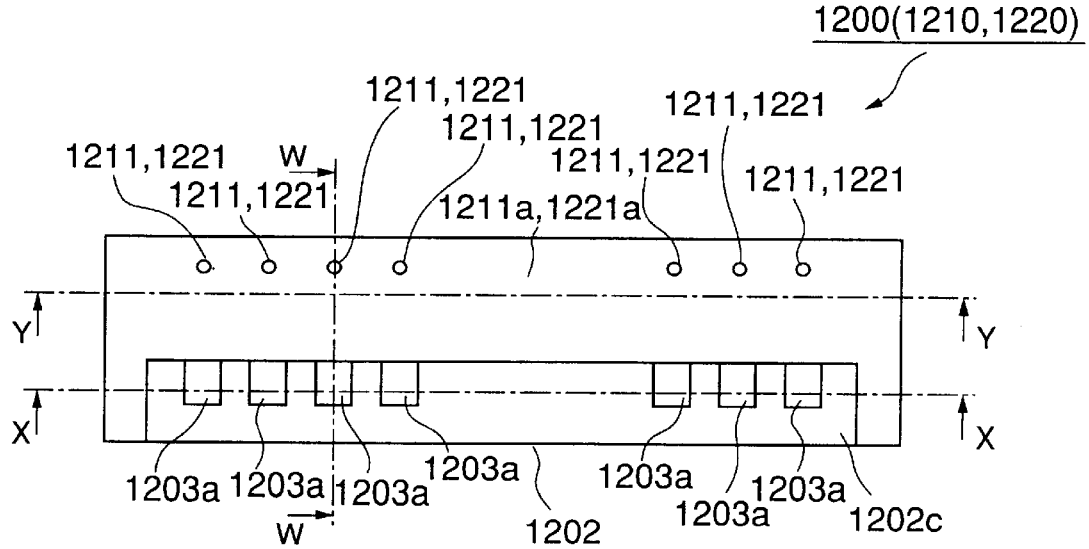
FIG. 93 is a plan view of an electrostatic actuator (an electrostatic micropump or an ink jet recording head including the electrostatic actuator) according to a 14th embodiment of the present invention.
Figure 94:
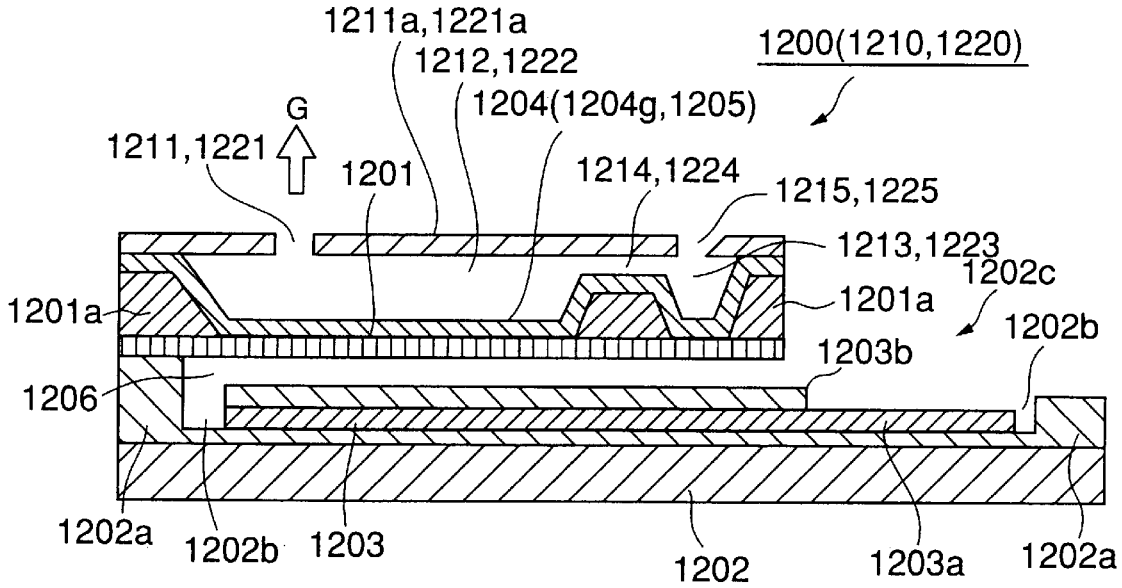
FIGS. 94 through 96 are sectional views of the electrostatic actuator (the electrostatic micropump or the ink jet recording head) of FIG. 93 taken along the lines W—W, X—X, and Y—Y, respectively.
Figure 95:
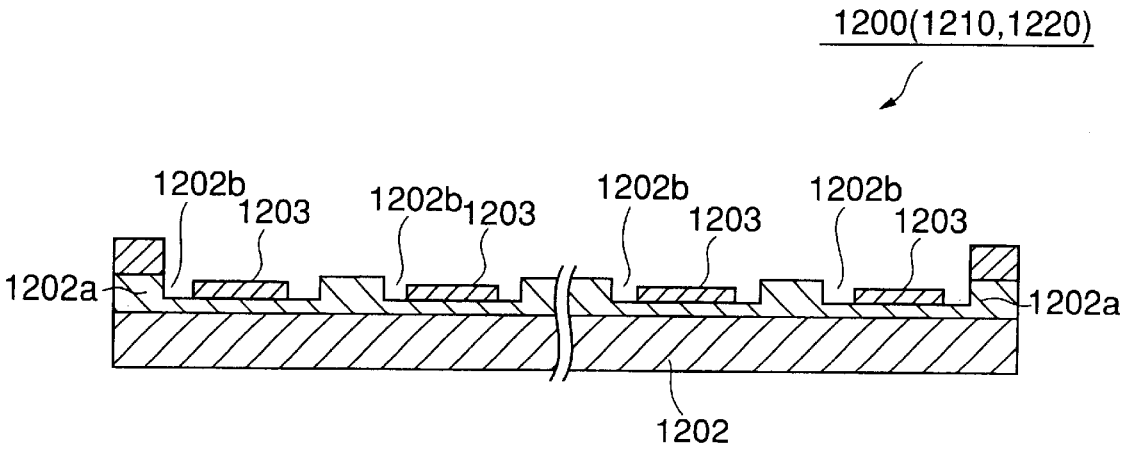
Figure 96:
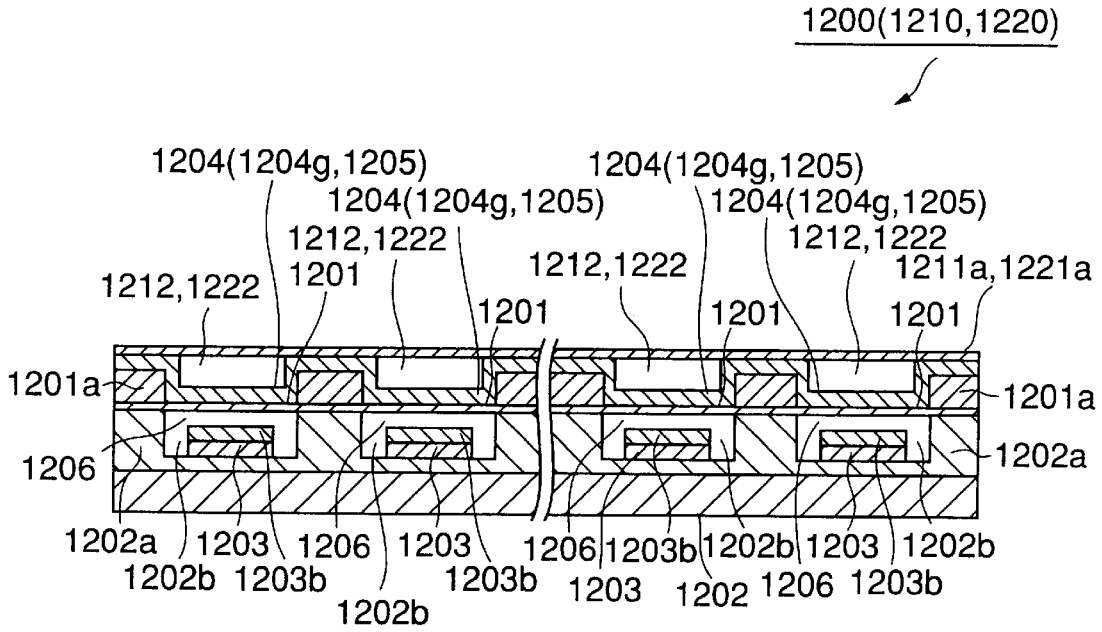

FIG. 93 is a plan view of an electrostatic actuator 1200 (an electrostatic micropump 1210 or an ink jet recording head 1220 including the electrostatic actuator 1200) according to the 14th embodiment of the present invention. FIGS. 94 through 96 are sectional views of the electrostatic actuator 1200 (the electrostatic micropump 1210 or the ink jet recording head 1220) of FIG. 93 taken along the lines W—W, X—X, and Y—Y, respectively. The electrostatic actuator 1200 includes an anti-corrosive thin film 1204 of a uniform thickness thin film 1204*g* serving as diaphragm deflection prevention means 1205. The uniform thickness thin film 1204*g*, which is another simple stress structure that is easily formable, has a wide setting range of stresses, a uniform film thickness distribution, and a tensile stress.

Each of the electrostatic actuator 1200, the electrostatic micropump 1210, and the ink jet recording head 1220 includes a (110) single-crystal silicon substrate 1201*a* in which the diaphragms 1201 are formed and an electrode substrate 1202. Further, the electrostatic micropump 1210 and the ink jet recording head 1220 respectively include liquid chambers 1212 and ink chambers 1222 in which liquid and ink are pressurized, respectively, a common liquid chamber 1213 and a common ink chamber 1223, liquid channels 1214 and ink channels 1224 formed by anisotropic etching in the diaphragm substrate 1201*a*, and nozzle plates 1211*a* and 1221*a* of glass, metal, or silicon in which nozzle holes 1211 and 1221 and liquid supply path 1215 and liquid supply path 1225 are formed, respectively.

In the single-crystal silicon substrate that is the diaphragm substrate 1201*a*, the diaphragms 1201 driven by electrostatic force are formed so as to correspond to the liquid chambers 1212 or the ink chambers 1222 and the nozzle holes 1211 or 1221, and the common liquid chamber 1213 or the common ink chamber 1223 for supplying liquid or ink to the liquid chambers 1212 or the ink chambers 1222 are formed.

The liquid chambers 1212 and the ink chambers 1222 communicate with the common liquid chamber 1213 and the common ink chamber 1223 through the liquid channels 1214 and the ink channels 1224, respectively.

On the surfaces of the diaphragm substrate 1201*a* and the diaphragms 1201 and the liquid or ink-contacting surfaces of the liquid chambers 1212, the ink chambers 1222, the common liquid chamber 1213, the common ink chamber 1223, the liquid channels 1214, and the ink channels 1224, formed is the uniform thickness thin film 1204*g* having anti-corrosiveness against liquid or ink. A film thickness distribution is uniform at least on the diaphragms 1201.

The uniform thickness thin film 1204*g* having a tensile stress and a uniform film thickness eliminates unevenness in a planar distribution of stress on the diaphragms 1201, thereby relaxing stress and relieving deflections of the diaphragms 1201.

The uniform thickness thin film 1204*g* forming the anti-corrosive thin film 1204 and serving as the diaphragm deflection prevention means 1205 vibrating to operate by electrostatic force is formed of a metal such as titanium nitride and has a thickness of 10 to 5000 Å, preferably, 100 to 2000 Å, and is formed by sputtering, CVD, or oxidation that well controls an internal stress. The uniform thickness thin film 1204*g* may be formed of any anti-corrosive material.

The uniform thickness thin film 1204*g* may be formed in layers to prevent the formation of pinholes resulting from minute defects.

Further, the silicon diaphragms 1201 forming the liquid chambers 1212 or the ink chambers 1222 corresponding to the nozzle holes 1211 or 1221, with a silicon oxide film 1202*a* serving as a gap spacer, are arranged to oppose the electrodes 1203 to which the voltages are applied to drive the electrostatic actuator 1200 and the electrostatic micropump 1210 or the ink jet recording head 1220 including the electrostatic actuator 1200.

Arrow G of FIG. 94 indicates a direction in which liquid or ink is ejected, which direction is determined by an orientation with which each nozzle hole 1211 or 1221 is arranged.

The electrode substrate 1202 is an n- or p-type single-crystal silicon substrate. Normally, a (100) single-crystal silicon substrate is employed, but a (110) or (111) single-crystal silicon substrate may be employed depending on a process. A glass substrate may be employed instead of the silicon substrate.

The electrodes 1203 are arranged in concave parts 1202*b* formed in the silicon oxide film 1202*a* formed on the electrode substrate 1202 that is a single-crystal silicon substrate, and may be formed of any conductive material.

The electrodes 1203 are insulated from one another and formed of a refractory metal and its nitride or compound formed by reactive sputtering or CVD, such as titanium, tungsten, or tantalum. The electrodes 1203 may have a layer structure of the refractory metal and its nitride or compound. Preferably, the electrodes 1203 are formed of a titanium nitride or have a layer structure of titanium and titanium nitride formed in the order described on the silicon oxide film 1202*a*. The electrodes 1203 are formed in the gap spacer of the silicon oxide film 1202*a* formed by performing thermal oxidation on the electrode substrate 1202.

The gap spacer of the silicon oxide film 1202*a* is provided to form gaps 1206 between the diaphragms 1201 and the electrodes 1203. The electrostatic attractions are generated between the diaphragms 1201 and the electrodes 1203 by applying the voltages to the electrodes 1203 with the gap spacer of the silicon oxide film 1202*a* separating the electrodes 1203.

A pad part 1202*c* is a driving voltage application pad part that conducts electricity to the electrodes 1203. The pad part 1202*c* includes electrode pads 1203*a* for mounting an FPC or performing wire bonding. The driving voltages are applied from outside the electrode substrate 1202 to the electrode pads 1203.

The electrode substrate 1202 is a (100) p-type single-crystal silicon substrate having a resistivity of 10 to 30 Ω.cm.

The electrodes 1203 are arranged in the concave parts 1202*b* of 0.5 μm in deepness formed in the silicon oxide film 1202*a* of 2 μm in thickness formed on the electrode substrate 1202 by thermal oxidation, and are formed of titanium nitride of 150 nm in thickness formed successively by reactive sputtering on the silicon oxide film 1202*a*. The electrodes 1203 are insulated from one another.

Insulators 1203*b* of a silicon oxide film of 150 nm in thickness are formed by plasma CVD on the titanium nitride of the electrodes 1203 so as to secure insulation between diaphragms 1201 and the electrodes 1203.

The pad part 1202*c* of the electrode substrate 1202 is an area in which the insulators 1203*b* are removed by etching and the electrode pads 1103*a* of the electrodes 1203, to which the driving voltages for driving the electrostatic actuator 1200, the electrostatic micropump 1210, or the ink jet recording head 1220 are applied, are formed.

The diaphragm substrate 1201*a* is a (110) single-crystal silicon substrate in which the diaphragms 1201 of 2 $\mu$m in thickness including boron impurity atoms of 1E20/cm$^3$ or more are formed by anisotropic etching using KOH and arranged to oppose the electrodes 1203 with the silicon oxide film 1202*a* serving as the gap spacer.

Further in the diaphragm substrate 1201*a*, the liquid chambers 1212, the common liquid chamber 1213 for supplying liquid to the liquid chambers 1212, and the liquid channels 1214 connecting the liquid chambers 1212 and the common liquid chamber 1213 are formed by anisotropic etching in the case of the electrostatic micropump 1210, and the ink chambers 1122, the common ink chamber 1123 for supplying ink to the ink chambers 1222, and the ink channels 1224 connecting the ink chambers 1222 and the common ink chamber 1223 are formed by anisotropic etching in the case of the ink jet recording head 1220.

On the surfaces of the diaphragm substrate 1201*a*, the diaphragms 1201, the liquid chambers 1212, the ink chambers 1222, the common liquid chamber 1213, the common ink chamber 1223, the liquid channels 1214, and the ink channels 1224, the uniform thickness thin film 1204*g* was formed of titanium nitride to have a thickness of 500 Å on the diaphragms 1201.

The uniform thickness thin film 1204*g* of titanium nitride had a tensile stress of 8E08 dyne/cm$^2$ and a uniform film thickness distribution on the diaphragms 1201.

At this point, it was confirmed by observing an amount of deflection using optical interference that the diaphragms 1201 had an extremely small amount of deflection.

On the other hand, a great amount of deflection was observed in the diaphragms 1201 when the titanium nitride film of the uniform thickness thin film 1204*g* did not have a uniform thickness distribution or when the titanium nitride film has a compressive stress.

The nozzle plates 1211*a* and 1221*a* are formed of glass plates, in which the liquid supply path 1215 for supplying the liquid and the ink supply path 1225 for supplying the ink and the nozzle holes 1211 and 1221 are formed by sand blasting, respectively. The nozzle plates 1211*a* and 1221*a* are attached over the liquid chambers 1212 and the ink chambers 1222, respectively.

In the above-described electrostatic actuator 1200, the electrostatic micropump 1210, or the ink jet recording head 1220, when the diaphragms 1201 were electrically grounded and voltages were applied to the electrodes 1203 via the electrode pads 1203*a*, the diaphragms 1201 vibrated and operated at a certain frequency.

When the voltages were applied to the electrodes 1203 via the electrode pads 1203*a*, electrostatic forces were exerted between the diaphragms 1201 and the electrodes 1203. Since the diaphragms 1201 were prevented from including deflections, the diaphragms 1201 were attracted sufficiently toward the electrodes 1203 by electrostatic attractions.

As a result, the liquid chambers 1212 or the ink chambers 1222 were sufficiently depressurized so that the liquid or ink was supplied from the common liquid chamber 1213 or the common ink chamber 1223 to the liquid chambers 1212 or the ink chambers 1222 via the liquid channels 1214 or the ink channels 1224.

The diaphragms 1201 returned to their original positions by stiffness of silicon in accordance with the frequency of the driving voltages. At this point, the liquid chambers 1212 or the ink chambers 1222 were pressurized so that liquid or ink droplets were stably ejected through the nozzle holes 1211 or 1221 in a direction indicated by arrow G in FIG. 94.

Further, the results of the measurement of differences in the ejection characteristic among bits in this state showed highly good uniformity in the ejection characteristic.

As a result of conducting a reliability test using liquid or ink droplets in this state, it was confirmed that the uniform thickness thin film 1204*g* had good anti-corrosiveness.

Figure 97:
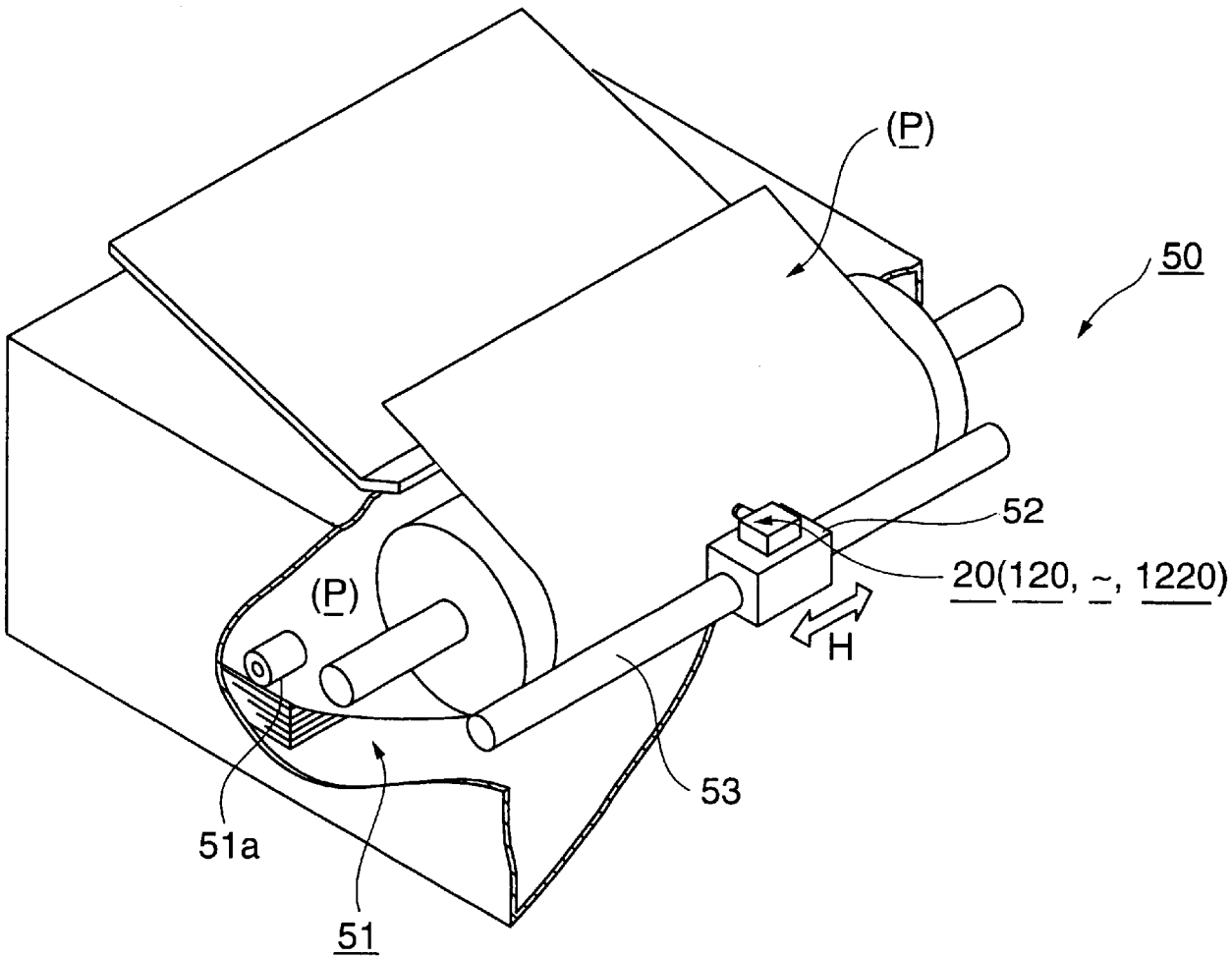
FIG. 97 is a perspective view of an ink jet recording apparatus according to a 15th embodiment of the present invention.

FIG. 97 is a perspective view of an ink jet recording apparatus 50 according to a 15th embodiment of the present invention. The ink jet recording apparatus includes a recording medium conveying part 51 for conveying a recording medium (P) that is a sheet of paper on which an ink image is recorded and the above-described ink jet recording head 20 for forming the ink image by ejecting ink on the recording medium (P). The ink jet recording head 20 may be replaced by any of the above-described ink jet recording heads 120, 220, 320, 420, 520, 620, 720, 820, 920, 1020, 1120, and 1220.

The ink jet recording head 20 is attached to a carriage 52. The carriage 52 is attached to a guide rail 53 so as to be movable in a direction of a width of the recording medium (P) which direction is indicated by arrow H in FIG. 97, so that the ink image is recorded on the recording medium (P).

Figure 98:
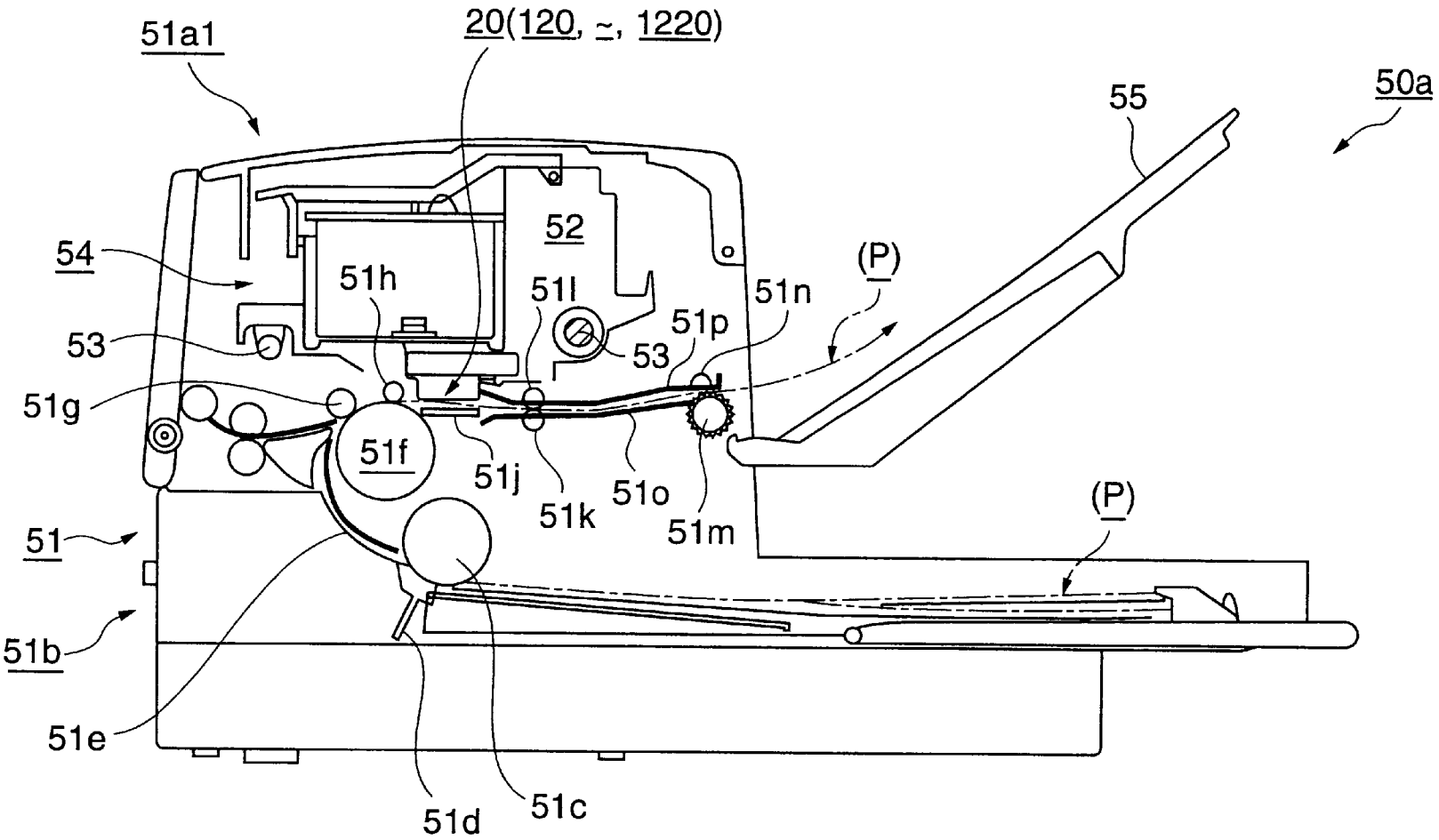
FIGS. 98 and 99 are a sectional view and a perspective view of an ink jet recording apparatus according to a 16th embodiment of the present invention.
Figure 99:
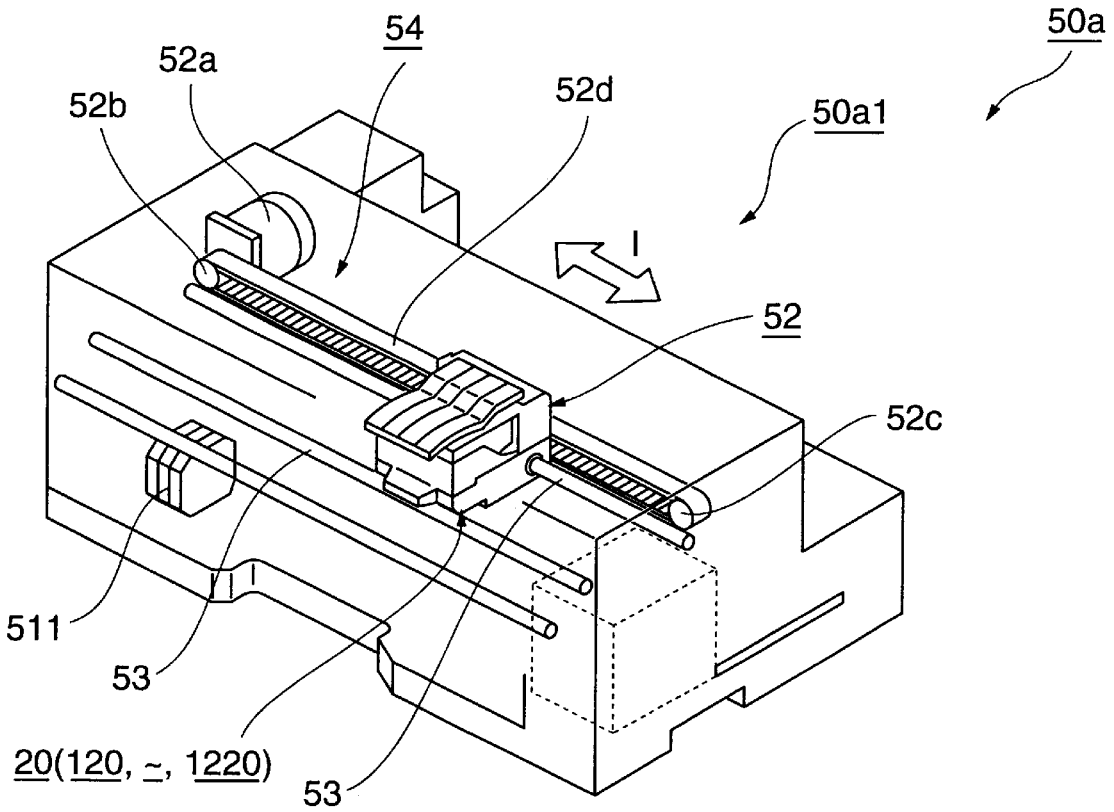

FIGS. 98 and 99 are a sectional view and a perspective view of an ink jet recording apparatus 50*a* according to a 16th embodiment of the present invention. The ink jet recording apparatus 50*a* includes the recording medium conveying part 51 for conveying the recording medium (P) that is a sheet of paper on which an ink image is recorded and the above-described ink jet recording head 20 for forming the ink image by ejecting ink on the recording medium (P). The ink jet recording head 20 may be replaced by any of the above-described ink jet recording heads 120, 220, 320, 420, 520, 620, 720, 820, 920, 1020, 1120, and 1220.

The ink jet recording apparatus 50*a* includes the carriage 52 that is movable in a primary (main) scanning direction indicated by arrow I in FIG. 99, the ink jet recording head 20 attached to the carriage 52, and a print mechanism part 54 including an ink cartridge for supplying ink in a main body 50$a_1$ of the ink jet recording apparatus 50*a*. The ink jet recording apparatus 50*a* also includes, under the main body 50$a_1$, a paper supply unit 51*b* that is a detachable paper supply cassette in which a plurality of recording media (P) that are recording papers can be stored from a front side of the ink jet recording apparatus 50*a*. The ink jet recording apparatus 50*a* further includes a manual feed tray for manually feeding the recording medium (P).

According to the ink jet recording apparatus 50*a*, the recording medium (P) is fed from the paper supply unit 51*b* to the print mechanism part 54 to have a desired ink image recorded thereon. Thereafter, the recording medium (P) is ejected on a paper ejection tray 55 attached to the backside of the ink jet recording apparatus 50*a*.

The print mechanism part 54 holds the carriage 52 slidably in the primary scanning direction by a main guide rod and a sub guide rod of the guide rail 53 that is a guide member provided between opposing side plates (not shown). The ink jet recording head 20 ejecting ink droplets of yellow (Y), cyan (C), magenta (M), and black (Bk) is attached to the carriage 52 so that ink droplet ejection orifices (not shown)

of the nozzle holes 21 are arranged in a direction to cross the primary scanning direction and the ink droplets are ejected in a downward direction of FIG. 98 (toward the recording medium (P)).

The carriage 52 has its backside engaging slidably with the main guide rod and its front side placed slidably on the sub guide rod.

The carriage 52 has a timing belt 52*d* fixed thereto. The timing belt 52*d* is provided between a drive pulley 52*b* rotated by a primary scanning motor 52*a* and an idle pulley 52*c*. The primary scanning motor 52*a* rotates in forward and reverse directions so that the carriage 52 repeats a scanning movement in the primary scanning direction.

In order to convey the recording medium (P) set in the paper supply unit 51*b* to a position below the ink jet recording head 20, the recording medium conveying part 51 includes a paper feed roller 51*c* and a friction pad 51*d* for extracting the recording medium (P) from the paper supply unit 51*b* and conveying the recording medium (P), a guide member 51*e* for guiding the recording medium (P), a conveying roller 51*f* for conveying the fed recording medium (P) upside down, a conveying roller 51*g* pressed against the conveying roller 51*f*, and a top roller 51*h* for determining an angle at which the recording medium (P) is fed from the conveying roller 51*f*.

The conveying roller 51*f* is rotated by a secondary (sub) scanning motor 51*i* via a gear train (not shown).

A print support member 51*j* that is a recording medium guide member is provided for guiding the recording medium (P) fed from the conveying roller 51*f* below the ink jet recording head 20 within the movement range of the carriage 52 in the primary scanning direction.

A conveying roller 51*k* and a spur 51*l* rotated for conveying the recording medium (P) in a paper ejection direction, a paper ejection roller 51*m* and a spur 51*n* for conveying the recording medium (P) to the paper ejection tray 55, and guide members 51*o* and 51*p* forming a paper ejection path are provided on the downstream side of the print support member 51*j* in a direction in which the recording medium (P) is conveyed.

In recording an ink image, with the carriage 52 moving, the ink jet recording head 20 is driven in accordance with an ink recording image signal as follows. The ink jet recording head 20 ejects ink droplets on the stationary recording medium (P) for one line. Then, after the recording medium (P) is conveyed by a given amount, the ink jet recording head 20 again ejects ink droplets for the next line. This operation is repeated for completing the ink image.

The ink jet recording head 20 stops this ink recording operation by receiving a signal informing the end of ink image recording or a signal notifying that the lower end of the recording medium (P) reaches a recording area. Thereafter, the recording medium (P) is ejected.

Thereby, realized are the ink jet recording apparatuses 50 and 50*a* each including the ink jet recording head 20 including the electrostatic actuator 0 having good anti-corrosiveness and an increased yield, producible at low costs, and preventing the diaphragms 1 on which the anti-corrosive thin film 4 is formed from buckling, deflecting, and malfunctioning. This allows the ink jet recording apparatuses 50 and 50*a* to realize high print quality with low power consumption.

Figure 100:
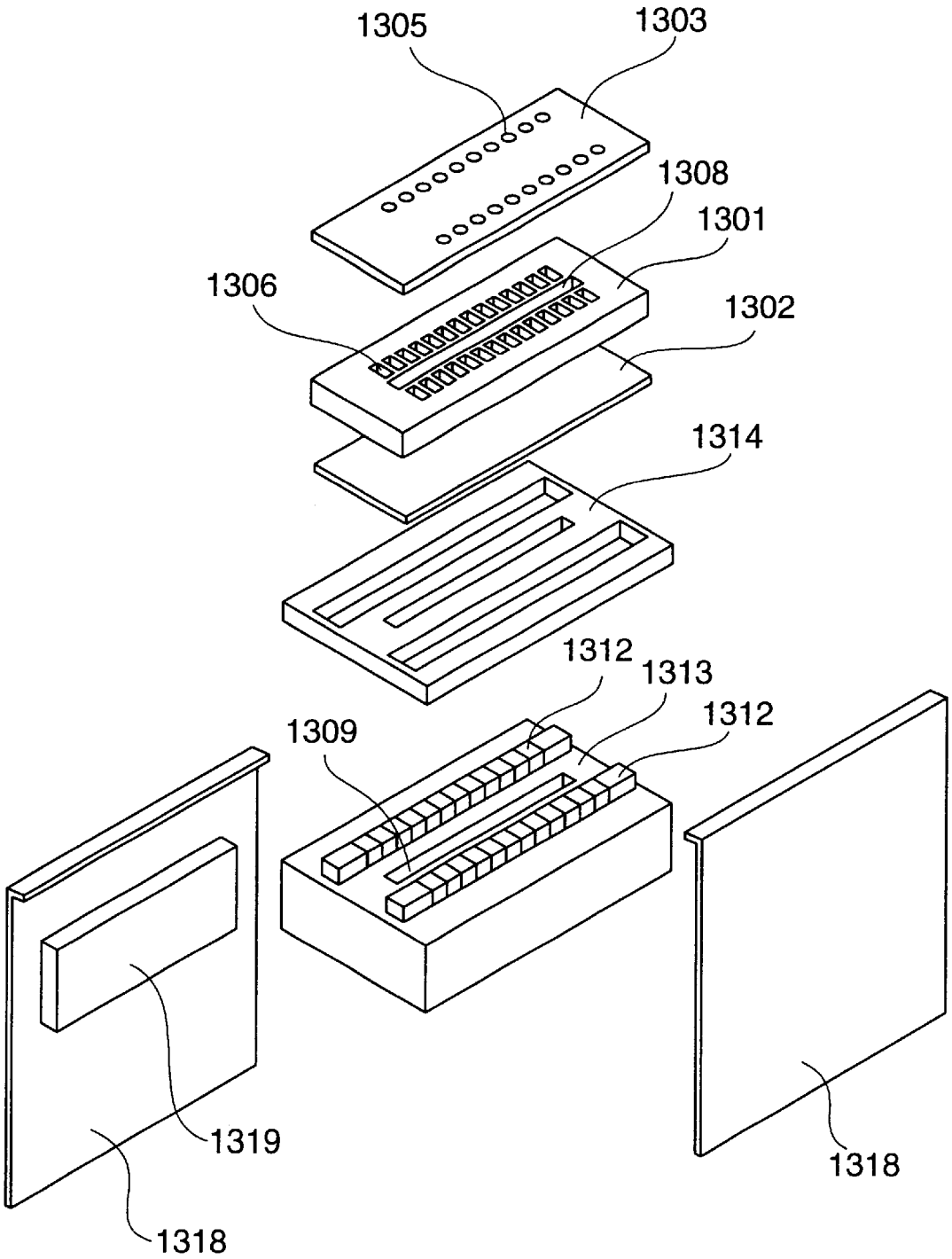
FIG. 100 is a perspective view of an ink jet head according to a 17th embodiment of the present invention.
Figure 101:
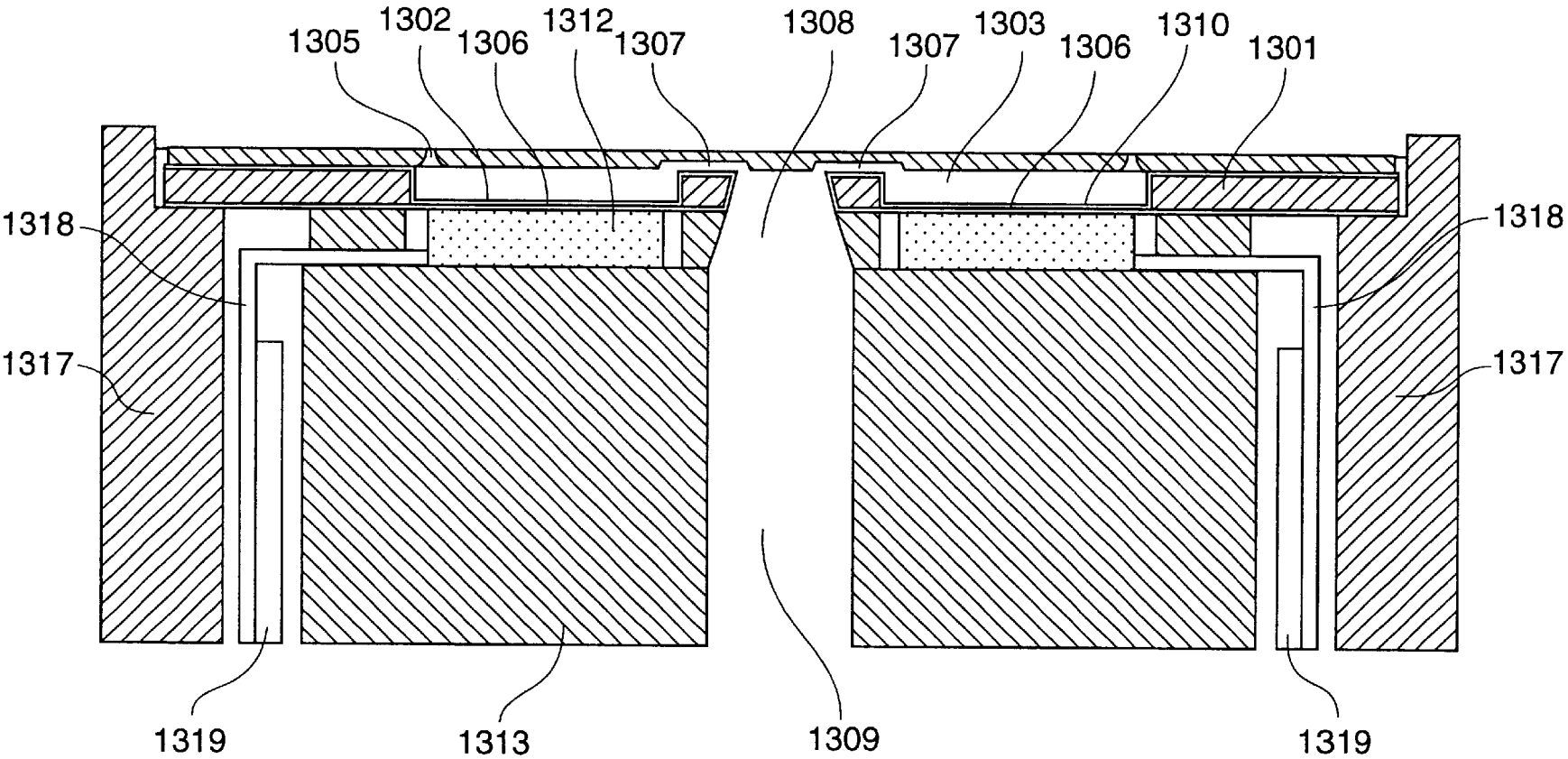
FIG. 101 is a cross sectional view of the ink jet head of FIG. 100 taken along a longitudinal side of a liquid pressure chamber of the ink jet head.
Figure 102:
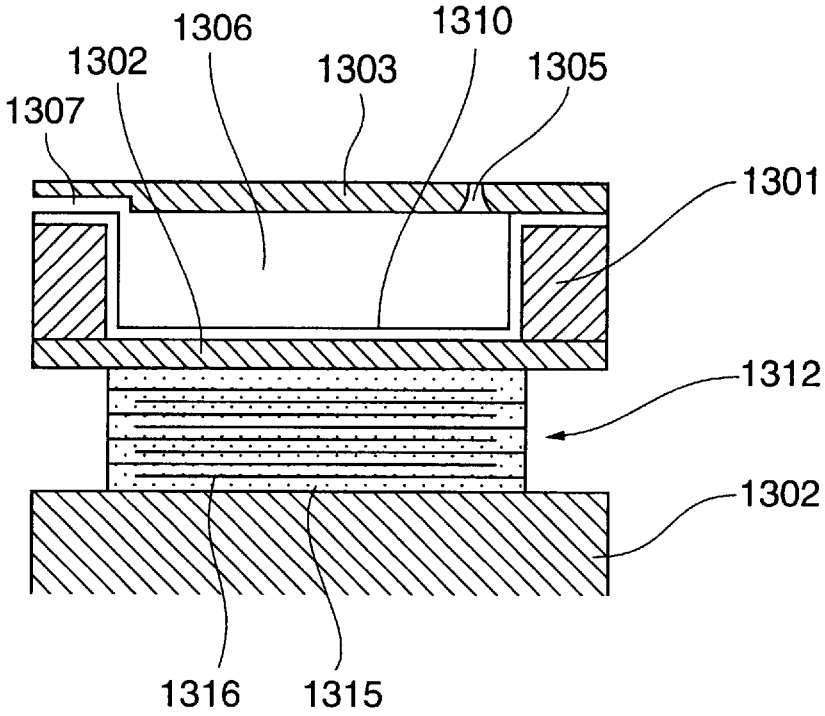
FIG. 102 is an enlarged sectional view of a principal part of the ink jet head of FIG. 100.
Figure 103:
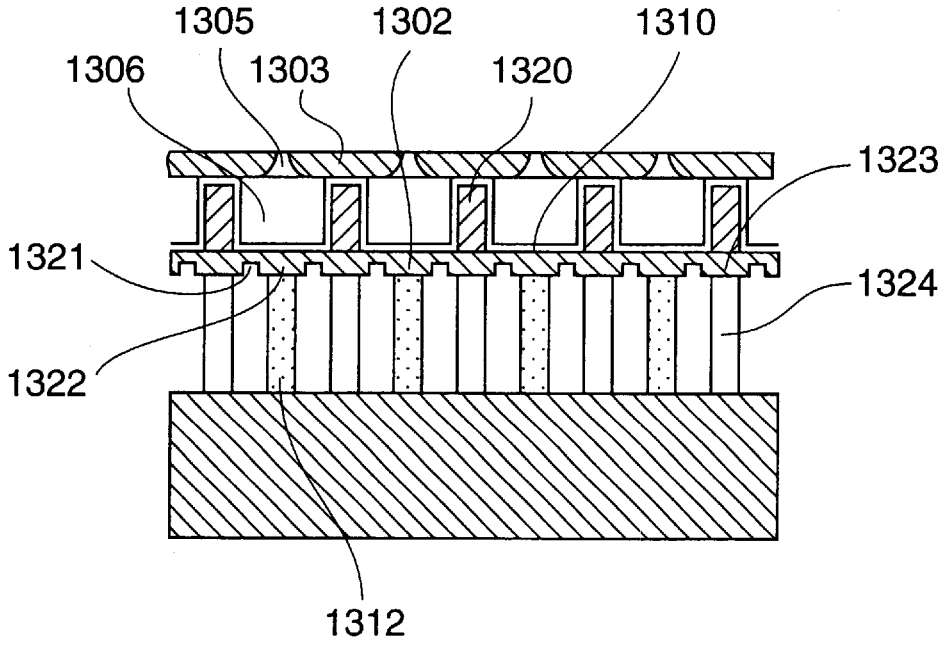
FIG. 103 is a sectional view of the ink jet head of FIG. 100 taken along a width of the liquid pressure chamber.
Figure 104:
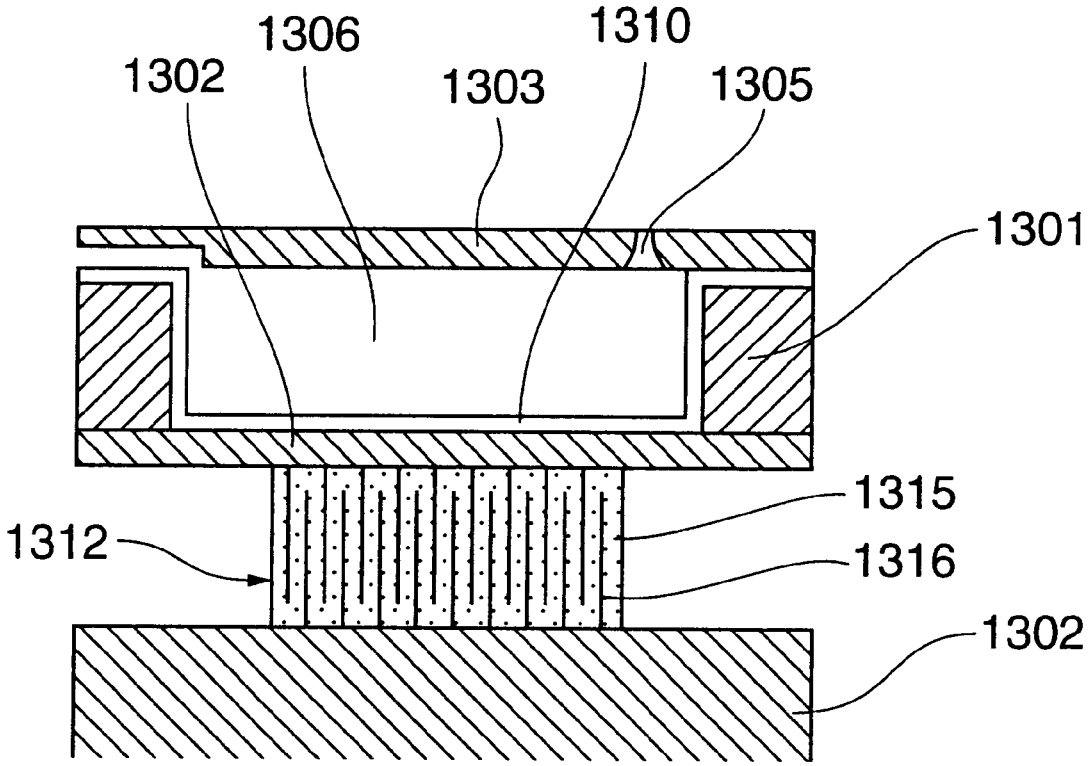
FIG. 104 is an enlarged sectional view of the principal part of the ink jet head for illustrating a variation of a piezoelectric element of the ink jet head.

Next, a description will be given of a 17th embodiment of the present invention. FIG. 100 is a perspective view of an ink jet head according to the 17th embodiment of the present invention and FIG. 101 is a cross sectional view of the ink jet head of FIG. 100 taken along a longitudinal side of a liquid pressure chamber 1306 of the ink jet head. FIG. 102 is an enlarged sectional view of a principal part of the ink jet head of FIG. 100. FIG. 103 is a sectional view of the ink jet head taken along a width or short side of each liquid pressure chamber 1306, that is, a direction substantially perpendicular to a direction in which each liquid pressure chamber 1306 extends. FIG. 104 is an enlarged sectional view of the principal part of the ink jet head for illustrating a variation of a piezoelectric element 1312 of the ink jet head.

The ink jet head includes a channel formation substrate (a channel formation member) 1301 formed of a single-crystal silicon substrate, a diaphragm 1302 joined to a lower surface of the channel formation substrate 1301, and a nozzle plate 1303 joined to an upper surface of the channel formation substrate 1301, thereby forming the liquid pressure chambers 1306 that are channels (ink chambers) communicating with nozzles 1305 ejecting ink and a common liquid chamber 1308 supplying ink via ink supply paths 1307 serving as fluid resistance parts to the liquid pressure chambers 1306. A liquid-resistant thin film 1310 is formed of an organic resin film on the wall faces of the liquid pressure chambers 1306, the ink supply paths 1307, and the common liquid chamber 1308 which wall faces form the ink-contacting surface of the channel formation substrate 1301.

The multilayer piezoelectric elements 1312 are joined to the lower (external) surface of the diaphragm 1302, which surface is opposite to an (upper) surface forming the wall faces of the liquid pressure chambers 1306, in positions corresponding to the liquid pressure chambers 1306. The piezoelectric elements 1312 are fixedly joined to a base plate 1313, and a spacer member 1314 is joined to the base plate 1313 so as to surround the arrays of the piezoelectric elements 1312.

Each piezoelectric element 1312, as shown in FIG. 102, is formed by alternately stacking piezoelectric materials 1315 and internal electrodes 1316 in layers. Here, as shown in FIG. 102, the ink is pressurized in the liquid pressure chambers 1306 by employing a displacement in a d33 direction (a displacement in a direction perpendicular to a layer direction in which the piezoelectric materials 1315 and the internal electrodes 1316 are stacked in layers) as a piezoelectric direction of each piezoelectric element 1312. The ink, as shown in FIG. 104, may be pressurized in the liquid pressure chambers 1306 by employing a displacement in a d31 direction (a displacement in a direction perpendicular to a direction in which the piezoelectric materials 1315 and the internal electrodes 1316 are stacked in layers) as a piezoelectric direction of each piezoelectric element 1312. A through hole forming an ink supply hole 1309 for supplying the ink from outside to the common liquid chamber 1308 is formed in each of the base plate 1313 and the spacer member 1314.

The peripheral part of the channel formation substrate 1301 and the peripheral edge part of the lower surface of the diaphragm 1302 are bonded to head frames 1317 formed of an epoxy resin or polyphenylene sulfide by injection molding. The head frames 1317 and the base plate 13 have respective parts (not shown) bonded to each other by an adhesive agent. Further, FPC cables 1318 for supplying driving signals to the piezoelectric elements 1312 are joined thereto by soldering, ACF (anisotropic conductive film) bonding, or wire bonding, and a driving circuit (a driver IC) 1319 for supplying a selected one of the piezoelectric elements 1312 with a driving waveform is mounted on each FPC cable 1318.

Here, the channel formation substrate 1301 is formed of the (110) single-crystal silicon substrate in which through holes for the liquid pressure chambers 1306, grooves for ink supply paths 1307, and a through hole for the common liquid chamber 1308 are formed by anisotropic etching using an alkaline etchant such as an aqueous solution of hydrated potassium (KOH). In this case, the liquid pressure chambers 1306 are partitioned by partition walls (liquid chamber partitioning walls) 1320.

The diaphragm 1302 is formed of a nickel metal plate by electroforming. The diaphragm 1302 has thin wall parts 1321 for allowing easy deformation of the diaphragm 1302 and thick wall parts 1322 for joining the diaphragm 1302 to the piezoelectric elements 1312 formed therein in positions corresponding to the liquid pressure chambers 1306. Further, the diaphragm 1302 has thick wall parts 1323 formed therein in positions corresponding to the partition walls 1320. The diaphragm 1302 has its upper (flat) surface bonded by an adhesive agent to the channel formation substrate 1301 and the thick wall parts 1323 bonded by an adhesive agent to the head frames 1317. Pillar parts 1324 are provided between the thick wall parts 1323 of the diaphragm 1302 and the base plate 1313. The pillar parts 1324 have the same structure as the piezoelectric elements 1312.

The nozzle plate 1303 has the nozzles 1305 of 10 to 30 $\mu$m formed therein in positions corresponding to the liquid pressure chambers 1306, and is bonded to the channel formation substrate 1301 by an adhesive agent. As the nozzle plate 1303, a metal such as stainless steel or nickel, a combination of a metal and a resin such as a polyimide film, silicon, and combinations thereof may be employed. Further, in order to secure water repellency with respect to the ink, the nozzle plate 1303 has a water repellent film formed by a known method such as plating or water-repellent coating on a nozzle (ejection) surface (a surface in a direction of ejection) of the nozzle plate 1303.

In this ink jet head, as previously described, the liquid-resistant (meaning ink-resistant and anti-corrosive in this embodiment) film 1310 of the organic resin film is formed on the ink-contacting surfaces of the common liquid chamber 1308, the ink supply paths (fluid resistance parts) 1307, and the liquid pressure chambers 1306 forming liquid channels. As the organic resin film of the liquid-resistant thin film 1310, a polyimide film, a urethane-based resin film, a urea-based resin film, or a phenol-based resin film may be employed.

Some of polyimide films include polyimide and others include polybenzoxazole as a main ingredient. Both types of polyimide films (1) have good resistance to chemicals, strong acid and weak alkaline materials, and ultraviolet light and also has good weatherability, (2) are highly heat-resistant. Normally, the above-described types of polyimide films have resistance to heat of up to approximately 200° C., but some have resistance to heat of as high as approximately 350° C., (3) are easy to treat. An amide material (oligomers) is formed by one liquid heating radical reaction into a polymer (macromolecule) material of polyimide, and (4) can be formed into thin films with high quality. That is, oligomers are polymerized into polymers by heat. Since the above-described types of polyimide films are of no-solvent type, the polyimide films have their materials all remaining to have good thin film quality and a low occurrence rate of pinholes.

Specifically, the polyimide films including polyimide as a main ingredient include UPICOAT and U-Varnish (product names) of UBE INDUSTRIES, LTD., and PHOTONEECE (product name) of TORAY, and the polyimide films including polybenzoxazole as a main ingredient include the products of SUMIRESIN EXCEL CRC-8000 (product name) series of SUMITOMO BAKELITE CO., LTD. Particularly, the products of SUMIRESIN EXCEL CRC-8000 series are preferable.

Urethane-based resin films are of an emulsion type and employ water or organic cellosolve as a solvent. The urethane-based resin films are eco-friendly, have good operability, and are soft and flexible as films. The urethane-based resin films basically have resistance to heat of up to 120° C. The urethane-based resin films are formed as hard-coat films which, it has been confirmed, can undergo ink reliability evaluation. Specifically, the urethane-based resin films include TAKERAKKU W-6010, W-6020, W-635, and WS-5000 (product names) of TAKEDA CHEMICAL INDUSTRIES, LTD. Particularly, TAKERACK W-6010 and WS-5000 are preferably.

Phenol-based resin films each include a condensation-type resin of phenols and aldehydes and have good resistance to heat and chemicals and good weatherability. The phenol-based resin films are very hard and can be formed by coating of liquid varnish.

Further, a fluorine-based resin film may be employed besides the above-described resin films. In the case of the fluorine-based resin film, it is also possible to fill a liquid chamber with ink of high permeability without air bubbles. However, since the urethane-based resin film has water repellency, it is necessary to provide the urethane-based resin film with hydrophilicity. Further, an electrocoated resin film may also be employed. The electrocoated resin film is commonly used in the field of the automotive industry and the application of the electrocoated resin film on electronic devices by fine coating is now discussed. The electrocoated resin film is controlled to have a desired thickness in a desired part and is formed into a hard coat by performing heat aging at a temperature in a range of 80 to 120° C. Results have been gotten with cation-type alkyd resins and the like.

Of these organic resin films, the polyimide films are the most preferable for their characters described above and reasons described later. As the polyimide films, those including polyimide or polybenzoxazole as a main ingredient are preferable.

Here, the wall faces (ink-contacting surfaces) of the through holes formed in the channel formation substrate 1301 which through holes form the liquid pressure chambers 1306 are completely coated with the liquid-resistant thin film 1310. In this case, as will be later described, the partition walls 1320 (including their outer wall parts) partitioning or separating the liquid pressure chambers 1306 to which the nozzle plate 1303 is joined are preferably formed so that their sidewall faces (faces serving as the sidewall faces of the liquid pressure chambers 1306) are completely coated with the liquid-resistant thin film 1310. More preferably, each partition wall 1320 has its upper end part formed to have at least two chamfered parts or a certain curvature, or has its sidewall faces slanted with respect to the diaphragm 1302.

Here, the liquid-resistant thin film 1310 is formed on all the surface of the channel formation substrate 1301, but it is sufficient if the channel formation substrate 1301 has its parts where silicon is exposed coated with the liquid-resistant thin film 1310. That is, if the diaphragm 1302 is formed of a metal plate of nickel as in this embodiment, the liquid-resistant thin film 10 is not necessarily formed on the surface of the diaphragm 1302 forming the wall faces of the liquid pressure chambers 1306 and the upper end surfaces of the partition walls 1320 which surfaces are joined to the nozzle plate 1303.

According to the ink jet head of this structure, a driving pulse voltage in a range of 20 to 50 V is applied to selected ones of the piezoelectric elements 1312 so that the selected piezoelectric elements 1312 to which the driving pulse voltage is applied move in the layer direction of FIG. 102 to deform the diaphragm 1302 in the direction of the nozzles 1305. Thereby, the ink in the liquid pressure chambers 1306 is pressurized by changes in the capacities or volumes of the liquid pressure chambers 1306, thus ejecting ink droplets from the nozzles 1305.

With the ink droplets being ejected, liquid pressures in the liquid pressure chambers 1306 decrease. At this point, negative pressures are generated to some extent in the liquid pressure chambers 1306 by the inertia of the ink flow. By stopping applying the voltage to the piezoelectric elements 1312 under these conditions, the diaphragm 1302 returns to its original position so that the liquid pressure chambers 1306 return to their original shapes, thereby generating further negative pressures. At this point, the ink is supplied from the ink supply hole 1309 through the common liquid chamber 1308 and the ink supply paths 1307 to fill the liquid pressure chambers 1306. Then, after vibrations of the ink meniscus surfaces of the nozzles 5 attenuate to be stabled, a pulse voltage is applied to the piezoelectric elements 1312 for ejecting another ink droplets.

It has been confirmed that since the ink jet head of this embodiment has the ink-contacting surface of the channel formation substrate 1301 coated with the liquid-resistant thin film 1310 of the organic resin, silicon that is the channel formation material is prevented from dissolving in the ink, causing no nozzle clogging. Thus, the long operation stability and reliability of the ink jet head is achieved.

Figure 105:
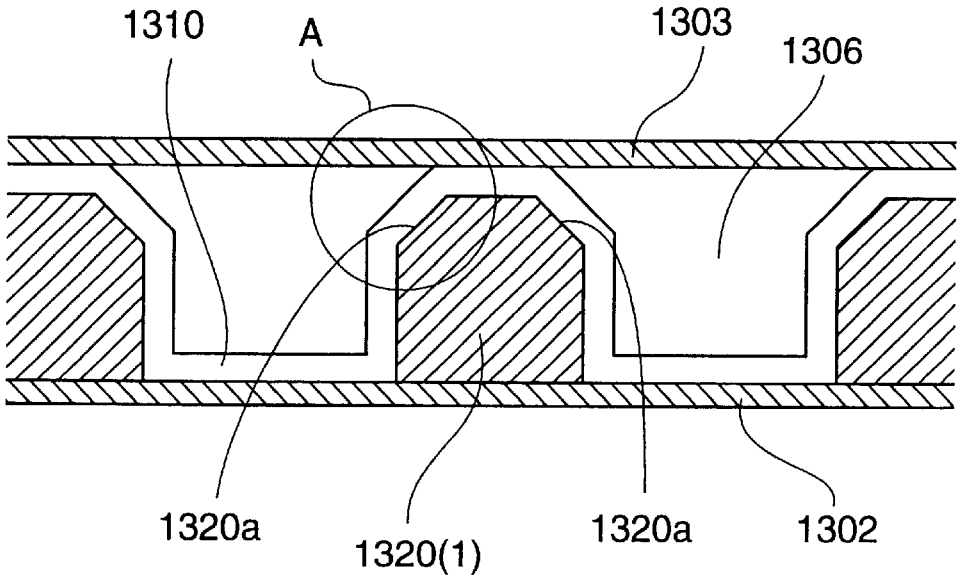
FIG. 105 is a sectional view of the ink jet head taken along the width of the liquid pressure chamber for illustrating a shape of a partition wall between the liquid pressure chambers.
Figure 106:
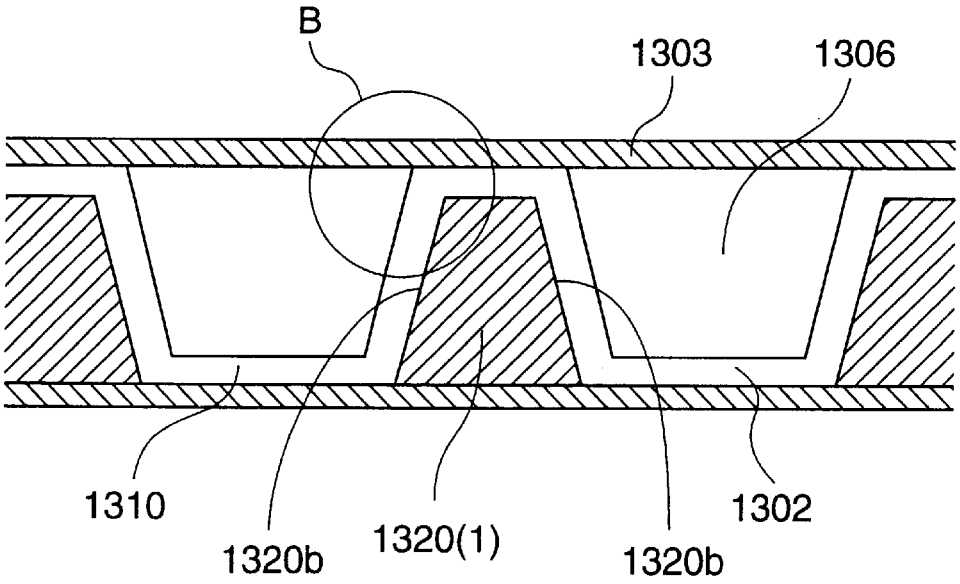
FIG. 106 is a sectional view of the ink jet head taken along the width of the liquid pressure chamber for illustrating another shape of a partition wall between the liquid pressure chambers.

Next, a description will be given, with reference to FIGS. 105 and 106, of variations (different shapes) of the partition wall 20 having the upper end parts of its sidewall faces, which are the upper end parts of the sidewall faces of the corresponding liquid pressure chambers 1306, coated completely with the liquid-resistant thin film 1310. FIGS. 105 and 106 are sectional views of the ink jet head taken along the direction substantially perpendicular to the direction in which each liquid chamber 1306 extends.

In a first variation shown in FIG. 105, the partition wall 1320 has chamfered parts 1320*a* formed therein so that the cross section of the partition wall 1320 has at least four angles or two slopes in the upper end part of the cross section. In other words, the entire cross section has a polygonal shape with at least six angles. The surface of the partition wall 1320 is coated with the liquid-resistant thin film 1310, and the nozzle plate 1303 in which the nozzles 1305 are formed is joined on the partition wall 1320.

By thus chamfering the upper end part of each partition wall 1320, the liquid-resistant thin film 1310 is formed to provide very good coverage on the upper end part of each liquid pressure chamber 1306, which part is indicated by circle A, so that silicon forming the partition walls 1320 is prevented from being exposed in the upper end part indicated by circle A. In a conventional structure, silicon forming partition walls between liquid pressure chambers is exposed in a part corresponding to this upper end part indicated by circle A because of shortage of coverage by an anti-corrosive thin film, so that corrosion occurs in the part. Corrosion of the partition walls 1320 can be prevented by such complete coverage provided by the liquid-resistant thin film 1310.

In a second variation shown in FIG. 106, the partition wall 1320 between the liquid pressure chambers 1306 is formed so that the sidewall faces 20*b* of the partition wall 1320 are slanted with respect to the diaphragm 1302. That is, the partition wall 1320 is formed to have a cross section of a trapezoidal shape. The overall surface of the partition wall 1320 is coated with the liquid-resistant thin film 1310, and the nozzle plate 1303 in which the nozzles 1305 are formed is joined on the partition wall 1320.

By thus forming each partition wall 1320 so that the sidewall faces 20*b* thereof are slanted with respect to the diaphragm 1302, the liquid-resistant thin film 1310 is formed to provide very good coverage on the upper end part of each liquid pressure chamber 1306, which part is indicated by circle B in FIG. 106, so that silicon forming the partition walls 1320 is prevented from being exposed in the upper end part indicated by circle B. In a conventional structure, silicon forming partition walls between liquid pressure chambers is exposed in a part corresponding to this upper end part indicated by circle B because of shortage of coverage by an anti-corrosive thin film, so that corrosion occurs in the part. Corrosion of the partition walls 1320 can be prevented by such complete coverage provided by the liquid-resistant thin film 1310.

Further, the partition wall 1320 between the liquid pressure chambers 1306 may be formed to have its upper face smoothly rounded at a certain curvature so that the cross section of the partition wall 1320 has a smoothly rounded upper side. The overall surface of the partition wall 1320 is coated with the liquid-resistant thin film 1310, and the nozzle plate 1303 in which the nozzles 1305 are formed is joined on the partition wall 1320.

By thus forming each partition wall 1320, the liquid-resistant thin film 1310 is formed to provide very good coverage on the upper end part of each liquid pressure chamber 1306, which part corresponds to the part indicated by circle A in FIG. 105 or by circle B in FIG. 106, so that silicon forming the partition walls 1320 is prevented from being exposed in the upper end part. Corrosion of the partition walls 1320 can be prevented by such complete coverage provided by the liquid-resistant thin film 1310.

Next, a description will be given, with reference to FIGS. 107A through 108E, of steps of producing a channel formation member that is the channel formation substrate 1301. FIGS. 107A through 107E are sectional views of the channel formation member, and FIGS. 108A through 108E are cross sectional views of the channel formation member of FIGS. 107A through 108E, respectively.

Figure 107A:
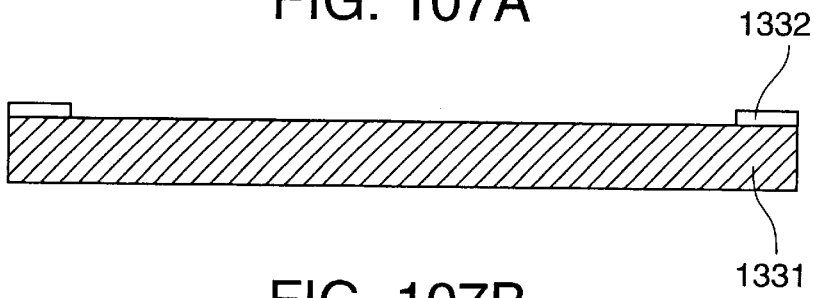
FIGS. 107A through 107E are diagrams for illustrating a production process of a channel formation member of the ink jet head.
Figure 108A:
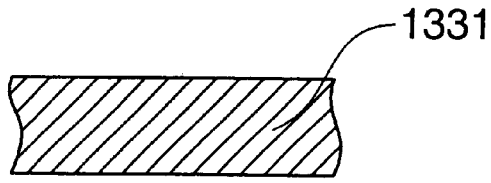
FIGS. 108A through 108E are cross sectional views of the channel formation member of FIGS. 107A through 107E, respectively.

(a) First, as shown in FIGS. 107A and 108A, an etching mask pattern 1332 of single-crystal silicon such as silicon oxide, silicon nitride, or tantalum pentaoxide is formed using a (111) p- or n-type single-crystal silicon substrate 31. The etching mask pattern 1332 defines the liquid pressure chambers 1306, the ink supply paths 1307, and the common liquid chamber 1308.

Figure 107B:
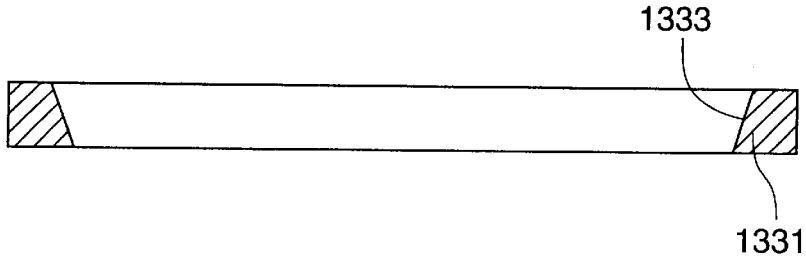
Figure 108B:
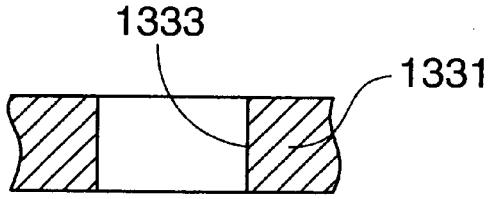

(b) As shown in FIGS. 107B and 108B, through holes 1333 for forming the liquid pressure chambers 1306 are formed, by anisotropic etching using KOH or TMAH, in the silicon substrate 1331 from a side thereof on which side the etching mask pattern 1332 is formed.

Figure 107C:
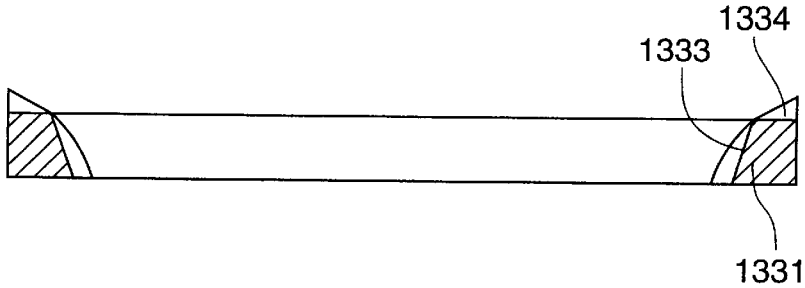
Figure 108C:
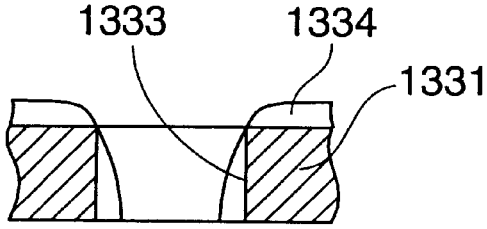

(c) As shown in FIGS. 107C and 108C, a resist 1334 is applied on the entire surface of the silicon substrate 1331, and etch back is performed on the entire surface.

Figure 107D:
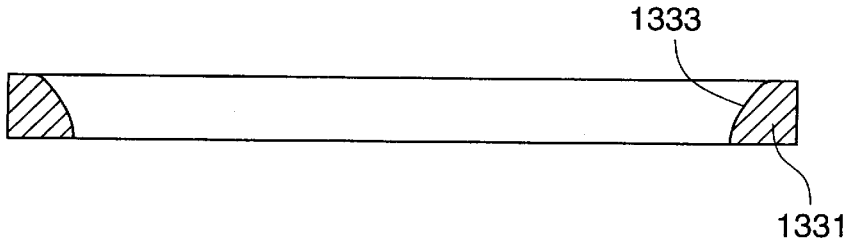
Figure 108D:
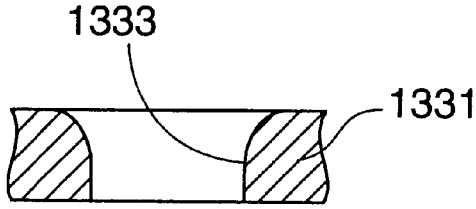

(d) As shown in FIGS. 107D and 108D, by performing etch back, in the upper end parts of the sidewalls of the through holes 1333, which sidewalls serve as the sidewalls of the liquid pressure chambers 1306, silicon under the resist 1334 is etched so that the corner of each upper end part is chamfered to have a chamfered surface rounded at a certain curvature or curved angularly with a plurality of angles. The residual resist 34 is all removed so that the silicon substrate 31 in which parts between the through holes 1333 which parts serve as the partition walls 1320 have their upper corners chamfered is completed.

Figure 107E:
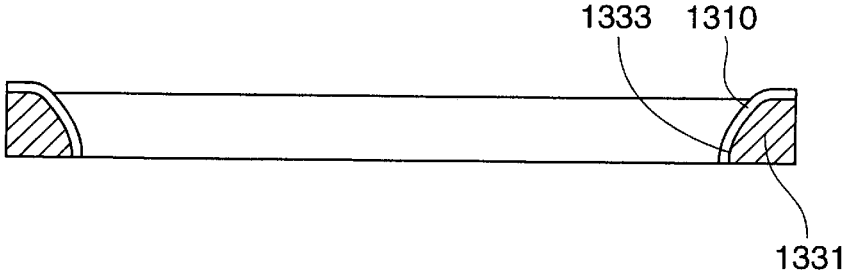
Figure 108E:
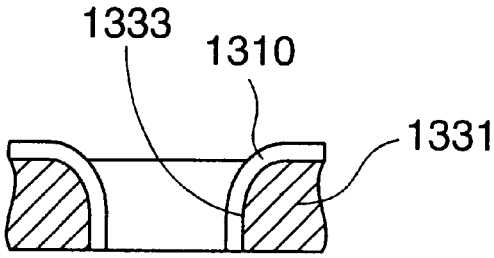

(e) As shown in FIGS. 107E and 108E, an organic resin film that serves as the liquid-resistant thin film 1310 is formed on the entire surface of the silicon substrate 1331 by spray coating. At this point, all the surfaces including the wall faces of the through holes 1333 are coated with the liquid-resistant thin film 1310 so that no part of the silicon substrate 1331 is exposed.

Thus, the liquid-resistant thin film 1310 having resistance to ink (liquid) is formed on the entire ink or liquid-contacting surface of the channel formation member made of silicon. Then, a liquid chamber unit is formed by joining to the silicon substrate 31 that is the channel formation member the nozzle plate 1301 in which the nozzles 1305 for ejecting ink droplets are formed and the diaphragm 1302 to which the piezoelectric elements 1312 are joined.

Figure 109:
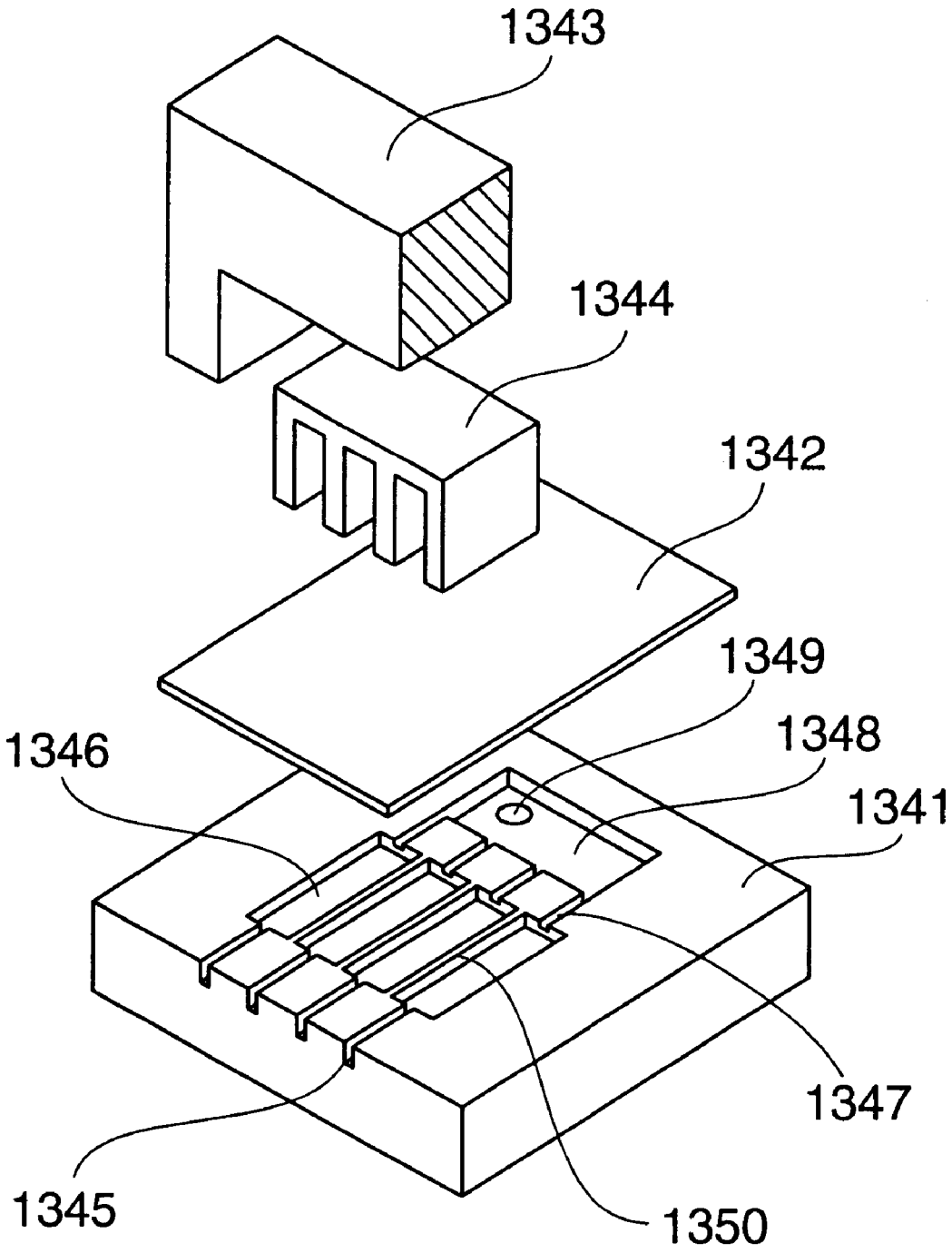
FIG. 109 is an exploded perspective view of an ink jet head according to an 18th embodiment of the present invention.
Figure 110:
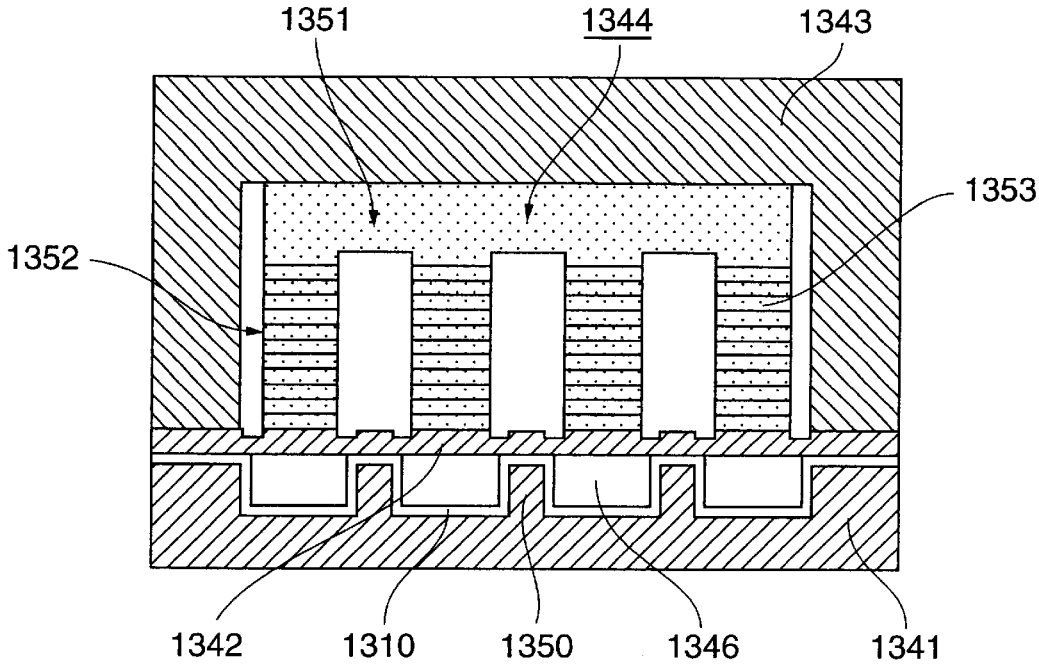
FIG. 110 is a sectional view of the ink jet head of FIG. 109 taken along a width of a liquid pressure chamber of the ink jet head.

Next, a description will be given of an 18th embodiment of the present invention. FIG. 109 is an exploded perspective view of an ink jet head according to the 18th embodiment of the present invention, and FIG. 110 is a sectional view of the ink jet head of FIG. 109 taken along a width or short side of each liquid pressure chamber 1346, that is, a direction substantially perpendicular to a direction in which each liquid pressure chamber 1346 extends.

The ink jet head of this embodiment has a diaphragm 1342 formed on a channel formation member 1341 corresponding to the channel formation substrate 1301 and the nozzle plate 1303 of the ink jet head of the 17th embodiment. The diaphragm 1342 is joined to a piezoelectric member 1344 supported by a support member 1343.

The channel formation member 1342 is formed of a silicon substrate. In the channel formation member 1342, grooves for forming nozzles 1345 for ejecting ink droplets, concave parts for forming the liquid pressure chambers 1346 communicating with the nozzles 1345, grooves for forming ink supply paths 1347 serving as fluid resistance parts, a concave part for forming a common liquid chamber 1348, and an ink supply hole 1349 communicating with the common liquid chamber 1348 are formed by anisotropic etching. The liquid-resistant organic resin thin film 1310 (not shown in FIG. 109) is formed on the wall faces of the nozzles 1345, the liquid pressure chambers 1346, the ink supply paths 1347, and the common liquid chamber 1348 which wall faces are the ink-contacting surface of the channel formation member 1341 which surface contacts ink.

The piezoelectric member 44 includes a non-driven part 1344 formed by stacking only green sheets formed of a piezoelectric material in layers and a driven part 1352 formed on the non-driven part 1344 by alternately stacking green sheets and internal electrodes in layers. By forming grooves in the driven part 1352 up to the non-driven part 1344 without processing the non-driven part 1344, a plurality of piezoelectric elements 1353 are formed in positions corresponding to the liquid pressure chambers 1346 in the driven part 1352. The tip parts of the piezoelectric elements 1353 are joined to the diaphragm 1342.

According to the ink jet head of this structure, a driving pulse voltage in a range of 20 to 50 V is applied to selected ones of the piezoelectric elements 1353 so that the selected piezoelectric elements 1353 to which the driving pulse voltage is applied move in a layer direction, that is a downward direction of FIG. 110, to deform the diaphragm 1342. Thereby, the ink in the liquid pressure chambers 1346 is pressurized by changes in the capacities or volumes of the liquid pressure chambers 1346, thus ejecting ink droplets from the nozzles 1345 in a direction substantially perpendicular to the layer direction in which the piezoelectric elements 1353 moves. The subsequent operation of the ink jet head of this embodiment is equal to that of the ink jet head of the 17th embodiment.

It has been confirmed that since the ink jet head of this embodiment has the ink-contacting surface of the channel formation substrate 1341 coated with the liquid-resistant organic resin thin film 1310, silicon is prevented from dissolving in the ink, causing no nozzle clogging. Thus, the long operation stability and reliability of the ink jet head is achieved.

Also in this embodiment, by forming each of partition walls 1350 partitioning the liquid pressure chambers 1346 to have its part of the side on which the diaphragm 1342 is joined formed to have a cross section as shown in, for instance, FIG. 105 or 106, all the wall faces (ink-contacting surfaces) of the concave parts for forming the liquid pressure chambers 1346 formed in the channel formation member 1341, that is, the wall faces of the partition walls 1450, are coated completely with the liquid-resistant thin film 1310.

Figure 111:
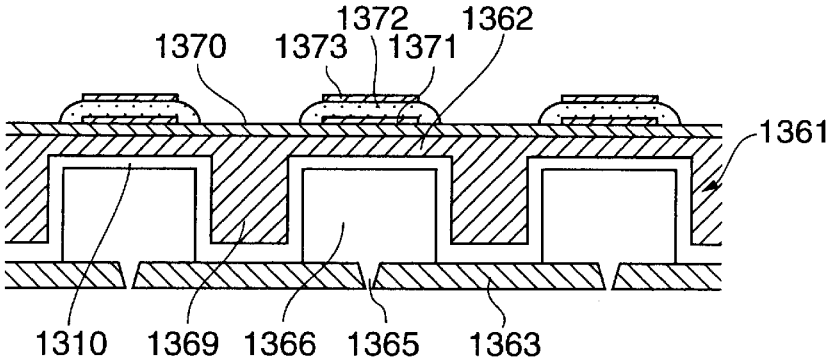
FIG. 111 is a sectional view of an ink jet head according to a 19th embodiment of the present invention taken along a width of a diaphragm of the ink jet head.
Figure 112:
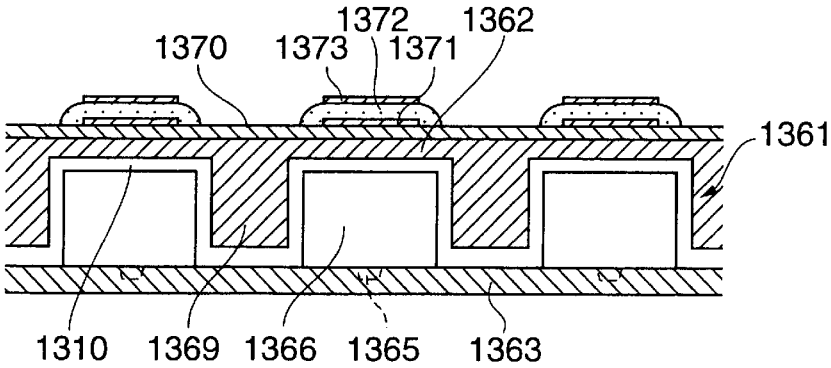
FIG. 112 is a sectional view of an ink jet head that is a variation of the ink jet head of FIG. 111 taken along the width of the diaphragm.

Next, a description will be given of a 19th embodiment of the present invention. FIG. 111 is a sectional view of an ink jet head of this embodiment taken along a width or short side of a diaphragm 1362, that is, a direction substantially perpendicular to a direction in which the diaphragm 1362 extends. FIG. 112 is a sectional view of an ink jet head that is a variation of the ink jet head of FIG. 111 taken along the width or short side of the diaphragm 1362.

In each of these ink jet heads, the diaphragm 1362 is formed integrally with a channel formation member 1361, and a nozzle plate 1363 is joined thereto so that liquid channels such as liquid pressure chambers 1366 communicating with nozzles 1365 are formed. The ink jet head of FIG. 111 is of a side-shooter type (the same type as that of the 17th embodiment) in which the nozzles 1365 are formed to penetrate through the nozzle plate 1363. The ink jet head of FIG. 112 is of an edge-shooter type (the same type as that of the 18th embodiment) in which the nozzles 1365 are formed in the nozzle plate 1363 to have groove-like shapes and communicate with the liquid pressure chambers 1366.

The channel formation member 1361 is formed of a silicon substrate such as a (110) single-crystal silicon substrate. A p-type impurity diffusion layer of a high concentration such as a boron diffusion layer is formed in the silicon substrate, and anisotropic etching is performed on the silicon substrate using an etchant or etching solution such as a KOH aqueous solution until the boron diffusion layer serving as an etching stopper layer is reached. Thereby, the diaphragms 1362 of the boron diffusion layer and of highly accurate thicknesses are formed integrally with the channel formation member 1361 in positions corresponding to the liquid pressure chambers 1366, that is, on the bottom surfaces of concave parts for forming the liquid pressure chambers 1366.

The liquid-resistant organic resin thin film 1310 is formed on the ink-contacting surface of the channel formation member 1361 which surface includes the wall faces of the liquid pressure chambers 1366, the sidewall faces of partition walls 1369 partitioning the liquid pressure chambers 1366, and the surfaces of the diaphragms 1362. Each ink jet head of this embodiment has the diaphragms 1362 formed of silicon thin films. Therefore, by forming the liquid-resistant thin film 1310 on the ink-contacting surfaces of the diaphragms 1362 which surfaces serve as the wall faces of the liquid pressure chambers 1366, silicon is prevented from dissolving from the diaphragms 1362 in the ink, thus eliminating differences in a vibration characteristic and defect vibrations. Thereby, the reliability and stability of the ink jet head are increased.

Further, an intermediate layer (insulation layer) 1370 is formed on the external side of the diaphragms 1462, and lower electrodes 1371, piezoelectric layer parts 1372, and upper electrodes 1373 are formed in layers in positions corresponding to the liquid pressure chambers 1366 on the intermediate layer 1370. The lower electrodes 1371 are formed, by screen printing, of an electrode material including, as its main ingredients, a refractory metal such as platinum or any of platinum group elements including as Pd, Rh, Ir, and Ru and its alloy. Calcinated powders of a piezoelectric material including PZT as its main ingredient are processed into paste to be screen-printed on the lower electrodes 1371. Further, the upper electrodes 1373 are formed of a silver-palladium alloy by screen printing.

In the ink jet head having the above-described structure, a driving pulse voltage is applied to the lower and upper electrodes 1371 and 1372 of the selected piezoelectric layer parts 1372 so that the selected piezoelectric layer parts 1372 deforms to deform the diaphragms 1362. Thereby, ink in the liquid pressure chambers 1366 are pressurized by changes in the capacities or volumes of the liquid pressure chambers 1366 so that ink droplets are ejected from the nozzles 1365. The subsequent operation of the ink jet head of this embodiment is equal to that of the 17th embodiment.

It has been confirmed that since the ink jet head of this embodiment has the ink-contacting surface of the channel formation substrate 1361 including the diaphragms 1362 coated with the liquid-resistant organic resin thin film 1310, silicon is prevented from dissolving in the ink, causing no nozzle clogging. Thus, the long operation stability and reliability of the ink jet head is achieved.

Figure 113:
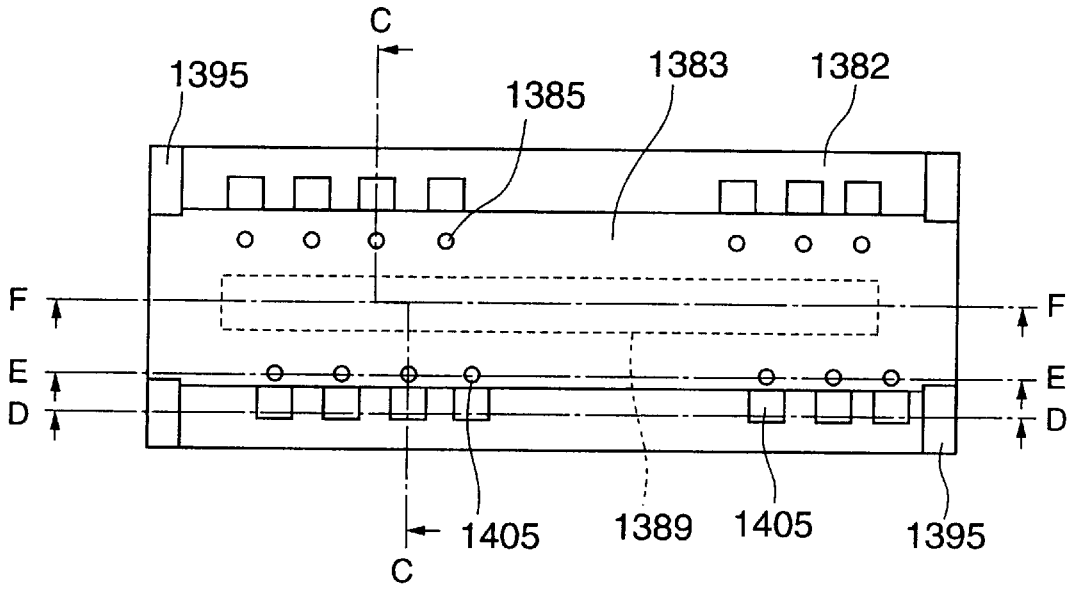
FIG. 113 is a plan view of an ink jet head according to the 20th embodiment of the present invention.
Figure 114:
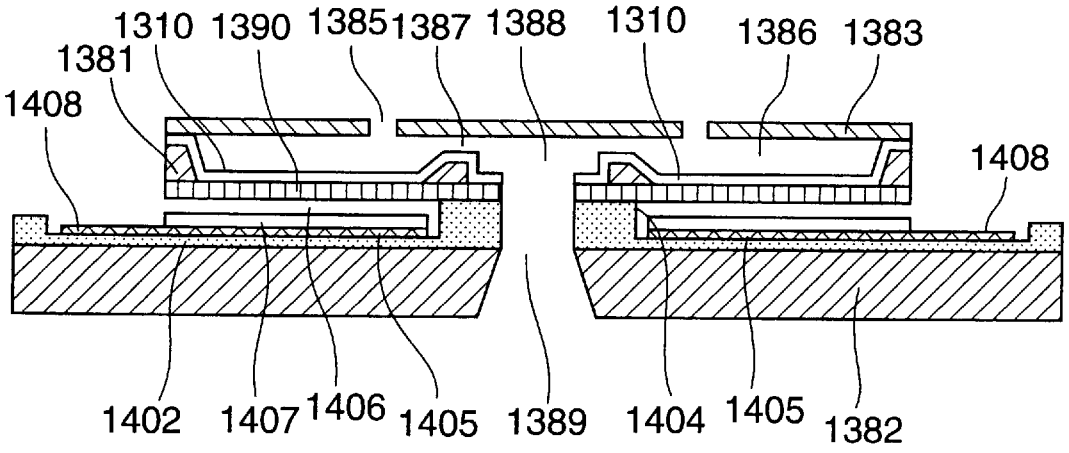
FIGS. 114 through 117 are sectional views of the ink jet head of FIG. 113 taken along the lines C—C, D—D, E—E, and F—F, respectively.
Figure 115:
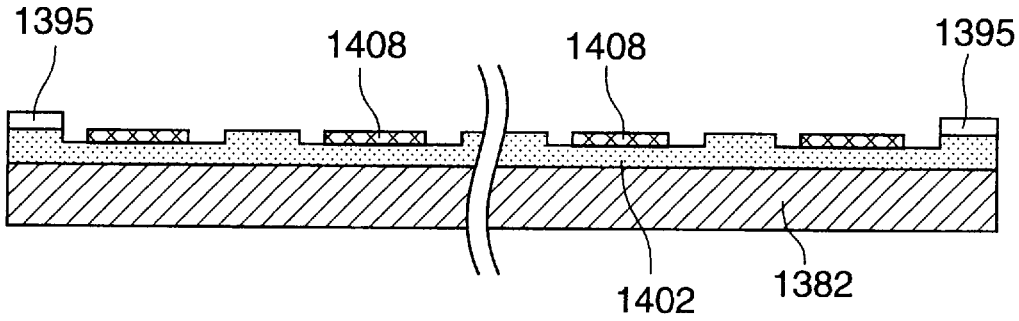
Figure 116:
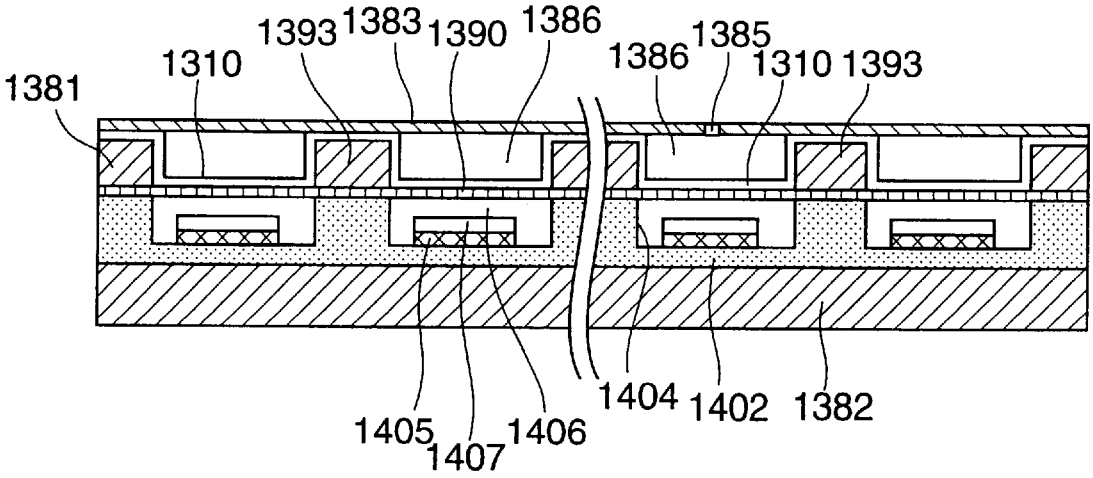
Figure 117:
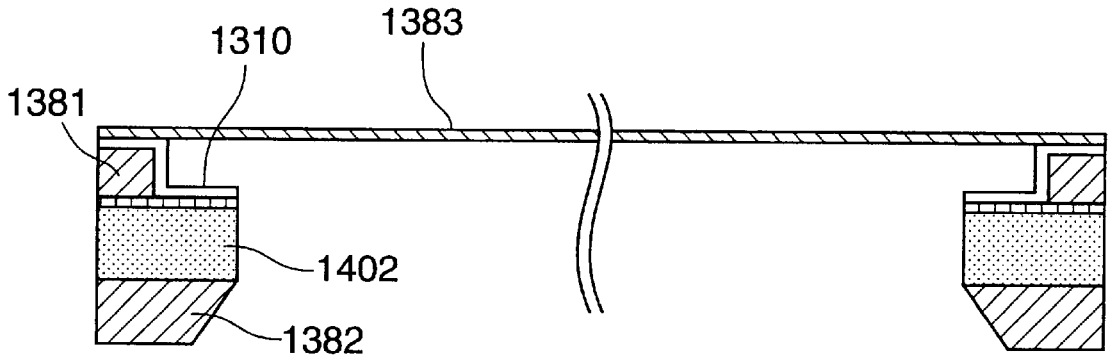

Next, a description will be given of a 20th embodiment of the present invention. FIG. 113 is a plan view of an ink jet head according to the 20th embodiment of the present invention. FIGS. 114 through 117 are sectional views of the ink jet head of FIG. 113 taken along the lines C—C, D—D, E—E, and F—F, respectively.

The ink jet head of this embodiment includes a first substrate 1381 that is a channel formation member, a second substrate 1382 that is an electrode substrate provided under the first substrate 1381, and a nozzle plate 1383 that is a third substrate provided on the first substrate 1381, thereby forming liquid pressure chambers 1386 that serve as liquid channels communicating with nozzles 1385 for ejecting ink droplets and a common liquid chamber 1388 for supplying ink via fluid resistance parts 1387 to the liquid pressure chambers 1386. The ink is supplied from a backside channel (ink supply hole) 1389 formed in the second substrate 1382 through the common liquid chamber 1388, the fluid resistance parts 1387, and the liquid pressure chambers 1386 to the nozzles 1385 from which the ink is ejected as ink droplets.

Concave parts for forming the liquid pressure chambers 1386 and diaphragms 1390 forming the bottom faces (wall faces) of the liquid pressure chambers 1386, groove parts for forming the fluid resistance parts 1387, a through hole for forming the common liquid chamber 1388 are formed in the first substrate 1381. The liquid-resistant organic resin thin film 1310 is formed on the entire ink-contacting surface of the first substrate 1381 in which the liquid pressure chambers 1386, the diaphragms 1390, the fluid resistance parts 1387, and the common liquid chamber 1388 are formed. The liquid pressure chambers 1386 are partitioned by partition walls 1393.

The first substrate 1381 is formed of, for instance, a (110) single-crystal silicon substrate. A p-type impurity diffusion layer of a high concentration such as a boron diffusion layer is formed in the silicon substrate and anisotropic etching is performed using an etchant such as a KOH aqueous solution until the boron diffusion layer serving as an etching stopper layer is reached. Thereby, the diaphragms 1390 are formed of the boron diffusion layer to have highly accurate thicknesses.

The first substrate 1381 may also be formed by using a SOI substrate formed by joining silicon substrates with an oxide film being formed therebetween. Also in this case, by forming the concave parts for forming the liquid pressure chambers by anisotropic etching using an etchant such as a KOH aqueous solution, the diaphragms 1390 are formed with a layer of the oxide film serving as an etching stopper layer.

Diaphragm electrode pads 1395 are formed on the first substrate 1381 for mounting an FPC or performing wire bonding for applying voltage to the diaphragms 1390 from outside. A metal such as Au, Al, Pt, TiN, or Ni may be employed as the diaphragm electrode pads 1395. Further, the diaphragm electrode pads 1395 are formed to cover an area from the upper sides of the diaphragms 1390 that project above driving electrodes 1405 with a distance of a few microns being therebetween to the first substrate 1481.

As the second substrate 1382, a single-crystal silicon substrate including n- or p-type impurity atoms of an amount in a range of $1E14/cm^3$ to $5E17/cm^3$ is employed. Normally, a (100) single-crystal silicon substrate is employed, but a (110) or (111) single-crystal silicon substrate may be employed depending on a process. Further, a glass substrate of Pyrex glass or a ceramics substrate may be employed instead of the single-crystal silicon substrate.

An insulation film 1402 is formed on the second substrate 1382 by HTO, LTO, thermal oxidation, CVD, or sputtering. Electrode formation grooves 1404 are formed by processing the insulation film 1402 by photolithography and etching. The driving electrodes 1405 are formed on the bottom face of the electrode formation grooves 1404 so as to oppose the diaphragms 1390 with gaps 1406 being formed therebetween. The diaphragms 1390 and the driving electrodes 1405 opposing the diaphragms 1390 form a microactuator that deforms the diaphragms 1390 by electrostatic force.

The film thickness of the insulation film 1402 is a design parameter that decides an operation characteristic of the ink jet head, such as an ink. jet head driving voltage. Therefore, the film thickness of the insulation film 1402 is properly selected based on the operation specifications of the ink jet head. The part of the insulation film 1402 other than the electrode formation grooves 1404 serves as a gap spacer part defining the gaps 1406.

The driving electrodes 1405 may be formed of a refractory metal such as titanium, tungsten, or tantalum and its nitride or compound, a layer structure of the refractory metal and its nitride or compound, Al, or polysilicon. As is not shown in the drawings, the driving electrodes 1405 may be diffusion electrodes formed of a conductive impurity layer having a conduction type different from that of the single-crystal silicon substrate.

An insulation protection film (gap film) 1407 is formed on the surfaces, at least the surfaces of the diaphragm side, of the driving electrodes 1405. As this insulation protection film 1407, a silicon oxide film formed by HTO, LTO, thermal oxidation, CVD, or sputtering may be employed.

The driving electrodes 1405 are formed integrally with electrode pad parts 1408 for mounting an FPC or performing wire bonding for applying voltage from an external driving circuit (a driver IC) to the driving electrodes 1405. Since the diaphragm electrode pads 1395 and the driving electrodes 1405 are arranged with a vertical distance of a few microns being therebetween, electrical connections to the diaphragm electrode pads 1395 and the driving electrodes 1405 can be simultaneously established by an FPC or wire bonding. In the case of using the FPC, the electrical connections can be established by a single FPC via an anisotropic conductive film, and in the case of wire bonding, continuous bonding can be performed without height adjustment between the driving electrodes 1405 an the diaphragm electrode pads 1395.

Further, in the second substrate 1382, the ink supply hole 1389 is formed of a through hole for supplying ink from outside to the common liquid chamber 1388. The ink supply hole 1389 has an opening formed in the middle of two arrays of the nozzles 1385 arranged in a staggered fashion so as to extend parallel to the arrays. The opening has a length longer than that of each array of the nozzles 1385 so that there are equal distances between the opening and the nozzles 1385.

The nozzles 1385 for ejecting ink droplets are arranged in the staggered fashion in the two arrays in the nozzle plate 1383. As the nozzle plate 1383, a metal such as stainless steel or nickel, a resin such as a polyimide film, a silicon wafer, or a combination thereof may be employed. Further, in order to secure water repellency with respect to the ink, the nozzle plate 1383 has a water repellent film formed by a known method such as plating or water-repellent coating on a nozzle (ejection) surface (a surface in a direction of ink ejection) of the nozzle plate 1383.

According to the ink jet head having the above-described structure, by applying a driving voltage between the diaphragms 1390 and the driving electrodes 1405 with the diaphragms 1390 serving as a common electrode and the driving electrodes 1405 serving as individual electrodes, the diaphragms 1390 deform toward the driving electrodes 1405 by electrostatic forces generated between the diaphragms 1390 and the driving electrodes 1405. Then, by discharging electrical charges between the diaphragms 1390 and the driving electrodes 1405 from this state, that is, by reducing the driving voltage to zero from this state, the diaphragms 1390 return to their original positions to change the capacities or volumes of the liquid pressure chambers 1386 so that ink droplets are ejected from the nozzles 1385.

At this point, since the ink-contacting surface of the first substrate 1381 including the diaphragms 1390 is coated with the liquid-resistant organic resin thin film 1310, silicon of the first substrate 1381 is prevented from dissolving in the ink, causing no nozzle clogging, differences in the vibration characteristic, or defective vibrations. Thus, the long operation stability and reliability of the ink jet head is achieved.

Figure 118:
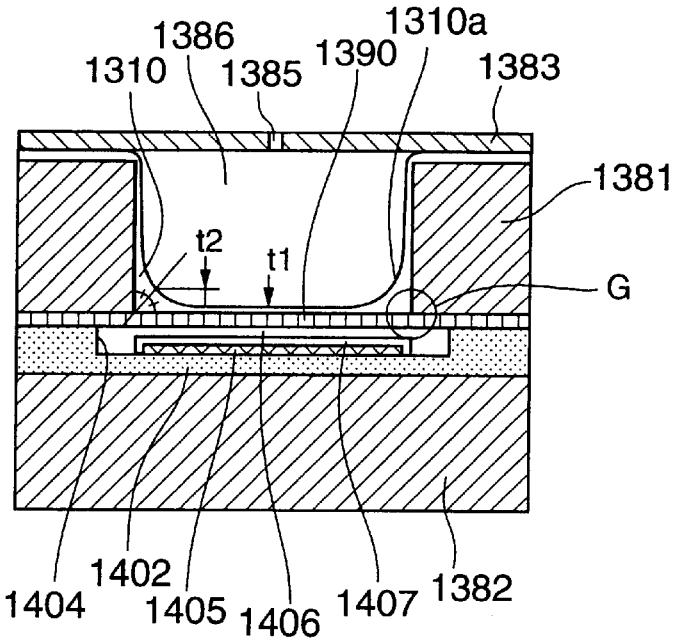
FIG. 118 is a sectional view of an electrostatic ink jet head taken along a width of a diaphragm for illustrating a first film structure of an organic resin film.
Figure 119:
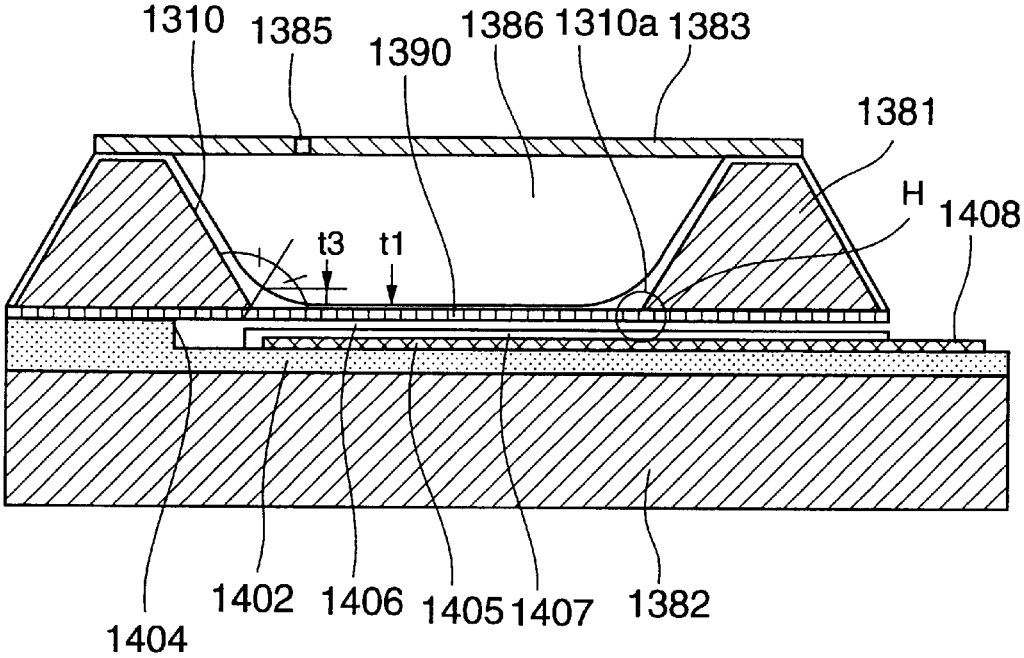
FIG. 119 is a sectional view of the electrostatic ink jet head of FIG. 118 taken along a length of the diaphragm.

Next, a description will be given of a first film structure of the organic resin film that is the liquid-resistant thin film 1310. FIG. 118 is a sectional view of an electrostatic ink jet head taken along a width or short side of each diaphragm 1390, that is, in a direction substantially perpendicular to a direction in which each diaphragm 1390 extends, and FIG. 119 is a sectional view of the electrostatic ink jet head taken along a length or longitudinal side of each diaphragm 1390, or in the direction in which each diaphragm 1390 extends. In FIGS. 118 and 119, the same elements as those of the ink jet head of the 20th embodiment are referred to by the same numerals, and a description will be omitted.

In the ink jet head of FIGS. 118 and 119, the liquid-resistant thin film 1310 is formed on the wall faces (including the bottom face) of the liquid pressure chamber 1386 to have a curvature on the bottom peripheral corners or angular parts of the groove of the liquid pressure chamber 1386, which bottom peripheral corner or angular parts are formed internally along the four sides of the bottom face of the liquid pressure chamber 1386 at which four sides the sidewalls and the bottom face of the liquid pressure chamber meet.

That is, as previously described, the liquid channels such as the liquid pressure chambers 1386 and the diaphragms 1390 are formed, for instance, in a (110) silicon substrate (wafer) by anisotropic wet etching using an alkaline etchant, and the liquid-resistant thin film 1310 is formed on the entire surface of the first substrate 1381 which surface includes the wall faces of the liquid pressure chambers 1386, or the wall faces of the partition walls 93 and the surfaces of the liquid chamber side of the diaphragms 1390.

Here, an organic resin material such as polyimide is employed as a material for the liquid-resistant thin film 1310. By employing the organic resin material, coating can be easily provided even if particles exist in the concave parts such as the liquid pressure chambers 1386. However, in the case of employing an inorganic material, mainly, sputtering, vacuum evaporation, ion plating, or CVD is employed as a film formation method, and the liquid-resistant thin film 1310 is hard to form on areas shaded by the particles, and ink soaks into the concave parts from the shaded areas so that the partition walls 1393 between the liquid pressure chambers 1386 and the diaphragms 1390 may be corroded.

A polyimide-based film, especially, a film formed mainly of polybenzoxazole, is effective as the liquid-resistant thin film 1310. The film including polybenzoxazole as its main ingredient has low water absorption and low swelling property. Further, this film has low solubility to alkaline ink used mainly in an ink jet head. Furthermore, this film has good adhesion to silicon used for a structure for forming the liquid pressure chambers 1386.

In the case of employing a (110) silicon wafer for the first substrate 1381, each liquid pressure chamber 1386 has its longitudinal sidewall faces forming substantially right angles with respect to the bottom face of the groove (concave part). Therefore, the cross section of each liquid pressure chamber 1836 taken along the width of each diaphragm 1390 has bottom corners of substantially 90 as shown in FIG. 118. Further, each liquid pressure chamber 1836 has its sidewall faces perpendicular to its longitudinal sidewall faces forming approximately 144.77 with respect to the bottom face of the groove. Therefore, the cross section of each liquid pressure chamber 1386 taken along the length of each diaphragm 1390 has bottom corners of approximately 144.77 as shown in FIG. 119.

Therefore, as shown in FIGS. 118 and 119, the liquid-resistant thin film 1310 is formed to have curvature parts 1310*a* along the four sides or periphery of the bottom face of each of the grooves serving as the liquid pressure chambers 1386 so that each of the curvature parts 1310*a* formed along the longitudinal sides of the bottom face of the groove has a film thickness t2 at a point at which the surface of each longitudinal curvature part 1310*a* intersects with a bisector of the internal angle formed by each longitudinal sidewall face and the bottom face of the groove and each of the curvature parts 1310*a* formed along the short sides perpendicular to the longitudinal sides of the bottom face of the groove has a film thickness t3 at a point at which the surface of each short curvature part 1310*a* intersects with a bisector of the internal angle formed by each sidewall face perpendicular to each longitudinal sidewall face and the bottom face of the groove with the film thicknesses t2 and t3 being twice or more than twice as thick as a film thickness t1 of the liquid-resistant thin film around the center of the surface of the diaphragm 1390, that is, the bottom face of the groove.

In other words, the four sides or periphery of the bottom face of each liquid pressure chamber 1386 form fixed edges G and H when the corresponding diaphragm 1390 deforms or is displaced. Therefore, stresses concentrate on the liquid-resistant thin film 1310 formed on the diaphragm 1390 around the fixed edges G and H, so that the removal of the liquid-resistant thin film 1310 is apt to occur on the fixed edges G and H.

Therefore, in order to relax the concentration of stress, the liquid-resistant thin film 1310 has a thick film thickness t along the fixed edges G and H. Further, by forming the liquid-resistant thin film 1310 with curvature around the fixed edges G and H on each diaphragm 1390, further relaxation of the concentration of stress is achieved, the ink flows more smoothly in each liquid pressure chamber 1386, and air bubble traps are prevented. Therefore, ejection efficiency is increased and an ejection characteristic is stabilized.

On the other hand, the film thickness of the liquid-resistant thin film 1310 on the bottom faces of the liquid pressure chambers 1386, that is, the surfaces of the diaphragms 1390, affects the vibration characteristic of the diaphragms 1390. With the same voltage being applied, the vibration deformation or displacement of each diaphragm 1390 is smaller if the film thickness is thicker. Therefore, it is preferable to make thinner the film thickness of the liquid-resistant thin film 1310 on the surfaces of the diaphragms 1390 unless the ink causes corrosion. For the above-described reason, the liquid-resistant thin film 1310 is required to have a thicker film thickness on each of the fixed edges G and H than around the center of the surface of each diaphragm 1390.

Therefore, it is preferable that the surface area of a part of the diaphragm 1390 in which part the diaphragm 1390 has a film thickness at least twice as thick as the film thickness t1 of the center area of the diaphragm 1390 is equal to or less than approximately the half of the surface area of the diaphragm 1390.

In order to form the liquid-resistant thin film 1310 as described above, it is preferable to apply the organic resin material by spray coating. As a method of spray coating, organic thin film polymers diluted with a highly volatile solvent may be sprayed on the channel formation member, or the first substrate 1381, in which the liquid pressure chambers 1386 are formed while the channel formation member is rotated at a low speed. The liquid-resistant thin film 1310 is formed by thermosetting the film of the sprayed polymers.

In the case of employing an organic resin film including polybenzoxazole as its main ingredient as the liquid-resistant thin film 1310, a film having low water absorption and low swelling property can be formed by processing the organic resin film at 150° C. for 30 minutes in a gaseous nitrogen atmosphere and then performing heat treatment on the organic resin film at an increased temperature of 320° C.

As another method of forming the liquid-resistant thin film 1310, spin coating controlling airflow over the surface of a substrate may be employed. As a method of controlling airflow, a cover that rotates in synchronism with rotations of the substrate may be used.

Figure 120:
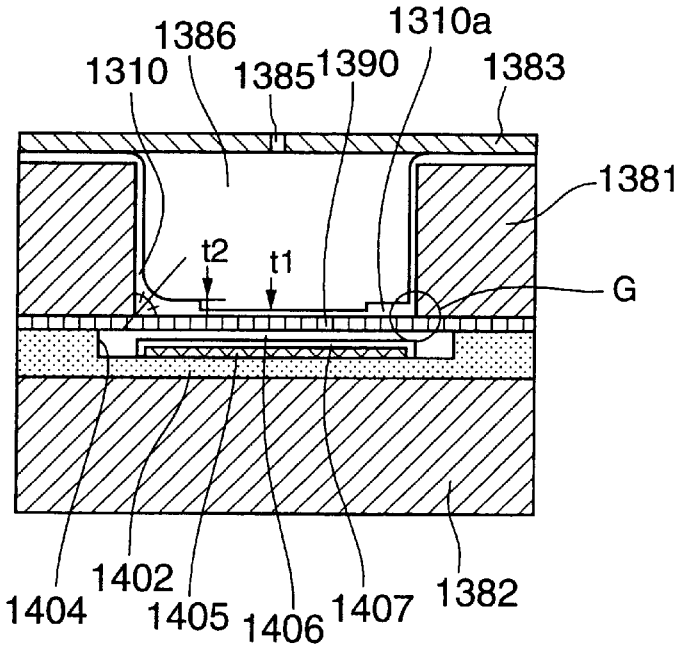
FIG. 120 is a sectional view of an electrostatic ink jet head taken along a width of a diaphragm for illustrating a second film structure of the organic resin film.
Figure 121:
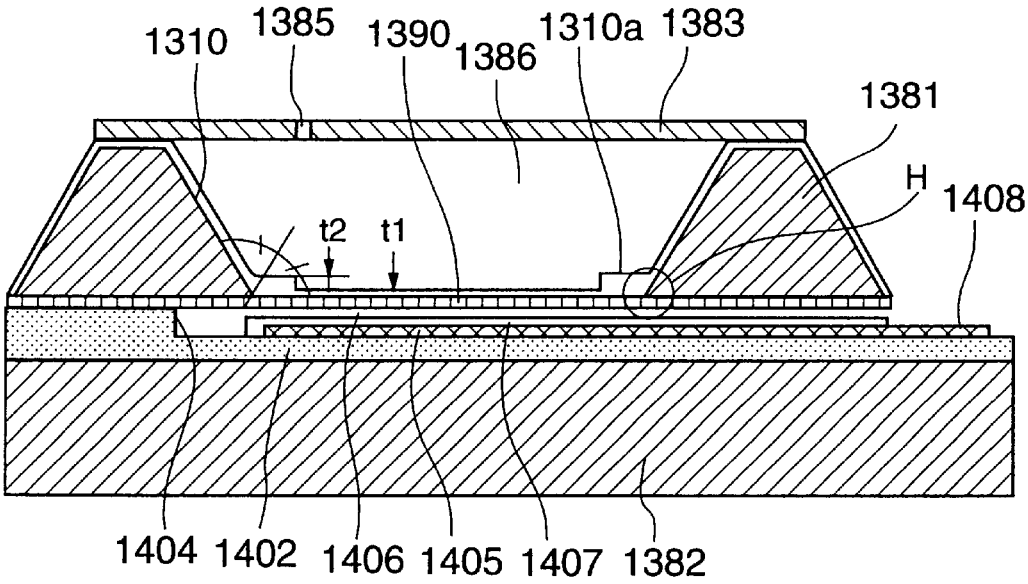
FIG. 121 is a sectional view of the electrostatic ink jet head of FIG. 120 taken along a length of the diaphragm.

Next, Next, a description will be given of a second film structure of the organic resin film that is the liquid-resistant thin film 1310. FIG. 120 is a sectional view of an electrostatic ink jet head taken along a width or short side of each diaphragm 1390, that is, in a direction substantially perpendicular to a direction in which each diaphragm 1390 extends, and FIG. 121 is a sectional view of the electrostatic ink jet head taken along a length or longitudinal side of each diaphragm 1390, or in the direction in which each diaphragm 1390 extends. In FIGS. 120 and 121, the same elements as those of the ink jet head of the 20th embodiment are referred to by the same numerals, and a description will be omitted.

In the ink jet head of FIGS. 120 and 121, the liquid-resistant thin film 1310 is formed on the wall faces (including the bottom face) of the liquid pressure chamber 1386 to have a step-like part formed on the bottom peripheral corners or angular parts of the groove of the liquid pressure chamber 1386, which bottom peripheral corner or angular parts are formed internally along the four sides of the bottom face of the liquid pressure chamber 1386 at which four sides the sidewalls and the bottom face of the liquid pressure chamber meet. That is, as shown in FIGS. 120 and 121, the liquid-resistant thin film 1310 is formed to have step parts (stepped parts) 1310*b* along the four sides or periphery of the bottom face of each of the grooves serving as the liquid pressure chambers 1386 so that each of the step parts 1310*b* formed along the longitudinal sides of the bottom face of the groove has a film thickness t2 at a point at which the surface of each longitudinal step parts 1310*b* intersects with a bisector of the internal angle formed by each longitudinal sidewall face and the bottom face of the groove and each of the step parts 1310*b* formed along the short sides perpendicular to the longitudinal sides of the bottom face of the groove has a film thickness t3 at a point at which the surface of each short step parts 1310*b* intersects with a bisector of the internal angle formed by each sidewall face perpendicular to each longitudinal sidewall face and the bottom face of the groove with the film thicknesses t2 and t3 being twice or more than twice as thick as a film thickness t1 of the liquid-resistant thin film around the center of the surface of the diaphragm 1390, that is, the bottom face of the groove.

As previously described, the four sides or periphery of the bottom face of each liquid pressure chamber 1386 form the fixed edges G and H when the corresponding diaphragm 1390 deforms or is displaced. Therefore, stresses concentrate on the liquid-resistant thin film 1310 formed on the diaphragm 1390 around the fixed edges G and H, so that the removal of the liquid-resistant thin film 1310 is apt to occur on the fixed edges G and H.

Therefore, in order to relax the concentration of stress, the liquid-resistant thin film 1310 has a step-like shape having a thick film thickness t along the fixed edges G and H. However, compared with the first structure of the organic resin film in which the organic resin film has the curvature parts 1310*a*, in the second structure, ink flows less smoothly in each liquid pressure chamber 1386.

In order to form the liquid-resistant thin film 1310, first, a thin film having the thickness t2 is formed, and then a part of the thin film on the center area of each diaphragm 1390 is etched until the part has the thickness t1.

Also in the second structure, for the same reason as that of the first structure, it is preferable that the surface area of a part of the diaphragm 1390 in which part the diaphragm 1390 has a film thickness at least twice as thick as the film thickness t1 of the center area of the diaphragm 1390 is equal to or less than approximately the half of the surface area of the diaphragm 1390.

The first and second film structures of the liquid-resistant thin film 1310 are not limited to an electrostatic ink jet head, but may also be applied to the above-described piezoelectric ink jet head using piezoelectric elements or to a later-described thermal ink jet head using heating resistances (electro-thermal conversion elements).

That is, in these structures, the liquid-resistant thin film 1310 is formed to have a thickness thicker on the bottom peripheral corners or angular parts of the liquid channel (the liquid pressure chamber 1386) than on the sidewall faces and/or bottom face (the surface of the diaphragm 1390) of the liquid channel. In this embodiment, the above-described structures are applied to the ink jet head employing the diaphragms 1390, but are also applicable to the later-described thermal ink jet head or an ink jet head without a liquid-resistant thin film being formed on a diaphragm, such as the one of the 18th embodiment.

In order to form the above-described film thickness structures, it is effective to employ the above-described spray method (spray coating). A description will now be given of a method of applying a liquid material for forming the organic resin film by the spray method.

First, a polyamide acid that is a precursor material of polyimide is diluted with a solvent such as N-methylpyrrolidone to a viscosity equal to or less than 20 cP (25° C.). In this case, the polyamide acid is diluted to a viscosity of 3 cP (25 ° C.).

The obtained solution is applied, by means of a spray coating device, on a substrate that serves as a channel formation member which diaphragms are integrally formed with or a separately formed diaphragm is attached to or a channel formation member without a diaphragm. In applying the solution, the evaporation of the solvent is considered.

Next, the substrate on which the polyamide acid is applied is heated at a temperature in a range of 100 to 180° C. so as to slowly evaporate N-methylpyrrolidone that is the solvent. N-methylpyrrolidone used herein has a boiling point of 203° C. If N-methylpyrrolidone is evaporated rapidly at a temperature close to or higher than this boiling point, a film may be formed unevenly because of foaming. Therefore, it is preferable to evaporate N-methylpyrrolidone slowly.

When the solvent is evaporated, a polyamide acid film remains on the side faces of partition walls and the surfaces of the diaphragms. At this point, if the film is not thick enough, the same operation may be repeated to make the film thicker.

Next, the substrate on which the polyamide acid film is formed is slowly heated so that the polyimide acid film is subjected to dehydrating condensation to be formed into a polyimide film. Here, heat treatment is performed at 150° C. for 15 min., 200° C. for 15 min., 250° C. for 10 min., 300° C. for 10 min., and 350° C. for 10 min., and thereafter, cooling is gradually performed. The purpose of slow heating is to prevent an extra stress from being applied to the substrate which stress is generated by the polyamide acid film being formed into the polyimide film by dehydrating condensation.

As previously described, the polyimide film has high liquid contactability (insolubility and swelling-resistant property) with respect to a variety of ink. Therefore, even a thin polyimide film can fill the role of an ink or liquid-resistant film. In this case, a thicker film is formed because the surfaces of the diaphragms, which surfaces are formed by etching, are irregular. Further, the thicker film is formed so as to prevent pinholes from being formed in the liquid-resistant thin film 1310 if there are fine specs of dust.

Further, a polyimide film may be formed by another film formation method by which pyromellitic acid anhydride and bis(4-aminophenyl)ether are heated under high vacuum to be deposited by evaporation on a substrate serving as a channel formation member, and the substrate is heated so as to activate a polycondensation reaction. In this case, a film is formable on the sidewall faces of partition walls and the surfaces of the diaphragms with high uniformity of film thickness by causing the substrate to make moves like revolutions and rotations.

Next, in the case of forming the liquid-resistant thin film 1310 on thin film diaphragms, especially, on silicon thin film diaphragms, the diaphragms may deflect by the stress of the liquid-resistant thin film 1310. Further, the stiffness of the entire diaphragms including the liquid-resistant thin film 1310 becomes high so that a higher voltage may be required to deform the diaphragms.

By observing the driving voltage characteristics of test ink jet heads formed by changing the stiffness (spring characteristic) of each diaphragm 1390 of the above-described electrostatic ink jet head which stiffness is changed by altering the thickness, width, etc. of each diaphragm 1390, it has been confirmed that a change in a driving voltage falls within the range of zero to two volts as far as the spring characteristic of a diaphragm is at most double the spring characteristic of a diaphragm having a target stiffness.

Therefore, letting a spring constant of a silicon thin film diaphragm without a liquid-resistant thin film be K1, it is preferable that a spring constant K2 of a diaphragm with the liquid-resistant thin film satisfy a condition 2>K2/K1.

Here, the spring constant K1 is given by K1=35Exhx3/a4 where Ex is a Young's modulus of a silicon diaphragm, hx is a thickness of the silicon diaphragm, and a is a width of the silicon diaphragm) and the spring constant K2 is given by K2=35/a4*(Exhx3+Eyhy3) where Ey is a Young's modulus of a polyimide film, hy is a film thickness of the polyimide film. It can be found from these relations that if the ratio of the film thickness of the polyimide film (liquid-resistant thin film) to the thickness of the silicon thin film diaphragm is equal to or less than 3:1, the ratio of the respective spring constants becomes equal to or less than 2:1. Therefore, for instance, if the silicon thin film diaphragm has a thickness of 1 $\mu$m, the polyimide film formed on the surface of the diaphragm is required to have a thickness of approximately 3 $\mu$m or less to avoid affecting the vibration characteristic of the diaphragm and thus to make the vibration characteristic stable.

Figure 122:
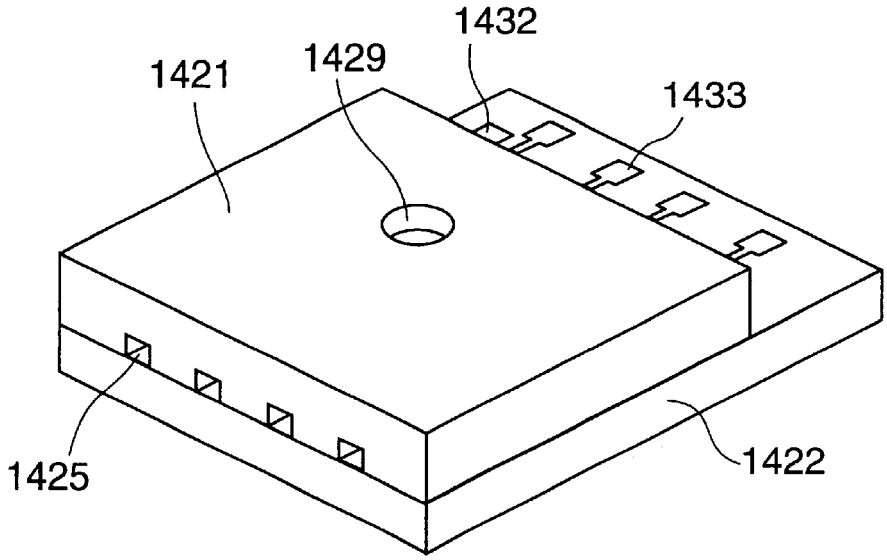
FIG. 122 is a perspective view of an ink jet head according to a 21st embodiment of the present invention.
Figure 123:
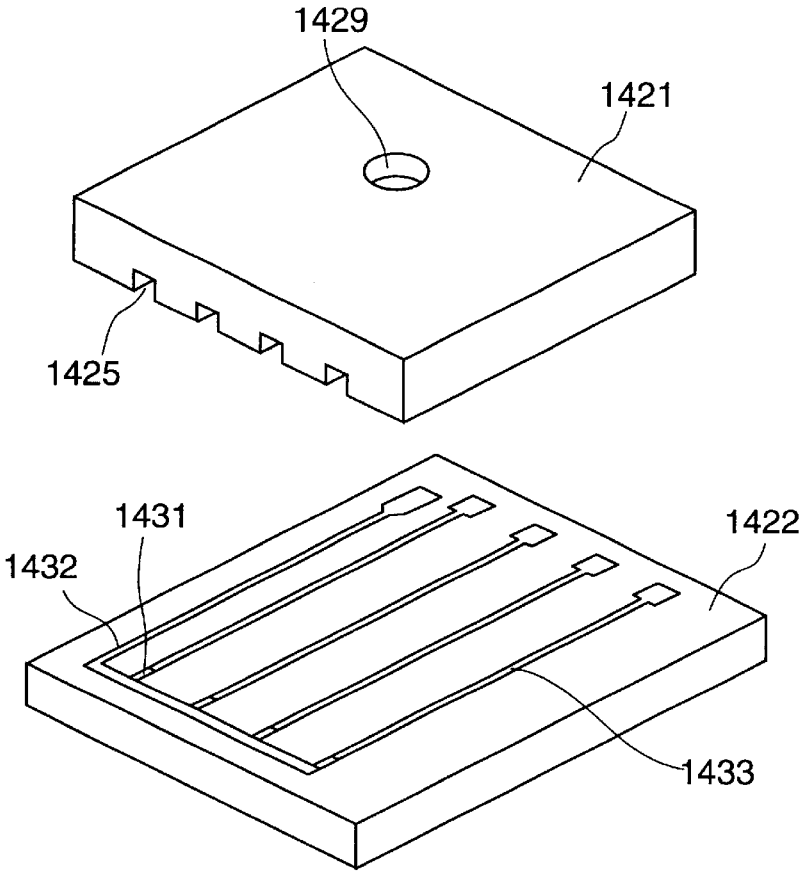
FIG. 123 is an exploded perspective view of the ink jet head of FIG. 122.
Figure 124:
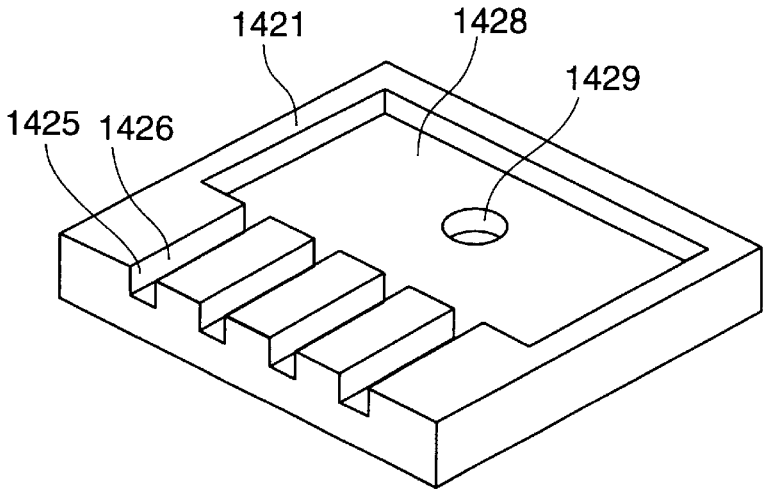
FIG. 124 is a perspective view of a channel formation substrate of the ink jet head of FIG. 122.
Figure 125:
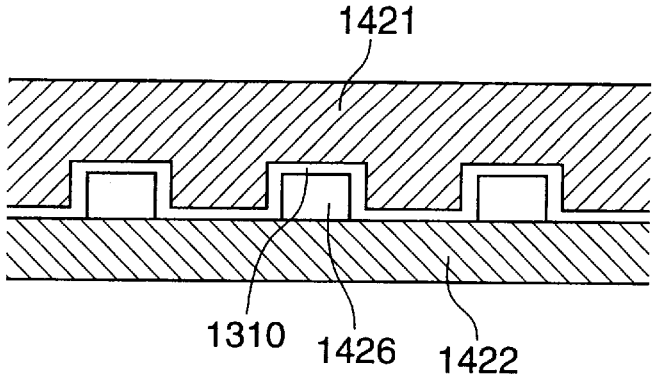
FIG. 125 is a sectional view of the ink jet head of FIG. 122 taken along a direction in which nozzles of the ink jet head are arranged.

Next, a description will be given of a 21st embodiment of the present invention. FIG. 122 is a perspective view of an ink jet head according to the 21st embodiment of the present invention. FIG. 123 is an exploded perspective view of the ink jet head of FIG. 122. FIG. 124 is a perspective view of a channel formation substrate of the ink jet head of FIG. 122. FIG. 125 is a sectional view of the ink jet head of FIG. 122 taken along a direction in which nozzles 1425 are arranged.

The ink jet head of this embodiment includes a first substrate 1421 that is the channel formation member and a second substrate 1422 that is a heating element substrate provided under the first substrate 1421, thereby forming the nozzles 1425 for ejecting ink droplets, liquid pressure chamber channels 1426 that are liquid channels communicating with the nozzles 1425, and a common liquid chamber channel 1428 for supplying ink to the liquid pressure chamber channels 1426. The ink is supplied from an ink supply hole 1429 formed in the first substrate 1421 via the common liquid chamber channel 1428 and the liquid pressure chamber channels 1426 to the nozzles 1425 from which the ink is ejected as ink droplets.

The first substrate 1421 is formed of a silicon substrate. In the first substrate 1421, grooves for forming the nozzles 1425 and the liquid pressure chamber channels 1426 and concave parts for forming the common liquid chamber channel 1428 are formed by etching. The liquid-resistant thin film 1310 (not shown in FIG. 124) of the organic resin film is formed on the entire surface of the second substrate side of the first substrate 1421 which surface includes its ink-contacting surface.

Heating resistances (electro-thermal conversion elements) 1431, a common electrode 1432 for applying voltage to the heating resistances 1431, and individual electrodes 1433 are formed on the second substrate 1422.

According to the ink jet head having the above-described structure, by applying the driving voltage to the selected individual electrodes 1433, the heating resistances generate heat so as to cause pressure changes in the ink in the liquid pressure chamber channels 1426. These pressure changes in the ink cause ink droplets to be ejected from the nozzles 1425.

At this point, since the ink-contacting surface of the first substrate 1421 is coated with the liquid-resistant thin film 1310 that is the organic resin film, silicon is prevented from dissolving in the ink, thus causing no nozzle clogging. Thereby, the long operation stability and reliability of the ink jet head can be obtained.

Figure 126:
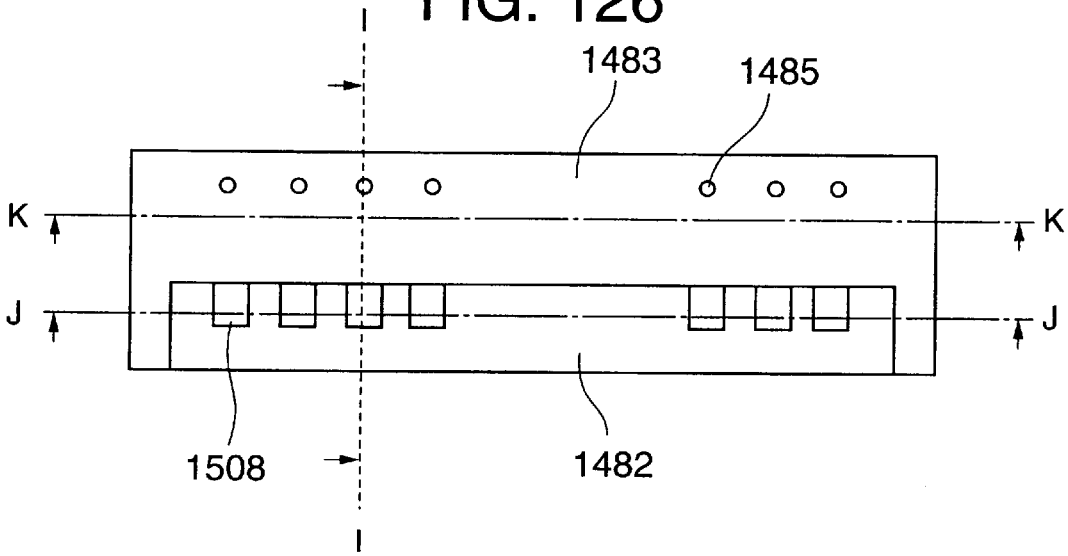
FIG. 126 is a plan view of an ink jet head according to a 22nd embodiment of the present invention.
Figure 127:
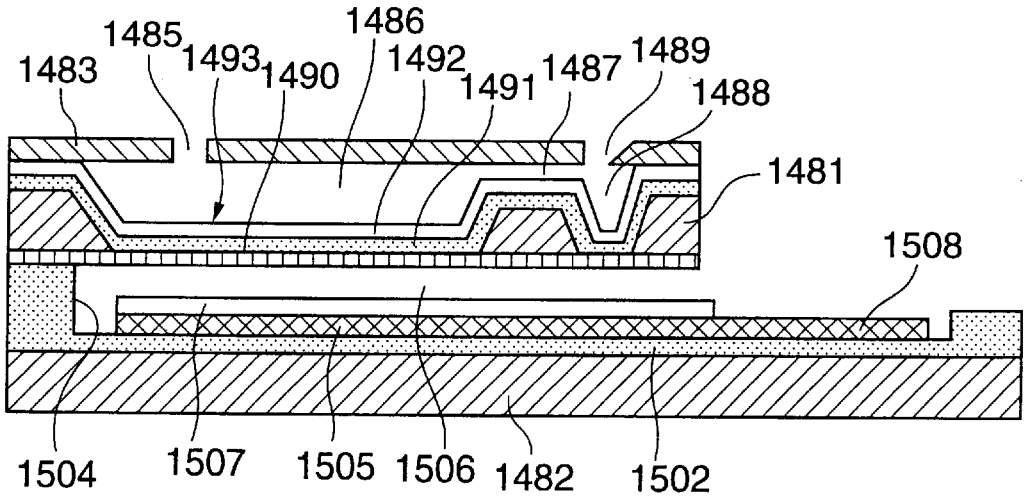
FIGS. 127 through 129 are sectional views of the ink jet head of FIG. 126 taken along the lines I—I, J—J, and K—K, respectively.
Figure 128:
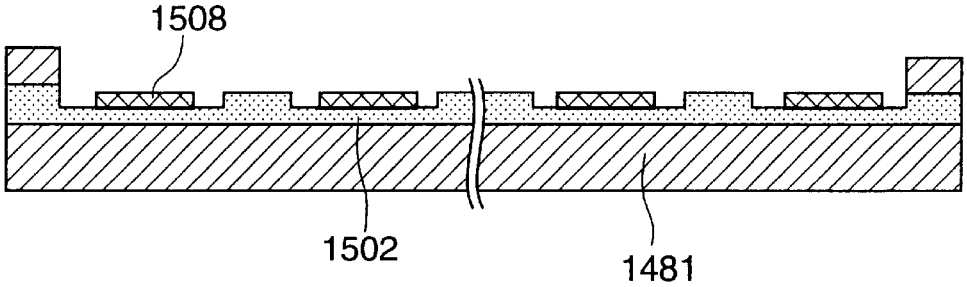
Figure 129:
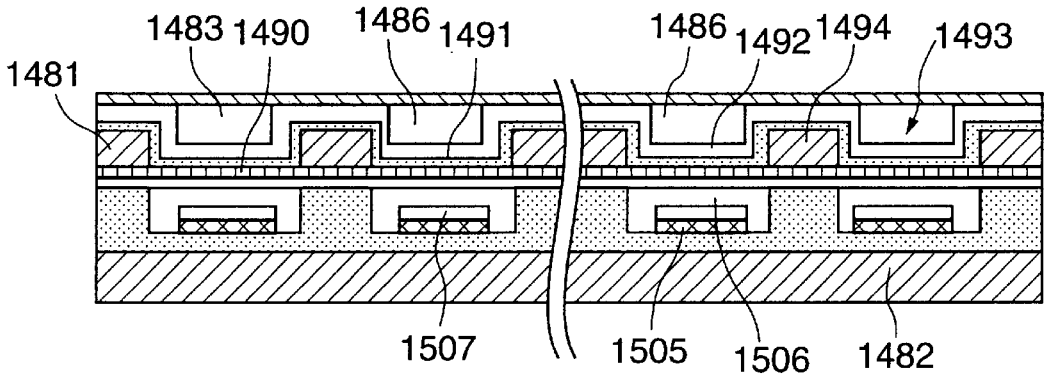

Next, a description will be given of a 22nd embodiment of the present invention. FIG. 126 is a plan view of an ink jet head according to the 22nd embodiment of the present invention. FIGS. 127 through 129 are sectional views of the ink jet head of FIG. 126 taken along the lines I—I, J—J, and K—K, respectively.

The ink jet head of this embodiment includes a first substrate 1481 that is a channel formation member, a second substrate 1482 that is an electrode substrate provided under the first substrate 1481, and a nozzle plate 1483 that is a third substrate provided on the first substrate 1481, thereby forming liquid pressure chambers 1486 that serve as liquid channels communicating with nozzles 1485 for ejecting ink droplets and a common liquid chamber 1488 for supplying ink via fluid resistance parts 1487 to the liquid pressure chambers 1486. The ink is supplied from a backside channel (ink supply hole) 1489 formed in the second substrate 1482 through the common liquid chamber 1488, the fluid resistance parts 1487, and the liquid pressure chambers 1486 to the nozzles 1485 from which the ink is ejected as ink droplets.

Concave parts for forming the liquid pressure chambers 1486 and diaphragms 1490 forming the bottom faces (wall faces) of the liquid pressure chambers 1486, groove parts for forming the fluid resistance parts 1487, a through hole for forming the common liquid chamber 1488 are formed in the first substrate 1481. An inorganic film 1491 of a material such as titanium nitride is formed on the entire ink-contacting surface of the first substrate 1481 in which the liquid pressure chambers 1486, the diaphragms 1490, the fluid resistance parts 1487, and the common liquid chamber 1488 are formed. Further, an organic resin thin film 1492 is formed on the entire surface of the inorganic film 1491 to form a liquid-resistant thin film 1493 that is a multilayer film formed by organic resin and inorganic films. The liquid pressure chambers 1486 are partitioned by partition walls 1494.

A silicon substrate is employed for the first substrate 1481, in which the liquid pressure chambers 1486, the diaphragms 1490, the fluid resistance parts 1487, and the common liquid chamber 1488 are formed as in the 20th embodiment.

As the second substrate 1482, a single-crystal silicon substrate including n- or p-type impurity atoms of an amount in a range of $1E14/cm^3$ to $5E17/cm^3$ is employed. Normally, a (100) single-crystal silicon substrate is employed, but a (110) or (111) single-crystal silicon substrate may be employed depending on a process. Further, a glass substrate of Pyrex glass or a ceramics substrate may be employed instead of the single-crystal silicon substrate.

An insulation film 1502 is formed on the second substrate 1482 by HTO, LTO, thermal oxidation, CVD, or sputtering. Electrode formation grooves 1504 are formed by processing the insulation film 1502 by photolithography and etching. The driving electrodes 1505 are formed on the bottom face of the electrode formation grooves 1504 so as to oppose the diaphragms 1490 with gaps 1506 being formed therebetween. The diaphragms 1490 and the driving electrodes 1505 opposing the diaphragms 1490 form a microactuator that deforms the diaphragms 1490 by electrostatic force.

An insulation protection film (gap film) 1507 is formed on the surfaces, at least the surfaces of the diaphragm side, of the driving electrodes 1505. As this insulation protection film 1507, a silicon oxide film formed by HTO, LTO, thermal oxidation, CVD, or sputtering may be employed.

The driving electrodes 1505 are formed integrally with electrode pad parts 1508 for mounting an FPC or performing wire bonding for applying voltage from an external driving circuit (a driver IC) to the driving electrodes 1505.

The nozzles 1485 for ejecting ink droplets are arranged in an array in the nozzle plate 1483. As the nozzle plate 1483, a metal such as stainless steel or nickel, a resin such as a polyimide film, a silicon wafer, or a combination thereof may be employed. Further, in order to secure water repellency with respect to the ink, the nozzle plate 1383 has a water repellent film formed by a known method such as plating or water-repellent coating on a nozzle (ejection) surface (a surface in a direction of ink ejection) of the nozzle plate 1483.

According to the ink jet head having the above-described structure, by applying a driving voltage between the diaphragms 1490 and the driving electrodes 1505 with the diaphragms 1490 serving as a common electrode and the driving electrodes 1505 serving as individual electrodes, the diaphragms 1490 deform toward the driving electrodes 1505 by electrostatic forces generated between the diaphragms 1490 and the driving electrodes 1505. Then, by discharging electrical charges between the diaphragms 1490 and the driving electrodes 1505 from this state, that is, by reducing the driving voltage to zero from this state, the diaphragms 1490 return to their original positions to change the capacities or volumes of the liquid pressure chambers 1486 so that ink droplets are ejected from the nozzles 1485.

At this point, the ink-contacting surface of the first substrate 1481 is coated with the liquid-resistant thin film 1493 formed by layers of the inorganic film 1491 and the organic resin film 1492 with the organic resin film 1492 serving as a top surface film forming the surface of the liquid-resistant thin film 1493. Therefore, even if the organic film 1491 contains a pinhole defect or the like, silicon of the first substrate 1481 is prevented from dissolving in the ink, causing no nozzle clogging, differences in the vibration characteristic, or defective vibrations. Thus, the long operation stability and reliability of the ink jet head is achieved. Further, forming the liquid-resistant thin film 1493 by the layers of the inorganic film 1491 and the organic resin film 1492 improves the anti-corrosiveness of each diaphragm 1490. Furthermore, the organic resin film 1492 may serve as a stress-relieving film to relax diaphragm stress generated by the inorganic film 1491.

Figure 130:
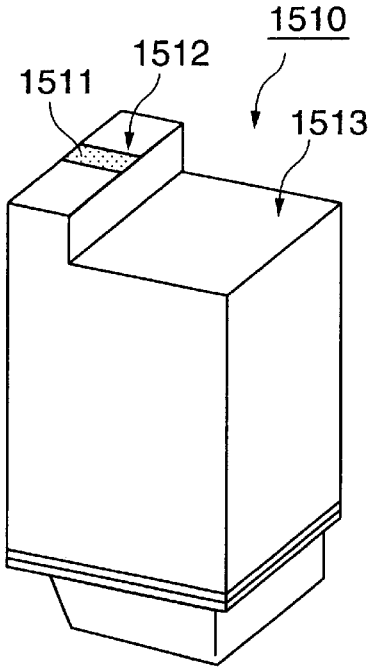
FIG. 130 is a perspective view of an ink cartridge according to a 23rd embodiment of the present invention.

Next, a description will be given of a 23rd embodiment of the present invention. FIG. 130 is a perspective view of an ink cartridge 1510 according to the 23rd embodiment of the present invention.

An ink jet head 1512 having nozzles 1511 and an ink tank 1513 for supplying ink to the ink jet head 1512 are integrated into the ink cartridge 1510. Here, the ink jet head 1512 is any of the ink jet heads of the above-described embodiments.

In the case of an ink jet head formed integrally with an ink tank, such as the ink jet head 1512, a defect of the ink jet head directly leads to a defect of the entire cartridge including the ink jet head. Therefore, reducing corrosion of head components caused by ink increases the reliability of a head-integrated ink cartridge.

Figure 131:
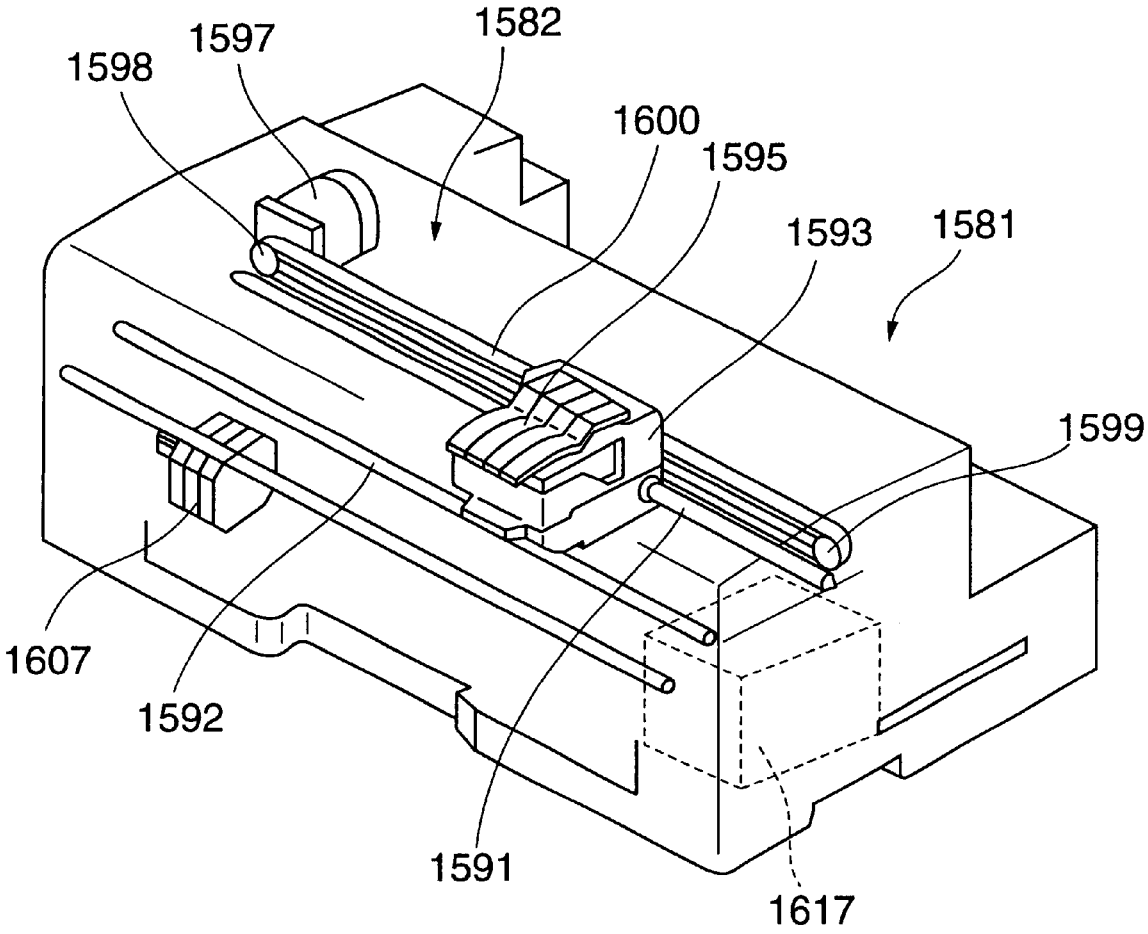
FIG. 131 is a perspective view of an ink jet recording apparatus according to a 24th embodiment of the present invention.
Figure 132:
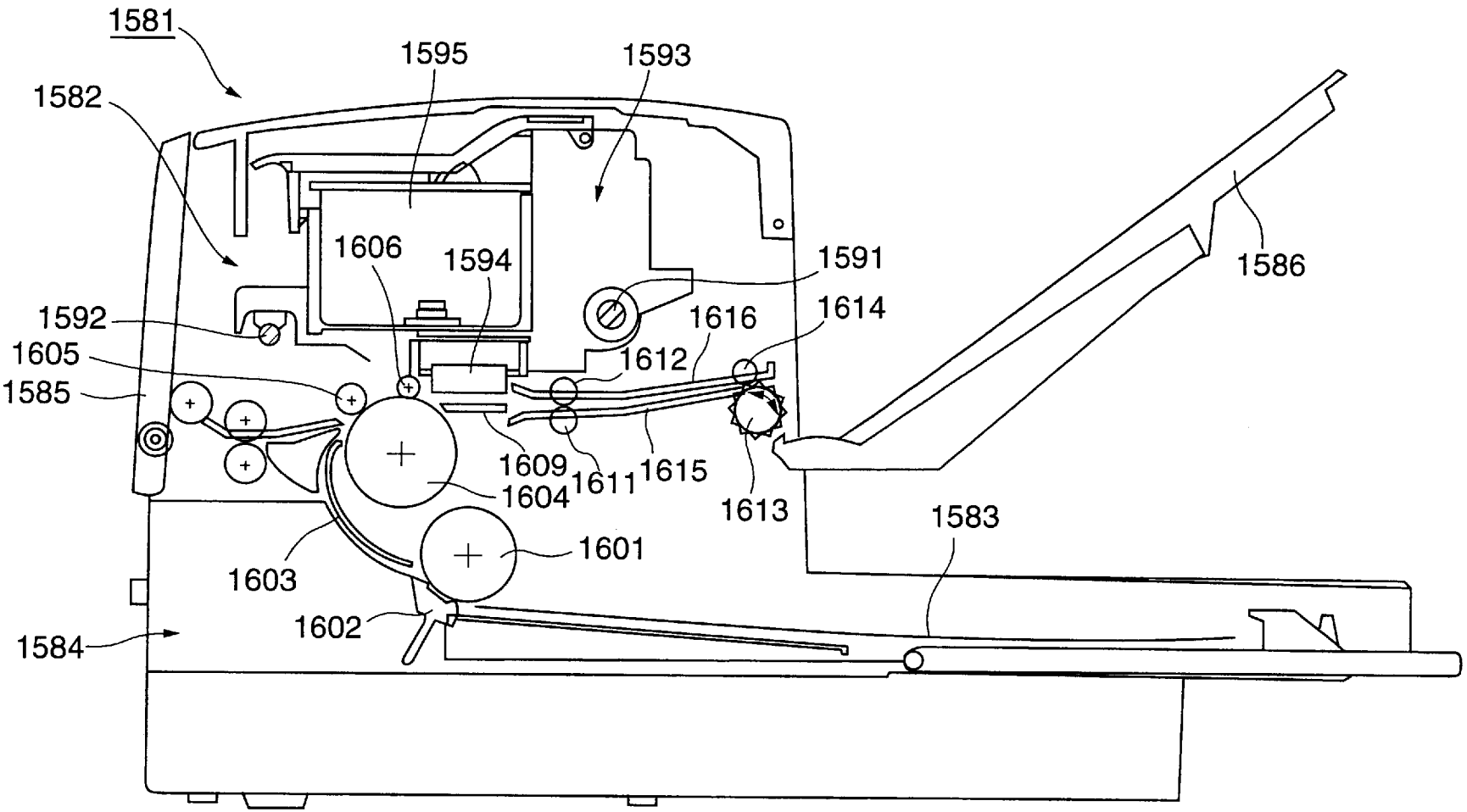
FIG. 132 is a side view of the ink jet recording apparatus of FIG. 131 for illustrating a mechanism thereof.

Next, a description will be given of a 24th embodiment of the present invention. FIG. 131 is a perspective view of an ink jet recording apparatus including a plurality of ink jet heads according to the 24th embodiment of the present invention. FIG. 132 is a side view of the ink jet recording apparatus of FIG. 131 for illustrating a mechanism thereof.

The ink jet recording apparatus has an apparatus body 1581 that includes a print mechanism part 1582. The print mechanism part 1582 includes a carriage 1593 that is movable in a primary (main) scanning direction, recording heads 1594 having a structure according to any of the ink jet heads of the above-described embodiments and mounted on the carriage 1593, and an ink cartridge 1595 for supplying ink to the recording heads 1594. A paper feed cassette 1584 in which sheets of paper 1583 can be stored from the front side of the ink jet recording apparatus is detachably attached under the apparatus body 1581. The paper feed cassette 1584 may be replaced by a paper feed tray. A manual feed tray 1585 for feeding the sheets of paper 1583 manually is turnably supported on the front side of the apparatus body 1581. The sheets of paper 283, which are not limited to paper but may be any media to which ink droplets adhere, are fed from the paper feed cassette 1584 or the manual feed tray 1585 to the print mechanism part 282, where desired images are recorded on the sheets of paper 1583. Thereafter, the sheets of paper 1583 are ejected onto a paper ejection tray 1586 that is attached to the backside of the apparatus body 1581.

The print mechanism part 1582 includes a main guide rod 1591 and a sub guide rod 1592 that are guide members provided between opposing side plates (not shown in the drawings), and the main guide rod 1591 and the sub guide rod 1592 slidably support the carriage 1593 in the primary scanning direction or in a direction perpendicular to the plane of FIG. 132. The recording heads 1594 ejecting ink droplets of a variety of colors of yellow (Y), cyan (C), magenta (M), and black (Bk), respectively, are arranged in the carriage 1593 so that the ink ejection holes (nozzles) of each recording head 1594 are arranged in a direction to cross the primary scanning direction and the ink droplets are ejected from the ink ejection holes in the downward direction of FIG. 132. The ink cartridge 1595 mounted on the carriage 1593 includes replaceable ink tanks for supplying the inks of the various colors to the corresponding recording heads 1594.

Each ink tank has an atmosphere hole communicating with atmosphere formed in its upper part and a supply hole for supplying the ink to the corresponding recording head 1594 formed in its lower part, and contains a porous material filled with the ink supplied to corresponding recording head 1594, which ink is maintained slightly at a negative pressure by the capillary force of the porous material. This ink jet recording apparatus employs the recording heads 1594 to eject the different colors, but may employ one recording head including nozzles for ejecting the different colors. Further, any of the ink jet heads of the above-described embodiments may be used for the recording heads 1594.

The carriage 1593 has its backside (a downstream side in a direction in which the sheets of paper 1583 are conveyed) engaging slidably with the main guide rod 1591 and its front side (an upstream side in the direction in which the sheets of paper 1583 are conveyed) placed slidably on the sub guide rod 1592. The carriage 1593 has a timing belt 1600 fixed thereto. The timing belt 1600 is provided between a drive pulley 1598 rotated by a primary scanning motor 1597 and an idle pulley 1599. The primary scanning motor 1597 rotates in forward and reverse directions so that the carriage 1593 repeats a scanning movement in the primary scanning direction.

In order to convey the sheets of paper 1583 set in the paper feed cassette 1584 to a position below the recording heads 1594, provided are a paper feed roller 1601 and a friction pad 1602 for extracting the sheets of paper 1583 from the paper feed cassette 1584 and conveying the sheets of paper 1583, a guide member 1603 for guiding the sheets of paper 1583, a conveying roller 1604 for conveying the fed sheets of paper 1583 upside down, a conveying roller 1605 pressed against the conveying roller 1604, and a top roller 1606 for determining an angle at which the sheets of paper 1583 are fed from the conveying roller 1604. The conveying roller 1604 is rotated by a secondary (sub) scanning motor 1607 via a gear train.

A print support member 1609 that is a paper sheet guide member is provided for guiding the sheets of paper 1583 fed from the conveying roller 1604 below the recording heads 1594 within the movement range of the carriage 1593 in the primary scanning direction. A conveying roller 1611 and a spur 1612 rotated for conveying the sheets of paper 1583 in a paper ejection direction, a paper ejection roller 1613 and a spur 1614 for conveying the sheets of paper 1583 to the paper ejection tray 1586, and guide members 1615 and 1616 forming a paper ejection path are provided on the downstream side of the print support member 1609 in a direction in which the sheets of paper 1583 are conveyed.

At a time of recording, by driving the recording heads 1594 in accordance with an image signal with the carriage 1593 moving, recording is performed on each stationary sheet of paper 1583 for one line by ejecting ink droplets, and after the sheet of paper 1583 is conveyed by a given amount, recording is again performed for the next line by ejecting ink droplets. This operation is repeated for completing the ink image. The ink jet recording head 1594 stops this recording operation by receiving a signal informing the end of recording or a signal notifying that the lower end of the sheet of paper 1583 reaches a recording area. Thereafter, the sheet of paper 1583 is ejected.

On the right side of the primary scanning direction in which the carriage 1593 is movable outside the recording area, a recovery device 1617 for restoring an ejection defect of the recording heads is provided. The recovery device 1671 includes capping means, suction means, and cleaning means. In a standby state, the carriage 1593 is moved on the side of the recovery device 1617 to have the recording heads 1594 capped by the capping means. Thereby, the nozzle parts of the recording heads 1594 are kept moist, thus preventing an ejection defect caused by ink drying. Further, during recording, ink unrelated to the recording is ejected so as to keep ink viscosity constant at all the nozzles, thereby maintaining the stable ink ejection characteristic of the recording heads 1594.

In the case of occurrence of an ejection defect, the nozzles of the recording heads 1594 are hermetically sealed by the capping means, and air bubbles, together with ink, are sucked from the nozzles through a tube by the suction means. Ink or dust adhering to the nozzle surfaces of the recording heads 1594 is removed by the cleaning means. Thereby, recovery from the ejection defect is achieved. Further, the sucked ink is ejected to a waste ink reservoir (not show in the drawings) provided under the apparatus body 1581 and is absorbed and contained by an absorber in the waste ink reservoir.

Thus, the ink jet recording apparatus of this embodiment includes the recording heads 1594 having a structure according to any of the ink jet heads of the above-described embodiments, thereby preventing corrosion of the channel formation member of each recording head 1594, being free of an ink droplet ejection defect for a long period of time, obtaining a stable ink droplet ejection characteristic, and improving image quality.

Figure 133:
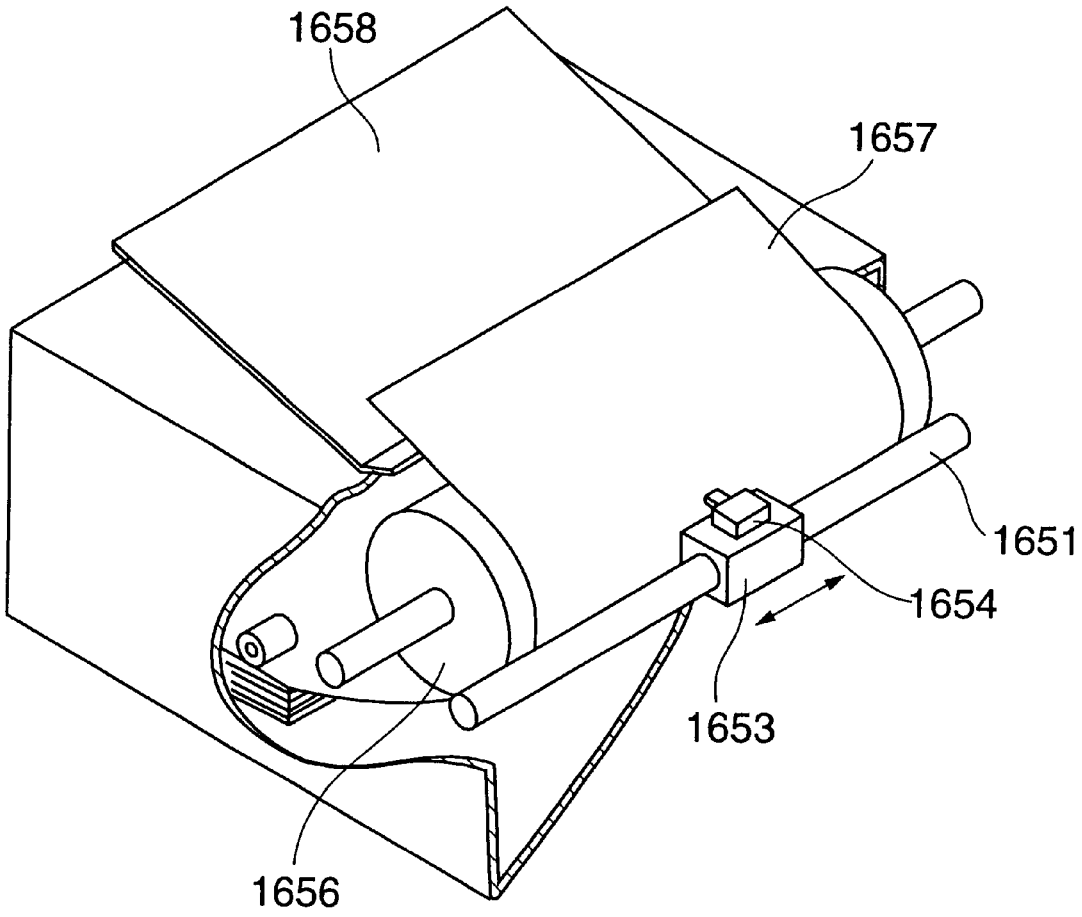
FIG. 133 is a perspective view of an ink jet recording apparatus according to a 25th embodiment of the present invention.

Next, a description will be given of a 25th embodiment of the present invention. FIG. 133 is a perspective view of an ink jet recording apparatus according to the 25th embodiment of the present invention.

The ink jet recording apparatus of this embodiment includes a carriage guide 1651, a carriage 1653 attached to the carriage guide 1651 to be slidable in a direction indicated by arrow of FIG. 133, and an ink cartridge 1654 into which an ink tank and an ink jet head having a structure according to any of the ink jet heads of the above-described embodiments are integrated. A sheet of paper 1657 is conveyed by a platen roller 1656 so that recording is performed on the sheet of paper 1657 by the ink jet head of the ink cartridge 1654. Thereafter, the sheet of paper 1657 is ejected onto a paper ejection tray 1658.

In the above-described embodiments, the liquid droplet ejection head according to the present invention is applied to the ink jet head. However, the liquid droplet ejection head according to the present invention is also applicable to a liquid droplet ejection head for ejection liquid other than ink, such as a liquid resist for patterning or specimens for gene analysis.

The present invention is not limited to the specifically disclosed embodiments, but variations and modifications may be made without departing from the scope of the present invention.

The present application is based on Japanese priority applications No. 2000-237825 filed on Aug. 4, 2000, No. 2001-078851 filed on Mar. 19, 2001, and No. 2001-179412 filed on Jun. 14, 2001, the entire contents of which are hereby incorporated by reference.

What is claimed is:

1. An electrostatic actuator comprising:

a diaphragm caused to vibrate by electrostatic force;

an electrode substrate opposing said diaphragm;

an electrode formed on said electrode substrate so as to oppose said diaphragm with a gap being formed between said electrode and said diaphragm;

an anti-corrosive thin film formed on said diaphragm; and diaphragm deflection prevention means preventing said diaphragm from deflecting.

2. The electrostatic actuator as claimed in claim 1, wherein said diaphragm deflection prevention means is said anti-corrosive thin film that prevents said diaphragm from deflecting by a stress of said anti-corrosive thin film.

3. The electrostatic actuator as claimed in claim 2, wherein said anti-corrosive thin film has an internal stress that is a tensile stress.

4. The electrostatic actuator as claimed in claim 2, wherein said anti-corrosive thin film has an internal stress that is a compressive stress equal to smaller than $1.0*10^{10}$ dyne/cm$^2$.

5. The electrostatic actuator as claimed in claim 2, wherein said anti-corrosive thin film is a titanium nitride thin film.

6. The electrostatic actuator as claimed in claim 5, wherein the titanium nitride thin film has a resistivity equal to or larger than 1.0E–3 Ω.cm.

7. The electrostatic actuator as claimed in claim 2, wherein said anti-corrosive thin film is formed of a material selected from a group consisting of silicon oxide, zirconium, and a zirconium compound.

8. The electrostatic actuator as claimed in claim 2, wherein said anti-corrosive thin film has a multilayer structure.

9. The electrostatic actuator as claimed in claim 2, wherein said diaphragm is flat.

10. The electrostatic actuator as claimed in claim 9, wherein said anti-corrosive thin film is a titanium nitride thin film.

11. The electrostatic actuator as claimed in claim 10, wherein the titanium nitride thin film contains oxygen atoms.

12. The electrostatic actuator as claimed in claim 11, wherein a concentration of the oxygen atoms is 1% or more.

13. The electrostatic actuator as claimed in claim 9, wherein said anti-corrosive thin film has a multilayer structure.

14. The electrostatic actuator as claimed in claim 2, said anti-corrosive thin film is a different stress multilayer thin film formed of a plurality of layers of films having stresses of different directions, the stresses being tensile and compressive.

15. The electrostatic actuator as claimed in claim 14, wherein said anti-corrosive thin film includes a titanium nitride thin film.

16. The electrostatic actuator as claimed in claim 14, wherein said different stress multilayer thin film includes an anti-corrosive thin film layer and a stress-relieving thin film for relieving a stress of the anti-corrosive thin film layer, the stress-relieving thin film being formed between the anti-corrosive thin film layer and said diaphragm.

17. The electrostatic actuator as claimed in claim 16, wherein the stress-relieving thin film is formed of an organic resin.

18. The electrostatic actuator as claimed in claim 2, wherein said anti-corrosive thin film is a uniform thickness thin film having a uniform distribution of film thickness and a compressive stress.

19. The electrostatic actuator as claimed in claim 18, wherein the uniform thickness thin film has a multilayer structure.

20. The electrostatic actuator as claimed in claim 1, wherein said anti-corrosive thin film has an internal stress that is a tensile stress.

21. The electrostatic actuator as claimed in claim 1, wherein said anti-corrosive thin film has an internal stress that is a compressive stress equal to smaller than $1.0*10^{10}$ dyne/cm$^2$.

22. The electrostatic actuator as claimed in claim 1, wherein said anti-corrosive thin film is a titanium nitride thin film.

23. The electrostatic actuator as claimed in claim 22, wherein the titanium nitride thin film has a resistivity equal to or larger than 1.0E–3 Ω.cm.

24. The electrostatic actuator as claimed in claim 1, wherein said anti-corrosive thin film is formed of a material selected from a group consisting of silicon oxide, zirconium, and a zirconium compound.

25. The electrostatic actuator as claimed in claim 1, wherein said anti-corrosive thin film has a multilayer structure.

26. The electrostatic actuator as claimed in claim 1, wherein said diaphragm is flat.

27. The electrostatic actuator as claimed in claim 26, wherein said anti-corrosive thin film is a titanium nitride thin film.

28. The electrostatic actuator as claimed in claim 27, wherein the titanium nitride thin film contains oxygen atoms.

29. The electrostatic actuator as claimed in claim 28, wherein a concentration of the oxygen atoms is 1% or more.

30. The electrostatic actuator as claimed in claim 26, wherein said anti-corrosive thin film has a multilayer structure.

31. The electrostatic actuator as claimed in claim 1, wherein said diaphragm deflection prevention means is said anti-corrosive thin film that is a different stress multilayer thin film formed of a plurality of layers of films having stresses of different directions, the stresses being tensile and compressive.

32. The electrostatic actuator as claimed in claim 31, wherein said anti-corrosive thin film includes a titanium nitride thin film.

33. The electrostatic actuator as claimed in claim 31, wherein said different stress multilayer thin film includes an anti-corrosive thin film layer and a stress-relieving thin film for relieving a stress of the anti-corrosive thin film layer, the stress-relieving thin film being formed between the anti-corrosive thin film layer and said diaphragm.

34. The electrostatic actuator as claimed in claim 33, wherein the stress-relieving thin film is formed of an organic resin.

35. The electrostatic actuator as claimed in claim 1, wherein said diaphragm deflection prevention means is an equal stress thin film having a stress equal to that of said anti-corrosive thin film, the equal stress thin film being formed under said diaphragm.

36. The electrostatic actuator as claimed in claim 1, wherein said diaphragm deflection prevention means is said anti-corrosive thin film that is a uniform thickness thin film having a uniform distribution of film thickness and a compressive stress.

37. The electrostatic actuator as claimed in claim 36, wherein the uniform thickness thin film has a multilayer structure.

38. A method of producing an electrostatic actuator including a diaphragm caused to vibrate by electrostatic force, an electrode substrate opposing said diaphragm, an electrode formed on said electrode substrate so as to oppose said diaphragm with a gap being formed between said electrode and said diaphragm, an anti-corrosive thin film formed on said diaphragm, and diaphragm deflection prevention means preventing said diaphragm from deflecting, said method comprising the steps of:

(a) joining a first substrate in which a diaphragm is formed and a second substrate on which an electrode is formed; and (b) forming an anti-corrosive thin film on the diaphragm after said step (a).

39. The method as claimed in claim 38, wherein said step (a) joins the first and second substrates directly.

40. The method as claimed in claim 38, wherein said step (b) forms the anti-corrosive thin film by a method selected from a group consisting of sputtering, CVD, and oxidation.

41. An electrostatic micropump comprising:

a nozzle hole for ejecting a liquid droplet;

a liquid chamber that is a liquid channel communicating with said nozzle; and an electrostatic actuator forming wall faces of said liquid chamber, said electrostatic actuator comprising:

a diaphragm caused to vibrate by electrostatic force;

an electrode substrate opposing said diaphragm;

an electrode formed on said electrode substrate so as to oppose said diaphragm with a gap being formed between said electrode and said diaphragm;

an anti-corrosive thin film formed on said diaphragm; and diaphragm deflection prevention means preventing said diaphragm from deflecting, wherein the liquid droplet is ejected by a pressure wave generated by the electrostatic force.

42. The electrostatic micropump as claimed in claim 41, wherein said diaphragm deflection prevention part is said anti-corrosive thin film that prevents said diaphragm from deflecting by a stress of said anti-corrosive thin film.

43. The electrostatic micropump as claimed in claim 41, wherein said diaphragm deflection prevention means is an equal stress thin film having a stress equal to that of said anti-corrosive thin film, the equal stress thin film being formed under said diaphragm.

44. An ink jet recording head comprising:

a nozzle hole for ejecting an ink droplet;

an ink chamber that is an ink channel communicating with said nozzle; and an electrostatic actuator forming wall faces of said ink chamber, said electrostatic actuator comprising:

a diaphragm caused to vibrate by electrostatic force;

an electrode substrate opposing said diaphragm;

an electrode formed on said electrode substrate so as to oppose said diaphragm with a gap being formed between said electrode and said diaphragm;

an anti-corrosive thin film formed on said diaphragm; and diaphragm deflection prevention means preventing said diaphragm from deflecting, wherein the ink droplet is ejected by a pressure wave generated by the electrostatic force.

45. The ink jet recording head as claimed in claim 44, wherein said diaphragm deflection prevention part is said anti-corrosive thin film that prevents said diaphragm from deflecting by a stress of said anti-corrosive thin film.

46. The ink jet recording head as claimed in claim 44, wherein said diaphragm deflection prevention means is an equal stress thin film having a stress equal to that of said anti-corrosive thin film, the equal stress thin film being formed under said diaphragm.

47. An ink jet recording apparatus comprising:

a conveying part for conveying a recording medium on which an ink image is recorded; and an ink jet recording head for recording the ink image on the recording medium by ejecting ink thereon, the ink jet recording head comprising:

a nozzle hole for ejecting ink;

an ink chamber that is an ink channel communicating with said nozzle; and an electrostatic actuator forming wall faces of said ink chamber, said electrostatic actuator comprising:

a diaphragm caused to vibrate by electrostatic force;

an electrode substrate opposing said diaphragm;

an electrode formed on said electrode substrate so as to oppose said diaphragm with a gap being formed between said electrode and said diaphragm;

an anti-corrosive thin film formed on said diaphragm; and diaphragm deflection prevention means preventing said diaphragm from deflecting, wherein the ink is ejected by a pressure wave generated by the electrostatic force.

48. The ink jet recording apparatus as claimed in claim 47, wherein said diaphragm deflection prevention part is said anti-corrosive thin film that prevents said diaphragm from deflecting by a stress of said anti-corrosive thin film.

49. The ink jet recording head as claimed in claim 47, wherein said diaphragm deflection prevention means is an equal stress thin film having a stress equal to that of said anti-corrosive thin film, the equal stress thin film being formed under said diaphragm.

50. A liquid droplet ejecting head comprising:

a channel formation member including liquid channels for containing liquid and partition walls separating the liquid channels;

nozzles communicating with said liquid channels; and a liquid-resistant thin film formed on liquid-contacting surfaces of said liquid channels, the surfaces contacting the liquid, said liquid-resistant thin film having resistance to the liquid and including an organic resin film, wherein the liquid in said liquid channels is pressurized to be ejected from said nozzles as liquid droplets.

51. The liquid droplet ejecting head as claimed in claim 50, wherein said liquid-resistant thin film is formed on substantially all the liquid-contacting surfaces of said liquid channels.

52. The liquid droplet ejecting head as claimed in claim 50, wherein the organic resin film is a polyimide-based film.

53. The liquid droplet ejecting head as claimed in claim 50, wherein the polyimide-based film includes, as a main ingredient thereof, a material selected from a group consisting of polyimide and polybenzoxazole.

54. The liquid droplet ejecting head as claimed in claim 50, wherein the organic resin film is one of a urethane-based resin film, a urea-based resin film, and a phenol-based resin film.

55. The liquid droplet ejecting head as claimed in claim 50, wherein the organic resin film forms a surface of said liquid-resistant thin film.

56. The liquid droplet ejecting head as claimed in claim 50, wherein said liquid-resistant thin film has a multilayer structure of the organic resin film and an inorganic film.

57. The liquid droplet ejecting head as claimed in claim 50, wherein sidewall faces of the partition walls are entirely coated with said liquid-resistant thin film.

58. The liquid droplet ejecting head as claimed in claim 57, wherein each of the partition walls includes at least two chamfered surfaces.

59. The liquid droplet ejecting head as claimed in claim 57, wherein each of the partition walls has a cross section shaped like a polygon with six angles or more.

60. The liquid droplet ejecting head as claimed in claim 57, wherein each of the partition walls has at least two angular parts in a cross section thereof.

61. The liquid droplet ejecting head as claimed in claim 57, wherein each of the partition walls has a surface smoothly rounded at a certain curvature.

62. The liquid droplet ejecting head as claimed in claim 57, wherein each of the partition walls has a cross section including a side smoothly rounded at a certain curvature.

63. The liquid droplet ejecting head as claimed in claim 57, wherein each of the partition walls has the sidewalls slanted with respect to a bottom face of a corresponding one of the liquid channels.

64. The liquid droplet ejecting head as claimed in claim 57, wherein each of the partition walls has a cross section shaped like a trapezoid.

65. The liquid droplet ejecting head as claimed in claim 50, wherein the channel formation member is made of silicon.

66. The liquid droplet ejecting head as claimed in claim 50, further comprising:

diaphragms each forming at least one of wall faces of a corresponding one of the liquid channels; and electromechanical transducing elements for deforming said diaphragms.

67. The liquid droplet ejecting head as claimed in claim 66, wherein said diaphragms are made of silicon.

68. The liquid droplet ejecting head as claimed in claim 66, wherein said liquid-resistant thin film has a first film thickness on sides of fixed edges of said diaphragms and a second film thickness on center areas of said diaphragms, the first film thickness being larger than the second film thickness.

69. The liquid droplet ejecting head as claimed in claim 68, wherein said liquid-resistant thin film has the first film thickness at each of points at which a surface of said liquid-resistant thin film intersects with bisectors of angles formed by the partition walls and said diaphragms and the second film thickness on the center areas of said diaphragms, the first film thickness being twice or more than twice as large as the second film thickness.

70. The liquid droplet ejecting head as claimed in claim 68, wherein an area of the first film thickness of the diaphragms has a surface area equal to or less than a half of an entire surface area of said diaphragms.

71. The liquid droplet ejecting head as claimed in claim 50, further comprising:

diaphragms each forming at least one of wall faces of a corresponding one of the liquid channels; and electrodes provided to oppose said diaphragms.

72. The liquid droplet ejecting head as claimed in claim 71, wherein said diaphragms are made of silicon.

73. The liquid droplet ejecting head as claimed in claim 71, wherein said liquid-resistant thin film has a first film thickness on sides of fixed edges of said diaphragms and a second film thickness on center areas of said diaphragms, the first film thickness being larger than the second film thickness.

74. The liquid droplet ejecting head as claimed in claim 73, wherein said liquid-resistant thin film has the first film thickness at each of points at which a surface of said liquid-resistant thin film intersects with bisectors of angles formed by the partition walls and said diaphragms and the second film thickness on the center areas of said diaphragms, the first film thickness being twice or more than twice as large as the second film thickness.

75. The liquid droplet ejecting head as claimed in claim 73, wherein an area of the first film thickness of the diaphragms has a surface area equal to or less than a half of an entire surface area of said diaphragms.

76. The liquid droplet ejecting head as claimed in claim 50, further comprising electrothermal elements for film-boiling the liquid in the liquid channels.

77. The liquid droplet ejecting head as claimed in claim 50, wherein said liquid-resistant thin film has a thicker film thickness along sides of bottom faces of the liquid channels than on sidewall faces and/or the bottom faces of the liquid channels.

78. The liquid droplet ejecting head as claimed in claim 77, wherein a surface of said liquid-resistant thin film includes rounded areas along the sides of the bottom faces of the liquid channels.

79. The liquid droplet ejecting head as claimed in claim 50, wherein said liquid-resistant thin film has a thicker film thickness on angular parts formed by sidewall and bottom faces of the liquid channels than on the sidewall and/or the bottom faces of the liquid channels.

80. The liquid droplet ejecting head as claimed in claim 79, wherein a surface of said liquid-resistant thin film is curved on the angular parts formed by the sidewall and bottom faces of the liquid channels.

81. The liquid droplet ejecting head as claimed in claim 79, wherein said liquid-resistant thin film has a cross section including a curved side on each of the angular parts formed by the sidewall and bottom faces of the liquid channels.

82. An ink cartridge comprising:

an ink jet head, the ink jet head comprising:

a channel formation member including ink channels for containing ink;

nozzles communicating with said ink channels; and an ink-resistant thin film formed on ink-contacting surfaces of said ink channels, the surfaces contacting the ink, said ink-resistant thin film having resistance to the ink and including an organic resin film, wherein the ink in said ink channels is pressurized to be ejected from said nozzles as ink droplets; and an ink tank for supplying the ink to said ink jet head, the ink tank being formed integrally with said ink jet head.

83. An ink jet recording apparatus comprising:

an ink jet head, the ink jet head comprising:

a channel formation member including ink channels for containing ink;

nozzles communicating with said ink channels; and an ink-resistant thin film formed on ink-contacting surfaces of said ink channels, the surfaces contacting the ink, said ink-resistant thin film having resistance to the ink and including an organic resin film, wherein the ink in said ink channels is pressurized to be ejected from said nozzles as ink droplets.

84. An ink jet recording apparatus comprising:

an ink cartridge, the ink cartridge comprising:

an ink jet head, the ink jet head comprising:

a channel formation member including ink channels for containing ink;

nozzles communicating with said ink channels; and an ink-resistant thin film formed on ink-contacting surfaces of said ink channels, the surfaces contacting the ink, said ink-resistant thin film having resistance to the ink and including an organic resin film, wherein the ink in said ink channels is pressurized to be ejected from said nozzles as ink droplets; and an ink tank for supplying the ink to said ink jet head, the ink tank being formed integrally with said ink jet head.

85. A method of producing a liquid droplet ejecting head including a channel formation member including liquid channels for containing liquid, nozzles communicating with said liquid channels, and a liquid-resistant thin film formed on liquid-contacting surfaces of said liquid channels, the surfaces contacting the liquid, said liquid-resistant thin film having resistance to the liquid and including an organic resin film, the liquid in said liquid channels being pressurized to be ejected from said nozzles as liquid droplets, said method comprising the step of:

applying a liquid material for forming the organic resin film on the channel formation member by a spray method.

86. A method of producing a liquid droplet ejecting head including a channel formation member including liquid channels for containing liquid, nozzles communicating with said liquid channels, and a liquid-resistant thin film formed on liquid-contacting surfaces of said liquid channels, the surfaces contacting the liquid, said liquid-resistant thin film having resistance to the liquid and including an organic resin film, the liquid in said liquid channels being pressurized to be ejected from said nozzles as liquid droplets, the organic resin film being a polyimide-based film, said method comprising the step of:

(a) applying a solution of a polyamide acid of a viscosity of 20 cP or less on the channel formation member, the polyamide acid being a precursor of polyimide; and (b) forming the polyamide acid into a thin film in a process of heating and dehydrating the polyamide acid into an imide.

87. A method of producing a liquid droplet ejecting head including a channel formation member including liquid channels for containing liquid, nozzles communicating with said liquid channels, and a liquid-resistant thin film formed on liquid-contacting surfaces of said liquid channels, the surfaces contacting the liquid, said liquid-resistant thin film having resistance to the liquid and including an organic resin film, the liquid in said liquid channels being pressurized to be ejected from said nozzles as liquid droplets, the organic resin film being a polyimide-based film, said method comprising the step of:

forming the polyimide thin film by performing heating and evaporation deposition under high vacuum.

* * * * *